US011049349B2

(12) United States Patent
Onischuk

(10) Patent No.: US 11,049,349 B2
(45) Date of Patent: Jun. 29, 2021

(54) COMPUTERIZED VOTING SYSTEM

(71) Applicant: Daniel William Onischuk, Edmonton (CA)

(72) Inventor: Daniel William Onischuk, Edmonton (CA)

( * ) Notice: Subject to any disclaimer, the term of this patent is extended or adjusted under 35 U.S.C. 154(b) by 0 days.

(21) Appl. No.: 15/820,433

(22) Filed: Nov. 22, 2017

(65) Prior Publication Data

US 2018/0350180 A1 Dec. 6, 2018

Related U.S. Application Data

(63) Continuation of application No. 14/730,582, filed on Jun. 4, 2015, now abandoned, and a continuation of application No. 14/730,582, filed on Jun. 4, 2015, now abandoned, which is a continuation of application No. 14/491,919, filed on Sep. 19, 2014, now Pat. No. 10,047,280, and a continuation of application No. 14/558,720, filed on Dec. 2, 2014, now abandoned, application No. 15/820,433, which is a continuation of application No. 13/710,263, filed on Dec. 10, 2012, now abandoned, and a continuation of application No. 13/769,354, filed on Feb. 17, 2013, now abandoned, and a continuation of application (Continued)

(30) Foreign Application Priority Data

Jul. 4, 2004 (CA) ..... CA 2469598

(51) Int. Cl.
*G06K 17/00* (2006.01)
*G07C 13/00* (2006.01)

(52) U.S. Cl.
CPC ..... *G07C 13/00* (2013.01)

(58) Field of Classification Search
CPC ..... G07C 13/00
USPC ..... 235/386
See application file for complete search history.

(56) References Cited

U.S. PATENT DOCUMENTS 6,865,543 B2 * 3/2005 Gibbs, Sr. ..... G07C 13/00 235/386
2007/0095909 A1 * 5/2007 Chaum ..... G07C 13/00 235/386

* cited by examiner

*Primary Examiner* — Tuyen K Vo

(57) ABSTRACT

Officials, Agents and Devices researching, creating lists of Registered Voters, Proxy Voters whom are sent machine readable encoded Documents (Registration, Language choice, Voting Ballots), optional return Containers. Each Document correlated to Receipt(s) via shared unique Random Symbolic Identifier(s), other Security Elements. For voting privacy, Voters exchange Ballots within their Voting Region. Voters complete Document(s), add Personal Security Identifier(s), keep Document Receipt, send Documents to Officials In-Person or by Postal Mail, Delivery Service, Telephone, Fax or Facsimile, Internet, EMail, Interactive Television. Officials receiving Documents provide delivery confirmation. Imaging machines record Documents duplicate images, correlates RSID, stores data. Timely, valid, authentic Documents are machine read via computer software extracting Voter information, selections, Write-In choices, Personal Security Items correlated to Document RSID. Read data stored, published to Voter privately accessible data vault. Completed ballots and Documents tallied for certifying. Official computers running artificial intelligence programs manage data (security, processing, integrity), communications, devices: availability, workload allocation.

20 Claims, 32 Drawing Sheets

Related U.S. Application Data

Figure 15:
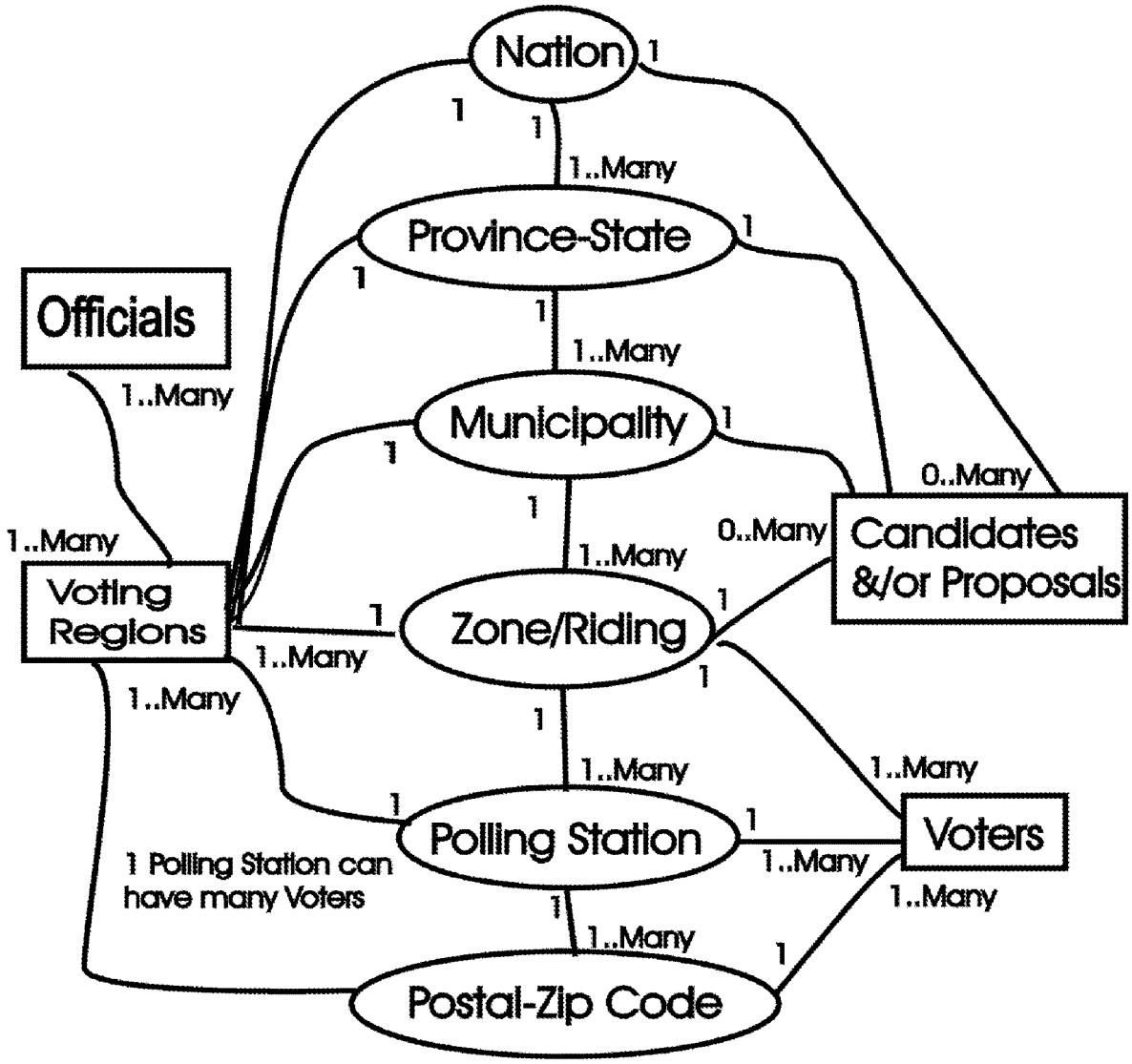

No. 13/898,467, filed on May 21, 2013, now abandoned, and a continuation of application No. 14/016,222, filed on Sep. 2, 2013, now abandoned, and a continuation of application No. 14/138,006, filed on Dec. 21, 2013, now abandoned, and a continuation of application No. 12/475,444, filed on May 29, 2009, now abandoned, and a continuation of application No. 12/537,657, filed on Aug. 7, 2009, now abandoned, and a continuation of application No. 12/793,694, filed on Jun. 4, 2010, now abandoned, and a continuation of application No. 12/813,519, filed on Jun. 11, 2010, now abandoned, and a continuation of application No. 12/860,890, filed on Aug. 21, 2010, now abandoned, and a continuation of application No. 12/916,640, filed on Nov. 1, 2010, now abandoned, and a continuation of application No. 12/938,372, filed on Nov. 2, 2010, now abandoned, and a continuation of application No. 13/007,649, filed on Jan. 16, 2011, now abandoned, and a continuation of application No. 13/007,658, filed on Jan. 16, 2011, now abandoned, and a continuation of application No. 13/007,782, filed on Jan. 17, 2011, now abandoned, and a continuation of application No. 13/033,577, filed on Feb. 23, 2011, now abandoned, and a continuation of application No. 13/081,444, filed on Apr. 6, 2011, now abandoned, and a continuation of application No. 11/160,003, filed on Jun. 4, 2005, now abandoned, and a continuation of application No. 11/161,752, filed on Aug. 16, 2005, now abandoned, and a continuation of application No. 11/163,884, filed on Nov. 2, 2005, now abandoned, and a continuation of application No. 11/163,962, filed on Nov. 4, 2005, now abandoned, and a continuation of application No. 11/555,204, filed on Oct. 31, 2006, now abandoned, and a continuation of application No. 11/627,174, filed on Jan. 25, 2007, now abandoned, and a continuation of application No. 11/735,435, filed on Apr. 13, 2007, now abandoned, and a continuation of application No. 11/738,191, filed on Apr. 20, 2007, now abandoned, and a continuation of application No. 11/765,310, filed on Jun. 19, 2007, now abandoned, and a continuation of application No. 12/053,621, filed on Mar. 23, 2008, now abandoned, and a continuation of application No. 12/131,085, filed on May 31, 2008, now abandoned, and a continuation of application No. 14/558,720, filed on Dec. 2, 2014, now abandoned, and a continuation of application No. 14/301,317, filed on Jun. 10, 2014, now abandoned, and a continuation of application No. 14/201,919, filed on Mar. 9, 2014, now abandoned, said application No. 14/730,582 is a continuation of application No. 14/491,969, filed on Sep. 19, 2014, now abandoned, which is a continuation of application No. 14/201,919, filed on Mar. 9, 2014, now abandoned, which is a continuation of application No. 13/769,354, filed on Feb. 17, 2013, now abandoned, said application No. 14/730,582 is a continuation of application No. 14/558,720, filed on Dec. 2, 2014, now abandoned, said application No. 12/475,444 is a continuation of application No. 11/161,752, filed on Aug. 16, 2005, now abandoned, said application No. 11/765,310 is a continuation of application No. 11/161,752, filed on Aug. 16, 2005, now abandoned, said application No. 11/738,191 is a continuation of application No. 11/161,752, filed on Aug. 16, 2005, now abandoned, which is a continuation of application No. 10/908,941, filed on Jun. 1, 2005, now abandoned, said application No. 11/735,435 is a continuation of application No. 11/163,962, filed on Nov. 4, 2005, now abandoned, which is a continuation of application No. 11/160,003, filed on Jun. 4, 2005, now abandoned, said application No. 14/201,919 is a continuation of application No. 14/138,006, filed on Dec. 21, 2013, now abandoned, said application No. 14/301,317 is a continuation of application No. 14/201,919, filed on Mar. 9, 2014, now abandoned, said application No. 14/491,969 is a continuation of application No. 14/301,317, filed on Jun. 10, 2014, now abandoned, said application No. 14/201,919 is a continuation of application No. 14/138,006, filed on Dec. 21, 2013, now abandoned, and a continuation of application No. 14/016,222, filed on Sep. 2, 2013, now abandoned, and a continuation of application No. 13/710,263, filed on Dec. 10, 2012, now abandoned, which is a continuation of application No. 12/475,444, filed on May 29, 2009, now abandoned, said application No. 12/537,657 is a continuation of application No. 12/475,444, filed on May 29, 2009, now abandoned, which is a continuation of application No. 11/161,752, filed on Aug. 16, 2005, now abandoned, which is a continuation of application No. 10/908,941, filed on Jun. 1, 2005, now abandoned.

(60) Provisional application No. 60/521,625, filed on Jun. 7, 2004, provisional application No. 60/521,626, filed on Jun. 7, 2004.

Fig.1 is comprised of two parts: Fig. 1A and Fig 1B
FIGURE 1A - Front View of Left Portion of Voter Registration Form (Master Part)
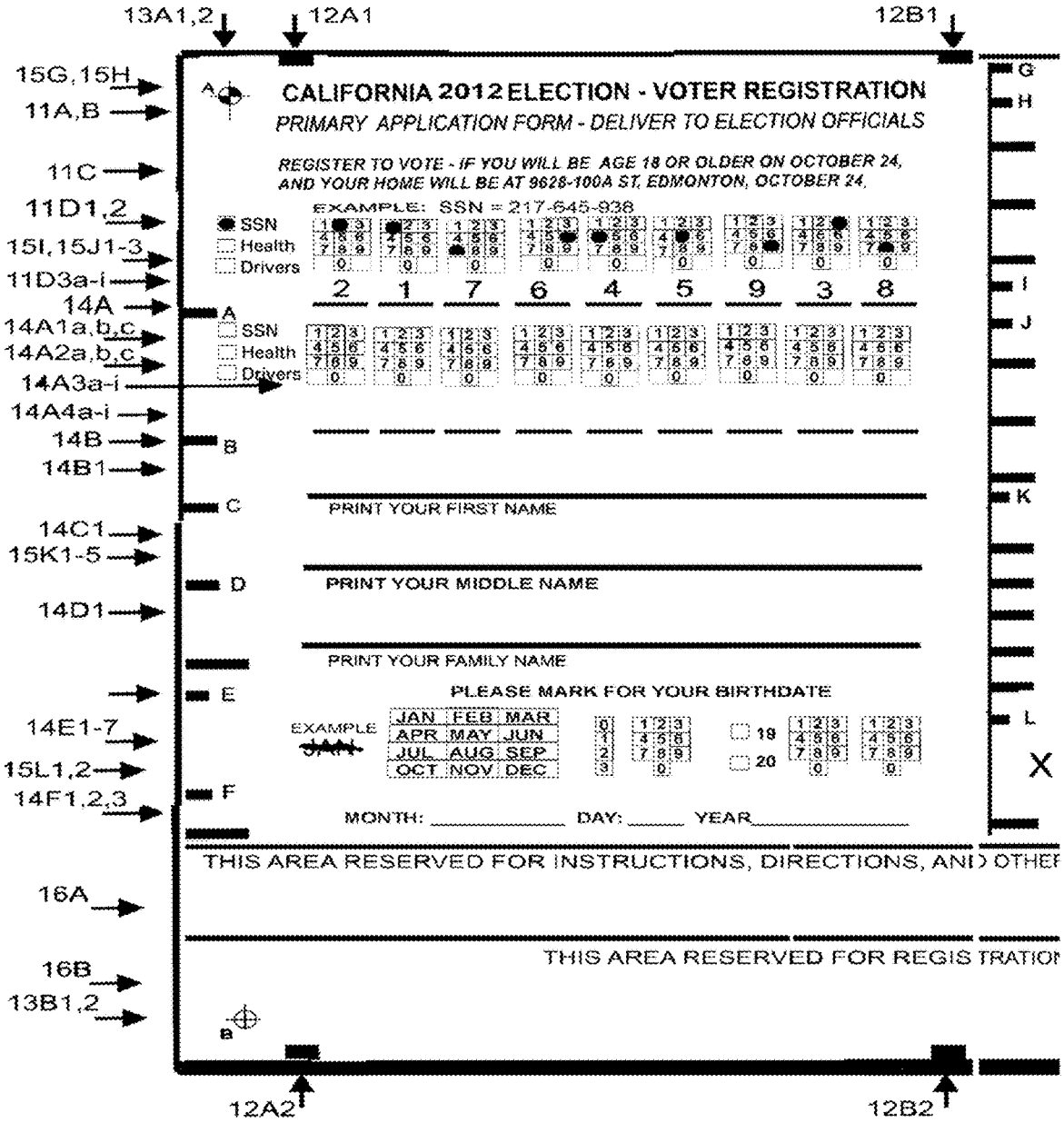

FIGURE 1B - Front View of Right PORTION of Voter Registration Form (Master Part)
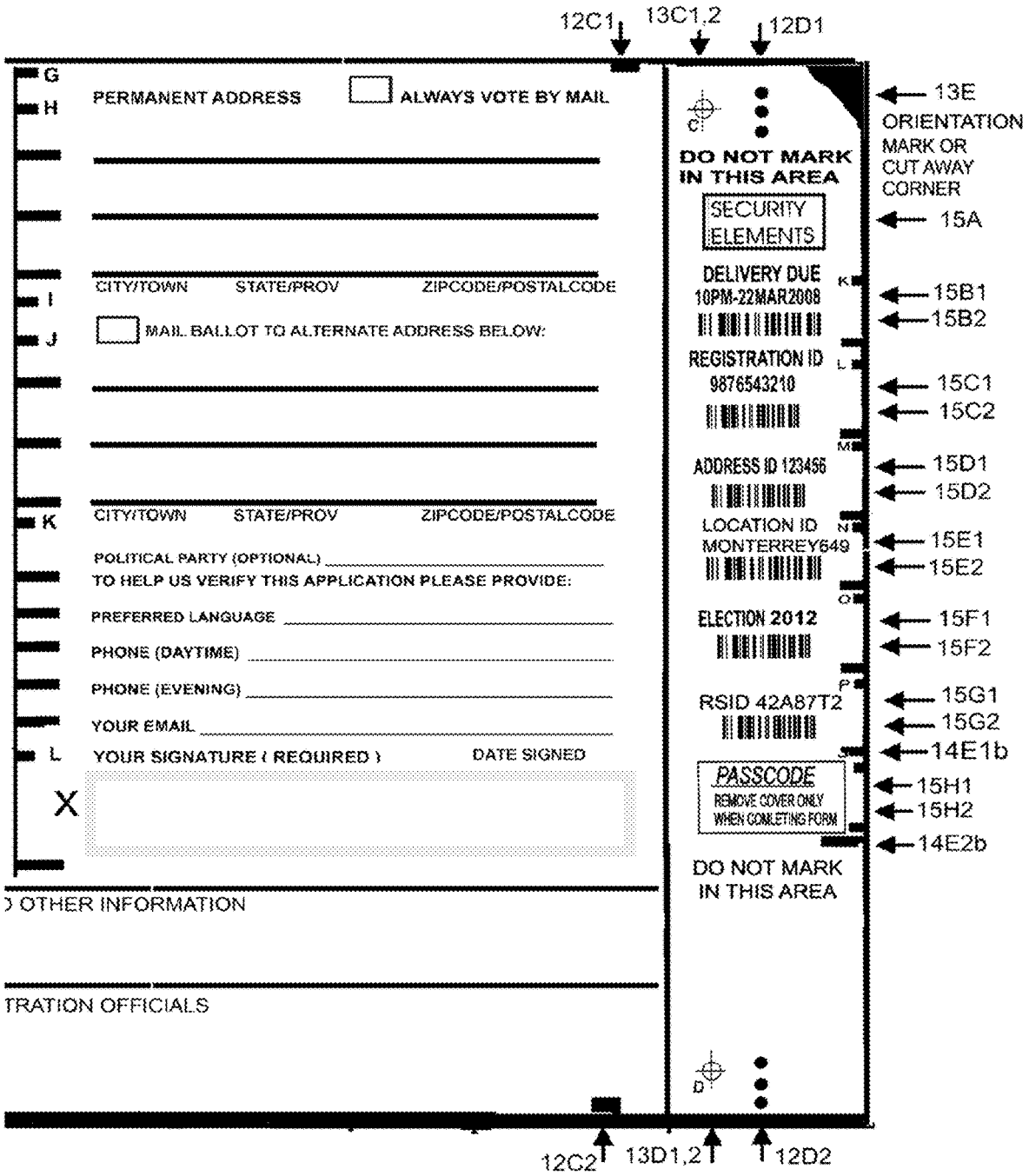

Fig.2 is comprised of two parts: Fig. 2A and Fig 2B
FIGURE 2A- Front View of Left Portion of Voter Registration Form ( Receipt Part)
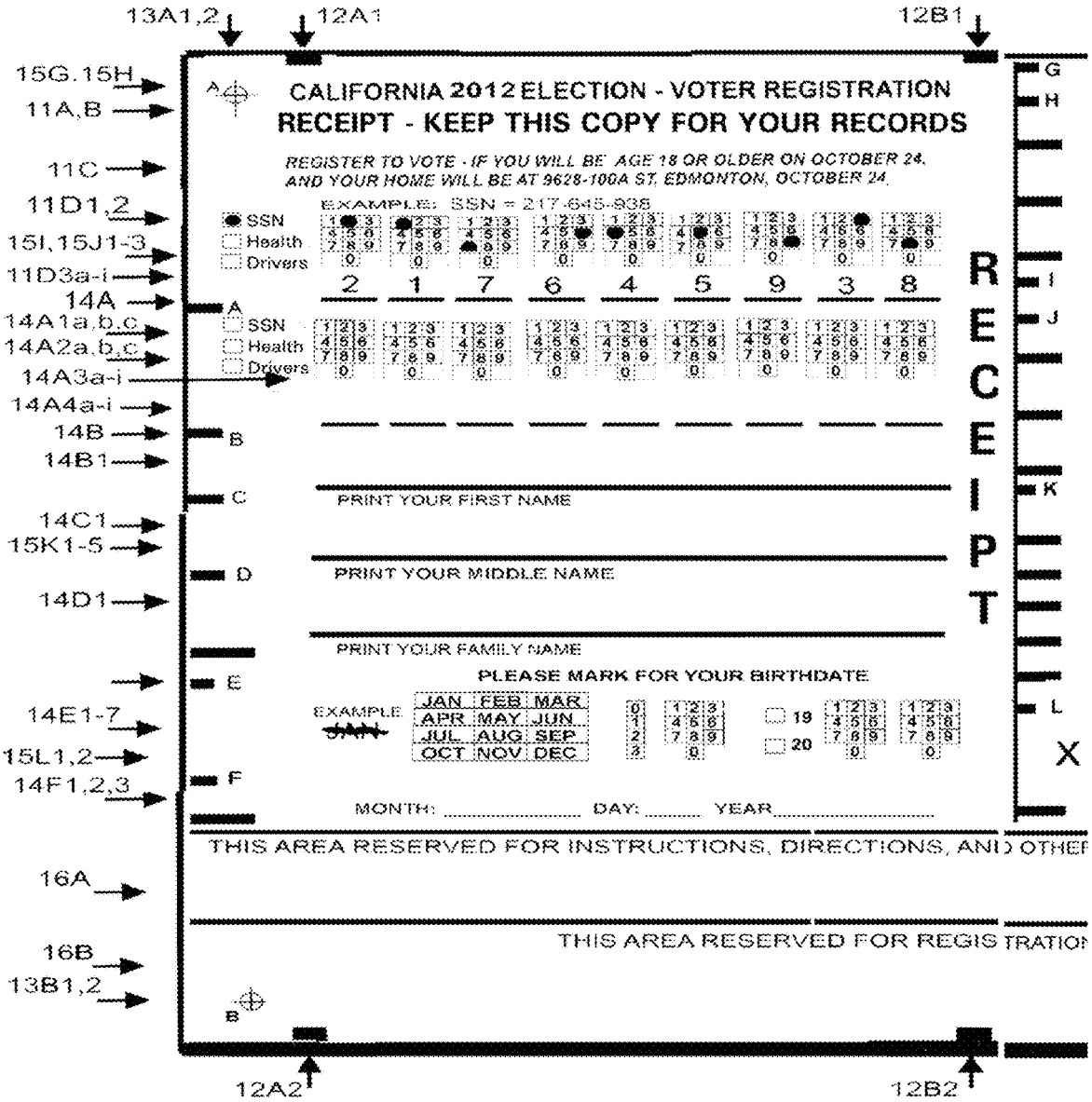

FIGURE 2B - Front View of Right Portion of Voter Registration Form ( Receipt Part )
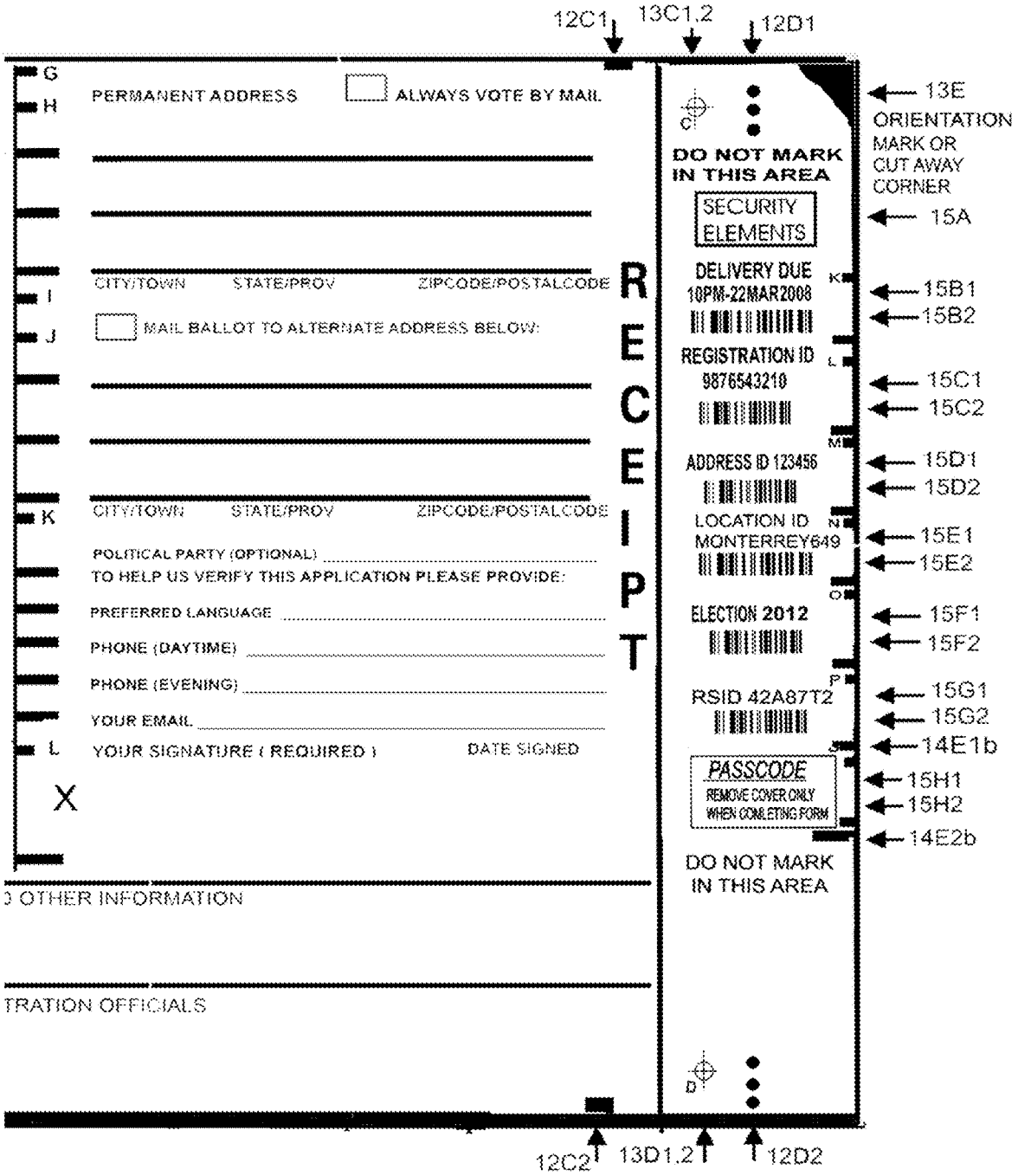

FIGURE 3 - FRONT VIEW OF MASTER VOTER LANGUAGE FORM

L

CALIFORNIA 2012 ELECTIONS - LANGUAGE CHOICE

RESIDENTS OF 9628-100A ST, MONTEREY, CA 92502

SELECT *ONE* LANGUAGE YOU PREFER FOR INFORMATION, VOTER REGISTRATION FORMS AND VOTING BALLOTS

RETURN THIS FORM TO OFFICIALS

1 ☐ ENGLISH
2 ☐ FRENCH - FRANCAIS
3 ☐ ITALIAN - ITALINAO
4 ☐ GERMAN - DEUTSCH
5 ☐ SPANISH - ESPANOL
6 ☐ CHINESE-CANTONESE
7 ☐ CHINESE-MANDARIN
8 ☐ UKRANIAN
9 ☐ FIRST NATIONS - SPECIFY _____
10 ☐ DUTCH - NEDERLANDS
11 ☐ POLISH
12 ☐ HINDI
13 ☐ AFRICAN - SPECIFY _____
14 ☐ OTHER - SPECIFY _____
15
16 *PLEASE SIGN & DATE - FOR SECURITY AND VALIDATION*
17
18 X
19
20
21

LANGUAGE REGISTRATION RSID | REGION ID | ADDRESS ID

T59J-452A-HH39-PL2 | MON649 | 123-456-78

R

FIGURE 4 - FRONT VIEW OF VOTER LANGUAGE FORM- RECEIPT

L

CALIFORNIA 2012 ELECTIONS - LANGUAGE CHOICE
RESIDENTS OF 9628-100A ST, MONTEREY, CA 92502

SELECT *ONE* LANGUAGE YOU PREFER FOR INFORMATION, VOTER REGISTRATION FORMS AND VOTING BALLOTS

RETURN THIS FORM TO OFFICIALS

RECEIPT

1 ☐ ENGLISH
2 ☐ FRENCH - FRANCAIS
3 ☐ ITALIAN - ITALINAO
4 ☐ GERMAN - DEUTSCH
5 ☐ SPANISH - ESPANOL
6 ☐ CHINESE-CANTONESE
7 ☐ CHINESE-MANDARIN
8 ☐ UKRANIAN
9 ☐ FIRST NATIONS - SPECIFY _____
10 ☐ DUTCH - NEDERLANDS
11 ☐ POLISH
12 ☐ HINDI
13 ☐ AFRICAN - SPECIFY _____
14 ☐ OTHER - SPECIFY _____
15
16 *PLEASE SIGN & DATE - FOR SECURITY AND VALIDATION*
17
18 X
19
20
21

LANGUAGE REGISTRATION RSID
T59J-452A-HH39-PL2

REGION ID
MON649

ADDRESS ID
123-456-78

$R_t$

FIG. 5 - FRONT VIEW OF CANDIDATE BALLOT - MASTER PART
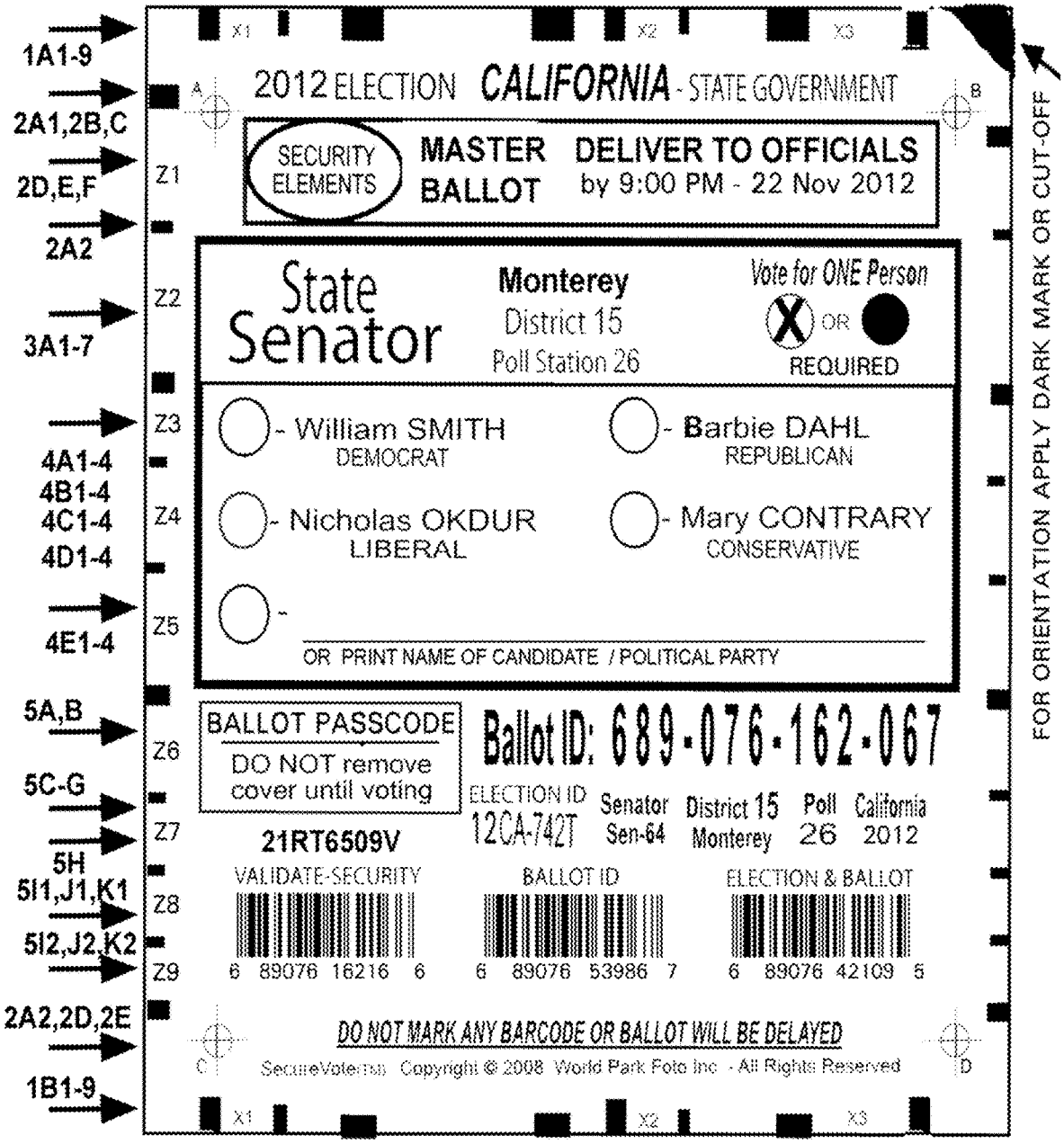

FIG. 6 - FRONT VIEW OF CANDIDATE BALLOT - RECEIPT PART
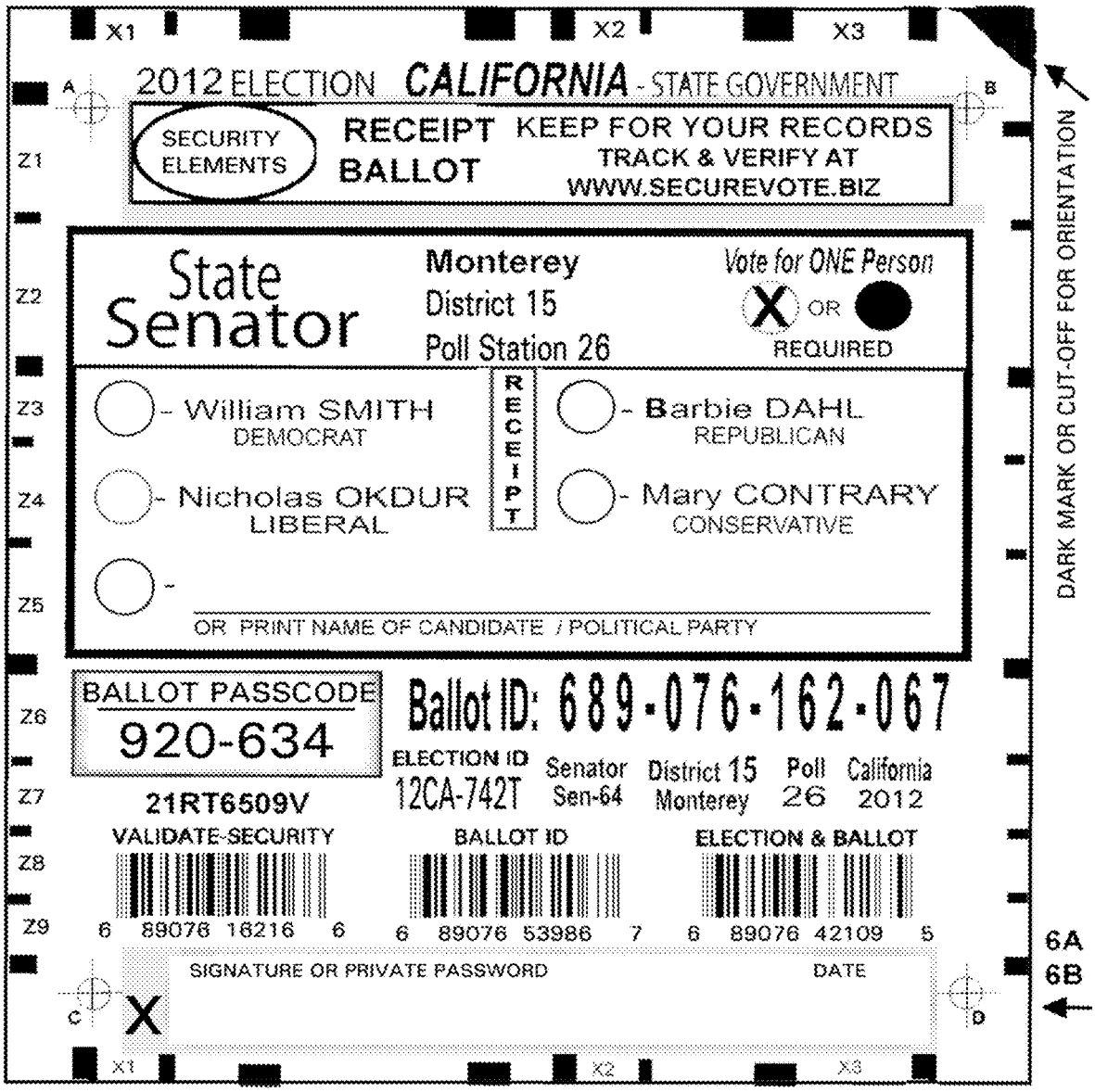

Figure 7 - Front view of a BALLOT - MASTER PART
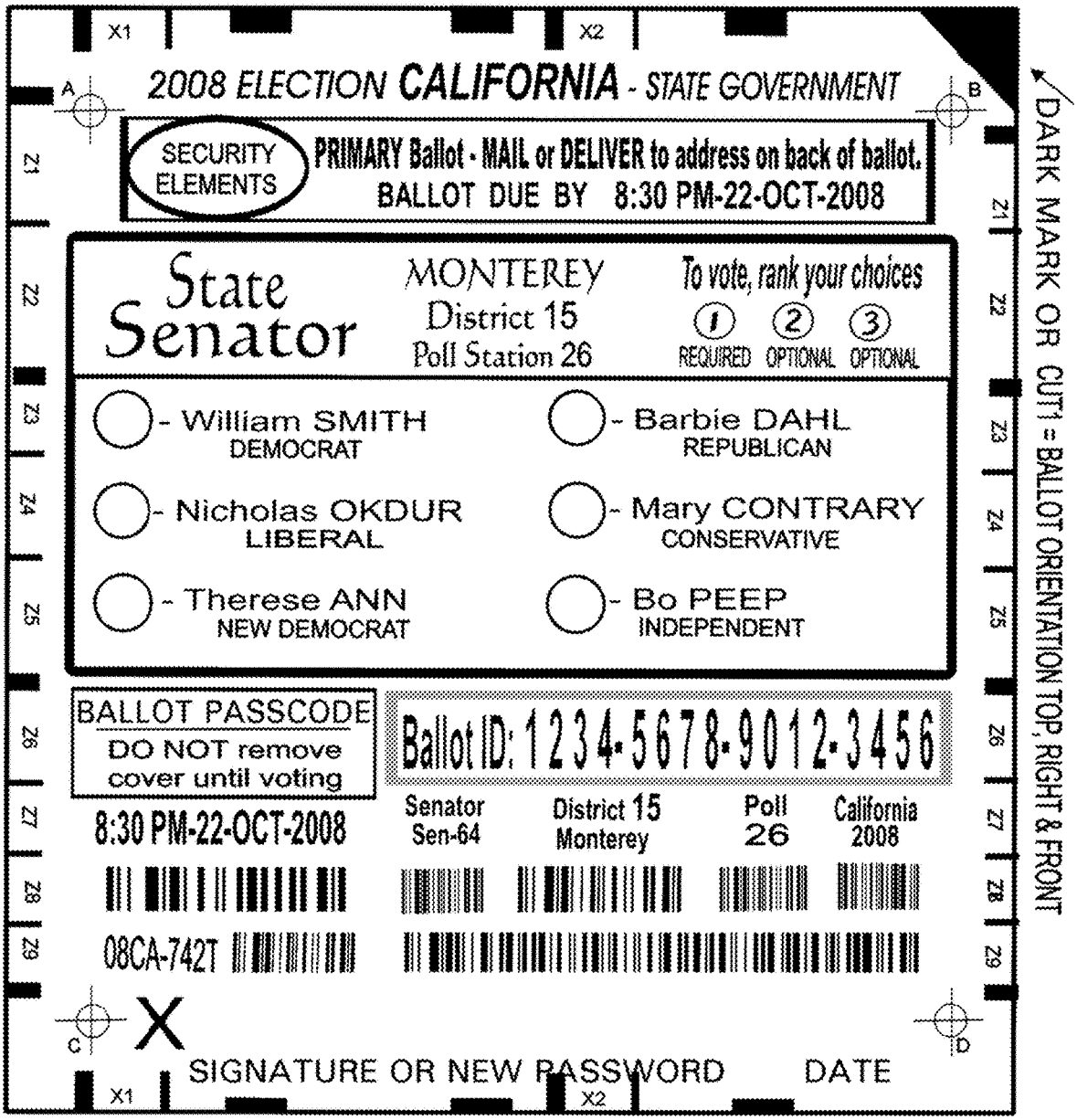

Figure 8 - Front view of a RECEIPT Ballot
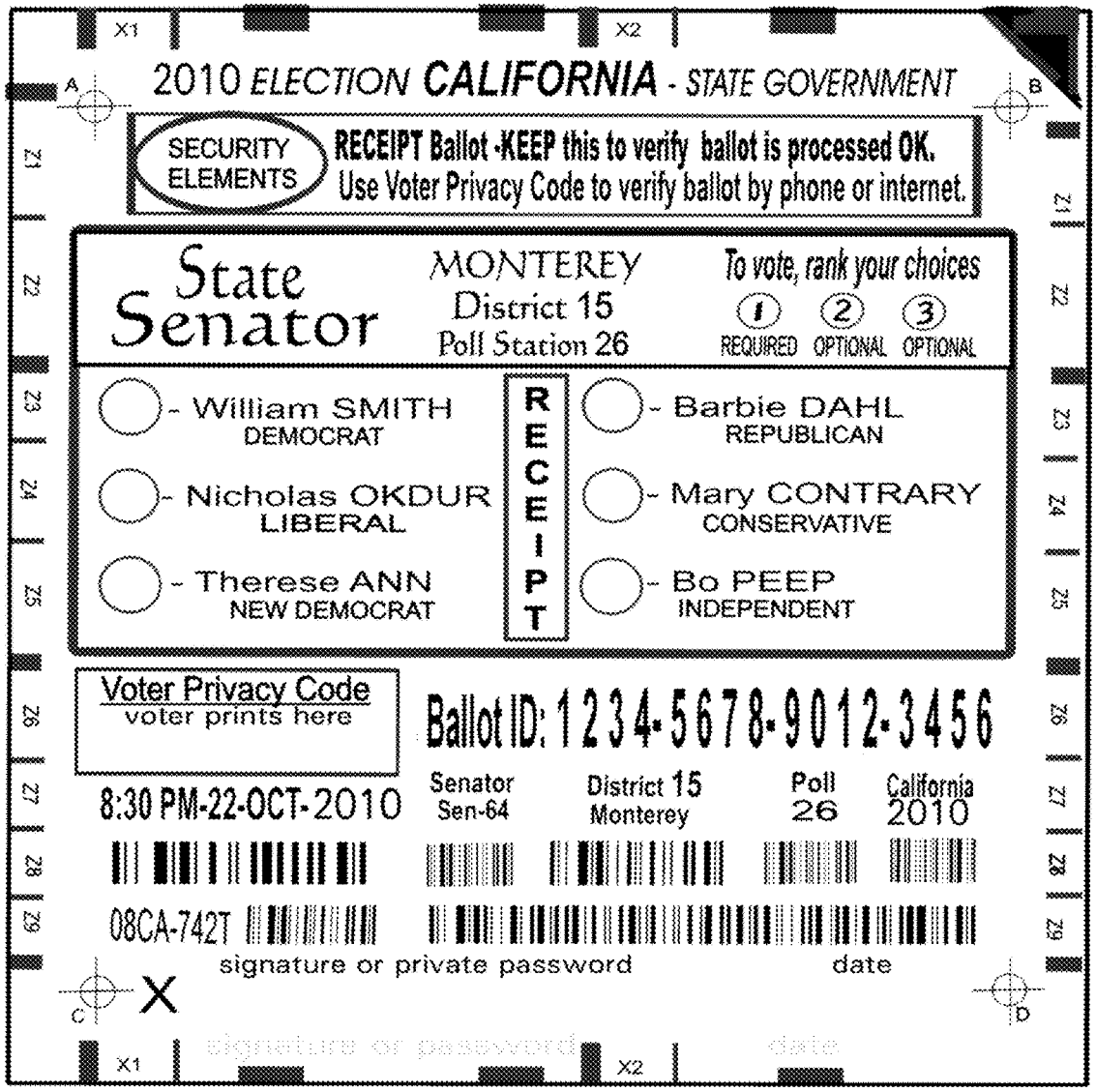

FIG. 9 - FRONT VIEW OF PROPOSITION BALLOT - MASTER PART
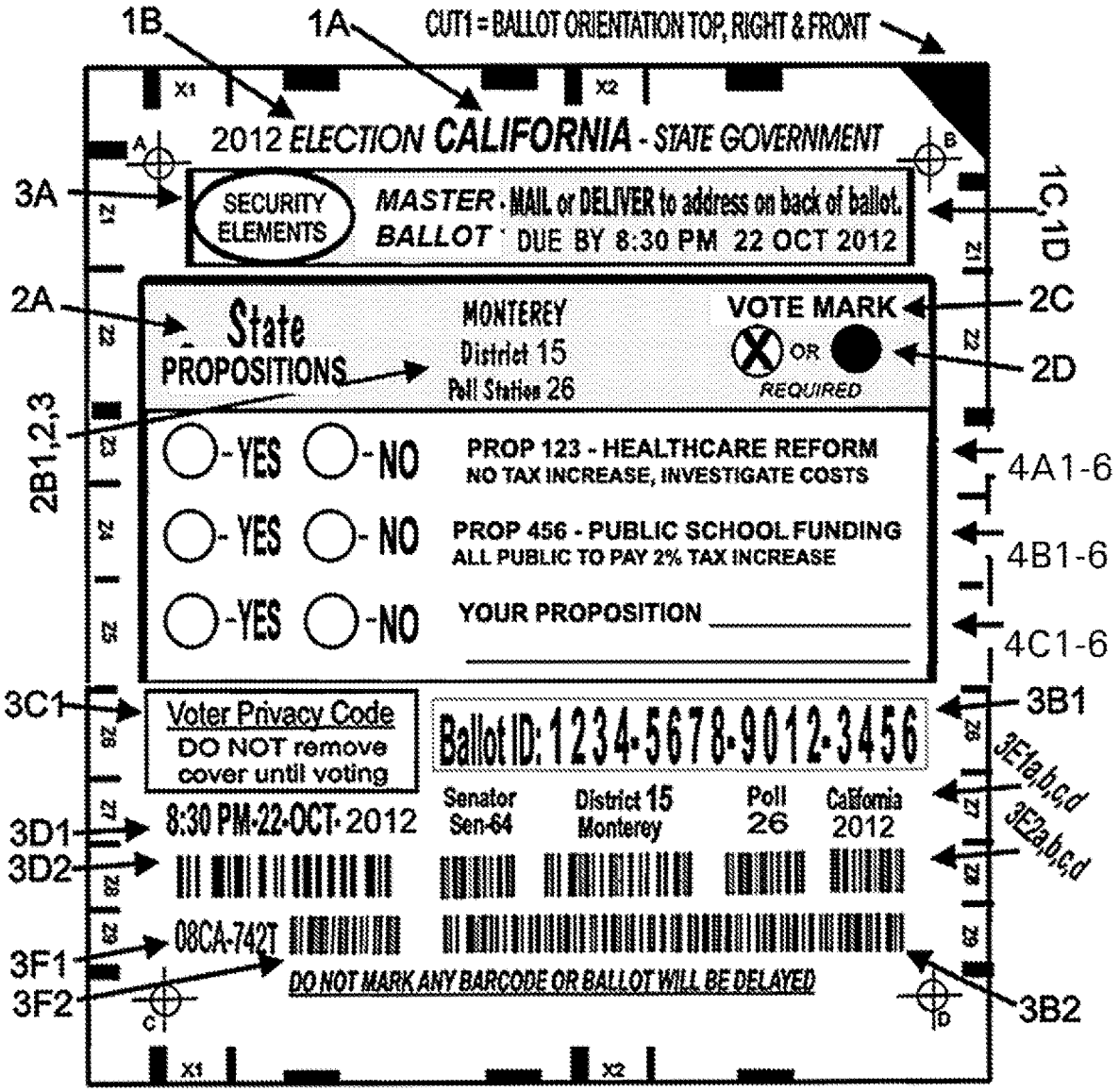

FIG.10 - PROPOSITION BALLOT - DUPLICATE RECEIPT PART
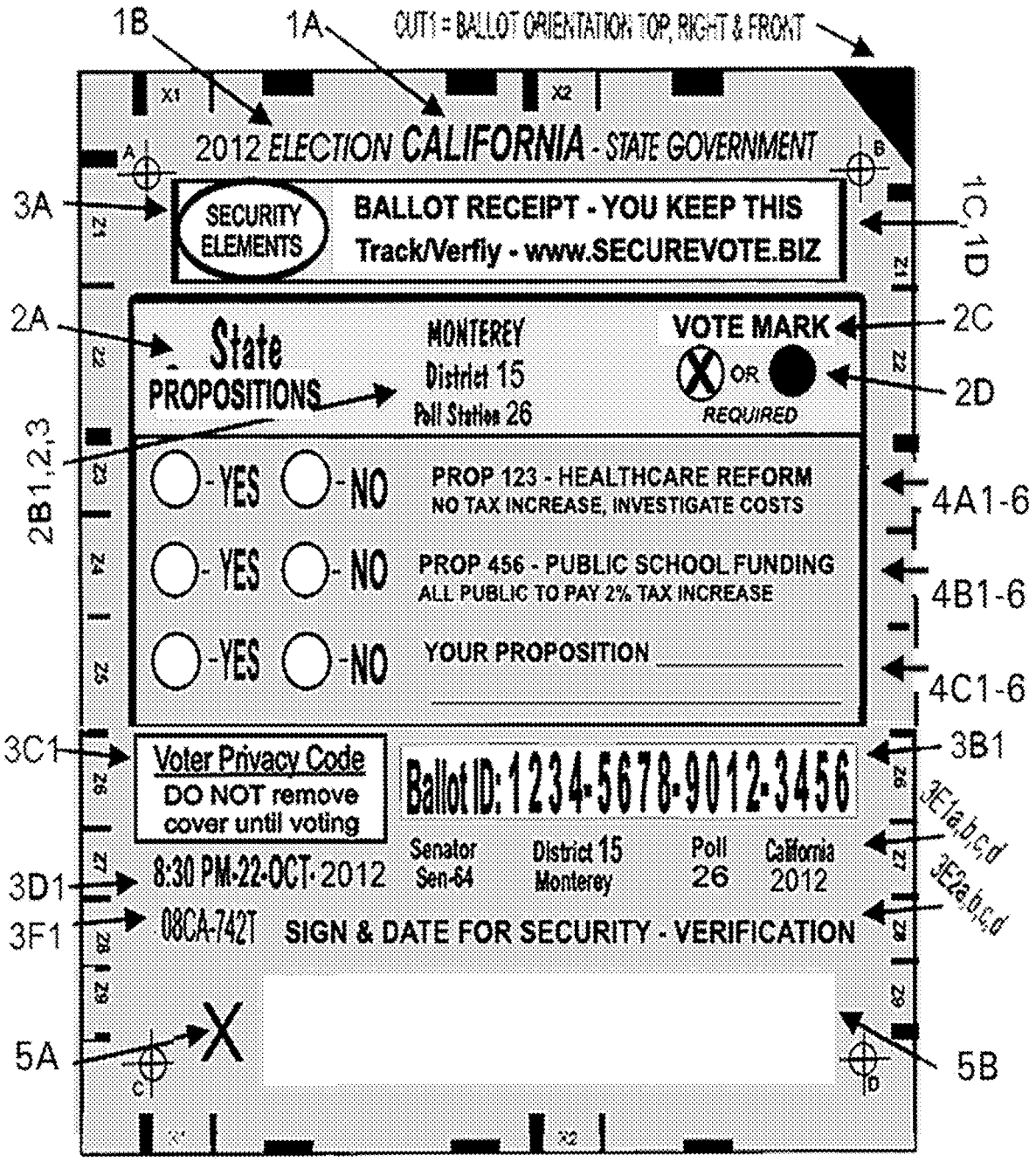

FIGURE 11 - FRONT VIEW OF VOTER INFORMATION SHEET

CALIFORNIA STATE GOVERNMENT & LAWS

*ELECTIONS 2008 - VOTE OCT 22,2008*

ELECTION DATA SHEET - KEEP TO VOTE

Mr. John Smith *ELIGIBLE, REGISTERED*
123 Sunshine Drive San Jose, CA 62011

You were sent a Ballot with Validation ID 512-456-980-345-765

*TO PROTECT YOUR PRIVACY, BEFORE VOTING, EXCHANGE BALLOTS WITH SOMEONE YOU TRUST, THEN EXHANGE BALLOTS AGAIN WITH SOMEONE ELSE.*
** BE SURE POLL STATION ID IS SAME ON EACH BALLOT EXCHANGED **

VALIDATE BALLOTS via TELEPHONE : 1-866-456-6000 to 6099
INTERNET : VALIDATE.CALIFORNIA.GOV
FAX : 1-877-123-3200 to 3299
EMAIL : VAIDATE @CALIFORNIA.GOV YOU CAN VOTE IN PERSON, BY MAIL, TELEPHONE, INTERNET, FAX or EMAIL.
VOTE IN PERSON AT 43551 W. ALEMEDA DRIVE, SAN JOSE *( MAP BELOW )*

VOTE BY TELEPHONE > 1-866-456-7800 TO 7899
VOTE BY INTERNET > VOTE.CALIFORNIA.GOV
VOTE BY FAX > 1-877-123-4500 TO 4599
VOTE BY EMAIL > VOTE@CALIFORNIA.GOV

QUESTIONS? 1-844-333-2200 MON-SAT 10AM-8PM PST

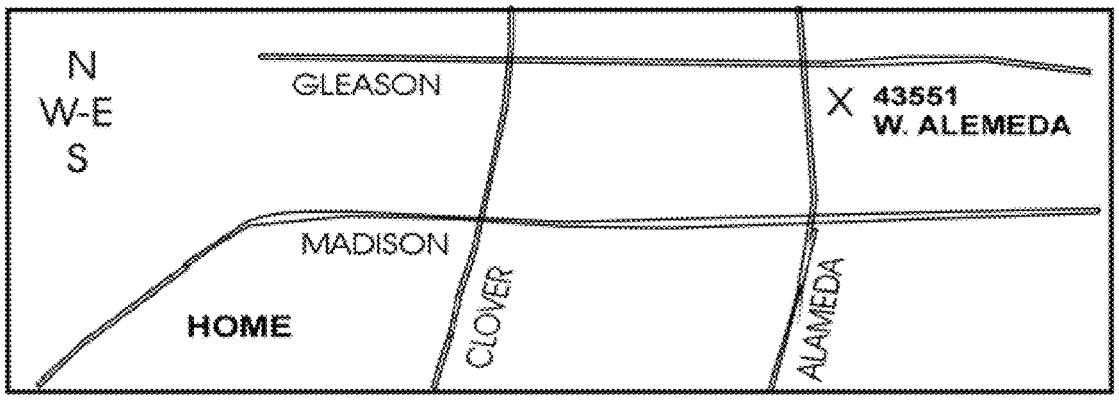

SECURITY ELEMENTS

Document ID K2NJ89CV411X

PRINTED
14-SEP-2008

Figure 12 - Front View of markings for a Ballot Return Container

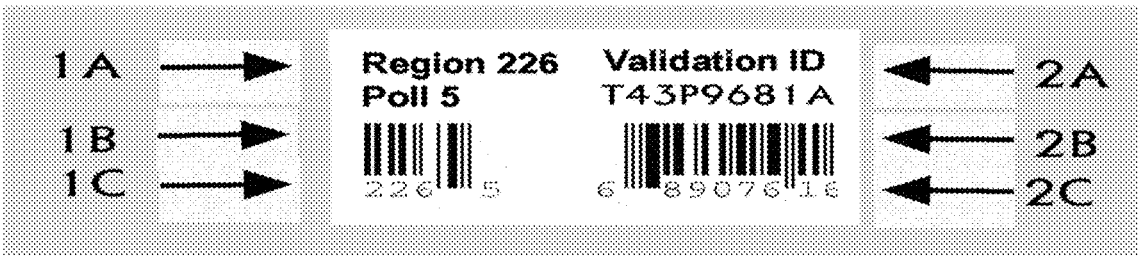

Invention: COMPUTERIZED VOTING SYSTEM
USA Patent Pending 60/521625
Canada Patent Pending 2,469,598
Inventors: Daniel W. Onischuk, World Park Foto Inc.
9628-100A ST. Edmonton, Alberta, Canada T5K0V8
Tel. 1-780-426-7676 WWW.SECUREVOTE.BIZ Figure 13 Venn Diagram of Ballot Relationships

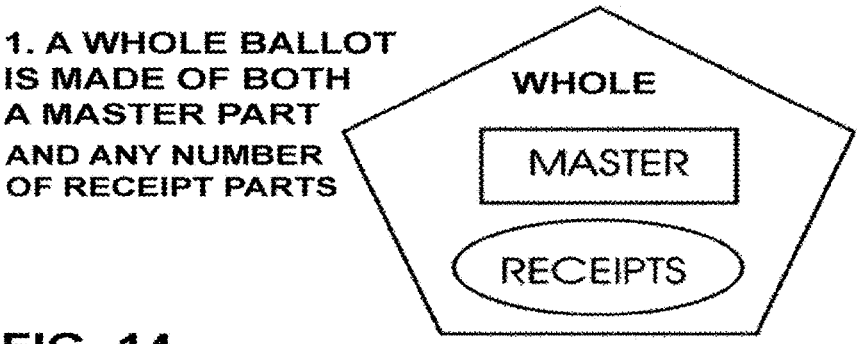

FIG. 14

B. Ballots - Entity Relationship Diagram

1 WHOLE BALLOT HAS AT LEAST 1 MASTER BALLOT PART
1 WHOLE BALLOT CAN HAVE ZERO TO MANY RECEIPT PARTS
1 MASTER BALLOT PART HAS ZERO TO MANY RECEIPT PARTS

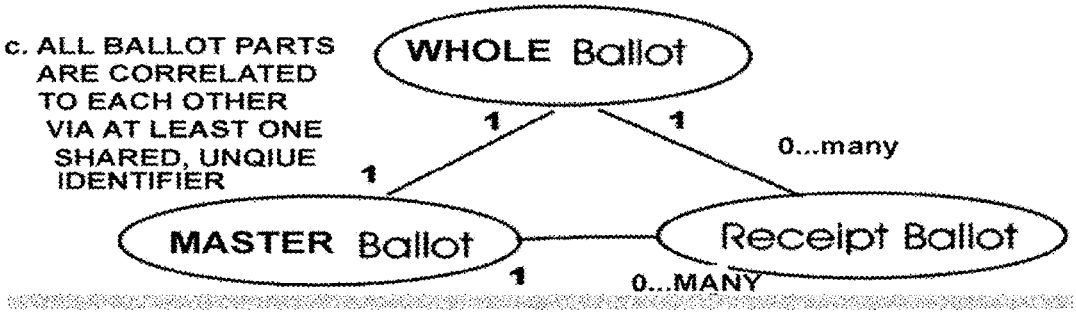

An Entity Relationship Diagram of a Voting Region and Participants

Voting Region encompasses any geographic or political area and any logistic sub-divisions Invention: COMPUTERIZED VOTING SYSTEM Inventor: Daniel W. Onischuk
9628-100A ST. Edmonton, Alberta, Canada T5K0V8
www.SECUREVOTE.BIZ Tel. 1-780-426-7676

All Rights Reserved Copyright (c)2004,2005 Dan & Therese Onischuk, World Park Foto Inc.

FIGURE 16 - List of Eligible Voters

Elections 2008 - Government of California

Eligible Voter List

Monterey District 15 Poll Station 24

Voter RegionID: A1234G
Electoral Riding: Montery Eligible Voters: 39450

| | | | | | | |
|---|---|---|---|---|---|---|
| 1477 | John | Q. | Smith | 112 | Wildrose Lane | 95202 |
| 1478 | Jane | E. | Smith | 112 | Wildrose Lane | 95202 |
| 1479 | Paul | C. | Lambert | 444 | LeMarchand | 95203 |

( etcetera )

Copyrights(c)2004,2005 Dan &Therese Onischuk, World Park Foto Inc

All Rights Reserved

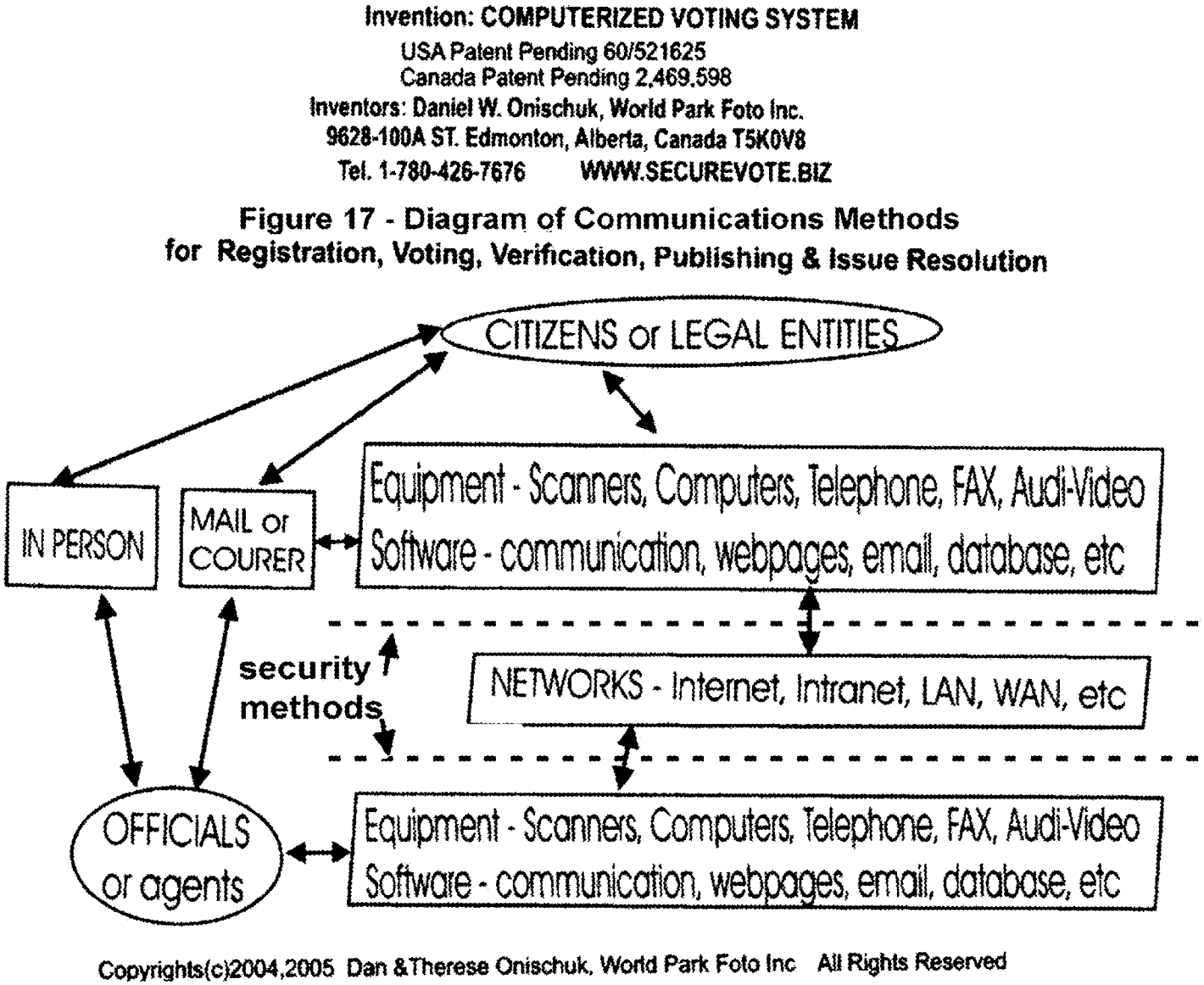
Invention: COMPUTERIZED VOTING SYSTEM
USA Patent Pending 60/521625
Canada Patent Pending 2,469,598
Inventors: Daniel W. Onischuk, World Park Foto Inc.
9628-100A ST. Edmonton, Alberta, Canada T5K0V8
Tel. 1-780-426-7676 WWW.SECUREVOTE.BIZ
Figure 17 - Diagram of Communications Methods
for Registration, Voting, Verification, Publishing & Issue Resolution
CITIZENS or LEGAL ENTITIES
IN PERSON
MAIL or COURER
Equipment - Scanners, Computers, Telephone, FAX, Audi-Video
Software - communication, webpages, email, database, etc
security methods
NETWORKS - Internet, Intranet, LAN, WAN, etc
OFFICIALS or agents
Equipment - Scanners, Computers, Telephone, FAX, Audi-Video
Software - communication, webpages, email, database, etc
Copyrights(c)2004,2005 Dan & Therese Onischuk, World Park Foto Inc All Rights Reserved INVENTION: COMPUTERIZED VOTING SYSTEM
INVENTOR: DANIEL ONISCHUK, 9628-100A ST NW EDMONTON,, AB. CANADA T5K0V8
TEL. (780) 426-7676 SALES@SECUREVOTE.BIZ www,SECUREVOTE.BIZ ALL RIGHTS RESERVED
COPYRIGHTS 2004-2010 DANIEL ONISCHUK, THERESE ONISCHUK, EDMONTON, CANADA
AND COPYRIGHT 2004-2010 WORLD PARK FOTO INC., EDMONTON, ALBERTA,CANADA

FIGURE 18 - Front view of a MASTER Ballot

2008 ELECTIONS *CALIFORNIA* - *STATE GOVERNMENT*

MASTER Ballot - Please RETURN

*TO VOTE - MARK CHOICE using* ⊗ ●

Member of State Senate *Select ONE person*

- ○ - William ONISCHUK
- ○ - Barbie DAHL
- ○ - Nicholas RUDKO
- ○ - Therese ANN
- ○ - Ella NICHOLSON
- ○ - Freah WILLY

| State Law Bill Proposals | YES | NO |
|---|---|---|
| S47 - Publish government spending monthly on the Internet | ○ | ○ |
| G44 - Improve Wildlife and Wilderness Protection | ○ | ○ |
| K9 - Reduce pesticide spraying 50% | ○ | ○ |

DO NOT MARK ANY BARCODE OR BALLOT WILL BE DELAYED

DWO 5H6DAN22CT5XL

DO NOT MARK ANY BARCODE OR BALLOT WILL BE DELAYED

SECURITY ELEMENTS

MONTEREY, CA
DIST15-POLL24

SEND BALLOT BEFORE
10PM-22MAR2008

SENATOR 54

PROP-S47W99G44K9

PASSCODE REMOVE COVER ONLY WHEN READY TO VOTE

INVENTION: COMPUTERIZED VOTING SYSTEM
INVENTOR: DANIEL ONISCHUK, 9628-100A ST NW EDMONTON,, AB. CANADA T5K0V8
TEL. (780) 426-7676 SALES@SECUREVOTE.BIZ www,SECUREVOTE.BIZ ALL RIGHTS RESERVED
COPYRIGHTS 2004-2010 DANIEL ONISCHUK, THERESE ONISCHUK, EDMONTON, CANADA
AND COPYRIGHT 2004-2010 WORLD PARK FOTO INC., EDMONTON, ALBERTA,CANADA

FIGURE 19 - Front view of a MASTER Ballot

2008 ELECTIONS *World Park Foto Inc* - *Edmonton*

*TO VOTE - CIRCLE CODE LETTER OF YOUR CANDIDATE* Z

CEO & PRESIDENT

*Select ONE person*

A - William ONISCHUK
B - Nicholas OKDUR
C - El l a NICHOLSON
D - Ann SMICZAK
E - Barbie DAHL
G- Freah WILLY
H- Cassie NOVAH
J- Glutias MAXIMUS
K - Mary CONTRARY
L - Bo PEAP
M - Asterix OBELIX

DO NOT MARK ANY BARCODE OR BALLOT WILL BE REJECTED

SECURITY ELEMENTS

VOTE REGION
A1234G

SEND BALLOT BEFORE
10PM-22MAR2008

CEO-PRESIDENT

World Park Foto

DO NOT MARK ANY BARCODE OR BALLOT WILL BE REJECTED

DWO 5H6DAN22CT5XL

INVENTION: COMPUTERIZED VOTING SYSTEM
INVENTOR: DANIEL ONISCHUK, 9628-100A ST NW EDMONTON,, AB. CANADA T5K0V8
TEL. (780) 426-7676 SALES@SECUREVOTE.BIZ www,SECUREVOTE.BIZ ALL RIGHTS RESERVED
COPYRIGHTS 2004-2010 DANIEL ONISCHUK, THERESE ONISCHUK, EDMONTON, CANADA
AND COPYRIGHT 2004-2010 WORLD PARK FOTO INC., EDMONTON, ALBERTA,CANADA

FIG.20 - FRONT VIEW OF WHOLE BALLOT - MASTER BALLOT PART

STOCKHOLDER CLASS A SHARES

*World Park Foto Inc - Edmonton*

*TO VOTE - CIRCLE YOUR CHOICE* ⊗ ●

Corporate Proposals

| | Select YES | Select NO |
|---|---|---|
| K9 - Donate $100,000 to wildlife protection | ○ | ○ |
| G44 - Sell 10,000 Class A on Alberta Stock Exchange | ○ | ○ |
| S47 - Invest $418,000 in new computer equipment | ○ | ○ |
| R68 - Split stock at 2:1 at $10 per new share | ○ | ○ |

DO NOT MARK ANY BARCODE OR BALLOT WILL BE REJECTED

SECURITY ELEMENTS

VOTE REGION
A1234G

SEND BALLOT BEFORE
10PM-22MAR2008

CLASS - A

WORLD PARK FOTO

DO NOT MARK ANY BARCODE OR BALLOT WILL BE REJECTED

DWO 5H6DAN22CT5XL

INVENTION: COMPUTERIZED VOTING SYSTEM
INVENTOR: DANIEL ONISCHUK, 9628-100A ST NW EDMONTON,, AB. CANADA T5K0V8
TEL. (780) 426-7676 SALES@SECUREVOTE.BIZ www,SECUREVOTE.BIZ ALL RIGHTS RESERVED Fig.21 - View of Back side of Whole Ballot - Master Part

This is a MASTER Ballot - Deliver to Officials of Voting Session

TO BE COUNTED THIS BALLOT MUST BE POSTMARKED BEFORE 10PM-31OCT-

*BEFORE USING THIS BALLOT*

DO NOT REMOVE COVER FROM THE PASSCODE UNTIL YOU ARE USING THIS BALLOT TO VOTE !!

I F YOU REC EIVED THIS BALLOT FROM ELECTION OFFICIALS YOU CAN PROTECT YOUR VOTE PRIVACY -- EXCHANGE THIS BALLOT AT LEAST ONCE WITH SOMEONE YOU TRUST

DELIVER BALLOT TO :
VOTE 2 0 0 8
9628-100A Street
EDMONTON, AB
CANADA T5K0V8

To verify Ballot ID call 1-800-333-4444

Or visit our website http://vote2008.org

Questions? 1-800-333-2012

This Ballot is limited and governed by the Laws of California and the rules of this election.

Invention: COMPUTERIZED VOTING SYSTEM

USA Patent Pending 60/521625 Canada Patent Pending 2,469,598

Inventors: Daniel W. Onischuk, World Park Foto Inc.
9628-100A ST. Edmonton, Alberta, Canada T5K0V8
Tel. 1-780-426-7676 WWW.SECUREVOTE.BIZ
sales@securevote.biz dan_onischuk@hotmail.com

FIGURE 22 - Back view of RECEIPT Ballot

This is a RECEIPT Ballot - KEEP to verify your votes were counted !

To verify your Ballot votes call 1-800-333-5555 Or visit website http://vote2008.org

*IF YOU DISCOVER AN ERROR IN OUR RECORDS OF YOUR VOTE*

PRIMARY BALLOT IS THE OFFICIAL RECORD - RECEIPT BALLOT ONLY TO VERIFY RECEIPT and PROCESSING OF PRIMARY BALLOT or DECLARE BALLOT PROBLEM

ALL BALLOT AND VOTING ERRORS MUST BE REPORTED BEFORE
31-MARCH-2008 500 PM MOUNTAIN DAYLIGHT SAVINGS TIME

TO START AN ERROR INVESTIGATION call 1-800-333-7777
or send email to: ERROR@vote2008.org
email subject: ERROR>your Ballot ID

Questions? 1-800-333-2008

This Ballot is limited and governed by the Laws of California and the rules of this election.

Copyrights(c)2004,2005 Dan &Therese Onischuk, World Park Foto Inc
All Rights Reserved Invention: COMPUTERIZED VOTING SYSTEM Inventors: Daniel W. Onischuk, World Park Foto Inc.
9628-100A ST. Edmonton, Alberta, Canada T5K0V8
Tel. 1-780-426-7676 WWW.SECUREVOTE.BIZ USA Patent Pending (prior) 11-161,752 Canada 2,469,598

FIGURE 23 - BALLOT FOR FIGS. .11,12,24 VOTER INFORMATION SHEET

CALIFORNIA 2008 STATE ELECTIONS

MARK X or FILL-IN ■ OF YOUR CHOICE(S)

| GOVERNOR choose ONE | SENATOR choose ONE | JUDGE choose TWO |
|---|---|---|
| SCHWARTZ | GOULD | SMARTE |
| JACKSON | GONZALES | ROUBBLE |
| HERNANDEZ | BLOSSOM | HOOK |
| SMYTHE | DONALD | MCGUFF |
| PILATES | RUBBLE | |
| AMENI | | |

LAW PROPOSALS

| | | |
|---|---|---|
| 415 (MEDICARE FOR POOR) | YES | NO |
| 233 (POLLUTION FINES UP) | YES | NO |
| 777 (STOP ANIMAL TESTS) | YES | NO |
| 442 (STOP INDUSTRY IN PARKS) | YES | NO |

BALLOT PRIVACY CODE
DO NOT REMOVE COVER
UNTIL READY TO VOTE

Security Element

ELECTION ID POLL#
SHOULD BE SAME
TO EXCHANGE OK

ElectionID POLL#
2008-CA-21 2249

Ballot ID > 512-456-980-345-765

Invention: COMPUTERIZED VOTING SYSTEM
Inventor: Daniel W. ONISCHUK 9628-100A ST. EDMONTON, AB. CANADA
Tel. 1-780-426-7676 Www.SECUREVOTE.BIZ
All Rights Reserved Copyright (c)2007 Dan & Therese Onischuk, World Park Foto Inc.

Fig. 24 - Front Side view of a Proposals Voting Results Report

Elections 2012 - California States Government

Proposals Voting Results
04 May 2012 @ 2:30 PM PST

State: California City: Santa Barbara

Eligible Voters: 1,889,888 Received: 966,666 (75.0%) Certified: 866,600 (74.8%) Spoiled: 60 (0.015%) Invalid:6 (0.005%)

| Region ID | Riding Name | Proposal Name | Proposal ID | Votes | %YES | |
|---|---|---|---|---|---|---|
| A1234G | Center | Healthcare Reform | CK-123 | 122,222 | 63.3 | APPROVED |
| A4567H | East | | | 60,600 | 35.7 | REJECTED |

State: California County: Napa Valley

Eligible Voters: 88,888 Received: 66,666 (75.0%) Certified: 66,600 (74.8%) Spoiled: 60 (0.015%) Invalid:6 (0.005%)

| Region ID | Riding Name | Proposal Name | Proposal ID | Votes | | |
|---|---|---|---|---|---|---|
| R1234N | Center | Healthcare Reform | CK-123 | 113,555 | 78.6 | APPROVED |
| R4567H | East | | | 20,600 | 21.4 | REJECTED |
| ( etcetera) | | | | | | |

PAGE SUMMARY TOTALS: 235,777 YES 71.4% APPROVED
OVERALL VOTING TOTALS : 1,496,578 YES 74.3% APPROVED

FIGURE 25 - FRONT VIEW OF A VOTING RECEIPT FROM OFFICIAL VOTING DEVICE(S)
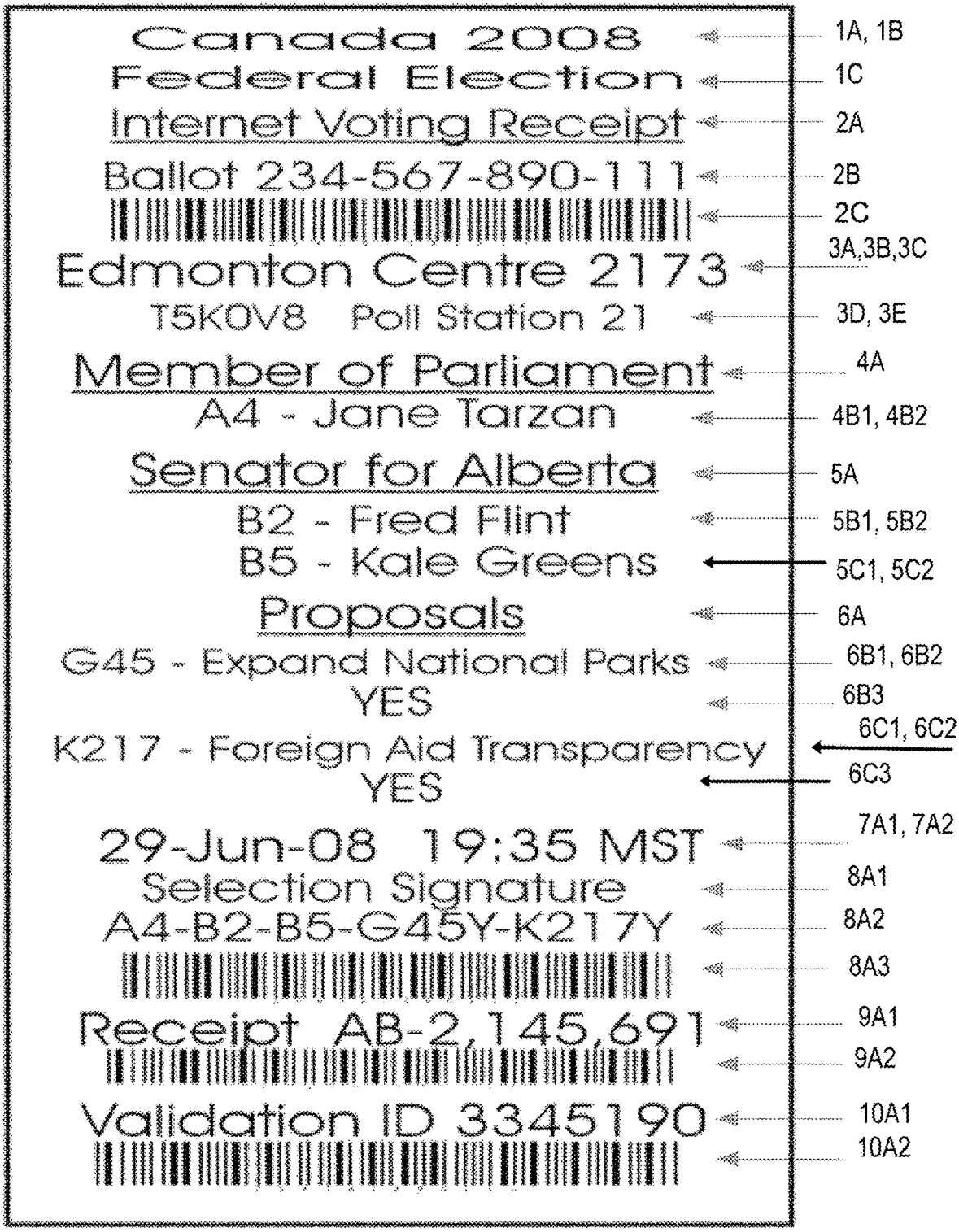

Figure 26 – Front side view of Voter Registration Receipt
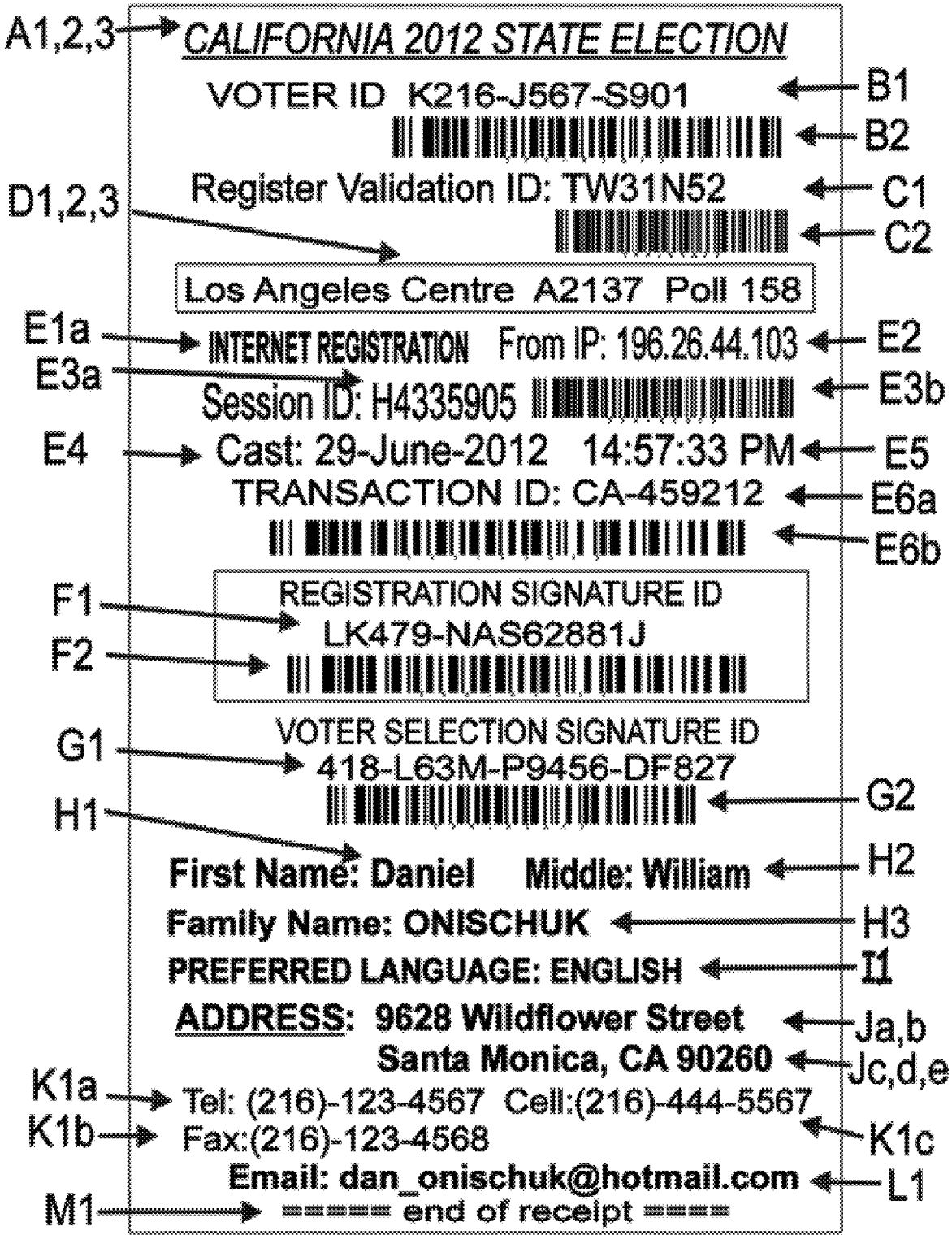

Invention: COMPUTERIZED VOTING SYSTEM
Inventor: Daniel W. Onischuk
9628-100A ST. Edmonton, Alberta, Canada T5K0V8
www.SECUREVOTE.BIZ Tel. 1-780-426-7676
All Rights Reserved Copyright (c)2007 Dan & Therese Onischuk, World Park Foto Inc.
Fig. 27 front view of a Delivery Confirmation for a MASTER Ballot
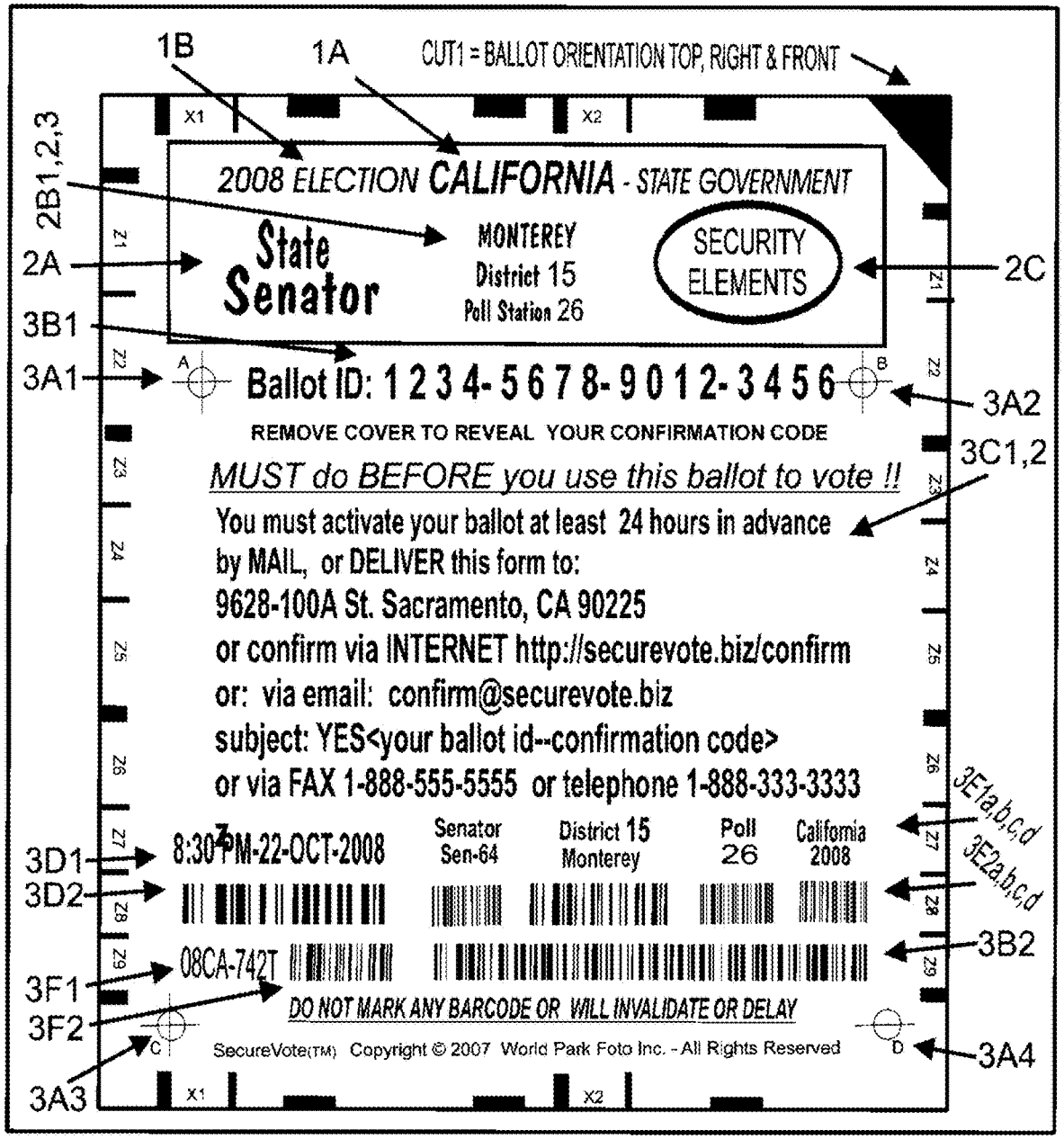
All Rights Reserved - Copyright (c)2007 Dan & Therese Onischuk, World Park Foto Inc.

Invention: COMPUTERIZED VOTING SYSTEM

Canada Pat.Pending 2,469,598 prior US Pat.Pending 11-627,174
Inventor: Daniel W. Onischuk
9628-100A ST. Edmonton, Alberta, Canada T5K0V8

All Rights Reserved Copyright (c)2007 Dan & Therese Onischuk, World Park Foto Inc.

FIGURE 28 - Ballot Delivery & Processing Report

Elections 2008 - California State Government

Ballot Delivery & Processing - Detailed Problem Reports for Los Angeles

| | | Delivery | | Processing | | | | |
|---|---|---|---|---|---|---|---|---|
| RegionID | Description | Deliverd | VotedOK | Problems | Spoiled | Invalid | Forgery | Missing |
| A1234G | Centre | 239,450 | 239,450 | 100 | 3 | none | 75 | 22 |
| | | 60.2% | 100% | 0.02% | 3.0% | nil% | 0.5% | 0.22% |

REPORTED MISSING BALLOTS-LOST OR STOLEN

| VoterID | Status | Name | Address | Contact |
|---|---|---|---|---|
| A4540NT54 | Replaced | Michael G. DONOF | 123 Laurel Lane | Tel. 780-123-4567 |
| H74TM90E | Replaced | George A. MOORE | 56 Pikes Peak Rd | gmoore@home.com |

REPORTED FORGERY BALLOTS

| VoterID | Status | Name | Address | Contact |
|---|---|---|---|---|
| A4540NT54 | Replaced | Olga Brundar | 12 Mayflower Lane | Tel. 780-123-4567 |
| H74TM90E | BallotOK | Mary Jones | 156 Laurel Peak Rd | gmoore@home.com |

Invention: COMPUTERIZED VOTING SYSTEM

Canada Pat.Pending 2,469,598 prior US Pat.Pending 11-627,174
Inventor: Daniel W. Onischuk
9628-100A ST. Edmonton, Alberta, Canada T5K0V8

All Rights Reserved Copyrights (c) 2007-2010
Daniel & Therese Onischuk, World Park Foto Inc.

Figure 29 - Registration Forms Delivery & Processing Report

Elections 2008 - California State Government

Registration Forms Delivery & Processing
Report for Los Angeles
04 May 2012 @ 2:30 PM PST

| RegionID | Description | Deliverd | RegOK | Problems | Spoiled | Invalid | Forgery | Missing |
|---|---|---|---|---|---|---|---|---|
| A1234G | Centre | 239,450 | 239,350 | 100 | 3 | none | 75 | 22 |
| | | 60.2% | 100% | 0.02% | 3.0% | nil% | 0.5% | 0.22% |

Voter Registration Forms Reported Lost or Stolen

| VoterID | Status | Name | Address | Contact |
|---|---|---|---|---|
| A4540NT54 | Replaced | Michael G. DONOF | 123 Laurel Lane | Tel. 780-123-4567 |
| H74TM90E | Replaced | George A. MOORE | 56 Pikes Peak Rd | gmoore@home.com |

Voter Regitration Forms Reported Forged or Erroneous

| VoterID | Status | Name | Address | Contact |
|---|---|---|---|---|
| A4540NT54 | Replaced | Olga Brundar | 12 Mayflower Lane | Tel. 780-123-4567 |
| H74TM90E | Is -OK | Mary Jones | 156 Laurel Peak Rd | gmoore@home.com |

Invention: COMPUTERIZED VOTING SYSTEM
Inventor: Daniel W. ONISCHUK 9628-100A ST. EDMONTON, AB. CANADA
Tel. 1-780-426-7676 Www.SECUREVOTE.BIZ
All Rights Reserved Copyright (c)2007 Dan & Therese Onischuk, World Park Foto Inc.

FIGURE 30 - CANDIDATES ELECTIONS RESULTS REPORT

Elections 2012 - California States Government Election Results
04 MAY 2012 @ 2:30 pm PST State: California City: Santa Barbara Eligible Voters: 1,889,888 Received: 966,666 Certified: 866,600 Spoiled: 60 Invalid:6
75.0% 74.8% 0.015% 0.005%

| Region ID | Riding Name | Winning Candidate | Party | Votes | %Votes | Rank |
|---|---|---|---|---|---|---|
| A1234G | Center | William ONISCHUK | Democrat | 122,222 | 63.3 | First |
| A4567H | East | Olga OKDUR | Republican | 60,600 | 35.7 | First |

State: California County: Napa Valley

Eligible Voters: 88,888 Received: 66,666 Certified: 66,600 Spoiled: 60 Invalid:6
75.0% 74.8% 0.015% 0.005%

| Region ID | Riding Name | Winning Candidate | Party | Votes | %Votes | Overall |
|---|---|---|---|---|---|---|
| R1234N | Center | Earl MOSTEN | Republican | 113,555 | 78.6 | First |
| R4567H | East | Jeanine DANIEL | Democrat | 20,600 | 21.4 | Second |

( etcetera)

PAGE TOTAL BALLOTS CAST : 235,777 PERCENT VOTED: 71.6
OVERALL TOTAL BALLOTS CAST: 2,456,783 PERCENT VOTED: 83.7

Invention: Computerized Voting System
Inventor: Daniel W. Onischuk – Edmonton, AB., Canada
www.SecureVote.Biz www.VoteByMail.Biz Figure 31: Front View of Voter Registration Confirmation United States of America - 2016 Federal Government Election
Voter Registration Confirmation

ELECTION IDENTIFIER
USA2016-FEDSENATE

ELECTORAL DISTRICT
CA-MLU-972-648

Voter Identifier
CA2136GH5791

Confirmation ID:
USCA-67V4YN905

| Family Name(s) | First Name | Middle Name(s) |
|---|---|---|
| JOHNSON-BROWN | OPHELLIA | ROSEMARIE |

Registrant Qualifying Home Address

413 Hickory Dickery Dock
Malibu, CA 90263

Address Identifier
CA221-MLU44TG36KL809NZ

Registrant Mailing Address

818 Pineview Road
Boston, MA 02110

Address Identifier
MA414-BSN93JR224TW

Home State Electoral District: Voter List Sequence ID: 2,293,625 or VG93LX47

Voting for: MALIBU, CA Electoral District: 972 Poll Station: 648 Voter: 8,492

Voter List Group: CL Group Sequence ID: 18,656 Status: OK-MIW

VOTER REGISTRATION KEY: CA972-MLU648-CL18656-VG93LX47-CA2136GH5791

If voting in person at BOSTON, MA refer to Voter List Group: EXT-STUDENT

Sub-Group: CA Sub-Group Seq. ID: 14,365 or SCA-T5H2

0

Invention: Computerized Voting System Inventor: Daniel Onischuk
SecureVote.Biz 9628-100A St NW Edmonton, AB. T5K0V8 tel.587-600-4475
FIGURE 32: Finalized Voting Ballot Confirmation & Receipt Document United States of America - 2016 Federal Government Election
Voter Registration Confirmation

ELECTION IDENTIFIER
USA2016-FEDSENATE

ELECTORAL DISTRICT
CA-MLU-972-648

Voter Identifier
CA2136GH5791

Confirmation ID:
USCA-67V4YN905

D2 GOVERNOR: BARBI DAHL – DEM.
E6 SENATOR: JON E. CARSON – DEM.
L4 CONGRESS: PABLO CRUIZE – DEM.
R3 CONGRESS: HOWARD HUGHES – REP.

P66 PROP. 66: YES - SAVE MARINE LIFE
P99 PROP. 99: YES - STOP CHEMICAL SPRAYS

TRANSACTION IDENTIFIER
CA221-MLU44TG36KL809NZ

BALLOT RECEIVED OK
MA414-BSN93JR224TW

Home State Electoral District: Voter List Sequence ID: 2,293,625 or VG93LX47

Voting for: MALIBU, CA Electoral District: 972 Poll Station: 648 Voter: 8,492

Voter List Group: CL Group Sequence ID: 18,656 Status: OK-MIW

DIGITAL SIGNATURE KEY: CA972-MLU648-CL18656-VG93LX47-CA2136GH5791

Sub-Group: CA Sub-Group Seq. ID: 14,365 or SCA-T5H2

COMPUTERIZED VOTING SYSTEM

Which is a continuation of USPTO applications Ser. Nos. 15/655,908, 14/730,582, 14/491,969, 14/301,217, 14/201,919, 14/588,897, 14/558,720, 14/491,969, 14/301,317, 14/201,919, 14/013,8006, 14/016,222, 13/898,467, 13/769,354, 13/710,263, 13/591,238, 13/033,577, 12/860,890, 12/475,444, 11/765,310, 11/555,204, 11/163,962, 11/160,003, 10/908,941, 60/521,625, 60/521,626 and claims benefits of the Paris Convention Treaty for Canada application 2,469,598.

PURPOSE OF INVENTION

Secure, Accurate, Rapid Processing of Voters, Ballots and Registrations

Technical Problems Resolved:

1. improve accuracy, time and money savings of compiling Voter lists;
2. extend the process of voting to encompass more Voters by providing significantly easier access to the process of voting;
3. extend the process of voting to encompass candidates, proposals or any combination of candidates and proposals;
4. maintain security, privacy and anonymity of Voter Ballots cast;
5. enable Voters to anonymously verify and correct the accuracy of Official records of any Ballots they have cast, by using electronic devices connected to communications networks;
6. Prevent counterfeit Ballots by special security elements and methods;
7. enable Voters to verify Ballots authenticity and validity by using electronic devices connected to communications networks;

Invention Uses:

1. Elections to select political candidates to Government duty.
2. Corporate group of stockholders vote to elect a Chief Executive Officer.
3. Public vote on passing a Government Bill Proposal as a Public Law.
4. Stockholders vote to accept or reject proposals on business activities.

BACKGROUND OF INVENTION

Although this invention was conceived without reference to existing patents, this invention differs from several existing patents significantly. The purpose of this patent is to overcome the following issues and limitations of existing patents according to my Cross Reference to Related Applications:

barcodes, whereby the barcodes themselves are not easily human readable. Furthermore, the process of Hall and Schwartz and other inventions referred to implicitly violate Voter privacy as there are means to link any persons ballot and vote to the ID number they are assigned for voting, such as, but not limited to visual observations of ID number, electronic interception of a generated ID number or any Voter can also be linked to a Ballot by human witnesses and electronic devices as to the date, time and place where the Ballot is cast.

The linking of a specific Ballot to a specific Voter can also be said for the patent of Way—U.S. Pat. No. 6,457,643 Way remarks 7. A Ballot paper as claimed in claim 5 or claim 6 wherein the unique Identifier is generated from a Voter's position on an electoral roll, the date and time the Ballot paper was issued, and an external value contributed by a key. Thus Officials could know when and where the specific Ballot Identifier was issued to a specific person, therefore the alleged privacy is penetrable through observation and deduction. Electronic surveillance technology could be used to detect electromagnetic waves emitted from devices issuing IDs which could then be sent to a portable computer that use software to determine an ID. The patent of Weiss U.S. Pat. No. 6,722,562 involves the use of Automated Teller Machines also links a Voter to a specific card and their personal identity number (PIN). Although ATM voting cards could be exchanged among Voters, ATM machines have cameras which would record the Voters face, along with the location, date and time of the Ballot cast from that particular ATM. The massive coordination of banks with government, computer software and privacy issues may prevent adopting that method, and also the magnetic field of ATM cards may be easily corrupted by mistake or malicious intent. Due to some similarities, it should be re-emphasized that this patent was developed without prior knowledge of Kargel U.S. Pat. No. 6,726,090 or any of the other patents, especially recent patents (Chung, Strabone, et al) which several years after my filing, and previously published patent applications. Chung appears to have copied various concepts including imaging entire Ballots using high speed scanning devices, use of ATM smart cards for Ballots and Voter information, and Strabone appears to reworded my previously filed descriptions of voting regions; yet, this invention overcomes disadvantages of Kargel, Chung and all other referred to patents by unique methods of:

(a) creating computer data lists to identify eligible Voters;

(b) extremely difficult to guess unique Identifiers to trace/link Registration Forms to Voters;

(c) extremely difficult to guess unique Identifiers to trace/link Ballots distribution to Voters;

(d) providing Voters with information to facilitate voting;

(e) decoupling Voters from specific Ballots to provide vote anonymity;

| | | | | | |
|---|---|---|---|---|---|
| 6640138 | April 2003 | Hall and Schwartz | 6726090 | April 2004 | Kargel |
| 3,141,976 | May 1974 | Hune | 6,722,562 | April 2004 | Weiss |
| 7,260,552 | August 2007 | Jorba | 6,457,643 | October 2002 | May |
| 7,975,920 | July 2011 | Chung and Dong | 7,861,918 | January 2011 | Strabone |
| 7,451,928 | November 2008 | Peterson | 8,024,570 | September 2011 | Noble |
| 6,888,898 | May 2005 | Chenes | 7,847,696 | December 2010 | Karjoth, et al |

Although Hall and Schwartz et al—U.S. Patent 60/540,138 refer to the use of scanning devices and scannable (f) collecting Ballots and Registrations from Voters and tracking the items received;

(g) telephonic and Internet voting that does not enable the Official person to link a specific Ballot ID to a specific Voter (in Kargel, Official person does not know if the Voter is legitimate, cannot protect Voter privacy when using an identifiable Ballot)

(h) extremely difficult to guess unique Identifiers to distinguish Master Ballots and their duplicates to prevent multiple voting using both Ballots at different voting locations;

(i) using at least one computer or telephone communication network; to facilitate Ballot issuance, Ballot replacement, Ballot Validation, private verification of voting;

(j) ensuring Ballots may not be counterfeited, to prevent unfair influence in results;

(k) providing Ballots with Security Elements to assist with Authentication;

(l) providing symbols and data on the Ballot to reduce human processing;

(m) voting to include people, proposals, or, any combination of people, proposals.

(n) providing an expiry time and date on the Ballot to limit Ballot use;

(o) providing additional information on the Ballot to facilitate accurate completion;

(p) providing additional information to help the Voter via a Voter Information Forms;

(q) providing extremely difficult to guess unique RSID Identifiers with additional prefixes, suffixes or embedded data symbols and binary data bits (zeroes and ones) within each RSID so as to intrinsically provide or enable grouping, sorting, organizing, error detection, error identification, error messaging, error location specification, error correction, error data recovery, encryption, decryption, compression, decompression, encoding, decoding of singular and groups of: data, words, images, symbols, numeric data, glyphs, security elements for transmitting, receiving, storing, searching, communicating and for the security of any number and types of data and for any further organization and data processing for each RSID and for one or a plurality of each type of Usage Group(s) of RSID(s);

(r) to ensure the integrity of the voting session, uniquely enabling and performing internal auditing capabilities of each data Object, data Object Events, participating Voter and Officials connected devices, security processes and all related signals, messages and communications;

(s) ensure voting anonymity by decoupling of voter identity from the ballots cast, selections made;

(t) security methods for ensuring voter privacy of personal sensitive information;

(u) methods for privately auditing ballots cast and reporting errors for investigation and resolution; After considering Chung, this invention is different and unique as there is no requirement to identify and link any specific Voter to any Ballot or the Ballot Container (Chung and Dong claims 9, 11, 29)—instead, this invention provides Voter privacy and prevents Official knowledge of any Voter link to a particular Ballot and the selections and Write-In choices thereon; After considering Hune—U.S. Pat. No. 3,941,976 it should be noted this invention also adds:

(i) assists the principles of democracy by making it easier for people to participate in voting, enabling the more accurate representation of Voters choices;

(ii) ensures the integrity of the Ballots so that the processing and voting selections may be verified and adjusted by the Voter and Official persons upon detection of any processing errors after the Ballot has been processed;

(iii)(a) use of a Random Symbolic ID (RSID) and other security elements and processes so as to ensure the integrity of Ballots so that a Whole Ballot, Master part of a Whole Ballot, and the Receipt part of a Whole Ballot and Voter Registration Form, and for any other Document-form of this invention may not be easily duplicated in any quantity to significantly affect the overall percentage of vote tallies, and any such duplicates would be immediately detected and removed for investigation to guarantee integrity of the final certified tally;

(iii)(b) use of a Random Symbolic ID (RSID) that is near impossible to guess or predetermine, and other Security Elements and error checking processes so as to ensure the integrity of Ballots, Voter Registration Forms, Proxy Voter Registration forms, Voter-Proxy Language Registration forms and any other Documents Objects, Containers, data items, data communications cannot be easily duplicated, and that any such duplicates would be immediately detected and removed for investigation so as guarantee integrity of the final tally and results; and optionally, for core RSID symbols: data attribute appending, error bit appending, data bit compression, overall re-encoding and encrypting so as to provide a composite RSID with embedded error detection, error identification, error location specification, error correction, error data recovery, error data rejection, and additional security, source identification, authorization and timing data, further hiding true core RSID symbols and security data information from Voters and potential counterfeiters with substitution data replacement or with public-private key pair data encryption or by a combination of each aforesaid methods substitution data replacement and public-private key pair data encryption;

(iv) additional security by use of Random Symbolic Identifiers (RSID's) or other Security Elements, which are evaluated to determine data accuracy and authenticity of Ballots, Registration forms, Containers, data transmissions;

(v) optionally applying tamper-proofing methods of signatures, dates, private PassWords;

(vi) utilizing Ballot activation Documents prior to voting;

(vii) providing Voters Receipts to confirm voting and Registration successfully completed and further providing Voters with a copy of their submissions;

(vii) methods providing voter anonymity for physical ballots casting and for methods of optical, electronic, electro-magnetic ballot casting;

(viii) security methods for ensuring voter privacy of personal sensitive information;

(ix) methods for privately auditing ballots cast and reporting errors for investigation and resolution;

SUMMARY OF INVENTION

The present invention provides a method and system that improves and extends the tasks of certifying eligible Voters, Voter participation, ensuring accurate vote reception, tallying, verification, and error reporting. The major components of the method involve providing specially designed Voter Registrations and Voting Ballots to a group of Voters; recording Registrations and Ballots received from the group of Voters; tallying the votes from Ballots that were authenticated and validated; publishing the vote tallies from the group of Voters; verifying the published Ballot votes and tallies on a per-Voter basis; and certifying the groups tallied Ballot votes were accurately recorded and counted. systems are also taught herein for accomplishing these tasks by use of:

1. acquiring information from computer databases and other sources to organize and construct any at least one of each of: Lists of Eligible Voters, Lists of Officials, and any other data relevant to the Voting Session or to this invention;

2. Official Voting Session Documents (VSDs) used for Registration, Voting, Auditing and Error reporting methods having at least one Receipt part; said Documents contain at least one unique Identifier (Random Symbolic Identifiers (RSID), or, at least one series of unique Sequential Identifiers, or, a hybrid of both Random Symbolic Identifiers and Sequential Identifiers) that are extremely difficult to guess, calculate, derive or infer outside of Officials or Document holders possession; further said Documents may optionally contain or be linked to a unique PassCode that is correlated to a specific Random Symbolic Identifier or specific Sequential Identifier to limit access use of the Document to only the person possessing the correlated PassCode;

3. Voting Session Documents (VSDs) containing special Security Elements for authentication;

4. Voting Session Documents may include Validation RSID(s) with or without Validation PassCode(s);

5. Limits of Use portion containing data to control, sort, filter, select Voting Session Documents;

6. VSDs use of optical barcodes, QR codes, any other codes to facilitate computer processing;

7. Official Voting Session Documents (VSDs) used for Registration, Authenticating, Voting, Validating, Tallying, Error processing and Reporting (RAVTER) processing using standard Physical, Optical, Electronic, Electro-Magnetic (also known as POEM) formats and methods for Object representation, data processing, data exchange and communications which may further be enhanced by Chemical embedding and composition analysis;

8. Postal Mail or Courier Delivery Services methods for transporting VSDs during Registration, Voting, Authenticating, Tallying, Error and Report (RAVTER) processing of physical format Documents, Containers and attachments or inclusions thereto or therein and further: transmitting, receiving, encoding, decoding, encrypting, decrypting, compressing, decompressing, reading, storing, retrieving, translating, visually rendering in any POEM format for at least one and for a plurality of: VSDs, VSDs data, Voters data, Officials data, session control data for a plurality of RAVTER sessions;

9. Telephone (land-line, cellular, mobile, satellite) methods for: transmitting, receiving, encoding, decoding, encrypting, decrypting, compressing, decompressing, reading, storing, retrieving, translating, visually rendering in any POEM format for at least one and for a plurality of: VSDs, VSDs data, Voters data, Officials data, session control data for a plurality of RAVTER sessions;

10. Optical-Electronic facsimile (Fax or Facsimile) Voting methods for: transmitting, receiving, encoding, decoding, encrypting, decrypting, compressing, decompressing, reading, storing, retrieving, translating, visually rendering in any POEM format for at least one and for a plurality of: VSDs, VSDs data, Voters data, Officials data, session control data for a plurality of RAVTER sessions;

11. Internet (electronic mail, secure web-pages) methods for: transmitting, receiving, encoding, decoding, encrypting, decrypting, compressing, decompressing, reading, storing, retrieving, translating, visually rendering in any POEM format for at least one and for a plurality of: VSDs, VSDs data, Voters data, Officials data, session-control data for a plurality of RAVTER sessions;

12. Interactive Television (electronic mail, secure web-pages) methods for: transmitting, receiving, encoding, decoding, encrypting, decrypting, compressing, decompressing, reading, storing, retrieving, translating, visually rendering in any POEM format for at least one and for a plurality of: VSDs, VSDs data, Voters data, Officials data, session-control data for a plurality of RAVTER sessions;

13. For a plurality of RAVTER sessions: Audio and Video devices and methods for: officials and voter registering, casting of ballots, Official and Voter authentication processing, communicating (transmitting, receiving, encoding, decoding, encrypting, decrypting, compressing, decompressing), error detecting, error correcting, error reporting, data Object security processing, ballot and registration authentication and normal non-error processing, storing, retrieving, translating, visually rendering in any POEM format for at least one and for a plurality of: VSDs, VSDs data, Officials data, Voters data, Officials data Objects, Voter data Objects, all communications and data exchange sessions and each related session-status and information handling meta-data as well as the desired Voter data;

14. In-Person methods using enhanced security and auditing methods for: transmitting, receiving, encoding, decoding, encrypting, decrypting, compressing, decompressing, reading, storing, retrieving, translating, visually rendering in any POEM format for at least one and for a plurality of: VSDs, VSDs data, Voters data, Officials data, session-control data for a plurality of RAVTER sessions;

15. Further to the aforesaid methods (such as: In-Person, Courier, Postal Mail, Email, Internet, Telephone, Computer, Personal Data Device, Interactive Television, Facsimile) of Voting (casting a Ballot) and Registering to Vote, additional methods are described that serve to better empower Voters with assured anonymity, freeing Voters from any concerns of retaliation by whomever they vote against, thus giving Voters true freedom of expression, true freedom of choice, vital for true democracy. These additional methods employ independent third party Ballot Processor Agents and Agent Devices, effectively decoupling Voters Identity from specific Ballots, thus decoupling Voter Ballot Selections and Write-In Choices from the Voter Identity.

The additional methods described herein also serve to protect the Voters private, sensitive personal information from third party Ballot Processor Agents and Agent Devices, thereby protecting Voters from having their personal identity revealed or linked to the Ballot Selections, Write-In Choices and any Ballots they cast.

(C) The additional methods also enables each and a plurality of Voters and Proxy Voters to privately and securely verify their respective Ballots and Voter Registrations were properly processed and further enables Officials to securely provide a fully verifiable audit trail for Voter and Proxy Voter Registrations, Ballots, Ballots cast, Ballot selections (Candidates, Proposals), Ballot write-in choices, Voter Language Selections forms, and for plurality of any other types of documents or document containers of this invention; The systems discussed herein are given as some of the illustrations of particular embodiments of the invention. Other embodiments of the invention are expected to employ differing degrees of automation in providing, validating, authenticating, recording, tallying, publishing, certifying recorded and tallied votes. The systems taught and described herein are not intended to limit the application of the method claimed. The method of the invention may also involve instrumentalities and combinations having different manifestations of representation, physical sizes, methods and characteristics to suit the many corresponding physical limitations, abilities, and requirements that bear on a particular voting session or the available technology used to achieve some purpose for any voting session. The spirit of this invention will be fulfilled as long as the principles of ensuring all Eligible Voters and Proxy Voters have anonymity when casting their initial Ballots, and may anonymously verify and be able to report errors for amendments regarding the record of their cast Ballots, thus ensuring the election system provides the intended integrity for each vote cast. This invention shall also include non-anonymous voting systems which apply any method, Documents or methods of any part of this invention.

Accordingly, it is an Object of the present invention to provide a voting method and system that allows one or more Voters to completely verify the accurate recording, tally and publication of each vote on any Proposal or Candidate and for each combinations of candidates and proposals; and it is a further Object of the invention to provide:

(A) a voting method and system that allows for a plurality of Voters: each Registered Voter, each Registered Proxy Voter and a plurality of Officials to verify their votes on any Proposal or Candidate was correctly recorded, tallied and published;

(B) each Voter with a private Receipt Ballot record of the Voter's Master Ballot vote;

(C) a public post-polling record of all votes cast on a proposal or candidate;

(D) the capability for each Voter to use their Receipt Ballot data to locate, verify then optionally report errors and authorize correction of the public record of their personal votes cast;

(E) the capability for Voters to use the verified or corrected public record of all votes cast to verify or authorize correction of the tallies or summaries of votes;

(F) vote verification and vote correction capabilities in a voting method or system that utilizes any physical, or, electronic, or, optical means of providing, receiving, recording validating, verifying, authenticating, tallying, summarizing, publishing and certifying: votes, Ballots records, tallies, summaries or results;

(G) a voting system the capability for Voters to use the records of all Eligible Voters to verify or authorize correction of their name and contact information to any list of Eligible Voters;

(H) vote verification and vote correction capabilities in a voting method or system that utilizes any physical, or, electronic, or, optical means of providing, receiving, recording validating, verifying, authenticating, tallying, summarizing, publishing and certifying any records, tallies, summaries or publications of any List of Eligible Voters;

(I) for a plurality of Documents, forms, and containers: Voting Ballot Documents, Voter Registration Documents, Voter Language Selection forms, Voter Registration Confirmation Documents, Voting Ballot Receipt Documents, Voter Registration Receipt Documents and any types of marked Containers (Ballot Delivery, Ballot Receipt, Ballot Casting, Registration Delivery, Registration Receipt, Registration Casting, Voter Complaint, Public Complaint, Official Reply) and any other Objects of this invention—whereby the aforesaid are in physical form, or electronic data, or as electromagnetic field data, or as optical data, physical markings, physical structures, chemical markers, electronic devices, or any combination thereof the steps and methods for electronic, electric, electro-magnetic, optical machines or devices used for recording, processing, storing, retrieval, and rendering of: Optical Visual Images, Audio Recordings, Electronic Data, Electronic-Optical data, Electromagnetic Data, Biological or Chemical Data; said machines or devices are programmed, directed or otherwise employed by Officials personally manually, or, by employing at least one Data Reading machine or device employing at least one Data Reading and Decoding Template to: actively capture exact images of the Document, Form or Container, then to locate, read, decode by the steps an methods of:

(i) relevant scanning orientation and alignment Marks or other markers used to determine location-position, boundaries, orientation, alignment, and used to calibrate, ensure accuracy, enhance any data or the process of capturing, or any other meta-data about the data, Document, form or container being scanned for:

(ii) any Official data, meta-data and Security Elements;

(iii) Voter data, meta-data and Voter Personal Security Items;

(J) and further whereby said reading each marked Container, Document or Form includes imaging of marked physical Containers: Voters submit a plurality of Documents, from each of the aforesaid Document group types (such as: Ballots, Voter-Proxy Registration forms, Voter-Proxy Language Registration forms, any types of Receipt Documents and any types of marked Containers (such as: Ballot Delivery, Ballot Receipt, Ballot Casting, Registration Delivery, Registration Receipt, Registration Casting, Voter Complaint, Public Complaint, Official Reply) to Officials by enclosing and one or a plurality of any types of Documents or Forms wrapped in a physical or electronic or optical or electromagnetic Container having one or a plurality of unique machine-readable Identifiers for each:

(1)(i) Container Identifiers, (ii) Jurisdictional Identifiers, (iii) Voting Session Identifiers, (iv) Voter Identifiers, (v) submitted date-stamps or date-time-stamps markings; (vi) Container Contents Identifier or markings;

(2) wherein for each Official designated Identifier (Container, Jurisdiction, Voting Session, Voter, Container Contents) shall also include: (a) one correlated binary value, (b) at least one correlated barcode value, (c) at most a single two-dimensional bar code graphics, (d) whereas the Container Contents identification markings may be a simple choice selection marking with an X or check-Mark, solid fill-in box, or Identifier markings;

(3) the aforesaid Identifiers, markings, barcodes and values shall also have a prescribed font, symbolic representations of characters, symbols, numbers, alphanumeric characters, non-alphanumeric characters, graphical drawings, graphical icons that are represented accurately in any format (physical, electronic, magnetic, optical), that are capable of data capture, optical recognition (OCR) processing, intelligent character reading (ICR), data inter-format conversion, and data storage in any type of form (Physical, Optical, Electronic, ElectroMagnetic) using any format (such as: binary data, alphanumeric data, images, audio, video) for a plurality of combinations of form and formats;

(4) aforesaid Identifiers criteria shall include and apply to one or a plurality of correlated Official Security Elements and one or a plurality of Voter Personal Security Items thereof, and for capturing exact image for physical Documents that are:

(i) effectively transported along a physical transport path of an image Document scanner, or (ii) by capturing an image of the Container or Document or Object by using a remotely controlled or an autonously controlled, manually focusing or self-focusing high resolution digital optical camera, or (iii) using one or a plurality of alternative scanning data acquisition device (optical barcode reader, ultra-violet light invisible ink illuminator and reader, electromagnetic ink reader, plastic credit card magnetic stripe reader, electronic micro-device, integrated circuit reader), or (iv) by converting physical, electronic, optical, electromagnetic data of the physical, electronic, optical or electromagnetic Container or Document so as to be able to render said Container or Document as a high resolution optical image in a pixelated or bitmapped image file format—that is implemented for a plurality of, each types of: Containers, Documents, Objects and Data Communications of this invention;

(K) wherein all physical, electronic, optical and electromagnetic representational formats of: Documents, Forms and Containers have boundary, alignment, orientation and sorting markings used to facilitate the scanning process which are applied prior to scanning;

(L) whereby the aforesaid process of scanning comprises the steps:

(i) determine the Document, form or container voting primary Jurisdiction, and for one or a plurality of sub-Jurisdictions;

(ii) determine one or a plurality of attached, linked or correlated Voting Session Identifier(s), Official Marks and Security Elements, Voter Marks, and Personal Security Items;

(iii) determine the types of Document(s) to be scanned;

(iv) optional pre-sorting and grouping a plurality of Documents, as well as sorting and grouping by type of Document;

(v) at least one imaging control devices for Officials or at least one Official manually scanning, interpreting and inputting data;

(vi) enables at least one scanning device; (vii) loads scanning device parameters;

(viii) captures the entire Document image and for any portions thereof;

(ix) applies image processing software to adjust visibility, quality and file size;

(x) applies Image Processing Software (IPS) to convert said image file to at least one image storage format, then saves-stores the image in at least one type of formats: Physical, Optical, Electro-Magnetic as well as one or many types of forms of the saved type of format;

(xi) applying IPS to scale the image view to required size;

(xii) rotating the image to the proper orientation;

(xiii) signaling an error if the image is blank, illegible, or too dark to use;

(xiv) setting the image to the proper alignment relative to a test alignment sheet;

(xv) loading the appropriate Document reading (image processing) Template, or a series of Templates (for that respective Document type, voting Jurisdiction, Voting Session Identifier on that specified date for the allowed time period)—that is designed to scan Voter Data portions of the Document to extract the Voter provided information thereon and therein that is correlated to specific Voter Data positions areas of the said Document;

(xvi) scanning each Voter Data position that is correlated to the Voter Template Data Field Value adjacent to, or at each Voter Data position;

(xvii) reading and decoding each Voter data field value that is converted from optical images to the actual values of the characters, numbers and symbols by using at least one computer running programs of Optical Character Recognition (OCR) software and Intelligent Character Reading (ICR) software;

(xviii) storing at least one image parts of any Document portions or Container having markings of Voter signature, initials, date, PassWords, PassCodes or any other Voter Personal Security markings or graphics;

(xix) and also to scan, read, and decode from each reading Template area that corresponds to each Official data position: every Official data field Identifier, each correlated Official data field values, one or a plurality of: correlated barcodes, characters, numbers, symbols, graphics, Official Security Elements;

(xx) scan, read, decode from each reading Template area corresponding to each Officials Marks for alignment, orientation, scan zone Identifier, image quality control;

(xxi) Voter portions captured of what is read and decoded has correlated values redundantly stored (physically, optically, electronically, electromagnetically) immutably, then converted and correlated to binary, octal and hexadecimal number values that are used for machine processes (comparisons, validation, authentication, certification, tallying, counting, sorting, analyzing, summarizing, reporting, storing) for provided Voter data; and further said Voter portion (Document, Container) read images of Voter signature, Voter initials, Voter PassWords, Official Ballot RSID(s) and Official PassCodes are used to compare to verify or reject one or a plurality of Voter signatures, Voter initials, Voter PassWords, Official Ballot RSID(s) and Official PassCodes, and any other type of graphics or Security Elements on any type of Document and Container by comparison to that specified Voter signatures, Voter initials, Voter PassWords, Official Ballot RSID(s) and Official PassCodes, and to any other type of graphics or Security Elements recorded previously for the said Voter Registration, Documents or Ballots;

(M) whereby aforesaid steps of part (L) are also used for each marked Container that is received so as to determine First whether the Container and internal Document(s) were sent to the proper Jurisdiction and whether were timely submitted for processing whereby:

(a) each said Container Identifier includes one or a plurality of unique Container Identifiers, one or a plurality of unique voting session Identifiers, at least one unique Jurisdiction Identifiers, one or a plurality of unique Voter Identifiers—wherein determining is from:

(i) Container Identifiers and barcodes or QR codes, (ii) Jurisdictional Identifiers and barcodes or QR codes, (iii) Voting Session Identifiers and barcodes or QR codes, (iv) Voter Identifiers and barcodes or QR codes, (v) Voter Personal Security Items (Voter: signatures, initials, PassWords, graphics, glyphs) personal access numbers and symbols, graphical barcodes, QR codes, multi-dimensional holograms of barcodes, and correlated barcode values;

(vi) Official Ballot RSID(s), Official PassCodes, Security Elements, any other Official, Voter or Third Party graphics or markings;

(vii) date-stamps or date-time-stamps markings and barcodes or QR codes, (viii) Container Contents Identifier or markings and barcodes or QR codes, (ix) orientation, alignment, boundary and scanning enhancement markings;

(x) meta-data for each said Container, Identifiers and scanning quality (accuracy) related meta-data;

(b) determining whether the Container or Document is a valid, verifiable Container or Document comprises: determining whether the Template read values of Voter Personal Security Items (Voter: signatures, initials, PassWords, graphics), Official Ballot RSID(s), Official PassCodes, Security Elements, any other Official, Voter or Third Party graphics or markings are also found in the voting system data storage and determined to be valid, active identical Identifiers found in each of the:

(i) Voting Session Group Identifiers, (ii) Certified Voter Registration records having the same Registered Voter Identifier, (iii) Container Identifier records having the same Container Identifier, (iv) Jurisdiction Identifier records having the same Jurisdiction Identifier, (v) Document Identifier records having the same Document Identifier and correlated PassCode, (vi) Third-Party Identifier records having the same Third-Party Identifier;

(N) (a) said reading and decoding the machine readable Identifiers, markings, values, and data that are read from each Container and each Document and Form therein also includes locating and decoding the machine readable Identifiers, markings, values, and data from the said pixelated or bitmapped format of the Container image or Document image; and steps of acquiring, extracting, recording, organizing, correlating and storing:

(b) Container variables: (Document-type-Identifier, Document-style-Identifier, Document-version-Identifier, Document RSID, Document PassCode, Container-Identifier, Container-status, Voter-Identifier, Voter-address-Identifier, voting-session-Identifier, Jurisdiction-Identifier, region-Identifier, poll-station-Identifier, expiry-date, expiry-time, sending-date, sending-time, delivery-date, delivery-time, Security-Element1, Security-Element2, Security-Element3, Security-Element4, Voter-Marks-data, Official-Marks-data, sorting-Marks-data, alignment-Marks-data, Container-QR-code);

(c) Ballot variables: (Document-type-Identifier, Document-style-Identifier, Document-version-Identifier, Document RSID, Document PassCode, Security-Element1, Security-Element2, Security-Element3, Security-Element4, Security-Element5, Security-Element6, Security-Element7, Ballot-type, Ballot-session-Identifier, Ballot-session-Identifier-barcode, voting-session-Identifier, voting-session-Identifier-barcode, voting-region, voting-region-barcode, voting-district, voting-district-barcode, voting-poll-station, voting-poll-station-barcode, Ballot-purpose-total, Ballot-purpose-Identifier, Ballot-purpose-item, Ballot-purpose-description, Ballot-purpose-description-barcode, Ballot-expiry-date, Ballot-expiry-date-barcode, Ballot-expiry-time, Ballot-expiry-time-barcode, Ballot-validation-Identifier, Ballot-validation-Identifier-barcode, Ballot-validation-PassCode-barcode, Voter-submitted-rsid, Voter-submitted-PassCode, candidate-Identifier, candidate-Identifier-barcode, candidate-Ballot-position, candidate-description, candidate-political-group, candidate-Mark-image, candidate-writein-image, candidate-writein-extract-name, proposal-Identifier, proposal-Identifier-barcode, proposal-Ballot-position, proposal-description, proposal-Mark-image, proposal-writein-image, proposal-writein-extract-data, Voter-signature-image, Voter-signature-status, signature-date-time, signature-date-time-status, Voter-personal-security-item1, Voter-personal-security-item2, Voter-personal-security-item3, Official-Marks-data, sorting-Marks-data, alignment-Marks-data, Ballot-QRcode);

(N) (d) Registration variables: (Document-type-Identifier, Document-style-Identifier, Document-version-Identifier, Document RSID, Document PassCode, Security-Element1, Security-Element2, Security-Element3, Security-Element4, Security-Element5, Registration-ID, Delivery-Due-date-time, delivery-barcode, address-Identifier, address-Identifier-barcode, location-Identifier, location-Identifier-barcode, voting-session-Identifier, voting-session-Identifier-barcode, Voter-Identifier, Voter-first-name, Voter-middle-name, Voter-lastname, Voter-type, Voter-status, Voter-birth-year, Voter-birth-month, Voter-birth-day, identification-type1, identification-data1, identification-type2, identification-data2, identification-type3, identification-data3, Voter-Language-Identifier, Voter-signature-data, Voter-signature-image, Voter-signdate-image, Voter-signdate-data, Language-Registration-Identifier, Voter-address-Identifier, Voter-address-street1, Voter-address-street2, Voter-address-city, Voter-address-state-province, Voter-address-county, Voter-address-district, Voter-address-country, Voter-address-zip-code, Voter-address-postal-code, Voter-phone1, Voter-phone1-type, Voter-phone2, Voter-phone2-type, Voter-phone3, Voter-phone3-type, Voter-Fax or Facsimile, Voter-EMail1, Voter-EMail2, Voter-EMail3, Voter-personal-security-item1, Voter-personal-security-item2, Voter-personal-security-item3, Ballot-delivery-method-choice, political-party-preference1, political-party-preference2, assign-Proxy, Proxy-First-name, Proxy-middle-name, Proxy-lastname, alternate-Voter-Proxy, altprox-address-street1, altprox-address-street2, altprox-address-city, altprox-address-state-province, altprox-address-county, altprox-address-district, altprox-address-country, altprox-address-zipcode, altprox-address-postal-code, altprox-phone1, altprox-phone1-type, altprox-phone2, altprox-phone2-type, alt-prox-phone3, altprox-phone3-type, altprox-Fax or Facsimile, altprox-EMail1, altprox-EMail2, altprox-EMail3, Voter-Write-In1, Voter-Write-In2, Voter-Write-In3, Voter-Write-In4, Voter-Write-In5, Official-Write-In1, Official-Write-In2, Official-Write-In3, Official-Write-In4, Official-Write-In5, Voter-Marks-data, Official-Marks-data, sorting-Marks-data, alignment-Marks-data, Registration-QRcode);

(N)(e) Language selection variables: (Document-type-Identifier, Document-style-Identifier, Document-version-Identifier, Document RSID, Document PassCode, Security-Element1, Security-Element2, Security-Element3, Security-Element4, Security-Element5, Security-Element6, Voter-Identifier, Voter-type, Voter-status, Voter-submit-Identifier, Voter-submit-status, Voter-submit-type, Voter-address-Identifier, Voter-submit-address-Identifier, Voter-Language-Identifier, Voter-submit-Language-Identifier, Voter-Write-In1, Voter-Write-In2, Voter-Write-In3, Voter-submit-signature, Language-Registration-Identifier, Voter-First-name, Voter-middle-name, Voter-lastname, Voter-contact-phone, Voter-cell-phone, Voter-Fax or Facsimile, Voter-EMail1, Voter-EMail2, Voter-EMail3, Voter-personal-security-item1, Voter-personal-security-item2, Voter-personal-security-item3, Voter-Marks-data, Official-Marks-data, sorting-Marks-data, alignment-Marks-data, Registration-QRcode);

(f) and further whereby for each instance of said Container, Ballot, Registration, Language and any other related Documents (affidavits, drivers license, photo ID, passport, social security ID, citizenship papers, birth certificates, utility bills) are replicated and then logically correlated to Official Devices generated: (Object-ID, Event-ID, Group-ID, parent-Object-ID, parent-Event-ID, parent-Group-ID, child-Object-ID, Child-Event_ID, Child-Group-ID, voting-session-Identifier, voting-region-Identifier, poll-Identifier, poll-address-Identifier, Official-receiver-Identifier, Official-receiver-signature-data, date-receive, time-receive, Official-device-Identifier, device-address-Identifier, transaction-Identifier, validation-Identifier, source-Identifier-data, device-session-Identifier, Document-signature-Identifier, Voter-selections-hashing-signature-Identifier, Document-encryption-result, Document-encryption-methods, Document-encryption-metadata, Document-encryption-private-keys, Document-encryption-public-keys, Document-storage-Identifier, Document-storage-location-Identifier, Document-image-storage-Identifier, Document-image-backupcopy-storage-Identifier, Document-image-backup-copy-storage-Identifier, Document-copy-Official-markup-storage-Identifier, Document-copy-Official-markup-location-Identifier, Document-copy-Official-markup-PassCode, Document-copy-Voter-markup-storage-Identifier, Document-copy-Voter-markup-location-Identifier, Document-copy-Voter-markup-PassCode); (O)(a) wherein each said Document Identifiers includes at least one unique Document Identifiers, at least one unique Voting Session Identifiers, at least one unique Jurisdiction Identifiers, one or a plurality of Officially provided unique Voter Identifiers, one or a plurality of Voter Personal Security Items—whereby determining is from the unique Document Identifier, Jurisdiction Identifier, and Voting Session Identifier, and one or a plurality of Official unique Voter Identifiers and Voter Personal Security Items (such as: Voter signature, Voter initials, Voter PassWord, Voter images or graphics), Official Document RSID(s) (such as: such as: Registration, Language, Ballot, Activation, Receipt, Container, Complaint, Amendment, Error, Report, Object), correlated Document PassCodes, and Security Elements, other graphics and markings for that type of Document (such as: Registration, Language, Ballot, Activation, Receipt, Container, Complaint, Amendment, Error, Report, Object);

(O)(b) determining whether said Documents are valid, verifiable Document comprises: determining whether the Template read Official Document RSID(s) (such as: Registration, Language, Ballot, Activation, Receipt, Container, Complaint, Amendment, Error, Report, Object), correlated Official PassCodes, Security Elements, are found and correlated within Official Document records of the correlated Document type (such as: Registration, Language, Ballot, Activation, Receipt, Container, Complaint, Amendment, Error, Report, Object) for the current Voting Session;

(c) whether said Documents are from a Certified, Registered Voter comprises: determining whether the Template read Voter Personal Security Items (such as: Voter signature, Voter initials, Voter PassWord, Voter images or graphics) are found in the Certified Voter Registration record having the identical unique Certified Registered Voter Identifier for the current Voting Session;

(d) determining whether the Document is a valid, verifiable Document comprises: determining whether the Template read Jurisdiction Identifier, Voting Session Identifier, Voting District Identifier, Voting Zone Identifier, Polling Station Identifier, Security Elements, Random Symbolic Identifiers, PassCodes and any other type of graphics or markings are found in the voting system data storage and determined to be valid, active Identifiers, graphics and markings;

(P) Official Ballot RSID, Official Ballot PassCode are used for Ballot verification with Official databases, and further, for remote electronic devices, Ballot PassCode may also be used for two stage authentication of Official Ballot RSID and voting authentication; and further Ballot PassCode may also be used by the Ballot possessor as a mutually shared private key for data encryption employing public-private key pairs, including multi-iterative encryption techniques, and in conjunction with one or a plurality of shared Voter Personal PassWords created by the Voter;

(Q) upon successful, positive First stage authentication of said Documents and Ballots, further within each Documents and within each Ballots positively authenticated further comprises of said decoding of the Official data field label Identifiers, data fields and correlated barcodes, Official Security Elements, Voter selections, Voter Write-In data values, symbols, graphics and Voter Personal Security Items, Voter signatures, Voter initials, Voter PassWords, Official Ballot RSID(s) and Official PassCodes, or Security Elements, and any other type of graphics or markings that are read from each Document in accordance with the selected reading Template comprises decoding consistent with the pre-determined minimum acceptable values for: illumination, exposure level, tonal contrast, focus, sharpness, white point value, black point value, black and white contrast, color contrast, hue, saturation, greyscale quantum levels, gray scale contrast, and chromatic values of each Document for the Official data field label Identifiers, data fields and correlated barcodes, Official Security Elements, Voter selections, Voter Write-In data values, symbols, graphics and Voter Personal Security Items, Voter signatures, Voter initials, Voter PassWords, Official Ballot RSID(s) and Official PassCodes, or Security Elements, and any other type of graphics or markings which are marked on each Document or plurality of Documents in accordance with the selected, correlated reading Template or plurality (series) of Templates associated or selected for reading said Document and said plurality of Documents;

(R) so as to confirm Official processing accuracy and to make amendments, enabling each Voter to validate their Voter Registration, Voter Language Selection, or cast Ballot by using their privately known Ballot Voting RSID or Voter Registration RSID one or a plurality of Official PassCodes and one or a plurality of Voter Personal Security Items, by optionally referring to correlated private Internet WebPages and one or a plurality of correlated Official records, whereby Officials constrain access to said Voter webpage and correlated Voter Copy of Voter Data Vault by use of one or a plurality of Official Internet webpage(s) each having a private, specially encoded Internet Universal Resource Locator (URL) address(es) and one or a plurality of correlated Voter Internet Data Access RSID(s) (Voter Registration RSID, Voter Registration PassWord(s), Voter Authentication Identifier(s), Voter Ballot Validation RSID, Voter Ballot Validation Passcode(s), Voter Ballot Validation Authentication Identifier, Voter Ballot Voting RSID, Voter Ballot PassCode(s), Voter Ballot Authentication Identifier(s), Language Selection RSID, Registration Container RSID, Language Selection Container RSID, Ballot Container RSID, Ballot Container PassCode(s), Ballot Container Authentication Identifier(s), Object RSID, Event RSID, Group RSID, Service RSID, Process RSID, Error RSID, Session RSID, Location RSID, PollStation RSID, Communication RSID, Communication PassCodes(s), Communication Authentication Identifier(s), Security Elements RSID, Security Element PassCode(s), Security Element Authentication Identifier(s), Error Processing RSID, Storage RSID, Device RSID, Source RSID, Destination RSID, DateTimeStamp RSID, Transaction RSID, Receipt RSID, Voter Choices Signature RSID, Hashing Algorithm RSID, Private Encryption-Decryption Key RSID, Private Encryption-Decryption Key RSID PassCode(s), Private Encryption-Decryption Key RSID Authentication Identifier(s), Public Encryption-Decryption Key RSID, Public Encryption-Decryption Key RSID PassCode(s), Public Encryption-Decryption Key RSID Authentication Identifier(s), TransCoding RSID, Security Data Bits RSID, Data Error Correction Data Bits RSID) and correlated VIDA PassCode(s) that must be properly entered so as to enable viewing of said webpage(s) for each type of Document, Container, Object, Event, Communication, Error or Service for each said Internet Universal Resource Locator (URL) address and for a plurality of said Internet Universal Resource Locator (URL) addresses;

(S) for public validation: tallying, summarizing and publishing a complete list and optionally, correlated images of all Registrations and Ballots received whether timely or not, further identifying or extracting and providing a complete and logically organized list of all timely received, valid, and authentic RSIDs that were assigned to Ballots, Registrations, Language Selections, Containers, Error Reports, Error Corrections, Non-Error Amendments, Tallying, Reporting, Authentication, Validation, Certification, Publishing;

(T) receiving and investigating all requested Voter Registration or Voter Language Selection or Voter Ballot casting amendments and then completing or rejecting final processing for a plurality of Voters or Officials, and for each amendment affected Voter or Official, and for a plurality of Voters and Officials, steps of: confirming, verifying, validating then accurately recording, storing, certifying and publishing all valid amendments—and of rejecting any invalid untimely, or disallowed amendments according to Voting Session Rules;

(U) Officials actively authenticating, validating, monitoring, tracking, and assessing: actively participating voters, proxy voters, officials, official devices, voter and proxy voter devices, communications systems, computer processes and services—allowing valid, authentic activities but disallowing invalid, unauthenticated, and unapproved activities.

In addition to the foregoing, further, Objects, features, and advantages of the present invention should become more readily apparent to those skilled in the art upon a reading of the following detailed description in conjunction with the drawings, wherein there are shown and illustrated as examples of embodiments of the invention. It is evident that those skilled in the art may now make numerous other uses and modifications of and departures from the specific embodiments described herein without departing from the inventive concepts. Consequently, this invention is to be construed as embracing each novel feature or novel combination of novel features present in or possessed by the methods and techniques herein disclosed and is not to be limited to the spirit or scope of these descriptions, disclosures, appended claims or drawings:

There are 33 (THIRTY-THREE) drawings included for this invention:

A Whole Voter Registration form is comprised of one Master part of FIG. 1 that is solo without a duplicate receipt copy, or, is further logically correlated to at least one Receipt part(s) of FIG. 2—and further such that FIG. 2A is correlated to FIG. 1A, and FIG. 2B to FIG. 1B whereby:

FIG. 1 is a site plan view for the entire Front side of a First embodiment of a Master part of a Whole Voter Registration Form whereby FIG. 1 is comprised of two portions: FIG. 1A and FIG. 1B that are to be combined by joining at adjacent sides: FIG. 1A right side is joined to the left side of FIG. 1B so as to be a combined site plan view of FIG. 1 which is comprised of:

FIG. 1A: which is a site plan view showing the Left portion of the Front view for a First embodiment of a Master part of a Whole Voter Registration, and with further modifications may also be considered a First embodiment of the Left portion of the Front view for a First embodiment of a Master part of a Proxy Voter Registration;

FIG. 1B: which is a site plan view showing the Right portion of the Front view for a First embodiment of a Master part of a Whole Voter Registration, and with further modifications may also be considered a First embodiment of the Right portion of the Front view for a First embodiment of a Master part of a Proxy Voter Registration;

FIG. 2 is the Receipt part of a Whole Voter Registration whereby the Receipt part is comprised of two portions: FIG. 2A and FIG. 2B that are combined by joining at logically adjacent sides (FIG. 2A right side is joined to the left side of FIG. 2B portion) so as to be a combined site plan view for the entire Front view of a First embodiment of a Receipt part of a Whole Voter Registration which is comprised of:

FIG. 2A: which is a site plan view showing the Left portion of the Front view for a First embodiment of a Receipt part of a Whole Voter Registration, and with further modifications may also be considered a First embodiment of the Left portion of the Front view for a First embodiment of a Receipt part of a Proxy Voter Registration;

FIG. 2B: is a site plan view showing the Right portion of the Front view for a First embodiment of a Receipt part of a Whole Voter Registration, and with further modifications may also be considered a First embodiment of the Right portion of the Front view for a First embodiment of a Receipt part of a Proxy Voter Registration;

FIG. 3: a site of view for the Front side of a First embodiment of a Master part of the Voter Language Registration;

FIG. 4: a site of view for the Front side of a First embodiment of a Voter-Proxy Receipt part of the Voter-Proxy Language Registration; A Whole Ballot is comprised of one Master part of FIG. 5 that is logically correlated to one or a plurality Receipt part(s) of FIG. 6 whereby:

FIG. 5: a site plan view for the Front side of a First embodiment of a Master part of a Whole Ballot (comprised of a Master and Receipt parts);

FIG. 6: a site plan view for the Front side of a First embodiment of a Receipt part of a Whole Ballot that is correlated to FIG. 5 of this invention.

FIG. 7: a site plan view for the Front side of a Second embodiment of a Master Ballot part of a Whole Ballot of this invention;

FIG. 8: a site plan view for the Front side of a Second embodiment of a Receipt Ballot part of a Whole Ballot correlated to FIG. 7 herein;

FIG. 9: a site plan view for the Front side of a Third embodiment of a Master Ballot part of a Whole Ballot of the invention;

FIG. 10: a site plan view for the Front side of a Third embodiment of a Receipt part of a Whole Ballot correlated to FIG. 9 of the invention;

FIG. 11: a site plan view for the Front side of a First embodiment of the Voter Ballot Information Sheet Document of the invention;

FIG. 12: a site plan of the Front side of a First embodiment of Delivery Container and Return Container markings of the invention;

FIG. 13: a First embodiment of Venn Diagram of Ballot Relationships;

FIG. 14: a First embodiment of a Ballot-Entity Relationship Diagram

FIG. 15: a site plan view of a First embodiment of an Entity Relation Diagram of Voting Regions and Participants of the invention;

FIG. 16: a site plan view of a First embodiment of a List of Eligible Voters;

FIG. 17: a site plan view of a First embodiment of a Diagram of Communication Methods for Registration, Voting, Verification, Publishing. Issue Resolution FIG. 18: a plan for the Front side of a Fourth embodiment of a Master Ballot part;

FIG. 19: a plan for the Front side of a Fifth embodiment of a Master Ballot part;

FIG. 20: a plan for the Front side of a SIXTH embodiment of a Master Ballot part;

FIG. 21: a plan for a First embodiment of the BACK side of a Master Ballot, which may be correlated to FIGS. 5,7,9,18,20,23 of this invention; and with modification, FIG. 21 may also be correlated to FIG. 1 for the Voter Registration Form—Master part, and may also be correlated to FIG. 3: Voter Language Form—Master part;

FIG. 22: a site plan view for a First embodiment of the BACK side of a Whole Ballot-Receipt part that is correlated to FIGS. 6,8,10 and with further modifications, may be correlated to FIG. 2 for Voter Registration—Receipt part, or, correlated to any embodiment of the Voter Language Form—Receipt part of this invention;

FIG. 23: a site plan view for the Front side of an SIXTH embodiment of a Master Ballot of the invention, that may be correlated to FIG. 21 of this invention which could then be the BACK side for this FIG. 23, or, alternatively, FIG. 21 or 24;

FIG. 24: a site plan view for the Front side of a First embodiment of a Proposals Voting Results Report of the invention;

FIG. 25: a site plan view for the Front side of a First embodiment of a Internet Voting Receipt correlated to FIGS. 5,6,8,9,10,13,18,19,20,23 and with further modifications, may be correlated to FIG. 3,4,12,21,22,24 or may be used as a electronic voting Receipt;

FIG. 26: a site plan view for the Front side of a First embodiment of a Receipt for Voter Registration by Internet, Fax or Facsimile, EMail, or In-Person of the invention;

FIG. 27: a site plan view for the Front side of a First embodiment of a Delivery Confirmation for a Master Ballot of this invention;

FIG. 28: a site plan view for the Front side of a First embodiment of a Ballot Delivery and Processing Report of the invention;

FIG. 29: a site plan view for the Front side of a First embodiment of a Voter Registration Forms Delivery and Processing Report;

FIG. 30: a site plan view for the Front side of a First embodiment of a Candidates Election Results Report of the invention;

FIG. 31: a site plan view for the Front side of a First embodiment of a Voter Registration Confirmation Receipt of the invention which may be correlated to figure FIGS. 2A, 2B, 4 and to FIGS. 1A, 1B, 3 which may be the front view or top portion or bottom of the front view and may also to FIG. 11 which may also be included the back view or the bottom portion or top portion of the front view of this invention;

FIG. 32: a site plan view for the Front side of a First embodiment of a Finalized Voting Ballot Confirmation & Receipt that is first generated to record the unique Election Identifier and correlated unique Election Identifier Barcode, unique Election District Identifier and correlated unique Election District Identifier Barcode, an optional unique Voter Identifier and optional correlated unique Voter Identifier barcode, Confirmation Identifier that is used to Confirm said Voter is entitled to Vote is aforesaid Election and Election District, said Confirmation Identifier that is also correlated to a unique Confirmation Identifier Barcode, a plurality of Voter Ballot selections comprised of at least one: unique Candidate Selection Identifier that is correlated unique Candidate Selection Barcode, correlated Candidate legal names and optional political party affiliation description, and the optionally may also include at least one of a plurality of Proposition choices comprised of: unique Proposition Selection Identifier that is correlated to a unique Proposition Identifier barcode, a unique Proposition description, the value and description of the Voter Proposition selection choice, such that for each Voter and each Proxy Voter the said: Election Identifier, Election District Identifier, a unique Poll Station Identifier, optional Voter Identifier, Confirmation Identifier, and all Candidates selected and all Proposition chosen values, all Voter selected Candidates Choices Identifiers and correlated, Candidate Choice Barcodes, and all Voter choice values correlated to each Proposition Identifiers and all Proposition Choice Barcodes are combined and encoded as a group of Voter Ballot Selection Data Elements that are submitted by each Voter of a plurality of Voters and for each Proxy Voter of a plurality of Proxy Voters to at least one Voting Officials or Agents or Official Voting Devices or Agent Voting Devices; upon successful, accurate and complete receiving of all aforesaid Voter Ballot Selection Data Elements, this Voting Ballot Confirmation Receipt document is further modified by at least one Official, Agent, Officials Devices, Agents Devices to also record at least one unique Ballot Received OK Identifier and correlated unique Ballot Received OK Identifier Barcode, unique Ballot CastOK Transaction Identifier and correlated unique Transaction Identifier Barcode which are correlated to the aforesaid received Voter Ballot Selection Data Elements by at least one Official, Agent, Official Devices or Agent Device computer running software programs; further whereby said Voting Ballot Confirmation & Receipt is further modified to also record a a unique Digital Signature Key and correlated unique Digital Signature Key Barcode, whereby said Digital Signature Key is comprised of Voter Ballot Selection Data Elements, Ballot Received OK Identifier, Ballot CastOK Transaction Identifier, optional Voter Identifier, optional Confirm Identifier that are all combined and encoded by at least one Official or Agent computer running software programs which is then also recorded on said Voting Ballot Confirmation & Receipt along with other relevant information as shown or as may be modified in other embodiments; for a plurality of modified Finalized Voting Ballot Confirmation & Receipts: at least one Official, Agent, Official Devices or Agent Device computer running software programs redundantly stores on immutable media, and also generates an exact duplicate copy of each aforesaid Finalized Voting Ballot Confirmation & Receipt, then sends back said exact duplicate copy to each correlated Voter or correlated Proxy Voter, and optionally also stores an exact copy of said Finalized Voting Ballot Confirmation & Receipt as an image, PDF file, HTML, file or other document format at a secure Internet webpage having an Uniform Resource Locator address that is prefixed by a logical, organized directory structure and precisely located by the unique Digital Signature Key created for that specific Finalized Voting Ballot Confirmation & Receipt.

DISCLOSURE OF INVENTION

The methods and steps involved in the assembly of a List of Eligible Voters is unique and the First of many improvements to existing patents in this scope of invention.

A) Definitions of Terms

1) Electoral Board members act as and appoint human Officials to facilitate the Voting Session, whereby Officials also actively use and employ any number and any combination of: persons, devices, computer systems, security systems and communication networks;

2) Voter, or, Voters, Eligible Voter, or, Eligible Voters—refers to one or a plurality of, persons, or, business entities, or any group of people or business entities, that are, or may be, entitled to participate in the Voting Session for the purpose of selecting or writing in zero, one or a plurality of candidates, and zero, one or a plurality of Political Parties or Groups of People or Legal Entities, zero, one or a plurality of Proposals, thereafter delivering their Ballots to Officials for authentication and tallying;

3) Voting Session—refers to a process or series of steps and methods for at least one purpose: (i) to select and/or write-in candidate(s), or, (ii) to select and/or write-in to affirm or deny proposal(s), or (iii) any combination of selecting and/or writing-in zero, one or a plurality of Candidates, and to affirm or deny and/or write-in zero, one or a plurality of Proposals;

4) Voting Region describes the Scope of a Voting Session, refer to Entity-Relation Diagrams of FIG. 15. Voting Region may also refer to a variable group of attributes: Province/State, Municipality, Zone, Poll Station, Postal or Zip Code or any other other type of grouping method.

5) The attributes are used for data storage, and may also be components of the Voting Region, depending on the Scope of the Voting Session. one or a plurality of Voting Region attributes may be visible on Ballots, Reports, Calculations, Tallies, Summaries, etc. as set by Officials to meet the Official Objectives of the Voting Session.

B) Disclosure of Invention—Details

B. 1) an initial assessment is made to define the required tasks and estimate the labor time required to complete the required tasks to complete the Official Voting Session in the time allotted, and to justify the acquisition of materials, devices, services, people to enable completion of the Voting Session in a timely manner;

B. 2) people, computers, devices, software programs, security and communication systems are acquired and developed to complete the tasks of the Official Voting Session;

B. 3) a determination is made for the number of Potential Voters that could participate in the Voting Session, using data from reliable sources (such as census population data, immigration data, social security numbers or tax data for governments, stockholders or employee data for businesses, membership data for groups or professional associations;

B. 4) Officials enquire about remote sources of information that could be used to identify Potential Voters or Eligible Voters, then contact owners of each selected remote data source to obtain agreements, access permissions and methods. A unique source Identifier (SID) is assigned to each remote source permission is obtained by, from, or for each data source.

B. 5) for a remote source of records to be accepted, it undergoes a preliminary inspection to assess whether it will meet standards for acceptable regarding the relative age of the data, reliability, consistency of data among records, or other quality control methods;

B. 6) remote sources of data that do not pass preliminary inspection requirements are ignored or designated for further investigation at some later time and date; For remote sources of data which do meet First Inspection requirements:

B. 7) to determine which people or businesses are eligible to vote, Official people, or, Official computers running software programs designed to determine who are Eligible Voters, access computer databases such as those affiliated with sources such as census population data, immigration data, social security or tax data of governments; stockholders or employee data for corporations or businesses; memberships data for groups or organizations, other information sources (paper records, microfilm, Internet) which contain any relevant data;

B. 8) to accurately determine and make verifiable records of people and business entities that are eligible to vote, remote data source(s) records containing data about people and business entities are retrieved by Officials using computers running research programs;

B. 9) remote source records that contain sufficient data to identify and fulfill the requirements for an Eligible Voter record, are duplicated; and the duplicate copy is verified, then transferred to the record storage facilities and computer data storage systems of the Officials of the Voting Session; furthermore, each of the records transferred is assigned a unique Potential Voter Identifier (PVID), and is marked with a remote data source Identifier (RDSID) so as to describe the information as being from a remote source, as well as date and time of transfer, identities of Officials authorized the transfer and data acceptance.

B. 10) remote source records that are missing data are then marked as Research Voter for further investigation, and each Research Voter record is assigned a unique Identifier (RVID); each Research Voter record is unique in every List of Eligible Voters, and is further unique among all pluralities of Lists of Eligible Voters;

B. 11) Officials assigned to investigate, update, report on each Research Voter record;

B. 12) when each Research Voter record is updated, it is also checked to determine whether it contains sufficient information to satisfy the requirements of data acceptance standards of an Eligible Voter; if so, then that record data is copied, the original Research Voter record status is marked Research-Eligible, the copy record is marked as Eligible Voter, then the copy record is added to the group of Eligible Voter records; and assigned a unique Eligible Voter Identifier (EVID), while also retaining the RVID Identifier to enable auditing;

B. 13) Official people or Official computers running software programs, determine which Research Voter records and which Potential Voter records meet the criteria of the Voting Session to be assigned the designation of Eligible Voter; furthermore, each Voter meeting the criteria is designated an Eligible Voter record, and assigned a unique Eligible Voter ID;

B. 14) Official people or Official computers running software programs, assemble and organize based on Voting Session criteria at least one List of Eligible Voters, comprised of the following Voter attributes: First name, middle name, family name, home address, alternate physical address for mail delivery, electronic mail address, Voter Fax or Facsimile number, interactive display device electronic address, or any other method for delivery (such as a private Fax or Facsimile machine number, or, forwarding contact address), home phone number, business phone number, other contact phone number; a portion for the Voter signature or initials, a portion for the signature date, at least one portion for the description of the type of Voter identification provided, one portion for the unique Identifier of the Voter identification, zero, one or a plurality of portions for: Voter signature witness name, witness address, witness phone, Voter Proxy: name, address, contact phone, contact EMail, at least one portion for Official use information; furthermore said Voter Registration can be modified for use as a Proxy Voter Registration form using the same or similar data fields; furthermore, each List of Eligible Voters is assigned an Eligible Voter List Identifier (LEVID); each List of Eligible Voters may be organized by any number of applicable sub-groups of political areas, geographic areas, electoral boundaries or voting castes of people (citizens of a country or state or municipality, group membership, stockholders voting shares) for a Voting Session;

B. 15) identical, duplicated records of Eligible Voters found in any one, or existing within several, Lists of Eligible Voters, are removed so that only one instance of a unique Voter remains, so as to prevent multiple Ballots delivery to a single Voter;

B. 16) if the rules of the Voting Session, or, any group of people or business entities, or members of a business allow multiple listing of a unique Eligible Voter, then that instance is also an instance or part of this invention; and preceding step B)xv) will be done in another manner so as to accommodate the integrity of the Voting Session, for any group of people or business entities, or any members of a group or business.

B. 17) Officials publish one or a plurality of List(s) of Eligible Voters—using media such as, but not limited to Internet website pages;

B. 18) Officials advertise the location and methods of accessing each List of Eligible Voters; this step may include sending confirmation notices to each Eligible Voter on each List of Eligible Voters, or, alternatively, placing the responsibility upon eligible Voters to remain informed and take any required self-service steps to register for voting;

B. 19) Officials provide means and opportunities to all Potential Voters and Eligible Voters to verify or amend each List of Eligible Voters;

B. 20) Officials provide means and opportunities to any subset of any, or, all Potential Voters, Research Voters, and Eligible Voters to contact Officials to amend the List of Eligible Voters in person physically or by at least one type of remote communication methods: Postal Mail, Delivery Courier, Electronic Mail (EMail), Telephone, Internet, Facsimile (Fax), Interactive Television, Personal Data Device (Computer, Tablet) or Officials are contacted by both in person and remote communication methods.

B. 21) Officials investigate each Potential Voter, Research Voter and Eligible Voter request for amendment and report the findings to Officials and the Voter;

B. 22) Officials amend any number of Lists of Eligible Voters;

B. 23) Officials and Voters verifies the amendments are completed accurately;

C. 1) Official people or Official computers running software programs to design, test and produce any format: Physical, Optical, Electronic, Electro-Magnetic (POEM) of specially designed Whole Ballots; using the Official Language of the Voting Session; or Language selected by the Eligible Voter;

C. 2) Official people or Official computers run software programs to print or generate any form of representation, of specially designed Whole Ballots; using the Official Language of the Voting Session; or, Language selected by the Eligible Voter;

C. 3) the number of Whole Ballots printed or generated is determined by the number of Eligible Voters plus an estimated number to accommodate Lost, Stolen, Damaged, or Spoiled Ballots, and an estimated number of additions to every List of Eligible Voters used for each Voting Session;

C. 4) each Whole Ballot is tested to be both Valid and Authentic;

C. 5) for each Whole Ballot is passing tests to be Authentic and Valid according to step C. 6) the further step of designating the Whole Ballot, and its constituent parts, to having a Verification Status Identifier designated Certified;

C. 7) Delivery Status Identifier of Whole Ballots of step 3.e. is set to Ready;

C. 8) Activity Status Identifier of Whole Ballots of step 3.f is set to Dormant;

C. 9) the number of Whole Ballots printed or generated is very carefully controlled, monitored and regulated by Officials of the Voting Session;

C. 10) Officials use computers running software programs to arrange delivery of zero, one or a plurality of Whole Ballots to each Certified Eligible Voter on every Certified Eligible Voter List, or, zero, one or a plurality Whole Ballots are retrieved by zero, one or a plurality Certified Eligible Voters;

C. 11) as each Whole Ballot is processed through the final steps for delivery, the value of the Delivery Status Identifier changes from Ready to Delivered;

C) 12) as each Whole Ballot is processed through the final steps for delivery, the value of the Activity Status Identifier changes from Dormant to Active;

D. 1) Officials prepare and publish one or a plurality of Voter Data Sheets (FIG. 23) which describes any combination of candidates, proposals, voting session rules, voting instructions, polling station maps, and any other voting information. The Voter Data Sheets may then also be published on at least one Officials website(s);

D. 2) Eligible Voters receive at least one Whole Ballot from Officials or appointees;

D. 3) Eligible Voters receive zero, one or a plurality of optional Voter Data Sheets;

D. 4) Eligible Voters receive zero, one or a plurality of Master Ballot return envelopes;

E. 1) zero, one or a plurality Eligible Voters, Proxy Voters and Officials may obtain a replacement Whole Ballot in exchange for a Damaged or Spoiled Ballot with an Activity Status of Active;

E. 2) one or a plurality of Voters, Proxy Voters (Applicants) and Officials deliver one or a plurality Whole Voter Registrations, Master Voter Registrations, Voter Receipt Registrations, Whole Proxy-Voter Registrations, Master Proxy-Voter Registrations, Proxy-Voter Receipt Registrations and Whole Ballots, Master Ballots, Receipt Ballots which are each submitted using at least one method of delivery of: In-Person, by Postal Mail, Delivery Courier, Electronic Mail, Telephone, Internet, Facsimile, Interactive Television, Personal Data Device to any number of Officials;

E. 3) Voters or Officials use the pre-marked or otherwise properly Mark, affix sticker labels, associate electronic data, include Voter Information Documents, and optionally place their personal signature or private PassWord inside or outside or, both inside and outside of each Voter Registration Return Containers and upon each Voter Registration Form;

E. 4)(a) Voters then mail or otherwise deliver to one or a plurality of Voter Registrations;

E. 4)(b)(i) Officials receive one or a plurality of Registrations and one or a plurality of Ballots;

E. 4)(b)(ii) Officials and subordinate electronic devices running computer programs use information of the Return Containers to sort, verify, then further process each Voter Registration;

E. 4)(c) Officials record at least the names and address of each Applicant requesting Ballot Replacement; as well as the date and time of filing the request for replacement; as well as additional identification such as social security number, drivers license number, passport Identifier, may also be recorded;

E. 4) (d) if the Applicant claims to be an Eligible Voter, Officials search each current List of Eligible Voters for that Voting Session until a determination is made;

E. 4) (e) if the Applicant claims to be an Official of the current Voting Session, other Officials search each List of Officials of the Voting Session for a verification;

E. 4) (f) Each Qualified Applicant becomes a Registered Voter status, and is then given or sent at least one specially marked and unique Whole Ballot with which to vote with;

E. 4) (g) Each Registered Voter Marks the Master Ballot part of their Whole Ballot, then manually or automatically, generates a duplicate copy on each Receipt part of the Ballot;

E. 4)(h)(i) Each Voter then uses the Master Ballot Return Container (which is pre-marked or alternatively the Voter properly Marks or affixes sticker label(s) to the external surface, or otherwise associates electronic data to their personal Ballot Return Container, and may also optionally include a duplicate or Receipt of their Master Voter Registration, and the further step for each Master Ballot part of optionally placing their signature or private PassWord and date on the inside, outside or, inside and outside of one or a plurality of Master Ballot Return Container(s) that are sent to at least one Officials for authentication, tallying, reporting.

E. 4)(h)(ii) Officials and subordinate electronic devices running computer programs use information of the Master Ballot Return Containers to sort, verify, process any verification of any included Voter eligibility information (Voter Registration copy-Receipt, Voter signature, Voter Personal Security Items) prior to separate processing for each Master Ballot part.

E. 5) (a) Officials accept or reject each received Master Ballot based on the findings of tests applied to confirm the authenticity and validity of each Ballot: by verifying at least one Security Elements of the Ballot is valid and active, verifying the Random Symbolic Identifier is valid and active verifying Limits of Use parameters are valid and active, and further that the origin of delivery was valid and timely:

E. 5) (b) Officials may further accept or reject each received Ballot based on the Activity Status attribute of the Ballot, whereby the Officials accept Valid, Active Ballots;

E. 5) (c) (i) Providing the Applicant, Affidavit, and Ballot submitted are all valid, the Ballot receiving Officials cancels the correlated Ballots (by referring to the Ballot Random Symbolic Identifier), and records the relevant details of each Ballot cancellation;

E. 5) (c) (ii) for all Master Ballots with identical RSID's received, Officials amend all Voting Session records for Ballot Activity Status attribute so as to be Cancelled;

E. 5) (c) (iii) Officials verify the Spoiled or Damaged Ballot Activity Status attribute is designated as Cancelled, on all Voting Session records.

E. 5) (c) (iv) Officials select one Whole Ballot, designated as a Replacement Ballot, for each Ballot that was Cancelled; whereby each Replacement Ballot is identical to the Cancelled Ballot, except for at least one Random Symbolic Identifier of the Replacement Ballot being distinctly different from every Random Symbolic Identifier of the Cancelled Ballot; each Replacement Ballot is tested to be both Valid and Authentic; each Replacement Ballot passing tests of preceding steps has a Verification Status designated as Active or Yes;

E. 5) (c) (v) at least one Official delivering, or arranging the delivery of, a correlated number of Replacement Ballots to each Applicant Voters and Proxy Voters; whereupon the Ballot is now designated as a Whole Ballot, and Delivery Status attribute of each delivered Replacement Ballot is set to Yes or Delivered;

E. 5) (c) (vi) at least one Officials record the quantity and type of Replacement-Whole Ballots delivered to every Applicant Voters and Proxy-Voters;

E. 5) (c) (vii) zero, one or a plurality of Applicants Voters and Proxy Voters receives zero, one or a plurality of uniquely different Replacement—Whole Ballots of the same type submitted for replacement;

E. 5) (c) (viii) Any Eligible Voter or Official may obtain a replacement Whole Ballot in exchange for any Lost or Stolen Ballot having an Activity Status of Active or Yes;

E. 6) (a) one or a plurality of Applicants: Voters and Proxy Voters or Officials deliver one or a plurality of Whole, Master and Receipt Ballots, by said delivery methods to one or a plurality of Officials, Official Agents, and Official Devices;

E. 6) (b) Officials, Official Agents, and Official Devices receive one or a plurality of Ballots of the preceding steps;

E. 6) (c) Officials, Official Agents, and Official Devices record at least the names and address of each Applicant requesting Ballot Replacement; recording the date and time of filing the Affidavit along with additional identification such as: social security number, drivers license number, healthcare identifier, passport identifier;

E. 6) (d) one or a plurality of Officials, Official Agents, and Official Devices provides zero, one or a plurality of Applicants Voters and Proxy Voters with at least one Affidavit form for the purpose of declaring a Ballot to be either Lost, or, Stolen;

E. 6) (e) each Applicant completes the Affidavit of previous step E)Vi)d) whereby:

E. 6) (f) each Applicant provides their full legal name with the Affidavit;

E. 6) (g) each Applicant provides their address, when applicable, with their Affidavit;

E. 6) (h) each Applicant provides at least one form of Voter identification to verify their identity according to the Affidavit;

E. 6) (i) each Applicant signs the Affidavit, physically, electronically, or by any other acceptable means according to the Rules of the Voting Session;

E. 6) (j) each Applicant delivers, or arranges delivery of their Affidavit to Officials;

E. 6) (k) Officials, Official Agents, and Official Devices receives zero, one or a plurality of Affidavits and identification;

E. 6) (l) if the Applicant claims to be an Eligible Voter, Officials, Official Agents, and Official Devices determine if the claim is valid by searching every List of Eligible Voters for that Voting Session;

E. 6) (m) if the Applicant claims to be an Official or Official Agent of the current Voting Session, other Officials, Official Agents, and Official Devices determine whether the Applicant is valid by searching every List of Officials for that Voting Session until a determination can be made;

E. 6) (n) Officials, Official Agents, and Official Devices may further accept or reject each received Ballot based on the Activity Status attribute of the Ballot, accepting to tally only Active Ballots;

E. 6) (o) one or a plurality of Officials, Official Agents, and Official Devices computers, optical or electronic devices, or humans accepts or rejects all other information provided for each Applicant, Affidavit or Ballot;

E. 6) (p) for each valid Applicant whose Affidavit that has been sufficiently verified, at least one Official amends the Voting Session computer records to Cancel each Lost or Stolen Ballot that was previously delivered to the Applicant;

E. 6) (q) at least one Official verifies that each Lost or Stolen Ballot according to the preceding steps, is designated as Cancelled on all Voting Session records; and the Activity Status attribute for each Cancelled Ballot record is set to Cancelled;

E. 6) (r) at least one Official replaces or arranges to replace each Lost or Stolen Ballot, comprising of at least the steps whereby: 5.b.11.a. selecting one Whole Ballot designated as a Replacement Ballot for each Ballot that was Cancelled; 5.b.11.b. each Replacement Ballot is identical to the Cancelled Ballot, except for at least one Random Symbolic Identifier of the Replacement Ballot being different from every Random Symbolic Identifier of the Cancelled Ballot; each Replacement Ballot of claim is tested to be both Valid and Authentic; each Replacement Ballot passing tests has a Verification Status designated as Certified; the Replacement Ballot of Activity status is set to Yes or Active;

E. 6) (s) for each verified Applicant whose Affidavit was accepted, at least one Official delivers, or arranges delivery of, at least one, Replacement Ballot to the Applicant(s);

E. 6) (t) at least one Official delivers, or arranges the delivery of, one or a plurality of Replacement Whole Ballots; whereupon delivery, and the Delivery Status attribute of each delivered Replacement Whole Ballot is set to Yes or Delivered;

E. 6) (u) one or a plurality of Officials record the quantity/type of Replacement-Whole Ballots delivered to each Applicant;

E. 6) (v) zero, one or a plurality of Applicants receive zero, one or a plurality of unique, different Replacement-Whole Ballots of the same type submitted for replacement;

F) Whole Ballot Exchange—this method is unique among registered US Patents, and provides a significant improvement in the arts pertinent to this invention.

F. 1) Eligible Voters are optionally entitled to optionally exchange with someone they trust, one or a plurality of Whole Ballots they possess for identical, valid Whole Ballots that are valid per Limits of Use. Voters can validate the Ballot by communicating with Officials in person, by telephone, Fax or Facsimile, EMail, cellular phone or personal data device text message, or by Internet webpage search submission by submitting at least the Random Symbolic Identifier and optional Ballot validation PassCode (which may be separate and distinct from the Ballot voting PassCode). Security Elements may also be used to determine if a Ballot is authentic.

F.2) To protect privacy, Voters are instructed to swap the Ballot the Voter received, at least once, with someone they trust for a similar Ballot that is valid within the geographic-political boundary of the Voting Session. This random, private Ballot exchange decouples the Ballot recipient from the Eligible Voter List that was used to deliver the unique Ballot Voting RSID to a specific person and address. This can be done many times to increase the anonymity of the Voter. The privacy of the Voter is still enabled even if a Voter does not exchange Whole Ballots, as the Voting Session Officials likely have no easy method to determine whether or not any Whole Ballot was exchanged before being returned to them for tallying. Thus, Voter privacy is assured (Inventor comments: This step methods are unique among inventions to preserve the anonymity of any Voter, and thus, for every Voter, since Voting Session Officials cannot determine which Voters used these steps/methods; In essence, Ballots are like treated like currency, whereby any Eligible Voter can use the Whole Ballot, which would be exchanged in kind for an identical Whole Ballot in a Voting Region-Zone, as per the Election Rules; Even if a PassCode RSID or Ballot Voting RSID were revealed, the Voter can determine electronically or in person, whether the Ballot has already been used to Vote; By using hard to fake Security Elements, and nearly impossible to guess traceable Ballot-ID RSIDs, traceable Ballot Voting RSIDs, and dealing with known to be trustworthy people, ensures the integrity of the voting system and assists Voters to be sure a Voter exchanges their valid, authentic Whole Ballot(s) only for valid, authentic Whole Ballot(s));

G. 1) Each Whole Ballot has two parts—a Master Ballot and at least one Receipt Ballot (refer Entity Relation Diagram describing Whole Ballot and constituent parts)

G. 2) Each Whole, Master and Receipt Ballot has at least one status attribute each attribute remains static in value until redefined by Officials;

G. 3) The paper version of a Whole, Master, or Receipt Ballot may include one or a plurality of alignment Marks and indices for orientation of optical, magnetic, electronic scanning device(s) so as to facilitate the accurate scanning of data on any reasonable timely, authenticated, eligible Ballot.

G.4) Each part of the Whole Ballot, both the Master Ballot and one or a plurality of Receipt Ballots, share an identical, unique group of symbols as a correlating Identifier. A unique feature of this invention is a Random Symbolic Identifier (RSID) as the unique correlating Identifier, discussed in following sections of H)e)1) to H)e)4), H)f) to H)h);

G.5) the Second Ballot part of the Whole Ballot is referred to as a Receipt Ballot; a unique feature of this invention is that each Receipt Ballot is manufactured so as to be easily and readily distinguishable from the Master Ballot, to the unaided human eye using any combination of methods and drawings described herein so as to readily distinguish the Receipt Ballot part from the correlated Master Ballot part;

G.6) the Ballot PassCode is unique and distinct among all Ballots, and is of a different length and composition than the Ballot RSID; said Ballot PassCode may be kept hidden from view with a removable covering, or electronically obscured or optically obscured until time for using the Ballot for voting, thereby allowing Ballot RSID validation for exchange without revealing the Ballot PassCode thus providing additional security of Ballot, and further since the Ballot PassCode is already known to Officials, there is no need to transmit the Ballot PassCode to paper Ballot holders, thus providing another layer of security for authentication (two-stage authentication) as to enable voting, both Ballot RSID and correlated Ballot PassCode must be given to cast Ballot; and further, Ballot PassCode provides a mutually known private key for Ballot data encryption, whereby public-private key pair is used solely or in combination with an iterative encryption method which uses multiple encryptions of the data repeatedly, self-generating new encryption keys that are successively embedded (encryption) or extracted (decryption) which at each stage (encrypt-decrypt) makes extremely unlikely for any external guessing of the keys or extracting meaningful data without the exact key at each encrypt-decrypt stage; and further whereby a Voter Personal PassCode may also be used as a third stage of encryption-decryption protection separately with the Official Ballot PassCode, whereby the Voter Personal PassCode is associated with all the Voter Ballot selections for the Voter Ballot RSID and is created by the Voter, and then encrypted and stored with Officials using a public-private key encryption method with the Ballot RSID as a pseudo public key after voting, and the Ballot PassCode as a Voter Ballot RSID specific mutually shared private key.

H.1) To understand the Master Ballot part referred to in G) a), G) b) (refer to FIGS. 5,6,7,8 site plans for embodiment of Master and Receipt parts of a Whole Ballot;

H.2) Ballot Header portion—this portion improves the invention of Kargel by providing information to enable the Voter to independently make clearly informed decisions regarding the Ballot by providing information to the Voter:

(i) as to the source of the Ballot (FIG. 5 item 2A1,2,B, C=Ballot Source);

(ii) defining the purpose of the Ballot (FIG. 5 item 3A1-7=Ballot purpose) including specific information as to the title of political position (FIG. 5 item 3A1,2=candidate position description), the political voting region details (FIG. 5 items 3A3,4,5=voting region info) for which the candidates of FIG. 5, items 4A1-4 to 4E1-4 are applying for as correlated to the political position of FIG. 5, items 3A1,2);

(iii) clearly identifying the type of Ballot (FIG. 5 item 2E—Ballot type); (iv) instruction as to what to do with the completed Ballot (FIG. 5 item 2F—Ballot delivery instruction). FIG. 5 items 3A1 to 3A5 can be correlated to FIG. 5 items 5C to 5G such that FIG. 5-3A1 correlates to 5C, FIG. 5-3A2 to 5D, etc.

H.3) Ballot Voting portion—this portion (FIG. 5, items 4A1-4 to 4E1-4) improves the invention of Kargel by providing vital information to enable the Voter to independently make clearly informed decisions regarding the Ballot selection options by providing specific instructions:

(i) as to how many candidates to select (FIG. 5 item 3A6=voting instructions);

(ii) and information as to how to properly select the candidates of choice (FIG. 5 item 3A7 of candidate selection methods) which pertains to the correlated Candidates Selection Area (FIG. 5, Item 4A1 to 4E1=candidate selection area) that is used for marking to select zero, one or a plurality of candidate(s);

(iii) and specific descriptions of each candidates to significantly reduce selection errors (FIG. 5 item 4A2 to 4E2, and 4A3 to 4E3=candidate names); and (iv) an optional description of the candidate political party affiliation (FIG. 5 items 4A4 to 4E4);

(v) and the further degree of democratic freedom of choice is given in FIG. 5 whereby a Voter may print the Candidate name or Political Party description of their preferred candidate(s) or political party(s) for their voting region that are not already printed on the Ballot, and therefore by so doing, may cast a vote for each of their Write-In candidate(s) and Write-In political party(s).

H.4) Ballot ID portion—this portion is unique among registered Patents, providing significant improvements by this invention in the arts of invention of this invention type.

H.5) Although this invention was conceived without knowledge of Kargel's invention, there is a common thread whereby each Whole Ballot, and the constituent parts comprising the Master Ballot, and one or a plurality of Receipt Ballots, share an identical, Identifier. However, Kargel does not specify any characteristics of his Identifier or her Identifier;

H.5)(i) This invention improves significantly on Kargel by the use of Random Symbolic Identifier(s) (FIG. 5 items 5B, 5J2—Ballot ID in the form of a Random Symbolic Identifier and for extra security are extremely hard to guess (improving over Chung and Dong, et al).

For my invention, the Random Symbolic Identifier (RSID) is comprised of a group of randomly selected symbols, which are arranged in a combination unique among all RSID's of a Voting Session. Thus each Master Ballot part and each Receipt Ballot part(s) that comprise a Whole Ballot are uniquely identifiable among all Ballots (and is also unique among all Voter Registration Forms) of a Voting Session.

H.5)(ii) The same improvements of my invention can also be said for recently discovered (21 Jun. 2012) U.S. Pat. No. 7,975,920 which was developed years after these patent Documents were published—although a random Identifier is noted in U.S. Pat. No. 7,975,920, it could be any simple random number, simply constructed, easy to guess, and there is no specification (as this patent provides) that for this my invention the random Identifier is constructed to be near impossible to guess, extract, predict, or pre-calculate—thus assuring it is near impossible to forge any RSID correlated Documents, Voter Registrations, Proxy Registrations and Ballots of this invention;

H) 6) a) This invention improves significantly on Kargel by the use of Random Symbolic Identifier(s) (FIG. 5 items 5B, 5J2—Ballot ID in the form of a Random Symbolic Identifier and for extra security are extremely hard to guess (improving over Chung and Dong, et al). The Random Symbolic Identifier (RSID) is comprised of a group of randomly selected symbols, which are arranged in a combination that is unique among all RSID's of a Voting Session.

H) b) 2) The RSID, as for RSID of FIG. 5—item 5B, 5J2 is encoded and correlated to a unique barcode (FIG. 5—item 5J1) to facilitate rapid, automated optical scanning.

H) 6)(i) For each Master Ballot part and each Receipt Ballot part(s) that comprise a Whole Ballot are uniquely identifiable among all Ballots (and is also unique among all Voter Registration Forms) of a Voting Session—and further that this invention includes methods of rapid RSID location and authentication which other prior patent applications have not mentioned nor claimed, and so this may also be a unique feature among other similar inventions for this purpose and for any other derivative inventions;

H) 6)(ii) A unique aspect and benefit of this invention is that the RSID is a random Identifier which prevents anyone with any Ballot from fabricating a series of Ballots, by incrementing or decrementing values in reference to any known Ballot Identifier.

H.6)(iii) This invention shall also include the provision to include a sequential series of symbols, or a repeatable pattern of symbols, should the Officials of the Voting Session desire such a feature. It should be noted that an implementation of either would require corresponding adjustment to this invention, including the understanding that the term RSID would imply either a sequence or pattern for this invention Document; It is beyond the scope of this Document to speculate at all the possible combinations of symbol sequences or patterns may be created for either potential request.

H.6)(iv) Furthermore, this invention shall also include the methods whereby no group of unique symbols are assigned to uniquely identify any Ballot whereby authentication relies primarily upon Ballot Security Elements; and further the steps of research, computerized data mining of Eligible Voters, mailing Ballots, exchanging Ballots, and any parts of this invention or any alternative versions of this invention shall include methods of sequential Ballot Identifier or no Ballot Identifier or any random or specific Ballot Identifier that is linked to a specific Voter identification.

H.6)(v) This Document considers use of the RSID of steps H)5)1) to H) 6) iv), with the implied claims to include other Ballot ID methods that may be applied instead of sequential symbols or numbers or a sequential mixture of symbols and numbers in lieu of RSID(s)).

H.7) A very significant improvement of this invention is to make the RSID of steps H.5)(i) to H.6)(iv) to be extremely difficult to guess. The purposes of the RSID is to enable verification by computer of the Ballot identity as an authentication test of validity and to Prevent counterfeiting of a multitude of Ballots. The actual number of symbols to use for the RSID of this invention must be calculated, based on the number of Voters anticipated, perception of security desired for making the RSID extremely difficult to guess, balanced with the data storage needs, scanning error rate, computer processing error rate and extra communication required for having a large number of symbols comprising each RSID; also taking into consideration the total number of Ballots issued, expected replacements, anticipated number of enquiries, verifications, authentications, publications, etc. Using at least one, and possibly two, or more, concatenated symbolic characters as a Random Symbolic ID (RSID) would provide unique identity security of every single Ballot (depending on the number of Ballots issued) for a single Voting Session. To understand this consider that one symbolic character can be represented by a single unique combination of eight (or more) binary digits in range of 00000000 to 11111111. Each unique combination of computer binary digits has an equivalent Base 10 numeric value:

| ASCII characters | Binary value | Base 10 value |
|---|---|---|
| A | 01000**01** | 65 |
| B | 01000**10** | 66 |

Concatenating symbolic characters increases the number of binary digits that can be interpreted to represent larger binary and numeric (base 10) numbers, as well as for a plurality of counting base methods such as base 8 (octal), base 16, etcetera.

| ASCII characters | Binary code | Base 10 value |
|---|---|---|
| BA | 01000**10** 01000**01** | 16961 |
| AB | 01000**01** 01000**10** | 16706 |

Therefore each and every unique concatenation of symbolic characters has a unique binary value and one correlated unique numeric value correlated only with one specific combination of symbolic characters. Each unique linear concatenation of symbolic characters is a unique linear sequence of symbolic characters (Random Symbolic Identifier or RSID) which has correlated a unique binary value and a unique numeric value. When multiple combinations of symbolic characters forms multiple groups of symbolic characters (Random Symbolic Identifiers), within each cluster RSID group of symbolic characters (Random Symbolic Identifier Symbol Cluster Group), then within each cluster RSID group (comprised of at least one, or more often multiple unique groups of concatenated symbols), each unique sequential symbolic character (RSID) ordering will be assigned a unique binary value (Random Symbolic Identifier Binary Value), having a correlated unique, equivalent numeric value (Random Symbolic Identifier Numeric Value), that can be used to uniquely identify a specific sequence of concatenated symbolic characters. Therefore each and every unique concatenation of symbolic characters also has a unique numeric value associated only with that specific combination and sequence ordering of symbolic characters (a specific unique Random Symbolic Identifier) from among all properly formed Random Symbolic Identifiers within each Random Symbolic Identifier Symbol Cluster Group and further distinguishable and unique from among any and all unique Random Symbolic Identifiers in any and all RSID Cluster Groups of properly formed Random Symbolic Identifiers. This can be so as when using a consistent method of assigning each character symbol to only one binary value whereby the maximum value of the most significant digit of the binary number is calculated by 2 exponent N where N=total number of binary digits.) Consider 1×10E1=10, 1×10E3=1,000 thus for binary digits 1×2E1=2: (0, 1), 2E2=4: (00, 01, 10, 11), 2E8=256 unique combinations; thus:

| ASCII Characters | | Binary Digits | | Total N Binary Digits | 2 exponent N = Maximum Value (base ten counting) |
|---|---|---|---|---|---|
| 8 | × | 8 | = | 64 | 2 exponent 64 = 1.8 × 10E19 |
| 16 | × | 8 | = | 128 | 2 exponent 128 = 3 × 10E38 |
| 24 | × | 8 | = | 192 | 2 exponent 192 = 6 × 10E57 |
| 32 | × | 8 | = | 256 | 2 exponent 256 = 1 × 10E77 |

To understand how relatively large these numbers are, (and how many unique Random Symbolic Identifiers may be obtained), consider that the Planet Earth has about 3.6×10E51 atoms; the entire Universe about 10E78 to 10E81 atoms according to this (2004) reference source—http://mathforum.org/library/drmath/view/59178.html How effective is a 16 character (128 binary digits) RSID (3×10E38) for Voters?

If we divided RSIDs among the entire human population of Earth: 7,000,000,000

3×10E38/7×10E9=4.28×10E28=42,800,000,000,000,000,000,000,000,000 unique RSID combinations available to each person on Earth. Guess which one their Ballot was given! A super-computer capable of 4.28×10E12 guesses per Second=4.28×10E28/4.28×10E12=1×10E16 Seconds/(365 days×24 hours×3600 Seconds)=317×10E6=317,000,000 YEARS to enumerate each possible RSID available for any Ballot given to each person on Earth!! At best it may take a 100 years to lucky guess one valid RSID! So forgery on any large scale (or even of a single Ballot) is essentially eliminated!! Especially when used in conjunction with other security elements such as embedded holograms, privacy PassCodes, etc. This inventions unique application of these aforementioned mathematical facts are such that any attempts to counterfeit any Ballots are futile, as without a valid RSID, a Ballot is rejected by the Voting Session computers. There is no point trying to fake multiple copies of a known Ballot Voting RSID, as only one Ballot Voting RSID is considered in the vote records and tallies. When two or more Ballots having an identical Ballot Voting RSID are detected, the Ballots prior and subsequent votes are nullified, then all Ballots with the identical Ballot Voting RSID are extracted and processed electronically or manually to inspect each Ballot composition and Security Elements for Authentication and Validation to certify which one Ballot to tally for a Vote. Therefore it is crucial that all valid Ballot Voting RSID's created by the Voting Session Officials be kept absolutely secret before and during the voting session.

H.8) To ensure RSID security, privacy and uniqueness, Official computers running software programs computing randomization of RSID symbolic character binary values, correlated number base for computing correlated numeric value, as well as distribution and repetition control for each and all RSIDs;

H.9) Further improvements of my invention use the use of hashing algorithms and values, N-trees, sparse matrices as data storage retrieval, sorting and organizing methods;

By calculating hashing values for any RSID parts at the time of RSID assembly, then for each partial RSID hashing part calculated value, sorting, organizing and storing each hashing value in data structures (such as arrays, linked lists, n-trees, sparse matrices, lookup files, tables, database records) which help to organize and localise RSID searches to RSID hash values of similar and identical hashing values which may be integrated as the RSID search engine computer software algorithms used to assist in rapid sorting, organizing, storage and retrieval of RSIDs, creating an indexed table of data entries consisting of at least the binary value for each completed well formed RSID concatenated symbolic characters and also the correlated RSID Assembly Identifier (which is stored with each correlated RSID as the Assembly RSID identifies and correlates the specific group of RSID symbols used to assemble each unique RSID of the correlated unique RSIDClusterGroupName as well as the unique RSIDClusterGroupID, unique RSIDAssemblyID, RSIDAssemblyStatus, RSIDAssemblyValue, RSIDAssemblyDate, RSIDAssemblyTime, RSIDAssemblyDeviceID(s) and RSIDAssemblyLocationID), and thereafter applying sorting and grouping mathematical algorithms in computers running software programs so as to also derive the RSID symbolic characters and RSID correlated numeric value which may alternatively been pre-computed and stored with the binary value so as to facilitate sorting, organizing, storing and retrieval of RSIDs; Further employing consistent method to create at least one RSID hashing value for all or parts of each RSID is performed by computers running software programs and at least one type of hashing value calculation algorithm so as to obtain at least one value for one or a plurality RSID symbolic characters of the entire RSID, and for any portions and sub-sections at the beginning, middle, and end of any RSID and for any sub-section portion derived from any RSID, whereby said RSID hashing values are used to group or cluster identical and similar RSIDs having identical or similar hashing values; Officials creating and assigning one or a plurality of Data Organization Groups to be correlated to one or a plurality of other groups; (i) and the further steps of correlating Data Organization groups to any other group types, and further correlating Data Organization groups to data attributes, and further correlating Data Groups to Object state information;

(ii) Officials using computers running software programs:

(a) creating Data Organization groups thereby organizing a plurality of RSIDs for a plurality of each Identifier of: Officials, Voters, Proxy Voters, Documents, containers, registration Documents identifiers, language session identifiers, ballot identifiers, voting session identifiers, voting type identifiers, location identifiers, region identifiers, zone identifiers polling station identifiers, postal-zipcode identifiers, official devices identifiers, data-time-stamp identifiers, voter candidate selection signatures, voter proposal selection signatures, Document submission identifier, Document validation identifier, RSID hashing algorithm calculated values, RSID Cluster Identifiers, data transmissions, data encryption keys, data decryption keys, Security Elements, Voters Personal Security Items, Officials Security Elements, Session Identifiers, Document Receipt Identifiers, Transaction Receipt Identifiers, Transmission Identifiers, Error Message Identifiers, Date-Time-Stamp identifiers, Report Identifiers, Internet webpage identifiers, PassCode identifiers;

(b) for each RSID of the currently active Voting Session: actively sorting and organizing each RSID into usage groups and sub-usage types then for each usage group and for each sub-usage type: (i) calculating hashing values for each RSID and for a plurality of RSIDs using computer software programs applying hashing algorithms;

(ii) grouping said RSID calculated hashing values having similar hashing values into at least one RSID Cluster Groups that is assigned a unique Cluster Group Identifier, then further refining by grouping RSIDs having only identical hashing values into at least one RSID Cluster sub-Group (Cluster Node group) which contains a plurality of RSID Data Nodes data structures such that each RSID Data Node contains: the RSID, RSID Assembly data, RSID Status Data, correlated parent RSID Cluster Node Identifier, correlated parent RSID Cluster Group Identifier, correlated linking Cluster Vines Identifiers; and a pointer link to the correlated RSID Access Log containing: Requestor Identifier, Requestor Device Identifier, Requestor Location Data, Requestor Access Data, Requestor Action Data, Official Session Identifier, Official Device Identifier, Official Date-TimeStamp, Official Action Data;

(iii) for a plurality of Cluster Groups and Cluster sub-groups (Cluster Nodes), logically connecting and interconnecting a plurality of Cluster Groups and Cluster Nodes with Cluster Vines, also assigning a unique Identifier to each Cluster Vine; then further connecting Cluster Nodes to each RSID Data Nodes with Node Vines;

(iv) for a plurality of Cluster Groups and Cluster sub-groups (Cluster Nodes), logically connecting and interconnecting a plurality of Cluster Groups and Cluster sub-groups with Cluster Vines, also assigning a unique Identifier to each Cluster Vine, and further assigning a Cluster Root Node to each Cluster Vine, then further connecting and interconnecting Cluster Vines using at least one Primary Vine and one or a plurality of Secondary Vine(s), then further assigning a Primary Vine Root Node to each Primary Vine, and a Secondary Vine Root Node to each Secondary Vine whereby said Primary and Secondary Vines Root Nodes contains data and connection information for each Cluster Vines and Cluster Root Nodes to which they are connected; and further having a plurality of distinct Cluster Vines, Cluster Root Nodes, Primary Vines and Secondary Vines, Primary Vine Root Nodes, Secondary Vine Root Nodes whereby each are clearly distinct, uniquely identified;

(v) and further whereby each said Cluster Group, Cluster sub-group, Cluster Node, Cluster Vines, Primary Vines, Primary Vines Root Nodes, Secondary Vines and Secondary Vines Root Nodes are uniquely identified and accessible by at least one uniquely identifiable connection path and further connected to each other by one or a plurality of uniquely identifiable connection paths;

(vi) further connecting aforesaid Clusters, Groups, sub-groups, Vines and Nodes to a plurality of Officials and Official Devices using said connection paths to a plurality of Clusters, Cluster sub-groups, Cluster Nodes, Cluster sub-group Nodes, Cluster Vines, Primary Vines, Secondary Vines, Cluster Vine Root Nodes, Primary Vine Root Nodes, Secondary Vine Root Nodes to at least one Official Devices, and to at least one internally connected computer and one or a plurality of externally connected: computer, personal data and communications software programs, verification and validation devices, authentication devices, error detecting, error reporting, and error correcting devices, communications devices, data cryptography devices, communications cryptography devices, data and communication compression and decompression devices, data or communication encoding or decoding devices, and further to one or a plurality of: Voter Devices, Government devices, Candidate devices, and Political Party devices, third-party devices, news media devices and general public devices;

(vii) applying beam-search and nearness factoring algorithms using computers running software programs so as calculate, record and store correlated values for optimal searching and data access paths for each RSID Cluster Group, RSID Cluster Node Group, RSID Data Node as well as for the inter-connecting RSID Cluster Vines linking said Cluster Groups and Nodes, then storing said calculations and values in each logically correlated Cluster Vine Root Node;

(viii) for a plurality of RSIDs, recording each RSID, primary usage type, Secondary usage type, correlated hashing value, correlated similar Cluster Group Identifier and identical RSID Cluster sub-Group (Cluster Nodes group) Identifier, at least one Cluster Vines Identifiers, along with the creation date-time-stamp, author-identifier, transaction identifier, official identifier, official devices identifiers, source-location identifier, official-record-identifier, into at least one computer accessible, logically organized, sequentially searchable Official computer data file record, Official computer database record, Official computer linked list, Official computer circular linked list, Official computer N-tree data structure, Official computer sparse matrices, in at least one Official computer data storage device and at least one immutable Official computer data storage media, and in each logically correlated Vine Root Node;

(viii) Requestors (Officials, Voters, Proxy Voters, Potential Voters, News Media, Registered Political Person or Registered Political Group, Registered Interested Party): attempting to locate a plurality of RSIDs by employing POEM data processing devices connecting to Officials data sources to search for, or validate a plurality of RSIDs applying Officials software that employs Officials data storage devices and correlated RSID Cluster Groups, RSID Cluster Nodes, and RSID Cluster Vines and correlated Personal Identification data and correlated data of the prior step (iv) above; recording search results, signalling to each Requestors whether the RSID was located, then granting further processing for each found valid RSID or alternatively for each unfound RSID permitting error correction, thereafter for each Requestor whose search fails then limiting or denying any further processing for a time period;

(ix) for a plurality of RSIDs and within each RSID Data Node data structure, recording each RSID, primary usage type, Secondary usage type, correlated hashing value, correlated similar Cluster Group Identifier and identical RSID Cluster sub-Group (Cluster Nodes group) Identifier, at least one Cluster Vines Identifiers, along with the creation date-time-stamp, author-identifier, transaction identifier, official identifier, official devices identifiers, source-location identifier, official-record-identifier, into at least one computer accessible, logically organized, sequentially searchable Official computer data file record, Official computer database record, Official computer linked list, Official computer circular linked list, Official computer N-tree data structure(s), Official computer sparse matrix(es), in at least one Official computer data storage device and at least one immutable Official computer data storage media;

(x) Requestors (Officials, Voters, Proxy Voters, Potential Voters, News Media, Registered Political Person or Registered Political Group, Registered Interested Party): attempting to locate a plurality of RSIDs by employing POEM data processing devices connecting to Officials data sources to search for, or validate a plurality of RSIDs applying Officials software that employs Officials data storage devices and correlated RSID Cluster Groups, RSID Cluster Nodes, and RSID Cluster Vines and correlated Personal Identification data and correlated data of the prior step (iv) above; recording search results, signalling to each Requestors whether the RSID was located, then granting further processing for each found valid RSID or alternatively for each unfound RSID permitting error correction, thereafter for each Requestor whose search fails then limiting or denying any further processing for a time period to deter automated guessing or intellectually compromised, immature or unscrupulous persons;

H.10) Alternatively or in conjunction with hash-values calculations, when being assembled, each RSID is automatically sorted and stored in a data structure whereby the RSID is sorted by at least one of the First RSID symbolic characters—doing said sorting progressively for each RSID symbolic character which are sequentially stored in a data structure such as a linked list, or array or sparse matrix and correlated, linked N-tree which can be further modified with 'node weighting' and 'beam search' data so as to expedite search efficiency and effectiveness and the aforesaid data structures may further be manipulated to be stored in a relational or flat-file database in tables and correlated indexed records containing an exact replica of said RSID stored in the same sequence that each RSID symbol was generated.

H.11) Each said RSID and component symbolic characters may further have any combination of being appended, prefixed or embedded adjacent to or within: by one or a plurality data symbols used for error detection, error identification, error location specification, error correction, usage designation Identifier, data encryption security, data compression, data decompression, data encoding, data decoding and optionally also for creating and deciphering public key and private key pairs that are used for data encryptions and decryptions to ensure the security, accuracy and integrity of sensitive data and communications;

H.12)(a) Any Master Ballot and Master Ballot Voting RSID (private, unique ballot or Document confirmation RSID) may optionally be cast as a Master Ballot in conjunction with the use of a Ballot Voting PassCode (FIG. 5, item 5A) that are not revealed for use until the Voter is acting to use to use their Ballot to Vote;

Only the person casting their Master Ballot should know the Ballot Voting RSID and any optional correlated Ballot Voting PassCode(s) that may be required to cast their Ballot votes. Optionally, the Master Ballot Voting RSID and correlated Ballot Voting PassCode(s) are used for both pre-voting Ballot Validation purposes for each of a plurality of Officially Issued Ballots given to Eligible Voters or for each of a plurality of Voter Traded (Voter Swapped) Ballots and then also again for casting a Ballot. The Ballot Voting PassCode(s) are not revealed for use until Voter is acting to use their Ballot to Vote;

H.12(b) In another application of use of this invention, which provides more security, is the optional use of a separate, distinct and unique Ballot Validation RSID and zero, one or a plurality of correlated Ballot Validation PassCode(s) which are correlated to the Master Ballot Voting RSID and Master Ballot Voting PassCode(s) so as to enable Voters to pre-vote or pre-trade check if their Master Ballot Voting RSID or any traded or exchanged Master Ballot Voting RSID is authentic and valid for use, and whether it has been previously used to cast any vote, without revealing the Master Ballot Voting RSID or Master Ballot Voting PassCode(s). The Validation RSID is publicly researchable, yet typically known only to the receiving Eligible Voter, and any person the Voter trades Master Ballots with, or that the Voter exchanges or seeks Ballot replacement from Officials.

This ensures the Voter traded Master Ballot Voting RSID and correlated Voting PasscCode(s) are not prematurely used by any Ballot trading Voter or any Official as the Ballot Voting RSID and correlated Voting PasssCode(s) remain hidden, unused and unusable until the Voter is ready to use their Master Ballot to cast vote(s) and are only revealed when they are ready to be used by the Voter and upon being enabled by authentication methods of the Computerized Voting System;

H.12)(c) As an optional requirement to enable Ballot voting, each voter may be required to submit their unique Voter Personal Identifier (similar to bank ATM card personal identifier) that may be comprised of personal signature, personal initials, letters, numbers, words, graphic images or any combination thereof so as to confirm their identity and authorization to cast a Voting Ballot;

H.12(d) Ballot Validation RSIDs and Validation PassCode(s) may be:

(i) pre-generated and correlated to a Ballot Voting RSID at the same as their correlated Ballot Voting RSID is generated, or, alternatively, (ii) generated solely without correlation to any Voting Ballot RSID, thereby leaving the Ballot Voting RSID to be generated either when the Voter has correctly completed a Ballot for casting, or when the Voter commences the Ballot Voting session by submitting their currently possessed:

(1) private Eligible Voter Identifier or Proxy Identifier and correlated Voter Password or Proxy Password, or, alternatively, (2) Ballot Validation RSID and correlated Ballot Validation PassCode(s), or, alternatively, (3) private Eligible Voter Identifier or Proxy Identifier and correlated Voter Password or Proxy Password and also their valid Ballot Validation RSID and correlated Validation PassCode(s);

and for each aforesaid options 1, 2, 3 by also submitting correct responses to zero, one or a plurality of Human Verification Codes or Human Verification Questions, Problems or Puzzles;

H.12(e) Generic Validation RSIDs and correlated Generic Validation PassCode(s) may also be used to Validate and Authenticate the Sender(s) or Receiver(s) Identity, and optionally the Integrity of Contents for one or a plurality of any type of Document Containers, Communication, Message, Data Transmission, Data Reception, Device, Service, Method, Action or Event that are each unique and uniquely associated with only one instance among a plurality of: Documents, Document Containers, Communications Containers, Data Security Networks and Data Security Containers which may be represented in any format (Physical, Optical, Electronic, Electro-Magnetic, Chemical or Structural) as well as for the steps and methods of Authentication, Validation, Data Processing, Error Detection, Error Correction, False Error Detection, False Error Correction, Data Encryption, Data Decryption, Data Hashing, Data DeHashing, Data Encoding, Data Decoding, Data TransCoding, Data Translation, Data Compression, Data Decompression, Data Rendering that are used by the Computerized Voting System or by any number and a plurality of Potential, Research and Eligible Voters, Proxy Voters, Officials, Third Party Officials, Third Party Services, Public, Candidates, Political Parties, Government, News Media; Generic Validation RSIDs are typically generated at the time the object, entity, message, transmission, action, event, method or service is created, activated, used, applied, queried or responded to by another entity, device, action, event, method or service of this invention;

H.13) To further reduce errors in computer Ballot processing a warning is included (example of FIG. 5, item 2D) for Ballot processing warning), to reduce manual processing;

H.14) To further reduce and detect errors, each type of RSID symbols (FIG. 5, items 5B, 5J2 are also scanned and compared to each other as well as the RSID derived from the correlated barcode (example of FIG. 5, item 5J1) for corroboration of the RSID.

H.15)(a) Security Elements portion—This is another unique feature of this invention with respect to other inventions of the scope of this art. This feature is a vital feature to ensure the integrity of the Ballot, in order to guarantee the final vote tallies are not unfairly influenced by the creation of fictitious Voters. Security Elements (FIG. 5 item 2D, 5H, 5I1, 5I2; Voter signature and private Voter PassWord and date Ballot cast as per FIG. 6 items 6A,6B in correlation-comparison with Voter Registration FIGS. 1A,1B, items 15L1, 15L2) are designed to assist with authentication of any Ballot, whereby the Security Elements may also be comprised of one or a plurality of components Random Symbolic Identifier codes of steps H.5 to H.14, sequential symbolic Identifiers, grouped symbolic Identifiers, physical characteristics or devices, optical characteristics, structures or devices, electronic characteristics, devices or structures, magnetic characteristics, fields or devices, organic or inorganic chemicals, biological materials, genetic materials or genetic structures or genetic sequences, special materials, crystal structures, plastics, metals, gas emissions, electromagnetic radiation, radioactive materials, optical emissions, natural fibers, man-made fibers, microfilm dots, microscopic writing, embossing, impressions, watermarks, seals of authenticity, and any other physical structures, or any other properties, affixed or associated with any Ballot; and options for decoding-encoding elements of every RSID so as to locate the RSID elements within a plurality of data structures for data correlation-comparisons, security-authentication;

H.15)(b) Limits of Use portion—The variety of Voting Sessions possible requires that this section of the Ballot be considered as a variable data area. The Limits of Use area of the Ballot contains several data fields, whereby any single data field may optionally be displaying one or a plurality of data items or data elements, individually, or, in combinations of data fields, having correlated data for each data field logically inter-related to each other and furthermore defining the correlation for each distinct group of Ballots, using correlated information derived from various sources of information. The Limits of Use area may also be considered a generic Ballot Data SUB-Container that is separate and distinct from both the Ballot Sending Data Container and the Ballot RECEIVING Data Container when using methods of marking, identification, encapsulating or otherwise hiding Ballot internal details (eg such as, but not limited to RSID) when implementing printing, distributing, receiving, sorting, validating, tallying, certifying, error detecting, error correcting of one or a plurality of Documents including Voter Whole Ballots, Voter Master Ballot parts of Voter Whole Ballots, Voter Receipt Ballot parts of Voter Whole Ballots, and Voter Whole Registrations, Voter Master Registration parts of Voter Whole Registrations and Voter Receipt Registration parts of Voter Whole Registrations, Voter Whole Ballots, Voter Master Ballot parts of Voter Whole Ballots, Voter Receipt Ballot parts of Voter Whole Ballots, and Voter Whole Registrations, Voter Master Registration parts of Voter Whole Registrations and Voter Receipt Registration parts of Voter Whole Registrations, and, for any other types of Documents, Containers or parts thereof;

H.15)(c) Voting Region sub-portion (FIG. 5, items 5C, 5E, 5F, 5G, 5K1, 5K2=Ballot region info) identified within the Limits of Use portion of a Ballot is used to describe the Scope of a Voting Session sub-portion (FIG. 15—ER Voting Regions).

Voting Region also refers to a variable group of attributes—Province or State, Municipality, Zone, Poll Station, Postal or Zip Code. The groups of Voting Region attributes are used for data storage, and may also be components of the Voting Region, depending on the Scope of the Voting Session. one or a plurality of Voting Region attributes may optionally be visible on Voter Registration (FIGS. 1,2) or Information Forms (FIGS. 3,4) Master Ballots and the correlated Receipt Ballots (ref FIGS. 5-10, 18, 20, 23), Delivery Confirmation-Ballot Activation Forms (FIG. 24), Electronic Voting Receipts (FIG. 25,26), Voting Reports, Process Reports, Calculations, Tallies, Summaries (FIG. 28-30), etcetera or as specified by Officials to meet the needs of any Voting Session.

H.15) (d)(i) Voting Region Identifier (FIG. 5—items 3A3,4,5 and FIG. 5, items 5E,F,G for the VotingRegionID) sub-portions of the Limits of Use portion is a unique Identifier or group of Identifiers used to further define the scope of application of the Ballot such that it is correlated to (but not limited to) a geographic area, or, a subset of a group of people or legally recognized entities, etcetera; as correlated to FIG. 15; and also whereby FIG. 5—items 5K1 is a composite barcode correlated to the values of FIG. 5—FIG. 5, items 5E,F,G which can alternatively be displayed as separate barcodes as per FIG. 9, items 3E2*b,c,d* correlated to FIG. 9 items 3Eb,c,d.

H.15)(d)(ii) Referring to FIG. 9—item 3E1*b,c,d* forms a Voting Region Name Description for ease of human interpretation to facilitate Ballot exchanges and other human processing; and 3E2*b,c,d* are correlated barcodes to facilitate electronic-optical machine processing. Refer to FIG. 9—item 3E1*b*1 is the Zone Identifier Number; item 3E1*b*2 is a Zone Name Description for item 3E1*b*1; item 3E2*b*1 is a barcode for items 3E1*b*1 and 3E1*b*2; H.15)(d)(iii) Refer to FIG. 9—Item 3E1*c*1 is a Polling Station Identifier, an attribute (component) of the Voting Region Identifier, used to organize Ballots and facilitate analysis. Item 3E1*c*2 is a barcode correlated to the value of item 3E1*c*1.

H.15)(d)(iv) Refer to FIG. 9—item 3E1*d*1 is a Province-State attribute of the Voting Region (as correlated to FIG. 15); item 3E1*d*2 is a Date component of the Voting Session; item 3E2*d*2 is a barcode correlated to the value of the concatenated items 3E1*d*1 and 3E1*d*2; and also for FIG. 9, Items 3E1*d*1 and 3E1*d*2 may also be considered as the Voting Session Host Identifier (VSHID) used to uniquely identify, distinguish and organize a variety and plurality of Ballots for any Voting Session;

H.15)(d)(v) an optional item is a Postal-Zip Code Identifier (as referred to by FIG. 15), an attribute (or component) of the Voting Region and of the ZONE ID to facilitate analysis of Voter responses. Postal-ZipCode Identifier may have a barcode correlated to description.

H.15)(d)(vi) Refer to FIG. 9, item 3E1*a* is a Title of the Elected regarding the purpose of the Ballot being a Candidate Election to fulfill the elected Duty. Item 3E1*a*2 is the abbreviation for the symbols used for the unique code associated to the Political Duty, which may be used for election accounting of Ballots, or verification for Ballot exchange, other Ballot processing, or Ballot cost accounting. Item 3E1*a*3 is a barcode correlated to the value of item 3E1*a*2.

H.15)(d)(vii) Refer to FIG. 9—item 3D1*a,b* refers to Ballot Delivery Due Time and Due Date Identifiers—Delivery Due Date (item 3D1*a*) and Delivery Due Time (item 3D1*b*) describes the latest date and time the Ballot is required to be delivered to the designated receiver(s) of the Voting Session, in order for the Ballot to be considered for any Official processing. Item 3D2 is a barcode with value correlated to concatenated or numeric value(s) of 3D1*a,b*.

H.15)(d)(viii) So far descriptions have looked at the constituent components of various types of Ballots which have general groupings, whereby FIGS. 5, 7, are examples of Candidate Ballots; whereby FIG. 9,20 is an example of a Proposal Ballot; FIG. 18, 23 comprised of Candidates and Proposals (Hybrid Ballot).

H.15)(d)(ix) In the case of a Proposal Ballot (FIGS. 9, 20), one or a plurality of Proposals are presented and each are given at least one unique proposal Identifier (PropID) that is correlated to the one correlated proposal, and further correlated to the sub-portion allocated to record the Voters choice(s). Each proposal unique Identifier (PropID) may also be assigned one or a plurality of barcodes correlated to the value of the associated PropID, and may be further correlated to the value(s) of the Voter choice(s) available for selection and further to one or a plurality choices the Voter marks for tallying; and the further degree of democratic freedom of choice is given in FIG. 9 whereby a Voter may print or Write-In their own new personal choices that may not be on the ballot, by printing or writing the name of their preferred candidate(s), political party(s), description or name of proposal(s) and the Voter's position on each of the new proposal(s) of being yes or in favour of otherwise no or opposed, or option of abstained to signify neither yes or no, alternatively: printing or writing-in any combination of each of candidate name(s), political party(s), proposal(s) and Voter's position on each of their new proposal(s) of being a check mark or y or yes for affirming in favour of, otherwise an x or n or no for opposed and not in favour of, or alternative option of having abstained from voting by not being in favour or opposed—each Voter thus voting in favour of or opposed to each of the Write-In candidate(s), party(s), proposal(s) which may be further confirmed by marking a check Mark or X or x or any other acceptable selection Mark(s) placed adjacent to the Write-In candidate(s) name(s), political party(s), proposal(s) and where further definition may be provided to Voters that a Y or y or a check-Mark symbol means Yes or In Favour Of and an X or x means No or Opposed.

Proposal Ballot Security Elements (Voter signatures and dates as FIG. 10 items 4A4, 4A5 in correlation-comparison with Voter Registration FIG. 1, items 15L1, 15L2) are designed to assist with authentication of any Ballot, H.15)(d)(x) Refer to FIG. 18, 23—Hybrid Ballot of Candidates and Proposals (Hybrid Ballot), a Voter may Mark to select the desired Candidate(s), Proposal(s), or Candidate(s) and Proposal(s);

H.15)(e)(i) Voting Region—refers to FIG. 5 (items 3A3, 4,5 5E,F,G) FIG. 9 (items 2B1,2,3, 3E1*b,c,d*), FIG. 18, FIG. 23 and correlates to FIG. 15 Voting Region—is used to reduce human error when exchanging or processing Ballots; an alternative is the use of an integrated Region-Poll Identifier that identifies one or a plurality of sub-regions within a Zone or Region ID; whereby the Region Name description eases human interpretation, and for each figure, each single barcode or group of amalgamated (combined) barcodes are correlated to the values of: Voting Region Name, Voting Region ID, Voting Poll Station ID, Voting Device Identifier;

H.15) (f) To further reduce and detect errors, the Identifier symbols of any descriptive human readable text of any Ballot, form or Document fields may also be scanned at the same time and compared to values of the respective scanned barcode(s) values for corroboration—and the additional options for decoding-encoding and evaluating the aforementioned Identifier symbols to the data contained by the elements within one or a plurality of multi-dimensional matrices of the correlated Voting RSID via associated decoded-encoded coordinates referred to in H or for any other data of this invention;

H.15) (g) As the steps, means methods and processes described involve people and devices that are not perfect in design, function or operation, all aspects of this invention shall also include, but not otherwise be limited to:

(i) All methods within the broad scope of data processing tasks may be applied to this invention; in particular this invention includes the means and methods of acquiring data from any remote or local data source, or any type of Ballots conforming to Voting Session rules;

(ii) The steps of locating, detecting, reading, receiving, interpreting, translating, correcting, and transmitting one or a plurality of any type of, and any combination of Security Elements: holograms, symbolic codes, physical characteristics, physical structures, optical structures, optical devices, electronic devices, electronic structures, magnetic fields, magnetic devices, organic chemicals, inorganic chemicals, biological materials, genetic materials or genetic structures or genetic sequences, special materials, crystal structures, plastics, metals, gas emissions, electromagnetic radiation, radioactive materials, optical emissions, natural fibers, natural or synthetic fibers, microfilm dots, microscopic writing and any other physical structures associated with a Ballot or a plurality of Whole Ballots, Master Ballots, Receipt Ballots, Voter Registration Forms, Voter Registration Receipts physical or electronic data Containers, or any other type of Documents, Containers, data items or data transmissions of this invention;

(iii) the tasks of locating, reading, receiving, detecting, translating, correcting, interpreting and transmitting one or a plurality of, any types of data items are performed by any combination of:

(a) one or a plurality of Official(s) of any type;

(b) one or a plurality of data acquisition devices;

(c) one or a plurality of communication networks;

(d) one or a plurality of other man-made device or plurality of devices;

(e) the methods of transmitting data to, and receiving data from, at least one humans, computers, devices, telephones, the Internet or any other communications networks; including the methods of translating human and device readable codes to methods, modes, protocols, of data communications, data-signal error corrections;

(f) the methods of locating, receiving, detecting, interpreting, translating, reporting, and transmitting error free data; or correcting: compromised, erroneous or duplicate data;

(g) any steps, means, methods and processes of monitoring, acquiring, detecting, receiving, transmitting, acknowledgement, confirmation, verifying or correcting of any compromises, errors, duplicate data; and furthermore, any steps, means, methods and processes of monitoring, acquiring, detecting, receiving, transmitting, encrypting, decrypting, encoding, decoding, error detecting, error correcting, authenticating, verifying, auditing the results and any related effects of any amending corrections or any other actions taken;

(h) optionally applying Voter anti-tamper methods of Voter Person Security Items of: personal hand-written signatures, personal initials, hand written signing dates, private: PassWords, PassCodes, pass-phrases, and public or personal: symbols, icons or graphics;

(i) utilizing Ballot activation Documents (FIG. 27) prior to voting;

(j) providing Voters Receipts to confirm voting successful completing and a copy of voting;

H.16) Constructing any type of RSID (Random Symbolic Identifier), Sequential Symbolic Identifier, Group Pattern Random Symbolic Identifier, Group Pattern Sequential Symbolic Identifier) used in any type of Document or items or processing of this invention (Ballots, Voter Registration forms, data Containers, Security Elements) such that the steps in creating each RSID and for each group of RSIDs are done in a logical consistent manner is comprised of:

(A) defining the maximum number of Random Symbolic Identifiers needed to ensure that each RSID is unique and extremely difficult to guess, infer and predict; First determining the minimum number of RSIDs required by considering data such as, but not limited to: the number of Potential Voters according to Research steps, the number of correlated RSIDs per each type of Objects and Events of this invention; whereby Officials determine, perform manual calculations, and use and one or a plurality of computers running software programs to apply mathematical concepts in estimating and calculating, for each RSID Object and Event group type (such as: Voter Ballots, Voter Registration forms, Proxy Registration, Voting Session Officials Registrations, Voting Sessions Devices Identifiers, Official and Voter Ballot Containers, Official and Voter Registration Containers, Official and Voting Receipt Identifiers, Official and Voter Registration Receipt Identifiers, Official and Voter Transaction Identifiers, Internal Computer System Identifiers, External Audit Identifiers, Secure Communications Identifiers, (private-public) Encryption-Decryption Keys) to estimate:

(i) total number of unique RSIDs needed per group;

(ii) the largest number of RSIDs needed for each group, (iii) the total number of RSIDs needed overall;

Whereby a plurality of Officials utilize one or a plurality of Voter lists, perform manual calculations, or alternatively use one or a plurality of computers running software programs to apply mathematical concepts and known data to estimate, calculate and generate an estimated number of required RSIDs for all anticipated Voters and a plurality of extra ballots to accommodate estimated lost and spoiled ballots, whereby said RSIDs that are constructed to differentiate and accommodate, all types of each required RSID secured items: Documents (Ballots, Voter Registration forms, Data Containers, Voter-Proxy Registration, Language Registration), Security Elements and labels, Voter Lists, Potential Voters, secure data items, securely identified transactions and correlated Receipts (in-person, Fax or Facsimile, Internet, telephone and television methods of Registration, Language selection, voting, verifying, auditing), secured Receipts, secure validations-authentications of any types of Documents, secure tagging identification of Official Vote Processing Devices, estimated number of Containers, estimated number of Voter Registrations, expected number of Ballot replacements, estimated number of Registration transactions, voting transactions, estimated number of Receipts generated, anticipated number of enquiries, verifications, authentications, publications, communications Events, error prevention, error detection and error correction methods, communications data security info, secure data communications, communications security methods, data security methods, Document(s) and Container secure scanning activities, Templates, and for securely extracted data, Objects, images, messages, corrections, and for all related data storage, data retrieval, data communications, authentication, validation, verification, enquiries, confirmations, error detections, error corrections and amendments, certifications, audits and reports;

(B) the steps and methods of creating and organizing a plurality of RSIDs whereby:

(i) The RSID and RSID group type symbols must be pre-determined, and the number of symbols to use for the RSID of this invention must be pre-calculated, based on the number of Voters anticipated, level of security desired for making the RSID extremely difficult to guess, balanced with the data storage needs, scanning error rate, computer processing error rate and extra communication required for having a large number of symbols comprising each RSID; also taking into consideration total number of Ballots issued, expected replacements, anticipated number of enquiries, verifications, authentications, transactions, secure communications, etc.;

(ii) Officials select or create at least one reference group of symbolic characters (which may include numeric symbols and any other symbols or characters graphics or icons from any known human Languages or codes) and specify correlated numeric values to each symbol removing redundant and easily confused symbols from each reference group;

(iii) Officials calculate the minimum and desired number of symbols needed to generate a sufficient number of unique permutations of RSIDs so as to be able to create unique symbol permutations (example: two letters A, B yields 4 unique permutations AA, AB, BA, BB) for the required number of RSIDs for each group; and the further steps of reviewing each of the aforesaid symbol permutation substring patterns, then removing and inhibiting the creation of any repetitious or undesirable permutations;

(iv) for the above calculations (iii), RSIDs are grouped (group type) according to usage (example: Ballot RSIDs—32 symbols, Voter Registration RSID—16 symbols, Registered Voter RSID—24) whereby each RSID group type is composed of identical or similar number of reference symbols of the RSID group types such as:

Ballot Data Containers ID: symbol group A (16 symbols),

Voter Registration: reference symbol group B (16 symbols),

Voter Language—reference symbol group C (8 symbols),

Whereby each symbol group can then be combined to create larger symbol groups enabling larger number of permutations of symbols and a larger range of correlated numbers for greater security, such as: Voter Ballot RSID: combined reference symbol groups A,B (32 symbols), Ballot Voting Transaction Receipt ID: combined reference symbol groups A,B,C (40 symbols);

(v) reiterative steps of reviewing contents of groups of merged reference symbols and removing any excessively repetitious or undesirable clusters and patterns of symbols;

(vi) and further iterative steps of adding a plurality of symbols and symbol permutations so as to increase the number of acceptable RSIDs patterns and acceptable RSID internal patterns to achieve the required total number of symbol permutations that are needed to assign to each RSID and to each RSID within each RSID group type and for any additional spare RSIDs for each group so as to enable additions, amendments, corrections;

(vii) Official(s) assign one unique numeric binary value to each symbol or use an existing symbol code set that already has symbols and correlated numeric values;

(C) for each RSID group type, and for each RSIDs belonging to each group, Official(s):

(i) randomly selects symbols from the set (prior step vi) of acceptable symbols until reaching the desired RSID size (symbol number count for max. value range) for the group;

(ii) concatenates each symbol of each RSID to produce a unique symbol string—which may then be split into sub-groups of symbols for easier human usage and or processing;

(iii) rejects undesirable RSIDs by limiting the number of times a single symbol, or group of symbols, is repeated within each RSID so as to avoid confusion, eliminate undesirable patterns, and to optimize human perceptions of recognizable uniqueness;

(D) (i) Official(s) assign one unique binary value to each acceptable RSID by consistently concatenating the correlated binary value assigned to each RSID symbol assigned in (b)(vii), then interpreting the combined assembled binary string as a single binary number (which may then be split into sub-groups of numbers for easier human usage);

(ii) Official(s) enforce the principle of substantial numeric spacing so that each RSID binary value is unequivocally unique and predominately numerically distant in value from all other RSIDs within a group and among all RSIDs;

(E) Officials correlating at least one RSIDs internal symbol group sub-patterns or directly to any symbols of: (i) any types of alpha-numeric symbols or any other Language graphic or character symbols (examples: English alphanumeric characters, Russian or Ukranian Cyrillic symbols, Greek, Norse, Arabic, Japanese, Chinese and any number of other Language symbols, images, icons, scientific or math symbols) in any format (printed, optical, electronic, magnetic, chemical, structural);

(ii) one or a plurality of barcode graphic image(s) or any other graphical symbolic representations correlated to a group of symbols referred to in the preceding step (i);

(iii) calculated or derived barcode values that are correlated to a specific barcode graphic;

(F) Furthermore, when a pre-determined maximum size of symbol groups is defined by determining a maximum number of symbols (example: 32 unique symbols implies that only 5 binary digits as a minimum to represent all 32 symbols) then the unused binary values (example: ASCII symbols assigned 8 bits but we may only need 5 bits) can be compressed further to reduce data storage needs or more importantly, to provide another layer of security by reassigning the unused binary values for each unused symbol to provide Data Security-Integrity data bits such as, but not limited to: signal marking, bit transition encoding, data parity, and one or a plurality of other bits for data security encoding, error detection, false error detection, error identification, error location specification and error correction

| symbols | 6-bit value | error bits | Binary value | base 10 |
|---|---|---|---|---|
| null | 000000 | 00 | 0000 0000 | 0 |
| Mark | 111111 | 11 | 0011 1111 | 112 |
| A | 100001 | 11 | 1110 0001 | 449 |

-continued

| symbols | 6-bit value | error bits | Binary value | base 10 |
|---|---|---|---|---|
| B | 100011 | 10 | 1010 0011 | 323 |
| 2 | 000010 | 10 | 1000 0010 | 258 |

(G) further step of assigning at least one of each of: Data Type, Data Mode, Data Source, Data Identifier data bits and further correlating one or a plurality of Data Type, Data Mode, Data Source, Data Identifier symbols to one or a plurality of RSID data signals or any other data of this invention so as to embed the signal information within the data for any data state (transmitted, in-transit, in-stasis, received, stored, retrieved, deleted, restored, rendered, analyzed, validated, authenticated, certified, published) for data handling, optimization and security (by implicitly characterizing the type and quality of the data received); further step of assigning one or a plurality of non-RSID Data Mode symbols to each unused compressed binary number after first determining the maximum number of data bits needed to represent a particular type of binary signal data type (Local-Data, Remote-Data, Internal-Data, Internet-Data, Fax or Facsimile-Data, EMail-Data, Telephone-Data, InterTV-Data), and data signal mode (Official Device Telemetry, Voter Device Telemetry, Internal Communication, External Communication, Official Security, Voter Security, External Security, Voter Data Storage, Official Data Storage, Voter Data Retrieval, Official Data Retrieval, Validation, Authentication, Printing, Voter Data Processing, Official Data Processing, Analyzing, Error Detecting, Error Correcting, Error Reporting, Amending, Reporting, Publishing);

(H) further steps and methods whereby any of the constructed resultant final data words of the prior steps (e), (f), (g) may then be re-encoded and re-correlated to the same original symbol encoding group (such as, but not limited to: ASCII symbols group) or, may alternatively be cross-encoded to another multi-bit code pattern, thereby further encrypting the original data contents while subsequently and separately embedding error detection data bits, error localization data bits, error identification data bits and error correction data bits, security encoding bits for capabilities which could also be used to improve secure data storage and secure data transmissions;

(I) RSID prefix-suffix-embedded data whereby for each of a plurality of specific usage purpose (group type) of RSIDs, whereby each RSID of a group type may optionally have appended additional data symbols optionally as prefixes, suffixes, at specific positions, by employing internally embedded data bits that are at specific positions within the RSID so as to used as meta-data or directly as usable integrated data symbols, Marks, signals, graphics or other manifestations (and any types of copies or facsimiles thereof) that are used upon or within Official Documents, Containers, devices, software, computer processes, computer software data structures and software algorithms and any form of physical, optical, electronic electromagnetic, or chemical Objects, and their optical, tactile, auditory or chemical renderings of this invention for:

administration or organization, (ii) security encryption-decryption, data transmission compression and decompression, error detection and error identification, (v) error specification and localization (vi) error correction and error data recovery, (vii) alphanumeric data transposition or substitution or encryption-decryption encoding or decoding, (viii) data type identification, (ix) signal type identification;

(x) Mark or correlated symbols of identification or marking for: fiducial, alignment, sorting, or security element, or signal type, or data type, or symbol sequence type, (xi) start or end Mark or signal for: fiducial, alignment, sorting, or security element, or data, or signal, or symbol sequence; and to provide further information as to the RSID source device identification, source device location, source author identification, source author authorization, creation date-time, voting session, voting region, polling station, Ballot type, Registration type (Voter, Proxy Voter), Document type, or any other relevant information that is any combination of: data appended as extra prefixes, suffixes attached to the RSID as well as optionally embedded data within the RSID—or, to create a composite RSID, while also retaining the integrity of the original core RSID, such that it is extremely difficult to estimate, calculate or guess, and the uniqueness of the RSID as it remains readily differentiable among all other Identifiers of this invention; and the further steps of disassembling and extracting the core RSID from the composite RSID;

(J) RSID Group types—whereby any RSID symbols may be organized to belong to a group type of step 4(b)(iv) of identical usage(s), and further whereby each RSID of each group type may have additional data symbols and data bits, or only data symbols, or only data bits, that are appended to the RSID as extra prefixes, suffixes, and optionally or alternatively embedded within the RSID so as to used for grouping RSIDs by identical usage purpose(s) for each correlated group type—and to provide embedded usage error check; RSIDs are grouped (group type) according to usage (example: Ballot RSIDs—32 symbols, Voter Registration RSID—16 symbols, Registered Voter RSID—24) whereby each RSID group type is composed of identical or similar number of reference symbols of the RSID group types (examples: Ballot Data Containers ID—symbol group A (16 symbols), Voter Registration—reference symbol group B (16 symbols), Voter Language—ref. symbol group C (8 symbols) Voter Ballot RSID—ref. symbol groups A,B (32 symbols), Ballot Voting Transaction Receipt ID—ref symbol groups B,C (24 symbols), etc;

(K) calculating and generating an estimated extra number of RSIDs for each RSID group type that are marked inactive-extra and stored separately for rapid assignment as need arises;

(1) creating, populating, and organizing top level of Modal group types: People, Objects, Actions, Events, Security, Communications and each has sub-groups or attributes: Type, Identity, Location, Connectivity, Signals, Data, Devices, Actions, Events, Objects, Processes, Communications, Error Handling, Imaging, Reading, Data Storage, Data Retrieval, Analysis, Reporting, Validating, Authenticating, Certifying, Publishing, each having correlated sub-group information attributes correlated to Voters data, Officials data, Documents data, devices data;

(2) the steps and methods of creating a plurality of data organization groups for each mode and method of voting to provide collecting, sorting, separating and organizing a plurality of data items, any types of RSIDs, Documents, forms, Containers, Objects, Events, groups, communications, processes, or any item of this invention; and further steps and methods of creating any number data organization structures of conceptual group types as group formation categorizations, and further of creating one or a plurality of groups for each of said group types so as to be usable instances of group types to enable further data organization and logical grouping for Voting Methods, Data Storages, RSIDs, Voters, Officials, Official Voting Devices and related equipment, Voting Regions and Locations, Security data partitioning, Communications, data processing, error processing (error detection, error identification, error specification, error localization, error position locating, error marking, error correction, error data recovery, false error detection rejection), auditing, reporting and voting system optimization;

(3) the further step of creating and assigning one or a plurality of said groups to be subordinate to any number of other groups; and the further steps of correlating groups to groups, correlating groups to attributes, correlating data and state information to attributes and to parent groups;

(L) Objects and Events Groups—(1) assign at least one reference symbol group to each group of Objects (Documents, Devices) and their correlated Objects Type of Document types: Ballots, Ballot Containers, Voter Registrations, Registration Containers, Officials Registrations, Official Registration Containers, Ballot Receipts, Registration Receipts, voting transaction Receipts, Registration transaction Receipts, Ballot delivery confirmation Receipts, Registration delivery confirmation Receipts, Ballot and Registration processing and error reports, Ballot and Registration tally reports, Registration audit reports, voting audit reports; and also of Devices usage types: printing, voting, verifying, authenticating, communicating, securing, auditing, encoding, decoding, encrypting, decrypting, error detecting, error correcting, translating, computing and publishing;

(2) for each Object group type, assigning a unique Object group Identifier (ObjectGID) to the overall group and further a unique Identifier (ObjectID) for each Object member of the Object group, further whereby the Event group Identifier may also be concatenated to each Object member for rapid association to the parent Object group;

(3) assign at least one reference symbol group to each Event groups of this invention (Events: Registrations, voting, authentication, transactions, security, auditing, communications, image capture and processing, error processing, data processing-retrieval-storage) and then generate correlated Identifiers for each Event group, and for each Event within an Event group;

(4) (i) assign one unique binary value to uniquely identify each group of Objects;

(ii) assign one unique binary value to uniquely identify each group of Events;

(iii) assign each particular groups of reference symbols, barcodes and correlated barcode values to Objects, groups, and Event groups of this invention so as to distinguish Objects group types from Event group types and from among all other Identifiers of the invention;

(iv) and further assigning each attributes and attribute values to each Object group and to each Event group and to a plurality of any other groups;

(5) (i) assign one unique binary value to uniquely identify each Object and Event from within each group of Objects, each group of Events;

(ii) assign particular groups of reference symbols, barcodes and the correlated barcode values to Objects groups, Event groups of this invention so as to distinguish Objects among all other Objects and also to distinguish each Event from among all other Events;

(iii) and the further step to facilitate organization and proper use, of concatenating the parent Object group Identifier to each Object within an Object group, concatenating the parent Event group Identifier to each Event within an Event group;

(6) and further steps and methods of creating any number data organization structures of conceptual group types as group formation categorizations, and further of creating one or a plurality of groups of said group types so as to be usable instances of group types to enable further data organization and logical grouping for Voting Methods, Data Storages, RSIDs, Voters, Officials, Official Voting Devices and related equipment, Voting Regions and Locations, Security data partitioning, Communications, Data Processing and voting system optimization;

(M) Modal Groups: are groups which are separate and distinct or contain attributes of Objects and Events groups, and which encompass the type of type of Voting Session activity (Voting, Registration, Imaging, Reporting, Security, Communication, Error Processing, Printing, Delivering, Auditing, Authenticating, Confirming, Analyzing, Tallying, Reporting)

(a)1) creating a plurality of Modal groups for each method of voting and further creating and correlating a plurality of data structures to each said Modal group categorization (Voter, Official, system, security, communications, internal, external) and for each Modal group categorization a plurality of correlated sub-groups (process, services, Events, data) which each further have a correlated functional mode status priority attribute (urgent, high, normal, error, pending, completed, suspended, terminated, archived) and related Modal status attribute value (true, false, yes, no, valid, invalid, unknown, secure, insecure, verified, unverified, authorized, unauthorized, confirmed, unconfirmed, submitted, committed, rollback, undone, canceled, transmitted, received);

(2) for each Modal group type the steps of creating one or a plurality of types of RSIDs for each group type and for each group subordinate Object, processes, services, Events, activities thereof by defining the upper limit number of Random Symbolic Identifiers needed to ensure that any one RSID is unique and extremely difficult to guess, by considering:

(i) the number of Potential Voters and estimated number of Eligible Voters, (ii) potential number of RSIDs for each Modal group of Objects, Events, Systems, Services;

(iii) and the further steps of assigning at least one reference symbol group to each top-level parent Modal group each Object group each Events group, each Systems group, each Process group, each Services group so as to provide auditing records;

(3) calculating the total number of Identifiers needed overall and the minimum number of symbols needed to generate a sufficiently number of unique permutations of symbols so as to be able to create one unique symbol permutation for the required number of Identifiers per Modal group; rejecting undesirable Modal-IDs by limit the number of times a single symbol, or group of symbols, is repeated within each Modal-ID so as to avoid confusion, eliminate undesirable patterns, and to optimize human perceptions of uniqueness;

(4) Officials assign one unique numeric binary value to each symbol or use an existing symbol code set that has symbols and correlated numeric value for each symbol;

(e) Officials concatenate each symbol to produce a unique symbol string;

(5) assign a unique binary value to each acceptable Identifier, by consistently concatenating the correlated binary value assigned to each Identifier symbol, interpreting the assembled binary string as a single binary number;

(6) enforce the principle of substantial numeric spacing so that each Identifier has a binary value that is unequivocally unique and predominately numerically distant in value from all other Modal-IDs within any group and among all Modal-IDs;

(7) and the further steps and methods of correlating one or a plurality of each Modal Identifier sub-patterns directly to any symbols of:

(i) any types of alpha-numeric symbols or graphical Language symbols, images or ico (ii) any types of barcode graphics and barcode values;

(N) Ballot PassCode Use: (1) (i) upon activation of the Whole Ballot, or lack of requirement for Whole Ballot activation, whereby: the Voter is enabled to vote either in person, by postal mail or delivery service, by telephone (land line, cellular, mobile, satellite), Internet, Fax or Facsimile, EMail, interactive television, or any other form of verifiable communication after revealing, viewing and using the Ballot PassCode RSID which may be delivered to the Voter separately from the Whole Ballot, or is within the Whole Ballot Container, printed on or associated with the Master Ballot, and the further step where the Ballot PassCode is also printed on the Receipt Ballot by Voting Officials, or, is not printed on the Receipt Ballot and may be manually recorded by the Voter, and (ii) the further step where the Ballot PassCode on the Receipt may also have a removable covering for privacy, or may be separately transmitted to the Voter by at least one Official or at least one Official Agent; and the further steps and methods whereby a Ballot PassCode is used in conjunction with a Ballot Voting for that same Whole Ballot, Master Ballot or Receipt Ballot for the purpose of validating or authenticating the correlated Whole Ballot, Ballot Master part or Ballot Receipt part; and (iii) the further steps whereby at least one of said Voters complete their Document, Registration, Ballot, or Language Selection or any other Document by optionally applying at least one: Voter signature or Voter private PassWord, Ballot signing date, Ballot selection(s) and Write-In choice(s) then submit Ballot Voting RSID, Ballot PassCode for each Master Ballots; and for each said Master Ballot completed for casting and tallying, the further step of each Voter manually creating or, at least one Voting System Official Device automatically generating, at least one or a plurality of Receipt Ballots that are correlated to each Voter's Master Ballot that was completed for casting and tallying; and the further step of each Voter then retaining one or a plurality of correlated Receipt Ballots for each Master Ballot completed for casting and tallying;

(iv) and the further steps and methods whereby one or a plurality of Voters each deliver one or a plurality of Master Ballots to Election Officials or Officially Designated Recipients for authentication, validation and tallying, as well as one or a plurality of successful completion Receipt Confirmation Documents that are delivered to each successful Voter by methods of: In-Person paper Receipts, Postal mail paper Receipts, or Electronic mail Receipts, Fax or Facsimile, Telephone-App-Message Texting, Interactive Tele-Vision, Telephone App or Internet website post-submit webpage(s), and to one or a plurality of third parties to verify the integrity of the Voting Session;

(O) Ballot Activation: and further steps whereby for each Voter and each Proxy Voter whom has successfully registered to receive and cast a Ballot, a plurality of Officials enable each Whole Ballot sent to each Voter or Proxy Voter; for each said Whole Ballot received by each Voter of a plurality Voters and for each Proxy Voters of a plurality of Proxy Voters, each said Voter or Proxy Voter may optionally First activate said Whole Ballot and constituent parts (Master, Receipt) thereof for use by applying the steps and methods for one or a plurality of Ballot Activation Documents (FIG. 27), submitting Ballot Validation RSID and one or a plurality of Ballot Validation PassCode(s) by methods of: in person, by postal mail or delivery service, by telephone (land line, cellular, mobile, satellite), Internet, Fax or Facsimile, EMail, interactive television, or any other form of verifiable communication to Officials and Official devices so as to enable said Whole Ballot for casting; or (b) each said Voter or Proxy Voter may not be required to activate said Whole Ballot and constituent parts (Master, Receipt) thereof for use, whereby such activation is automatically or manually done by at least one or a plurality of Officials, Official Agents, Official Devices or Third Party Officials, one or a plurality of Third Party Official Devices;

(c) alternatively no prior activation of the Voting Ballot is needed to use said Whole Ballot or any constituent parts (Master, Receipt) nor for any other type of Document or Container;

8) Remote Voting—Internet, Email, Telephone, Fax or Facsimile, Interactive Television The aforesaid Voter Registration and voting system described herein whereby a plurality of remote Voters and Proxy Voters whom are not at the polling station to cast their vote, said Voters and Proxy Voters may also register, cast Ballots, file complaints or amendments or any other types of Documents or reports in-person, by postal mail or delivery service, or may also employ personal communications devices to connect to a variety of data communications infrastructure by telephone (land line, cellular, mobile, satellite), Internet, Fax or Facsimile, EMail, interactive television, or any other form of verifiable communication) so as to then connect to an electronic virtual polling station and physical polling stations in order to: obtain voting information, register for voting, review, verify or amend their personal Registration, report Registration errors, assign Proxy Voters, amend Proxy Voters data or assignment, authenticate the Ballots received, cast their Ballots, review Ballots cast, report Ballot casting errors. Said polling stations employ various devices to connect to data communications infrastructure (telephone, Internet, television) so as to then connect to said Voter and Proxy Voters and further said polling stations devices also act to record, store and enable said remote Voters to register, cast their Ballots for Official tallying, review submitted data, amend or report errors whereby:

(A) the steps and methods whereby a plurality of Voters and Proxy Voters use any number of, any type and combination of electronic devices to connect to the Internet, telephone or cellular telephone communications systems, or interactive television system, or electronic mail system so as to securely access, input, verify, validate, review, amend, submit, retrieve, store, record, print or save—their Voter personal information and personal choices so as to optionally complete:

(i) one or a plurality of Voter Registration(s) or constituent parts thereof, (ii) one or a plurality of Voter Language Selection forms or constituent parts thereof;

(iii) one or a plurality of Master Ballot(s) or constituent parts thereof;

(iv) one or a plurality of Voter Proxy Assignment forms or constituent parts thereof;

(v) one or a plurality of Voter Contact Update forms or constituent parts thereof;

(vi) one or a plurality of Voter Registration Complaint forms or constituent parts thereof;

(vii) one or a plurality of Voter Ballot Complaint forms or constituent parts thereof;

(viii) one or a plurality of Polling Station Irregularities forms or constituent parts thereof;

(ix) one or a plurality of Official Investigation Report forms or constituent parts thereof;

(x) one or a plurality of Voter Status (Active-Inactive) Amendment forms or parts thereof;

(xi) one or a plurality of Proxy Registration forms or constituent parts thereof;

(xii) one or a plurality of Proxy Status (Active-Inactive) Amendment forms or parts thereof;

(xiii) one or a plurality of any other types of Documents of this invention;

(B) and further whereby one or a plurality of Voters submitting privately and securely to Officials all necessary data so as to enable Voter Registration, Voter Language Selection, and Voter Ballot Casting (a.k.a. Ballot voting) reviewing or casting of any number of Ballots for each registered Voter, or Proxy appointee(s);

(C) and the further steps whereby: any number of Officials and one or a plurality of third-parties provide services of: (i) Official Computer Authentication—the steps and methods whereby any number of Voters using computers, telephones or any other devices are provided with—any number of secure telephone lines, secure Internet connections (examples: Hyper-Text Transport Protocol Secured (https), Secure Socket Layer (SSL), Transport Layer Security (TLS), Virtual Private Network (VPN)) one or a plurality of privacy enabling devices and one or a plurality of privacy enabling software and any computer authentication data issued by a third party certificate authority so as to validate the authenticity of the Official computers and communications systems being used for voting and communications are legitimate and authorized for use; and (ii) the further steps and methods of:

(a) Official computer and data storage hacker protection—the steps and methods whereby at least one of: Official computers, networks, telephones or any other devices and communications systems are provided with enhanced security software, equipment, personnel and procedures to ensure the electronic voting systems availability and reliability for use for authorized users, and the further steps and methods of providing additional security measures to ensure the integrity and reliability of the voting system processes, for: data transmissions, data receptions, data error corrections, Document processing Document validations, certifications, calculations and publications); and the further steps and methods whereby:

(b) Internet Identity Masking—the steps and methods whereby one or a plurality of Voters using computers connected to the Internet for voting employ IP (Internet provider) masking to hide their unique Voter Internet address identity by enabling each Internet Voter to appear as another unrelated IP address to Officials and Voting Session Official networks and computers; and the further steps and methods whereby IP masking employs software that connect to commercial or privately owned computer and routers (Proxy Server, Virtual Private Network Server, The Onion Ring and Tomato enabled routers) so as to use the third party IP addresses as an alias for the Voter, and connect any number of public or private masking network systems whereby Internet routers encrypt the data and originating Voters IP address so as to hide the Voters data from Internet users and further hide each Voter's original IP and computer identity from the election computer systems, or employ client side software to mask the Voter IP address and the machine Identifier (MAC ID) of the Voters' sending device; and the further steps whereby:

(D) Voting Ballot Data Encryption—to ensure data integrity of Voting Ballots by reducing the possibility of falsification and Ballot tampering—the steps and methods whereby one or a plurality of Officials and Voting Session Official election computers, telephones and/or network devices employ public-private key pair encryption algorithms of Cast Voting Ballot information: [Ballot voting RSID, Ballot PassCode, Voter selections, selection validation codes, Voter Write-In choices, Ballot Casting sequence ID, Ballot Casting validation code, Voter Personal Security Items (Voter signature, Voter initials, Voter PassWord(s), Voter graphics, Voter submitting device ID), Voting Ballot casting date and time stamp, Official receiving Device ID, Official Encrypting Device ID, Encryption date and time, Encryption Methods IDs, Encryption KeySet ID, so that for each encrypted Cast Voting Ballot shall have a Voting Ballot Receipt (FIG. 25) with embedded PUBLIC Receipt Codes (PUB-CBRC) (FIG. 25, items Ballot Identifier, Selection Signature, Receipt Identifier, Validation Identifier, DateStamp, Time Stamp, Location Identifier, Zone Identifier Region Identifier, PollStation Identifier, Postal-Zip Code Identifier, Voting Session Identifier, Voting Purpose Identifiers, Voter Candidate Selections, Descriptions of Voter Candidate Selections, Voter Proposals Selections, Descriptions of Voter Proposals Selections, Official Receiver Identifier, Transaction Identifier, Transaction Record Identifier, Transaction DateTimeStamp) recorded by Officials devices automatically create to hide or obscure the original cast Voting Ballot voting information by using at least one private encryption key (a private encryption key: VOT-PRIKEY) that is a PassWord created by the Voter when registering or when casting their Ballot, and an Official device generated unique private key (COM-PRIKEY) that is used to encrypt the Voter private key to create an encrypted private Voter SuperKey (VOT-SUPKEY); Official device(s) generating a persistent, consistently used public key to enable secure encryption of Voter SuperKey such that each Voter can securely access their original Cast Ballot Receipt data; and further whereby encryption-decryption by said computer keys and Voter SuperKey employs Official device (s) assigned private encryption algorithm (PRI-ENALG) having multiple iterative encryption steps to further embed the encrypted data values and Voter key and Voter SuperKey via a series of multiple re-encrypted encryptions of Voter key, Voter SuperKey and Cast Ballot Receipt data; whereby said computer keys, Voter key and Voter SuperKey are redundantly, immutably stored, separate from the Cast Ballot Receipt data, yet associatively linked to said Cast Ballot Receipt data;

(E) and the further steps and methods whereby each original Ballot Receipt information is recoverable from the correlated public encrypted Ballot Receipt code (PUB-EBRC) by applying manually or by computer, the correlated private Receipt encryption key (PRI-KEY) and the correlated private Receipt encryption algorithm (PRI-ENALG) to the correlated public encrypted Ballot Receipt code (PUB-EBRC); and the further steps and methods:

(1) whereby a plurality of public encrypted Ballot Receipt codes (PUB-EBRC) are each correlated to their respective Ballot RSID;

(2) whereby optionally one or a plurality of Voting Session Official public encrypted Ballot Receipt codes (PUB-EBRC) are optionally printed on the the Ballot;

(3) whereby to preserve privacy of data Ballot RSID one or a plurality of Voting Session Official Ballot Information Data Elements are not printed on each Ballot; and further whereby each computer private encryption key (COM-PRIKEY) and encrypted Voter SuperKey are each unique, distinct and hidden;

(4) whereby a plurality of privately encrypted Ballot Receipt codes (PUB-EBRC) are each correlated to their respective Ballot RSID; (v) whereby one or a plurality of Voting Session Official public encryption algorithms (PUB-ENALG) and public encryption keys (PUB-KEY) are provided and employed to enable general public validation of Ballot Receipts data and Ballot Receipt codes without revealing private encryption algorithms (PRI-ENALG) or private (computer, Voter) encryption keys (PRI-KEY) or Voter SuperKey;

(5) whereby to facilitate machine scanning, one or a plurality of Voting Session Official barcodes and one or a plurality of Voting Session Official other symbolic marking codes are generated and correlated to one or a plurality of Voting Session Official Ballot Information Data Elements and further to one or a plurality of Voting Session Official public encrypted Ballot Receipt codes, which are then printed on or are physically, optically, electronically, electromagnetically, chemically and/or structurally incorporated into the Ballot Receipt and Ballot Receipt data;

(6) whereby to facilitate machine scanning, one or a plurality of Voting Session Official geometric shapes, lines and other symbolic marking codes which are used for orientation or alignment are optionally generated then printed on, or otherwise incorporated into the Ballot Receipt and Ballot Receipt data;

(F) Internet Processing (Voter Registration, Voting, Validation, Error Identification, Authentication, Error Reporting, Investigations, Amendments, Certifications, Reporting, Publishing) employing the steps and methods of claim 1 and the further steps and methods whereby:

(a) Internet Registrations, Internet Voting, Internet Complaints, Internet Investigations, Internet Amendments, Internet Auditing is performed by a plurality of Voters, Proxies, Officials, and Official Agents using personal communications devices to create a secure, private connection and interactive session, to at least one Official computer Internet server system and a plurality of Officials computer Internet server systems which are integrated and connected to the Voting System of claim 1; said private connection and interactive session to optionally establish one or a plurality of Voting Session Official inter-devices connection electronically, optically, electromagnetically by secured electronic, optical or electromagnetic data tunnels of isolated communications by using one or a plurality of: virtual private networks, Anonymous Proxy Servers, trusted devices, device Authentication Certificates, and at least one secure communications cryptography protocols (such as: Hyper-text Transport Socket Security (https and https2), Secure Socket Layer (SSL), Transport Layer Security (TLS)), and zero, one or a plurality of Public-Private encryption-decryption key pairs, RSIDs, and cryptographic protocols;

(b) a plurality of Voters and Proxys Registering to vote, or amending or activating their Voter Registration previously established by the Voter, Voter Proxy, or research of at least one Official or Official Device running artificial intelligence software for specific research validation;

(1) establishing said secure connections to at least one Official Computer Systems Internet Server(s) of claim 1;

(2) a plurality of Voters (Potential Voters, New Voters, Proxy Voters, Eligible Voters) receiving from at least one Officials Internet Server(s) which provide:

(i) at least one Internet accessible website with a main Home webpage giving access to the Official Voting Session with embedded inter-webpage optical-electronic links to enable navigation to each Voter Registration webpage, each Voter private data vault, and to one or a plurality of Voting Session Official other inter-linked WebPages that are used for the Voting Session; or, (ii) by direct Internet enabled navigation to the Voter Registration main Home webpage via a unique electronic address that is correlated to the Officials Internet Server(s), said Officials Internet Server(s) provide on WebPages, embedded inter-webpage optical-electronic links to enable navigation to the Voter Registration webpage, and to at least one or a plurality of Voting Session Official other inter-linked WebPages that are used for the Voting Session;

(3) said Voter(s) completing, reviewing and submitting their personal identity information to Officials via said Voter Registration webpage(s)—thus confirming, denying, amending, questioning or complaining as to Officials research—or, submitting new data for Officials to investigate, accept, amend or reject;

(4) Officials accepting a plurality of said Voters Registration submissions, then investigating, accepting, amending or rejecting each Voter submission, then creating new or amending existing or deleting existing Voter Registration records accordingly;

(5) Officials certifying a plurality of Voters whose Registrations were accepted or amended by Officials; communicating acceptance to each Certified Voter or rejection to unaccepted Voter(s); sending to each Certified Registered Voter, at least one Voting Whole Ballot via the method selected by each Certified Registered Voter;

(6) for each Certified Registered Voter, Officials creating an electronic, electromagnetic, optical data storage Voter Registration Vault containing all of the Voter private Voter Registration information in an encrypted form, communicating how to access said Voter Registration Vault to each Certified Registered Voter, communicating an Official generated combination of PassWord, image, graphics symbols, sounds; alternatively, allowing the Voter to create any combination of: a PassWord, selected images, graphics symbols, sounds, then applying said PassWord, image, graphics symbols and sounds as a private key, also applying one or a plurality of Voting Session Official public encryption keys and encryption algorithms, and one or a plurality of recursive repetitions to said Voter Registration data thereby encrypting said Voter Registration data; then storing said encrypted Voter Registration data redundantly, and in or on immutable media using any single or combination of physical, optical, electronic, magnetic, electromagnetic (POEM) formats;

(7) repeating aforesaid steps of Voter Registration for a plurality of Proxy Voters who may each be appointed by at least one Voters to cast a Ballot on the original Voter(s) behalf, (8) Enabling Internet Voting by a plurality of Officials transmitting one or a plurality of Voting Session Official Receipt Confirmation Documents to a plurality of Voters, whereby each Voter either electronically, (using methods of secure Universal Resource Locator (URL) webpage accessible by Ballot PassCode or Voter PassWord, by EMail to each Voter provided EMail, by Fax or Facsimile to the Voter specified Fax or Facsimile machine, telephone number, or by interactive television, personal computer or any other type of personal data device) or by Postal Mail delivery or Courier Delivery Service to each Voter who has successfully submitted their Registration in person or electronically; (b) and the further optional steps and methods of using the unique, private Registration RSID as part of an Internet address to organize and privately store each Voter Registration webpage vault, as well as all actions, tallies and summaries of Voter selections for each Registration of each Voter;

(9) for a plurality of Certified Registered Voters whose Registration was adequately completed and timely received—Officials sending or enabling to send at least one Whole Ballot and constituent parts (Master, Receipts) via Postal Mail, Courier Delivery Service or by any other preferred communication method of the Voter or as designated by Officials;

(10) for delivery method of Internet, a plurality of Voters and Officials using the Internet for sending, receiving at least one Ballot per Certified Registered Voter by applying modified (substituting the word Ballot for Registration) for above steps (F)(1) to (8);

(11) for a plurality of Voters and Officials, further modifying of aforesaid steps (F)(1) to (9) to enable Validation, Error Reporting and Amendments of Voter Registration, Voter Cast Ballots, Proxy Assignment, Voter Contact Updates, Proxy Contact Updates, Voter Active-Inactive, Proxy Active-Inactive, Voter Ballot Complaints, Voter Registration Complaints—all via Internet;

(12) and further whereby Internet Processing (Voter Registration, Voting, Validation, Error Identification and Amendments, Reporting) comprises of the steps and methods of Internet Processing, Internet Registration, Internet Voting, Validation, Error Identification, Amendments, Reporting are performed by one or a plurality of Voting Session Official Voters, Proxy Voters, Officials, Agents and optional Third Party Officials:

(a) Officials, Agents and Official Third Parties obtaining and utilizing one or a plurality of Voting Session Official Identity Authentication Certificates from one or a plurality of Voting Session Official public Certificate Authorities that are correlated to the respective Validation Session Identifier (IVALSID) or Voting Session Identifier (IVOTSID);

(b) Voters using the Internet to connect to at least one Official Internet Voting Website that is secured from unauthorized manipulation; said connection between Voter and Officials Internet Voting Website may be via a Virtual Private Network (VPN) connection or Double Virtual Private Network Connection (DVPN) that is provided by a Third Party or Official Network Devices and Official Computers running Virtual Private Network software programs; and the further steps and methods of Voters hiding the originating Internet Address and Computer Machine Identifier (MAC Address) by running software programs to hide that said information or by connecting to an anonymizing proxy server before connecting to an Official provided VPN or DVPN connection;

(c)(i) Voters navigating from one or a plurality of Voting Session Official webpage menus to a secure Official Internet webpage form that is used for validation of Ballot RSIDs and Ballot PassCodes; Voters computer internet browsers then receiving, verifying and error checking the Official, Agent or Third Party Certificate Authority Identity (CAI) to confirm the website is the Official, Agent or Third Party website; Voters then proceeding if no CAI error is detected, otherwise optionally terminating if a serious CAI error is detected;

(c)(ii) Officials, Agents or Official Third Party Devices provide one or a plurality of Voting Session Official messages, images, numbers, and symbols with one or a plurality of Voting Session Official requests that the Voter provide a reply to confirm that it is a human interacting with the IVALS system; whereupon after the Voter submits zero, one or a plurality of responses to at least one Official or Official Device, the Voter response and Rules of the Voting Session determine whether the Voter is allowed to continue;

(d)(i) Voters accessing said secure Official webpage form, then Officials, Agents or Third Party Officials creating and correlating an Internet Validation Session ID (IVALSID) created by Officials computers and devices and correlated to each particular connected Voter;

(d)(ii) Voters data entering a Validation RSID and optionally at least one or a plurality of correlated Validation PassCode(s) or a Ballot Voting RSID and correlated Voting PassCode on their local computer Internet Browser webpage form, then submitting and transmitting said webpage form and Ballot RSID and Ballot PassCode to the Internet Validation System (IVALS) for processing to at least one Official or Official Device or Official Agent or Agent Device;

(e)(i) IVALS receives correlates the IVALSID to the Ballot RSID submitted, records this information along with the Voter computer IP address, date and time;

(e)(ii) IVALS computer system employs computer running software programs and people to determine whether there have been statistically numerous RSID Masters from the Voter computer IP address for a given time period, and if so, communicates Denial Of Service (DOS) to the Voter and stops further processing upon detection of one or a plurality of Voter submitted false RSID's;

(e)(iii) whereby if there is no Denial of Service, the IVALS continues to determine whether the submitted Validation RSID or correlated Ballot Voting RSID is valid along with zero, one or a plurality of other Voting Session Official information items;

(e)(iv)(1) whereby if the Voter enters a Validation RSID that is determined to be valid, the Voter is shown Status information of the Ballot (Voted-OK, Voted-Error, ActiveVoting, Enabled2Vote, Disabled) correlated to the Validation RSID, but is not shown the Ballot Voting RSID, Ballot PassCode nor any Ballot selections of the Voter;

(e)(iv)(2) whereby if the Voter enters a Ballot Voting RSID that is determined to be valid, the Voter is shown Ballot Status information as well as the Ballot Validation RSID, Ballot Voting RSID, any Ballot selections made by the Voter;

(f)(i) whereby if the Voter enters a Ballot Voting PassCode RSID that is determined to be valid, and the Ballot Voting RSID has not been disabled, then the Enabled Voter receives the Validation RSID, Voter selections and zero, one or a plurality of other Voting Session Official information items associated with the Ballot Voting RSID for review that may be used for voting, excluding the Ballot Voting PassCode;

(f)(ii) whereby upon submitting a valid Ballot Voting RSID, the IVALS prompts the Voter, a limited number of times, to provide zero, one or a plurality of Ballot Voting PassCode(s) on a secure website form; said Ballot Voting PassCode is then compared to the Official Ballot Voting PassCode that is correlated to the Ballot Voting RSID; if said Voter provided PassCode matches the Official Ballot PassCode for the same Ballot Voting RSID then the Voter is granted access to the Internet Voting System (IVOTS) and the generated Voting WebPage correlated for the given Ballot Voting RSID;

(f)(iii) whereby zero, one or a plurality of Voting Session Official people and zero, one or a plurality of computers and/or other Official devices running software programs, determine whether the Ballot Voting PassCode provided is correlated to the Ballot Voting RSID of steps (5)(d)(ii) and said Officials allows processing to continue if they match;

(f)(iv) for each Voter and for a plurality of Voters attempting to submit a valid Ballot PassCode, the further steps and methods of IVALS counting and recording each Ballot PassCode submission attempt so as to determine, per Voter, whether the number of attempts to provide a Valid Ballot Voting PassCode has exceeded limitations, then if the number of attempts to provide a Valid Ballot Voting PassCode has exceeded limitations, the further steps of: temporarily disabling the Ballot, sending a message notifying the correlated Voter, signalling Officials, recording a change of Ballot status to Disabled with grounds of Exceeded PassCode Attempts;

(f)(v) the steps and methods for each Internet Ballot, of detecting, reporting, and stopping submission of Ballot RSIDs for Voting or Validation upon detecting not timely receiving the Ballot Voting RSID or Ballot Validation RSID being submitted to IVALS or IVOTS;

(f)(vi) if the Enabled Voter submitted Ballot Voting RSID has not already been cast, said Enabled Voter is connected to the Internet Voting System (IVOTS) which generates a unique Internet Voting Session Identifier IVOTSID with a date-time-stamp that are both correlated to the Ballot Voting RSID and zero one or a plurality of Ballot Validation RSID that are correlated to the Ballot Voting RSID; said Enabled Voter is then securely connected to an Official or Agent or Official Third Party provided Internet pre-Voting WebPage that provides the graphical and auditory options: Begin, Wait, Exit whereby: (1) for the choice of Exit, the Enabled Voter exits Internet Voting System (IVOTS) without disabling the Voting Ballot and Validation Ballot from future use and the Voter Status is set to Valid; (2) for the choice of Wait, IVOTS suspends the Enabled Voter Voting Session and displays a countdown timer on the webpage showing the time remaining to Begin or Exit the Voting Session, and if no choice is made before the countdown timer reaches zero then the Enabled Voter is automatically forced by IVOTS to exit Internet Voting System without disabling the Voting Ballot and Validation Ballot from future use and the Voter Status is set to Valid;

(3) for the choice of BeginVote:

(i) said Enabled Voter is connected by Official Voting Computer to the Internet Voting System (IVOTS) webpage;

(ii) a unique Internet Voting Session ID is generated, stored and associated with the Ballot Voting RSID provided by the Voter;

(iii) the IVOTS provides the Voter with at least one choices for any of:

(a) Candidates;

(b) areas to select, write, print or type Alternative Voter Candidates;

(c) Proposals;

(d) areas to select, write, print or type Alternative Voter Proposals;

(e) option to Abstain (decline) from Voting for Candidates, Proposals;

(f) related information items (web page data and hyperlinks to access, search and navigate each Candidate biographies, each Candidate political party affiliations and policies, each Proposals descriptions, current date, current time, time left until polling station closes, Internet connection information, Official devices information, Voter specific current voting session completion information, Voter specific Voter devices information, Voter specific Voting Session Security information, Voters, Proxy Voters, Official and Official Agents messages, status data, warnings, errors, events, pending actions (authorized, unauthorized, pending, completed, suspended, stopped, cancelled, outstanding, delayed);

(g) menus, links, audio and visual tools for navigating, searching and accessing each IVOTS Voting webpages and other related webpages;

(h) options for processing the IVOTS Voting webpage form and Voter selections: Submit, Reset, Pause, Save, Resume, Exit;

(i) options to store and communicate each Enabled Voter selections made and Submitted for processing: Download, Print, Internet Publish, Internet EMail, Telephone Voice Message, Telephone Text Message, Facsimile Message, Interactive Television Message;

(g)(i)(1) for each Enabled Voter and a plurality of Enabled Voters that chooses to Abstain from Voting for Candidates, the Candidates and Candidate Write-In portions are cleared of all Voter selections and the Candidates and Write-In Candidates portions of the IVOTS Voting Ballot webpage form is visually marked Abstained for the Voter to see, no selections are permitted in those portions, and the IVOTS detects and records the said Abstained portions as not being a voting error;

(g)(i)(2) for each Enabled Voter and a plurality of Enabled Voters that chooses to Abstain from Voting for Proposals, the Proposals and Proposals Write-In portions are cleared of all Voter selections and the Proposals and Write-In Proposals portions of the IVOTS Voting Ballot webpage form is visually marked Abstained for the Voter to see, no selections are permitted in those portions, and the IVOTS detects and records the said Abstained portions as not being a voting error;

(g)(ii) for each Enabled Voter and a plurality of Enabled Voters that completes and submits their Ballot selections of Candidates, Proposals, Write-In Candidates, Write-In Proposals:

(1) IVOTS software and zero one or a plurality of Officials or Official Devices or Official Agents detecting and identifying zero one or a plurality of errors on the aforesaid Submitted Ballot Voting form, then communicating those errors to the directly correlated Enabled Voter and in general to each Voter of a plurality of Enabled Voters;

(2) any number of Enabled Voters make any number of corrections, any number of times, until all Ballot Voting Selections of Candidates, Write-In Candidates, Write-In Proposals and Proposals are submitted without any significant, detectable error;

(3) zero one or a plurality of Enabled Voters, resubmits to IVOTS zero one or a plurality of amendments of their respective Ballot and zero one or a plurality of corrections for Candidate Selections, Write-In Candidates, Proposal Selections and Write-In Proposals;

(h)(i) for each Enabled Voter and plurality of Enabled Voters, if all of the said Ballot Selections and Enabled Voter Write-In choices submitted are processed successfully by IVOTS:

(1) a unique Ballot-Selection-Signature-Key is generated to precisely duplicate the Ballot selections made by the Voter;

(2) a unique IVOTS Receipt ID is generated, and then correlated to the IVOTS Session ID and further correlated to the Ballot Voting RSID and to any Ballot Validation RSID that is already correlated to the Ballot Voting RSID;

(3) the Voter is prompted by IVALS to provide their own Voter Privacy Key comprised of any combination of PassCode, PassWord, PassPhrase, Signature, Initials, Glyph, Symbols, Picture, Music, Song, Poem, Book or other personal validation reference to privately sign to enable Voter post-voting authentication and to enable secure encryption of each Voter specific Voting Session;

(4) for each Voter of a plurality of Voters, adding the Voter Ballot Selection Signature Keys to the Voter Privacy Key to form a Voter Privacy Record;

(5) encrypting the Voter Privacy Record using the Voter Privacy Key items as private variables in an encryption algorithm provided or selected by the Voter or using an Encryption Algorithm provided by IVOTS or from a Third Party to create an Encrypted Voter Privacy Record;

(6) redundantly storing the IVOTS Receipt ID, Session ID, Ballot Voting RSID, Ballot Voting PassCode, Ballot Validation RSID, Ballot Selections, Encrypted Voter Privacy Record, date, time, unique Location Identifier, unique Official Device Identifier, and zero one or a plurality of other related information items as the BallotCast Record in at least one Official BallotCast Data Structure;

(7) securely transmitting to each Enabled Voter computer browser, an exact copy of their cast Ballot, rendered on the Voter computer internet browser;

(8) IVOTS allows the Enabled Voter to download a copy of their Voter BallotCast Record, typically via a link to download a PDF file that is optionally encrypted with another Voter provided BallotVote PDF Privacy Key; said copy file is certified a true copy and digitally signed by IVOTS;

(9) optionally IVOTS provides an internet link to a secure Voter provided password encrypted BallotCast webpage that when decrypted displays an exact copy of the Voter Ballot, Selections and Write-In Choices and components of the Ballot Cast Record of prior step (v); said BallotCast webpage may be separately provided by an Official Third Party, and may be restricted only to Eligible Voters; said webpage may optionally embed the Ballot Voting RSID as part of the Internet Universal Resource Locator webpage address used to locate and access the encrypted BallotCast webpage; said encrypted BallotCast webpage may also contain or be preceded by a webpage that contains a data input field for the Voter to provide their Voter Privacy Key, and to select or provide the correlated Encryption Algorithm that was used to encrypt their Voter Privacy Record so that when both said Key and Algorithm are provided and the Voter selects a webpage control button to start decryption, the webpage software initiates a computer to run software programs to use said Key and Algorithm to perform decryption of the encrypted Voter Privacy Record, which is displayed in the computer browser with an exact copy of the cast Voting Ballot when decryption succeeds;

(10) using the unique, private Ballot RSID as part of an Internet address to organize and privately store each Voter BallotCast webpage, and a plurality of Voter BallotCast webpages;

(11) further steps and methods of securely transmitting the Ballot Cast Record to any number of: Enabled Voters, Election Officials, Political Parties, Candidates, News Media, Government Officials, and zero one or a plurality of other approved third parties and Official Agents for processing actions, verification, authentication, error detecting, error correcting, publishing and auditing;

(12) Officials, IVOTS, or an Official Third Party creating, publishing and continually updating a publicly accessible Internet webpage that displays summaries of BallotCast voting with Voting Ballot RSID and tallies of correlated Voter selections and write-in choices that are sorted by Voting Region, Voting Area, Voting Area Polling Station Identifier; Officials, IVOTS and zero one or a plurality of Official Agents or Third Parties sharing and transmitting exact copies of said BallotCast Summary webpage to at least one Voters, non-Voters, Election Officials, Political Parties, Candidates, News Media, Government Officials, and any other interested third parties for processing actions, verification, authentication, error detecting, error correcting, publishing and auditing;

(g)(ii)(1) creating and then transmitting zero one or a plurality of Official Receipt Confirmation Documents to each Enabled Voter and a plurality of Enabled Voters either electronically, using methods of secure Universal Resource Locator (URL) webpage accessible by Ballot ID and Ballot PassCode or Voter ID and Voter PassWord, and optionally by sending a confirmation EMail to each Voter provided EMail, and optionally by sending a confirmation Fax or Facsimile to the Voter specified Fax or Facsimile machine telephone number, and optionally by text messaging a confirmation message to each Voter provided cellular phone device or tablet or computer or other communications devices), and by any using any other POEM format, and by Officials or their delegates providing to a plurality of Voters at least one certified, verifiable Receipt Documents to each Enabled Voter who has successfully submitted their validated Ballots in person or electronically or by any using any other POEM format or method;

(g)(ii)(2) and the further optional steps and methods of using the unique, private Ballot RSID as part of an Internet address to organize and privately store each Voter webpage, as well as all actions, tallies and summaries of Voter selections;

(g)(iii) for a plurality of Enabled Voters and Enabled Proxy Voters, Officials providing at least one POEM Voting Receipt to each said Voter or Proxy Voter whom successfully casts their Ballot, whereby said POEM Receipt is rendered to the Voter in the format deliverable according to the Voter interactive device; said POEM Voting Receipt data comprises of Voting Session Identifier, Voting Session Descriptors (FIG. 25—item 1A,1B, 1C), Voter POEM Session Type (FIG. 25—item 2A), Ballot Voting RSID (FIG. 25—item 2B) with correlated Ballot Voting RSID barcode (FIG. 25—item 2C) having a unique numeric value correlated to the Ballot Voting RSID, Voting Location Descriptors (FIG. 25—item 3A,3B) and Voting Location Identifier (FIG. 25—item 3C), PostalZipCode Identifier (FIG. 25—item 3D), and Polling Station Identifier (FIG. 25—item 3E), Official Duty Title (FIG. 25—item 4A, 5A), Voter Selected Candidates (FIG. 25—item 4B2, 5B2, 5C2) and correlated Candidate Identifier (FIG. 25—item 4B1, 5B1, 5C1), Proposal Heading (FIG. 25—item 6A), Voter Selected Proposals (FIG. 25—item 6B2, 6C2) and correlated Proposal Identifier (FIG. 25—item 6B1, 6C1), and correlated Voter Proposal Vote Voter Selected Candidates (FIG. 25—item 4B2, 5B2, 5C2) and correlated Candidate Identifier (FIG. 25—item 6B3, 6C3), Official Ballot Casting DateTimeStamp (FIG. 25—items 7A1, 7A2), Voter Candidate Selection Signature (FIG. 25—item 8A1) concatenated to the front of the Voter Proposal Selection Signature (FIG. 25—item 8A2) with a combined alpha-numeric value that is correlated to the barcode of FIG. 25—item 8A3, POEM Voting Session Receipt Identifier having a unique alpha-numeric value (FIG. 25—item 9A1) for this Voting Session Receipt Document that is correlated to the barcode of FIG. 25—item 9A2, and POEM Voting Session Validation Identifier having a unique alpha-numeric value (FIG. 25—item 10A1) for the originating Official Voter Validation Session that permitted the Ballot to be cast and is correlated to the barcode of FIG. 25-item 10A2; and further whereby aforesaid data is correlated to other hidden, unprinted Official data that is recorded and stored at the time the ballot is cast;

and (h)(i) the further steps of applying any of the aforementioned steps and methods, actions, data or results zero one or a plurality of times, to each Ballots, Voters, Officials, or other legal entities;

(h)(ii) modifying aforesaid steps and methods to enable Voter Registration via Internet;

(h)(iii) and further modifying of aforesaid methods to enable Validation, Error Reporting and Amendments of Voter Registration, Ballots, Proxy Assignment, Voter Contact Updates, Proxy Contact Updates, Voter Active-Inactive, Proxy Active-Inactive, Voter Ballot Complaints, Voter Registration Complaints—all via the Internet Voting WebPages provided by Officials, IVOTS, and Official Agents, Official Third Parties;

(G) steps and methods of Telephone Voting, Registration, Validation, Error Reporting, Amendments whereby:

(1) each of a plurality of Voters and Proxy Voters using their Telephone for connecting to the public Internet directly or to a third party Telephone Communications System thereafter to at least one other Official or Agent Internet Communications devices or Telephone Communications devices thereafter connecting to at least one Official Internet Voting Website or Official Telephone Communication System that is optionally secured from unauthorized manipulation by each Voter, Proxy Voter or Official, Agent, Voting System Device;

(2) said connection between Voter and Officials Internet Voting Website or Official Telephone Communication System may optionally be providing security and anonymity via a Virtual Private Network (VPN) connection or Double Virtual Private Network Connection (DVPN) or multi-layered TOR (The Onion Router) Network that is provided by a Third Party or Official Network Devices and Official Computers running Virtual Private Network software programs; and the further optional steps and methods of Voters hiding the originating Internet Address and Telephone Identifier by running software programs to hide that said originating Internet Address and Telephone Identifier information by connecting to an anonymizing proxy server before connecting to an Official provided VPN or DVPN connection;

(3) for each of a plurality of Voters and Proxy Voters whose Telephones are connecting to the public Internet directly or to a third party Telephone Communications System thereafter to at least one other Official or Agent Internet Communications devices or Telephone Communications devices thereafter to at least one of a plurality of Officials, Agents and Official Devices thereafter modifying and applying the aforesaid steps and methods of: Internet Voting, Mail In Voting, email Voting whereby said Officials, Agents, Official Devices actively:

(a) Creating, Generating and Issuing, (b) Receiving and Reading, (c) Verifying and Authenticating, (d) Verifying and Validating, (e) Processing and Registering or Rejecting, (f) Error Detecting, (g) Error Reporting, (h) Error Correcting (i) Amending, (j) Cancelling and Revoking, (k) Reaffirming and Reinstating, (l) Tallying, Calculating and Certifying, (m) Researching, Summarizing, Reporting and Publishing, of at least one of a plurality of the Master & Receipt parts of each type of Documents:

(i) Official Registration, Official Agent Registration, Official Devices Registration;

(ii) Voter Registration Documents: (iii) Language Selections Documents;

(iv) Ballot Documents: (v) Voting Transaction Documents (vi) Error Report Documents, (vii) Ballot Issuing and Processing Documents, (viii) Registration Issuing and Processing;

(ix) Replacement Ballot Requests Processing, (x) Language Selection Processing And the further steps and methods of for creating Documents of Researching, Issuing, Delivery, Receiving, Reading, Processing, Verification, Validation, Authentication, Certification, Transactions, Activity, Tallying, Summarizing, Reporting for each and a plurality of Voters, Proxy Voters, Officials, Agents, Voting Session Devices:

(i) Registrations (ii) Ballots (iii) Voting and Ballot Casting;

(iv) Language Selections (v) Errors; (vi) Communications (vii) Security;

(4) and for each aforesaid Registration Documents, Ballot Documents, Language Selection Documents, and every other Document of this invention that is created and issued for each Voter, Proxy Voter, Official, Agent, Voting Session Device, the further steps and methods of: Rendering, Scanning, Reading and Processing of each of a plurality of said Documents, whereby said Rendering, Scanning, Reading and Processing includes therein each said Documents Respective Data comprised of: Data Fields, Barcodes, QR Codes, Security Elements, Personal Security Elements, Date, Due Date, Time, Location, Region, Zone, Polling Station, Document Selections, Document Write-In Choices, Random Symbolic Identifiers, PassCodes, Transaction Identifiers, Receipt Identifiers, and any other visible and hidden Document data elements and identifiers, security elements, any officials, agents, official devices, agent devices data elements and identifiers, any other voting system identifiers;

(5) and for each said Document and for each said Document Respective Data:

(a) the step of at least one Official, Agent or Voting System Device generating an exact Replica Image Document that is embedded with its unique Respective Data and Security Elements that are intended for that specific Voter or Proxy Voter;

(b) encoding & transmitting said Replica Image Document over the chosen telephone communication system to the specified and intended Voter or Proxy Voter;

(c) each intended Voter or Proxy Voter receiving said encoded Replica Image Document to the Telephone of said Voter or Proxy Voter;

(d) each Voter or Proxy Voter or their Telephone using software to decode said encoded Replica Document Image;

(e) each Voter or Proxy Voter or their Telephone running software programs for rendering the exact Replica Image Document on their Telephone visual graphical user interface (GUI);

(f) each Voter or Proxy Voter using their Telephone graphical user interface and running software programs to further modify the received Replica Image Document by making pre-defined Document item selections, to provide write-in choices or alternative selections, voter or proxy voter personal security identifiers, data entering any other Voter Input Data, as well as to use the running software programs intrinsic menu choices so as to apply validation processing, processing choices, error processing choices, submission choices for each Replica Image Document for each Voter or Proxy Voter, and for a plurality of Voters and a plurality of Proxy Voters;

(g) each Voter or Proxy Voter using their Telephone graphical user interface and running software programs to transmit to at least one Official, Agent or Voting Session Device each said Replica Image Document with their specified pre-defined Document item selections, write-in choices or alternative selections, voter or proxy voter personal security identifiers, Voter Input Data;

(h) at least one Official, Agent or Voting Session Device using computers and telephones running software programs and using the Official Telephone System, Official Internet System or Official Email System and optionally any security and privacy networks for receiving from at least one Voter or Proxy Voter each said Replica Image Document with their specified pre-defined Document item selections, write-in choices or alternative selections, voter or proxy voter personal security identifiers, Voter Input Data;

(i) for each received Replica Image Document, at least one Official, Agent or Voting Session Device using computers and telephones running software programs detecting the correct Replica Image Document submission format processing method (physical, email, internet) then choosing and applying the correct steps and methods used for processing the rendered scanned image used the previously described methods applied for physical mail-in documents or email submitted documents or internet submitted documents which are then applied for reading, authenticating, validating, verifying, processing, error detecting, error reporting, error investigating, error correcting, record amending, certifying, tallying, summarizing, reporting and publishing of said received Replica Image Document;

(j) applying the aforesaid steps and methods for each of a plurality of Replica Document Images, Voters, Proxy Voters, Official, Agents, Voting Session Devices;

(6) otherwise, for regular audio-only telephone methods, the following steps and methods apply whereby:

(a) at least one Voters or Proxy-Voter uses a telephone to connect to the Telephone Validation System (TVALS) managed by a plurality of Officials, Agents, Official Third Parties;

(b) Official computers, telephones and other devices running software programs creates a unique Telephone Validation Session Identifier (TELVALSID) that is correlated to each connected Telephone Session;

(c) for each active Telephone Session, a Telephone Recording Session is created for each Official Recording Device that is started; a Telephone Recording Session Identifier (TELVALRID) is created and correlated to the Telephone Recording Session and the related Telephone Validation Session Identifier;

(d) at least one Official computers running software programs obtains and utilizes any number of authentication certificates from at least one Identity Certificate Authorities that are then correlated to the TELVALSID;

(e) at least one Official computers, telephone or other devices running software programs optionally determine the Voter Telephone Number to detect issues excessive guessing of Ballot RSIDs and Passcodes;

(f) the Voter uses the telephone keypad, verbally words, or any other acceptable methods to navigate through at least one menus and menu options to interact with the Telephone validation menu;

(g) each Voter then uses an approved method (keypad tones, verbal words, text message, graphical touch-activated interface, menu option selections) to enter a Ballot Validation RSID or Ballot Voting RSID;

(h) the TELVALS records the Ballot RSID and correlates it to the TELVALSID, with the date, time, Official Telephone Device ID and optionally, the Voter telephone number when available;

(i) TELVALS then determines whether any statistically significant inhibitory issues are related to the Voter telephone number or Ballot RSID provided, and if so, then communicates Denial Of Service to the Voter; otherwise, (j)(i) TVALS processing determining whether the Ballot Validation RSID or correlated Ballot Voting RSID are valid and still usable for voting, processing any other essential information;

(j)(ii) Voters using their telephone keypad for data entering a Validation RSID and Validation PassCode or a Ballot Voting RSID and Voting PassCode, thus transmitting said Ballot RSID and Ballot PassCode to the Telephone Validation System (TELVALS) for processing;

(j)(iii) TELVALS receives and correlates the TELVALSID to the submitted Ballot RSID, recording this information along with the Voter computer IP address, date and time and Official Telephone Device ID and Voter Telephone Number when available;

(j)(iv) the TELVALS computer system employs computers running software programs and zero, one, or a plurality of people to determine whether there have been statistically numerous RSID Masters from the Voter Telephone Number for a given time period, and if so, communicates Denial Of Service (DOS) to the Voter and stops further processing of any Voter submitted false RSID's for zero, one or a plurality of Voters;

(k)(v) whereby if there is no Denial of Service, the TELVALS continues to determine whether the submitted Validation RSID or correlated Ballot Voting RSID is valid along with any other information items;

(k)(vi)(1) whereby if the Voter enters a Validation RSID that is determined to be valid, the Voter is told Status information of the Ballot (Voted-OK, Voted-Error, ActiveVoting, Enabled2Vote, Disabled) correlated to the Validation RSID, but is not told the Ballot Voting RSID, Ballot PassCode nor any Ballot selections of the Voter;

(k)(vi)(2) whereby if the Voter enters a Ballot Voting RSID that is determined to be valid, the Voter is told Voting Ballot Status information as well as the Ballot Validation RSID, Ballot Voting RSID, any Ballot selections made by the Voter;

(l)(i) whereby if the Voter enters a Ballot Voting PassCode RSID that is determined to be valid, and the Ballot Voting RSID has not been disabled, then the Enabled Voter is told the Validation RSID, Voter selections and any number of other information items associated with of the Ballot Voting RSID for review that may be used for voting, excluding the Ballot Voting PassCode;

(l)(ii) whereby upon submitting a valid Ballot Voting RSID, the IVALS prompts the Voter, a limited number of times, to provide zero, one or a plurality of Ballot Voting PassCode(s); said Ballot Voting PassCode is then compared to the Official Ballot Voting PassCode that is correlated to the Ballot Voting RSID; if said Voter provided PassCode matches the Official Ballot PassCode for the same Ballot Voting RSID then the Voter is granted access to TELVOTS and the correlated Telephone Voting Record generated for that specific Ballot Voting RSID;

(l)(iii) whereby zero, one or a plurality of Official people and zero, one or a plurality of computers, telephones or other devices running software programs, determine whether the Ballot Voting PassCode provided is correlated to the Ballot Voting RSID provided earlier and allows processing to continue if they do match;

(l)(iv) for each Voter and for a plurality of Voters attempting to submit a Valid Ballot PassCode, the further steps and methods of TELVALS counting and recording each Valid Ballot PassCode submission attempt so as to determine, per Voter, whether the number of attempts to provide a Valid Ballot Voting PassCode has exceeded limitations, then if the number of attempts to provide a Valid Ballot Voting PassCode has exceeded limitations, the further steps of: temporarily disabling the Ballot, sending a message notifying the correlated Voter, signalling Officials, recording a change of Ballot status to Disabled with grounds of Exceeded PassCode Attempts;

(l)(v) the steps and methods for each Internet Ballot, of detecting, reporting, and stopping submission of Ballot RSIDs for Voting or Validation upon detecting not timely receiving the Ballot Voting RSID or Ballot Validation RSID being submitted to TELVALS or TELVOTS;

(l)(vi) if the Enabled Voter submitted Ballot Voting RSID has not already been cast, said Enabled Voter is connected to the Telephone Voting System (TELVOTS) which generates a unique Telephone Voting Session Identifier (TELVOTSID) with a date-time-stamp that are both correlated to the Ballot Voting RSID and zero, one or a plurality of Ballot Validation RSID that are correlated to the Ballot Voting RSID; said Enabled Voter is then securely connected to an Official or Agent or Official Third Party provided Telephone pre-Voting Recorder that provides the graphical and auditory options: Begin, Wait, Exit whereby: (1) for the choice of Exit, the Enabled Voter exits the Telephone Voting System (TELVOTS) without disabling the Voting Ballot and Validation Ballot from future use and the Voter Status is set to Valid; (2) for the choice of Wait, TELVOTS suspends the Enabled Voter Voting Session and starts an audible countdown timer that states at regular intervals, the time remaining to Begin or Exit the Voting Session, and if no choice is made before the countdown timer reaches zero then the Enabled Voter is automatically forced by TELVOTS to exit the Telephone Voting System without disabling the Voting Ballot and Validation Ballot from future use and the Voter Status is set to Valid;

(3) for the choice of BeginVote:

(i) said Enabled Voter is connected by Official Voting Computer to the Telephone Voting System (TELVOTS) webpage;

(ii) a unique Internet Voting Session ID is generated, stored and associated with the Ballot Voting RSID provided by the Voter;

(iii) the TELVOTS audibly provides the Voter with any choices of:

(a) Candidates;

(b) areas to select or speak any number of Alternative Voter Candidates;

(c) Proposals;

(d) areas to select or speak any number of Alternative Voter Proposals;

(e) option to Abstain (decline) from Voting for Candidates, Proposals;

(f) related information items (audible data and audio-links to search, navigate and access each Candidate biographies, each Candidate political party affiliations and policies, each Proposals descriptions, current date, current time, time left until polling station closes, connection information, Official devices information, Voter specific current voting session completion information, Voter specific Voter devices information, Voter specific Voting Session Security information, Voters, Proxy Voters, Official and Official Agents messages, status data, warnings, errors, events, pending actions (authorized, unauthorized, pending, completed, suspended, stopped, cancelled, outstanding, delayed);

(g) menus, audio links, audio tools for navigating and searching TELVOTS Voting audio data pages;

(h) options for processing the TELVOTS Voting audio recording and correlated Voter selections: Submit, Reset, Pause, Save, Resume, Exit;

(i) audio command options to store and communicate each Enabled Voter Ballot selections made and Submitted for processing: Download, Print, Internet Publish, Internet EMail, Telephone Voice Message, Telephone Text Message, Facsimile Message, Interactive Television Message;

(m)(i)(1) for each Enabled Voter and a plurality of Enabled Voters that chooses to Abstain from Voting for Candidates, the Candidates and Candidate Write-In portions are cleared of all Voter selections and the Candidates and Write-In Candidates portions of the IVOTS Voting Ballot webpage form is visually marked Abstained for the Voter to see, no selections are permitted in those portions, and the IVOTS detects and records the said Abstained portions as not being a voting error;

(m)(i)(2) for each Enabled Voter and a plurality of Enabled Voters that chooses to Abstain from Voting for Proposals, the Proposals and Proposals Write-In portions are cleared of all Voter selections and the Proposals and Write-In Proposals portions of the IVOTS Voting Ballot webpage form is visually marked Abstained for the Voter to see, no selections are permitted in those portions, and the TELVOTS detects and records the said Abstained portions as not being a voting error;

(m)(ii) for each Enabled Voter and a plurality of Enabled Voters that completes and submits their Ballot selections of Candidates, Proposals, Write-In Candidates, Write-In Proposals using keypad menu selections or voice commands;

(1) TELVOTS software and zero, one or a plurality of Officials, Official Agents, Official Devices detecting and identifying any number of errors on the aforesaid Submitted Ballot Voting form then communicating those errors to the directly correlated Enabled Voter and in general to each Voter of a plurality of Enabled Voters;

(2) zero, one or a plurality of Enabled Voters make zero, one or a plurality of corrections, until all Ballot Voting Selections of Candidates, Write-In Candidates, Write-In Proposals and Proposals may be submitted without error using voice commands or by telephone or computer keypad selections;

(3) zero, one or a plurality of Enabled Voters, resubmits zero, one or a plurality of times to TELVOTS their respective Ballot and any corrections for Candidate Selections, Write-In Candidates, Proposal Selections and Write-In Proposals;

(n)(i) for each Enabled Voter and plurality of Enabled Voters, if all of the said Ballot Selections and Enabled Voter Write-In choices submitted are processed successfully by TELVOTS:

(1) a unique Ballot-Selection-Signature-Key is generated to precisely duplicate the Ballot selections made by the Voter;

(2) a unique TELVOTS Receipt ID is generated, and then correlated to the TELVOTS Session ID and further correlated to the Ballot Voting RSID and to any Ballot Validation RSID that is already correlated to the Ballot Voting RSID;

(3) the Voter is prompted by TELVOTS to provide their own Voter Privacy Key comprised of any combination of PassCode, PassWord, PassPhrase, Music, Song, Poem, or other personal validation audio reference to privately sign to enable Voter post-voting authentication and to enable secure encryption of each Voter specific Voting Session;

(4) for each Voter of a plurality of Voters, adding the Voter Ballot Selection Signature Keys to the Voter Privacy Key to form a Voter Privacy Record;

(5) encrypting the said Voter Privacy Record using the Voter Privacy Key items as private variables in an encryption algorithm provided or selected by the Voter or using an Encryption Algorithm provided by TELVOTS or from a Third Party to create an Encrypted Voter Privacy Record;

(6) redundantly storing the TELVOTS Receipt ID, Session ID, Ballot Voting RSID, Ballot Voting PassCode, Ballot Validation RSID, Ballot Selections, Encrypted Voter Privacy Record, date, time, unique Location Identifier, unique Official Device Identifier, and zero, one or a plurality of other related information items as the BallotCast Record in at least one Official BallotCast Data Structure;

(7) securely transmitting to each Enabled Voter, an exact copy of their cast Ballot;

(8) TELVOTS allows the Enabled Voter to fax or email a copy of their Voter BallotCast Record, typically a PDF file that is optionally encrypted with another Voter provided BallotVote PDF Privacy Key; said copy file is certified a true copy and digitally signed by TELVOTS;

(9) optionally TELVOTS provides an internet link to a secure Voter provided password encrypted BallotCast webpage that when decrypted displays an exact copy of the Voter Ballot, Selections and Write-In Choices and components of the Ballot Cast Record; said BallotCast webpage may be separately provided by an Official Third Party, and may be restricted only to Eligible Voters; said webpage may optionally embed the Ballot Voting RSID as part of the Internet Universal Resource Locator webpage address used to locate and access the encrypted BallotCast webpage; said encrypted BallotCast webpage may also contain or be preceded by a webpage that contains a data input field for the Voter to provide their Voter Privacy Key, and to select or provide the correlated Encryption Algorithm that was used to encrypt their Voter Privacy Record so that when both said Key and Algorithm are provided and the Voter selects a webpage control button to start decryption, the webpage software initiates a computer to run software programs to use said Key and Algorithm to perform decryption of the encrypted Voter Privacy Record, which is displayed in the computer browser with an exact copy of the cast Voting Ballot when decryption succeeds;

(10) using the unique, private Ballot RSID as part of an Internet address to organize and privately store each Voter BallotCast webpage, and a plurality of Voter BallotCast webpages;

(11) further steps and methods of securely transmitting the Ballot Cast Record zero, one or a plurality of: Enabled Voters, Election Officials, Political Parties, Candidates, News Media, Government Officials, Agents, and approved third parties for processing actions, verification, authentication, error detecting, error correcting, publishing and auditing;

(12) Officials, TELVOTS, or an Official Third Party creating, publishing and continually updating a publicly accessible Internet webpage that displays summaries of BallotCast voting with Voting Ballot RSID and tallies of correlated Voter selections and write-in choices that are sorted by Voting Region, Voting Area, Voting Area Polling Station Identifier; Officials, TELVOTS and zero, one or a plurality of Official Third Parties sharing and transmitting exact copies of said BallotCast Summary webpage to zero, one or a plurality of Voters, non-Voters, Election Officials, Political Parties, Candidates, News Media, Government Officials, and any zero, one or a plurality of other interested third parties for processing actions, verification, authentication, error detecting, error correcting, publishing and auditing;

(g)(ii)(1) creating and then transmitting zero, one or a plurality of Receipt Confirmation Documents to each Enabled Voter and a plurality of Enabled Voters either electronically, using methods of secure Universal Resource Locator (URL) webpage accessible by Ballot ID and Ballot PassCode or Voter ID and Voter PassWord, and optionally by sending a confirmation EMail to each Voter provided EMail, and optionally by sending a confirmation Fax or Facsimile to the Voter specified Fax or Facsimile machine telephone number, and optionally by text messaging a confirmation message to each Voter provided cellular phone device or tablet or computer or other communications devices), and by any using any other POEM format, and by Officials or their delegates providing to a plurality of Voters at least one certified, verifiable Receipt Documents to each Enabled Voter who has successfully submitted their validated Ballots in person or electronically or by any using any other POEM format or method;

(g)(ii)(2) and the further optional steps and methods of using the unique, private Ballot RSID as part of an Internet address to organize and privately store each Voter webpage, as well as all actions, tallies and summaries of Voter selections;

(g)(iii) for a plurality of Enabled Voters and Enabled Proxy Voters, Officials providing at least one POEM Voting Receipt to each said Voter or Proxy Voter whom successfully casts their Ballot, whereby said POEM Receipt is rendered to the Voter in the format deliverable according to the Voter interactive device; said POEM Voting Receipt data comprises of Voting Session Identifier, Voting Session Descriptors (FIG. 25—item 1A,1B, 1C), Voter POEM Session Type (FIG. 25—item 2A), Ballot Voting RSID (FIG. 25—item 2B) with correlated Ballot Voting RSID barcode (FIG. 25—item 2C) having a unique numeric value correlated to the Ballot Voting RSID, Voting Location Descriptors (FIG. 25—item 3A,3B) and Voting Location Identifier (FIG. 25-item 3C), PostalZipCode Identifier (FIG. 25—item 3D), and Polling Station Identifier (FIG. 25-item 3E), Official Duty Title (FIG. 25—item 4A, 5A), Voter Selected Candidates (FIG. 25—item 4B2, 5B2, 5C2) and correlated Candidate Identifier (FIG. 25—item 4B1, 5B1, 5C1), Proposal Heading (FIG. 25—item 6A), Voter Selected Proposals (FIG. 25—item 6B2, 6C2) and correlated Proposal Identifier (FIG. 25—item 6B1, 6C1), and correlated Voter Proposal Vote Voter Selected Candidates (FIG. 25—item 4B2, 5B2, 5C2) and correlated Candidate Identifier (FIG. 25—item 6B3, 6C3), Official Ballot Casting DateTimeStamp (FIG.

25—items 7A1, 7A2), Voter Candidate Selection Signature (FIG. 25—item 8A1) concatenated to the front of the Voter Proposal Selection Signature (FIG. 25—item 8A2) with a combined alpha-numeric value that is correlated to the barcode of FIG. 25—item 8A3, POEM Voting Session Receipt Identifier having a unique alpha-numeric value (FIG. 25—item 9A1) for this Voting Session Receipt Document that is correlated to the barcode of FIG. 25—item 9A2, and POEM Voting Session Validation Identifier having a unique alpha-numeric value (FIG. 25—item 10A1) for the originating Official Voter Validation Session that permitted the Ballot to be cast and is correlated to the barcode of FIG. 25-item 10A2; and further whereby aforesaid data is correlated to other hidden, unprinted Official data that is recorded and stored at the time the ballot is cast;

and (h)(i) the further steps of applying zero, one or a plurality of the aforementioned steps and methods, actions, data or results zero, one or a plurality of times, to zero, one or a plurality of Ballots, Voters, Officials, or other legal entities, by zero, one or a plurality of Voters, Officials or other entities;

(h)(ii) modifying aforesaid steps and methods to enable Voter Registration via Internet;

(h)(iii) further modifying of aforesaid methods to enable Validation, Error Reporting and Amendments of Voter Registration, Ballots, Proxy Assignment, Voter Contact Updates, Proxy Contact Updates, Voter Active-Inactive, Proxy Active-Inactive, Voter Ballot Complaints, Voter Registration Complaints—all via the Internet Voting WebPages provided by Officials, TELVOTS, and zero, one or a plurality of Official Agents, Official Third Parties;

(i)(1) further modifying aforesaid TELVOTS and TELVALS steps methods to enable Voter Registration via Telephone; and other further modifying of aforesaid TELVALS and TELVOTS steps and methods so as to enable Validation, Error Reporting and Amendments of Voter Registration, Ballots, Proxy Assignment, Voter Contact Updates, Proxy Contact Updates, Voter Active-Inactive, Proxy Active-Inactive, Voter Ballot Complaints, Voter Registration Complaints—all via Telephone;

(f) the Voter uses the telephone keypad, verbally words, or any other acceptable methods to navigate through zero, one or a plurality of menus and zero, one or a plurality of menu options to interact with the validation menu;

(g) each Voter then uses an approved method (keypad tones, verbal words, text message menu option selections) to enter a Ballot Validation RSID or Ballot Voting RSID and zero, one or a plurality of correlated Ballot PassCode(s)—whereby non-numeric characters within said Ballot Validation RSID, Ballot Voting RSID and Ballot PassCode are correlated to telephone keypad assignments or, for every character at each position of the RSID are consistently correlated to a pre-assigned limited set of symbols such as alphabetic-numeric characters (example: RSID position-1 limited to set of numbers 0 to 9, or alphabet uppercase characters A to Z but omitting similar letters O, I, Q and all lowercase alphabet characters, thereafter each acceptable 0 to 9 numbers and included uppercase A to Z characters are each consistently correlated to telephone keypad numeric values 1, 2, 3, 4, 5, 6, 7, 8, 9 or 0); further each Voter optionally submits additional information such as consistently entering the # or * symbol before or after each RSID symbol so as to explicitly define which RSID symbol is meant to be entered (eg 2=2, *2=A, 2=B, *2=C or 2#=2, 2*=A, 2=B, 2*=C or 2=2, *2=A, #2=B, 2*#=C, 2#*=C or 2=2, 2*=A, 2#=B, 2*#=C, 2#*=C) thus never enabling remote guessing by relying on RSID uniqueness and RSID value spacing and unique correlated PassCode to inferentially define limits of viable search results; or, alternatively, to reduce the number of extra Identifier #, * symbols to specify within each RSID, instead constructing each Validation RSID, Voting RSID, PassCode and any other type of RSID to only use a pre-assigned set of ten alphabet symbols that are consistently correlated to the set of numbers zero to nine, thus implicitly limiting the telephone keypad possibilities for each RSID position value (eg 2 keypad can be 2 or A, limited keypad entry set thus 2=2 or *2=A or #2=A); further assigning a last entry correction unique telephone keypad symbol sequence (eg ** or ## or *#); for a plurality of RSIDs of any type further enabling review and correction of each RSID symbol by entering the RSID symbol position numeric value then the new value, or, entering the RSID symbol position numeric value, unique combination of separator symbol(s) (eg ** or ## or *#), then the new value; further assigning a unique termination sequence of symbols (eg ** or ## or *#) and zero, one or a plurality of optional smartphone enabled keyboard keys and zero, one or a plurality of voice commands to denote actual letters, number and symbols as well as for any start and conclusion of corrections and RSID entry;

(h) the TELVALS records each alpha-numeric value submitted for the RSID and then correlates the complete RSID to the TELVALSID with the date, time and optional Voter telephone number; said submitted RSID is then decompressed, decoded and decrypted, further removing any administrative symbols, organizational symbols, meta-data symbols, error detecting symbols, error correcting symbols, security symbols and binary data bits used to ensure the integrity of the initial core RSID within the submitted RSID;

(i) Official TELVALS then determines whether any statistically significant issues are related to the Voter telephone number or RSID provided, and if so, then communicates Denial Of Service to the Voter and terminates the connection; otherwise:

(j) TELVALS proceeds to determine whether the Ballot Validation RSID and correlated Ballot Validation PassCode or correlated Ballot Voting RSID are valid, along with zero, one or a plurality of other information items of the Voter Registration, limits of use portion of the Ballot and of the current active Voting Session;

(k) whereby if the Voter enters only a Ballot Validation RSID that is determined to be valid, the Voter is informed of the Status information of the Ballot that is correlated to the Ballot Validation RSID, but is not informed of the Ballot Voting RSID, Ballot Voting PassCode, nor any Ballot selections made by the Voter;

(l) whereby if the Voter enters a Ballot Voting RSID that is determined to be valid, the Voter is informed of the Status information of the Voting Ballot as well the status of zero, one or a plurality of correlated Ballot Validation RSIDs, and may then be redirected to the Telephone Voting System (TELVOTS) if authorized by the Voting Session Rules or by Officials of the Voting Session;

(m) when the Voter provides a valid Ballot Validation RSID and zero, one or a plurality of correlated Ballot Validation PassCodes, the Voter is given the option to vote via telephone such that upon selecting the choice NOT VOTING, the Voter then exits the Telephone Validation System and the Validation RSID remains enabled for Voting later; otherwise, on selecting BEGIN VOTE, the Voter is connected to the Telephone Voting System and then is either asked to provide a Ballot Voting RSID and zero, one or a plurality of Ballot Voting PassCodes or the TVALS generates a Ballot Voting RSID and Ballot Voting PassCode that are revealed to the Voter after successfully completing and casting their Ballot to enable them to locate and access their Ballot later, or is revealed when the Voter declines to cast their Ballot or otherwise spoils their Ballot to disable their Ballot tallying;

(n)(1) upon being connected to the Telephone Voting System TELVOTS, a unique Telephone Voting Session Identifier (TELVOTSID) is automatically created and correlated to the Telephone Validation Session and the Eligible Voter status becomes Active Voter;

(n)(2) TELVOTS or zero, one or a plurality of Active Voters obtains and utilizes zero, one or a plurality of:

(i) Virtual Private Network connections to create a secure private connection between TELVOTS and the Active Voter; (ii) Identity Authentication certificates from zero, one or a plurality of certificate authorities that are then correlated to the TELVOTSID and applied by the TELVOTS computers and software and the Active Voters telephone device and software to authenticate the Active Voter or Voting Session;

(o) zero, one or a plurality of recording devices are automatically connected and record the Telephone Voting Session; and (p) optionally, the Voter Telephone Number Detection software is applied to detect any issues of excessive RSID guessing and attempted security breaches emanating from any Telephone;

(q) each Active Telephone Voter uses their telephone keypad, smartphone activated keyboard, verbally words, or any other acceptable methods to navigate through zero, one or a plurality of menus and zero, one or a plurality of menu options to interact with the validation menu;

(r)(1) TELVALS prompts the Active Voter, a limited number of times, to provide the correlated Ballot PassCode so as to enable the Active Voter to access the correlated Voting Ballot;

(r)(2) when the Active Voter uses an input device to provide a potentially valid Voting PassCode that may be correlated to the Ballot Voting RSID, zero, one or a plurality of Officials determine whether the number of attempts to provide a Valid Ballot PassCode has exceeded the number of attempt limits which results in disabling the Voting Ballot from further use unless re-enabled by an Official or Official Device; otherwise, Officials and Official Devices ac to determine whether the Ballot PassCode provided by the Active Voter is actually correct and correlated to the Ballot Voting RSID—if matching then the Active Voter status becomes Active Enabled Voter and is then given access to the Voting Ballot, otherwise if the Active Voter provided PassCode does not match the Ballot PassCode then Voter may be given permission by TELVOTS or Officials or Official Devices to retry another Ballot PassCode but only if the limit for number of attempts has not been exceeded;

(r)(3) whereby if the Voter enters a Ballot PassCode RSID that is determined to be valid, and the Ballot Voting RSID has not been disabled, the now Enabled Voter receives the Validation RSID, Voter selections and zero, one or a plurality of other information items associated with of the Ballot Voting RSID, and (r)(4) if the Ballot has not been cast, the Voter is provided with the options Begin Vote or Not Vote and, upon the choice of Not Vote, the Active Enabled Voter is forced to Exit the Telephone Validation System and Telephone Voting System which then terminates the telephone connection, and stores all of the call related data with the date, time and unique transaction record in a database record that is encrypted then securely and redundantly stored by a plurality of Officials and Official Devices for a each and a plurality of Active Voters whether Enabled or Not Enabled to Vote by Telephone;

(s) otherwise upon the Voter choice to Begin Vote:

(1) the Active Enabled Voter is connected to the Telephone Voting System (TELVOTS);

(2) a unique Telephone Voting Session ID (TELVOTSID) is generated, stored and associated with each Ballot Voting RSID provided by the Active Enabled Voter;

(3) the TELVOTS provides each Voter with zero, one or a plurality of alpha or numeric or alpha-numeric menu choices to select: (i) Candidates, Groups, Proposals, related information items (such as: numeric menu-options for Candidate biographies, menu options to Candidate political party affiliations and policies, menu-options to Proposal descriptions) and also (ii) TELVOTS menu options to Mark choices (such as star * key), unmark choices (such as # hashtag key) and (iii) menu options to process the Vote Selections (Submit, Cancel, Reset, Save, Pause, Resume, Exit) and (iv) menu-options (Save, Print, Publish, Email, TelText Message, Fax Message, Interactive Television Message) to record, store, replicate and send copies of Voter selections that were made; and (t) whereby the Voter completes and then submits their Voting Ballot, thereafter:

(i) no errors are detected and the Ballot and transaction data (date, time, database record sequential identifier, unique RSID transaction identifier, unique session identifier, ballot-selection-signature-key, voter privacy signature key) are temporarily stored as TELVOT Data Set;

(ii) TelVot Data Set is submitted to the TELVOT Error System whereafter zero, one or a plurality of errors are detected and identified to the Voter by the TelVOTS computers, telephone and software;

(iii) thereafter zero, one or a plurality of corrections are made, zero, one or a plurality of times by the Voter until all the Voting Ballot selections are submitted free of errors or otherwise spoiled or declined to Vote;

(iv) thereafter the Voter submits the Ballot Selections for final processing to the TELVOTS; and if the Ballot Selections are processed successfully, a unique TELVOTS Receipt ID is generated, that is then correlated to the TELVOTS Session ID and TELVOTES Transaction Identifier is then further correlated to zero, one or a plurality of other Voting System Identifiers, Ballot Voting RSID and Ballot Voting PassCode, and further correlated to zero, one or a plurality of Ballot Validation RSID that is correlated to the Ballot Voting RSID;

(u) the further, optional, steps and methods for each Telephone Ballot, of detecting, reporting and stopping processing of the appropriate Telephone Ballot cast via TVOTS upon detecting not receiving the printed or optically rendered form of the Master or Receipt Ballot(s), or, disregarding zero, one or a plurality of failures of delivery of zero, one or a plurality of printed or optically rendered Master or Receipt Ballots that are correlated to a Telephone Ballot cast via the TVOTS;

(v)(1) creating and then transmitting zero, one or a plurality of Receipt Confirmation Documents to each Voter either electronically, (using methods webpage form, EMail to each Voter provided EMail, or paper Receipt Documents) to each Voter who has successfully submitted their Voting Ballots Physically or Electronically or Optically or Electro-Magnetically or Auditorily or Chemically or any combination thereof;

(v)(2) and the further optional steps and methods of using the unique, private Ballot RSID as part of an Internet address to organize and privately store each Voter webpage, as well as all actions, tallies and summaries of Voter selections and (v)(3) the further steps and methods whereby any type of Voting System IDs and data items the TELVOTS Receipt ID, Session ID, Ballot Voting RSID, Ballot PassCode, Validation RSID, Ballot Selections and zero, one or a plurality of other related information items are permanently and redundantly stored, then transmitted securely to, and received by entities zero, one or a plurality of Election Officials, Political Parties, Candidates, and zero, one or a plurality of other approved third parties, for publishing, investigation, verification and accounting in zero, one or a plurality of formats (physical, optical, electromagnetic, electronic); and (w)(1) the further steps of applying zero, one or a plurality of the aforementioned steps and methods, actions, data or results zero, one or a plurality of times, to zero, one or a plurality of Ballots, Voters, Officials, or other legally recognized entities, by zero, one or a plurality of Voters, Officials or other legal entities (government Officials, news media, political groups);

(w)(2) modifying aforesaid steps and methods to enable Voter Registration via Telephone;

(w)(3) modifying of aforesaid steps and methods to enable Validation, Error Reporting and Amendments of Voter Registration, Ballots, Proxy Assignment, Voter Contact Updates, Proxy Contact Updates, Voter Active-Inactive, Proxy Active-Inactive, Voter Ballot Complaints, Voter Registration Complaints—all via public and private land line Telephone and cellular Telephone devices, mobile telephones and including Facsimile (Fax or Facsimile) devices and related communications transmissions and processing by related communication systems, software, firmware and hardware devices thereof and by Officials connected devices;

(H) the further steps and methods of Validation, Registration and Voting by Electronic Mail (EMail) and Internet Webpage Voting whereby the modified previous steps and methods of Internet and Telephone Voter Registration, Validation and Voting are employed, whereby zero, one or a plurality of Voters, Voter Devices, Officials and Official Devices:

(1) obtains and utilizes zero, one or a plurality of authentication certificates from zero, one or a plurality of certificate authorities;

(2) for Email Voting, Validations, Registrations:

(a) zero, one or a plurality of Voters utilize computer or electronic data devices running EMail communications software operating in conjunction with any combination of electronic communications and security devices and software acting to connect with zero, one or a plurality of and any types of communications systems operating to connect to the Voting Session Officials EMail Validation System (EMVALS) and whereby EMVALS and zero, one or a plurality of Voters obtains and utilizes zero, one or a plurality of authentication certificates from zero, one or a plurality of certificate authorities that is correlated to each respective, originating EMVSID which is recorded and stored by EMVALS;

(b) whereupon a Voter successfully connects to the Official EMVAL System by sending and EMail to the EMVALS whereupon Receipt of said Voter EMail, a unique EMail Validation Session Identifier (EMVSID) is generated by the Official EMVAL System and then is associated with the EMVAL Validation Session for that particular Voter EMail address and the submitted Voter EMail Initial Contact Message (VEM-ICM);

(c) for a plurality and each VEM-ICM contains and submits the Voter EMail Address, Ballot Validation RSID, and optional Voter Registration ID and optional correlated Ballot PassCode—which are recorded and stored by EMVALS along with the Date, Time and Voter EMail Message Header and related data which enables error checking of the VEM-ICM contents and tracing the source, distribution and transit-delivery path of each VEM-ICM;

(d) EMVALS then employs zero, one or a plurality of steps and methods of procession according to claim 9 along with computers running software for optical image and character recognition so as to securely receive and process the EM-ICM whereby zero, one or a plurality of Officials employ EMVALS to run computer software that automatically checks the validity and authenticity of the VEM-ICM contents submitted to Official data sources, and if the VEM-ICM contents and Voter EMail are valid, authentic and if not received from a known blacklisted, fraudulent SPAM EMail source, then:

(i) EMVALS then generates an EMICMVALID that is correlated to the VEM-ICM and EMVSID and is stored by EMVALS;

(ii) EMVALS generates and sends to the Voter provided VEM-ICM EMail address:

(1) an Official Validation EMail Message (EM-OVALM) with an a new Official Voting EMail Address to reply to with a subject header of the EMVSID and EMICMVALID and further that the Official vote enabling EMail message also contains an attached or embedded electronic optically readable EMail Voting Ballot which replicates the entire contents of the regular Official Voting Ballot and contains at least the Ballot Voting RSID, Ballot and Voting Session data, Voting Choices, and optional Write-In choices, optional Voter security data, and optional orientation Marks and alignment Marks;

(2) a computer software Internet link to the Officials Internet Voting Webserver Webpage which is visually rendered as an exact replica of the Official Voting Ballot, or approximation thereof for alternative use for voting—and which is then amended to reflect the Voter entry of their unique Ballot RSID, or, the link directs the user to the unique Webpage which already has the Ballot RSID integral to its rendered design form;

(e) zero, one or a plurality of EMVALS connected and validated-authenticated Voters then replies to EMVALS by submitting their completed EMail Voting Ballot and correlated Ballot PassCode to the EMVALS by reply to the original Official Voting EMail message that validated the EM-ICM or alternatively, by completing and submitting the Officials Internet Voting Webpage form(s);

(f) for a plurality of EMail Ballots, EMVALS:

(i) receives and processes each EMail Completed Voting Ballot (EM-CVB) and upon receiving and successfully verifying the EM-CVB was received before the Expiry Date and Expiry Time for a valid, active Voting Session; and further upon confirming that the validity of the Voter submitted Ballot Voting RSID and correlated Ballot PassCode;

(ii) disables and excludes from tallying the correlated Official Internet Voting Webpage for each of a plurality of Voter and for each said EM-CVB that is correlated to each Voter;

(iii) disables and excludes any other subsequent Ballot tallying submissions for the Ballot Voting RSID, but EMVALS still accepts submission for Ballot processing error complaints and Damaged, Lost or Stolen complaints for submitted Ballot RSID;

(iv) EMVALS generates an internal unique transaction Identifier (EMTID) then transfers the received EM-VB to the EMail Submitted Ballot System (EMSBS) for authenticating, analyzing, tallying, certifying, publishing, of a plurality of each received EMail Submitted Voting Ballot, or, alternatively rejecting any submitted EMail Voting Ballots upon detecting flawed authentication, improperly completed Ballot or invalid Ballot Voting RSID or invalid Ballot PassCode;

(g) zero, one or a plurality of EMVALS connected and validated-authenticated Voters then replies to EMVALS by submitting their completed EMail Voting Ballot and correlated Ballot PassCode to the EMVALS by reply to the original Official Voting EMail message that validated the EM-ICM or alternatively, by completing and submitting the Internet Voting Webpage form(s);

(h) for a plurality of EMail Ballots, EMVALS:

(i) receives and processes each EMail Completed Voting Ballot (EM-CVB) and upon receiving and successfully verifying the EM-CVB was received before the Expiry Date and Expiry Time for a valid, active Voting Session; and further upon confirming the validity of the Voter submitted Ballot Voting RSID and correlated Ballot PassCode;

(ii) disables and excludes from tallying the correlated Internet Voting Webpage for each said EM-CVB;

(iii) disables and excludes any other subsequent Ballot tallying submissions for the error reported Ballot Voting RSID, but EMVALS still accepts submission for Ballot processing error complaints and Damaged, Lost or Stolen complaints for any Voting Ballot RSID and for a plurality of Ballot RSIDs;

(iv) EMVALS generates an internal unique transaction Identifier (EMVALS-TID) then transfers the received EM-CVB to the EMail Submitted Ballot System (EMSBS) for authenticating, analyzing, tallying, certifying, publishing or alternatively rejecting EM-CVB upon detecting flawed authentication, improperly completed Ballot or invalid Ballot Voting RSID or PassCode;

(v) for a plurality of and for each successful transfer of each EM-VCB from EMVALS: (1) the EMSBS generates a unique Session Identifier Receipt (EMSBS-SIDR) that is correlated to the EMVALS-TID or, (2) upon failure of transfer from EMVALS, generates a error message and retries the transfer automatically;

(h) for each successful transfer of the prior step, EMSBS then employs zero, one or a plurality of steps and methods of ballot processing according along with computers running software for optical image and character recognition so as to validate any number data items securely receive and process the EM-VCB and correlated data (Ballot Voting RSID, Ballot PassCode, Voting Session Identifier and Limits of Use and Expiry data, Official Security Elements, Voter Choice selections, Voter Write-In Choices, Voter Personal Security Items, orientation and alignment Marks) and attached electronic optical image files copied from the original optical scans of the Document(s);

(i) when each Ballot Selections are processed successfully by EMSBS, then a unique EMSBS Receipt ID (EMSBS-OKRECID) is generated, then correlated to the EMSBS Session ID and further correlated to Voting System Identifiers Ballot Voting RSID, Ballot PassCode, Validation RSID for the correlated Ballot Voting RSID; and (j) the further steps and methods whereby any type of Voting System ID, Receipt ID, Session ID, Ballot Voting RSID, Ballot Voting PassCode, Ballot Validation RSID, Ballot Selections, Voter Write-In selections, Voter Personal Security Items, and zero, one or a plurality of other related information items are permanently and redundantly stored, then transmitted securely to, and received by any number of: Election Officials, Political Parties, Candidates, zero, one or a plurality of other approved third parties for verification, investigation and accounting in zero, one or a plurality of formats approved third parties, for publishing, investigation, verification and accounting in any format (physical, optical, electromagnetic, electronic);

and (k) the further steps and methods of transmitting zero, one or a plurality of Receipt Confirmation Documents to each successful Voter either electronically, using methods of:

(1) Fax or Facsimile confirmation copy of Voter Ballot cast transmitted back to the Voter specified or sending Fax or Facsimile machine;

(2) webpage with access requiring the Voter ID and Voter PassWord, or, alternatively, the Ballot ID and Ballot PassCode;

(3) Voter EMail address;

(4) interactive television locator data, software and device identifier;

(5) cell phone number or land line phone number for each Voter provided EMail address, Fax or Facsimile telephone number, private cellular telephone, interactive television, or, providing paper Receipt Documents to each Voter using Official Polling Station voting terminal devices, or, that paper Receipt Documents is are mailed or given in person to each Voter who has successfully submitted their Ballot(s), Voter Registration Documents and Voter Language selection forms;

(6) and the further optional steps and methods of using the unique, private Ballot RSID as part of an Internet address to organize and privately store each Voter webpage, as well as all actions, tallies and summaries of Voter selections; and (l) the further, optional, steps and methods for each EMail Ballot, to detect, report whereby:

(1) stopping processing of the appropriate EMail Ballot cast upon detecting any types of critical failures, failure of timely Receipt of the printed or, of the optically or electronically or electromagnetically rendered, retrieved or stored Master or Receipt Ballot, or, (2) of disregarding zero, one or a plurality of failures of non-critical Events;

(m) and any such further modifying of aforesaid methods to enable Validation, Error Reporting and Amendments of Voter Registration, Ballots, Proxy Assignment, Voter Contact Updates, Proxy Contact Updates, Voter Active-Inactive, Proxy Active-Inactive, Voter Ballot Complaints, Voter Registration Complaints;

(n) and further: repeating with modifying said steps of Email and Internet Voting, Registration, Error Reporting, Amendments, so as to enable said steps for the method of Interactive Television Voting, Registration, Error Reporting, Amendments by substituting use of an interactive television device connected to a television network or the Internet in place of a computer terminal or Internet tablet device connected to the Internet; and further Voter selecting appropriate interactive television channel and correlated secure Universal Resource Locator (URL) address of the Internet or private intranet or secure telephone communication line, so as to enable interactive voting, Registration, error reporting and amendments; repeating with modifying said steps of Internet Voting, Registration, Error Reporting, Amendments;

(I) and for all of the aforesaid methods of voting (Internet, telephone, Fax or Facsimile, EMail, texting, interactive television, in person) the further steps and methods of each Voter:

(1) affixing zero, one or a plurality of personal Identifiers their personal signature, personal verification data, private PassWord, personal EMail address, and zero, one or a plurality of date or time information to zero, one or a plurality of paper, or electronic Ballots, Registration forms, data Containers or any other types of Documents of this invention Master Voter Registration form, Master Language preference form, Whole Ballot Receipt part; and (2) further steps and methods of affixing per step a unique Container Identifier either inside (preferred to protect private sensitive data), or, upon the outside, or any combination thereof per items, so as to be upon or within any type of Return Container of this invention; and the step of zero, one or a plurality of Voters or Proxy Voters generating a digital signature or applying their Voter Registration Identifier and employ at least one digital signature algorithm to digitally sign their Ballot, Voter Registration, Voter Language selection, any types of Containers, zero, one or a plurality of affidavits for Ballot replacement;

(J) for zero, one or a plurality of Ballots, Officials first automatically enable and activate each Ballot for voting prior to or shortly after delivery to each Voter, or, Officials may optionally first determine if each said Ballot was properly been activated by a Voter using zero, one or a plurality of Ballot Activation Documents (FIG. 27); according to Voting Session Rules, a plurality of Officials then directing a plurality of activated Ballots to processing for activated Ballots, alternatively other processing for non-activated Ballots;

(3) the further steps and methods whereby zero, one or a plurality of Officials, Officials Agents, Electoral Board members, Voters, Proxy Voters, and Third Parties apply the steps and methods of: applying zero, one or a plurality of Ballot Voting PassCodes, Ballot Validation PassCodes, Voter Registration PassCodes, Voter Proxy Assign PassCodes, Voter Language Selection PassCodes, Voter Contact Update PassCodes, Voter Ballot processing complaint PassCodes, Voter Registration Complaint PassCodes, Voter PassWords, separately or in combination with zero, one or a plurality of symmetric digital data encryption-decryption key pairs and zero, one or a plurality of asymmetric digital data encryption-decryption key pairs, zero, one or a plurality of logarithmic or factorial or exponential power algebraic equation defined digital data encryption-decryption key pairs; zero, one or a plurality of messages and images, symbols and glyphs provided to zero, one or a plurality of Officials, Officials Agents, Electoral Board members, Voters, Proxy Voters, and Third Parties so as to require each person to confirm there is a living person interacting with the Voting System; zero, one or a plurality of digital key certificates by using computers running software programs employing encrypting algorithms and decrypting algorithms to digitally sign, digitally authenticate, encrypt, decrypt, read and secure any number of: Voter Ballot data sets, Voter Registration data sets, Voter Language data sets, Voter Personal Security Items, any types of Containers, any types of system data sets, any types of processing data sets, any types of transaction Identifiers, Ballot images, Registration form images, Language selection form images, Container images, any types of Voter identification images, any types of Document images, any types of affidavits, any types of Documents, communications, data storages, images, reports or tallies of the invention; this invention shall also include any related or further modifications of the aforesaid steps so as to meet the spirit of the invention and unique goals of any Voting Session;

(9) Steps and Methods of Document Imaging and Data Extraction whereby:

(a) for any types of Documents (Ballots, Voter Registration forms, Voter Language selection forms, Voter Ballot return Containers, Voter Ballot Receipts, Voter Registration Receipts, Voter Language selection Receipts, Official Ballot delivery Containers, Official) whereby information datum(s) (data) of Voter Ballot choices, Voter Registration information, and Official data are captured, recorded (stored), processed from Voter Ballot(s), Voter Registration(s) data is extracted by scanning and capturing an image of said Document by using high speed optical, electronic and electromagnetic scanning device(s) and photographic camera(s), then storing said image and then rendering (physically, optically, electronically, electromagnetically) the image so as to enable applying at least one or a series of reading Templates that isolate data fields and enable decoding of position data correlated to said data fields, then extracting data from said data field by use of computers running optical character recognition and intelligent character reading programs; recording extracted data then further interpreting, applying error detection, error identification, error specification, error localization, error correction, error visual rendering, error audio rendering, and error data recovery via computers running software programs with error processing algorithms as required; then verifying, validating, authenticating extracted data, then upon acceptance: confirming, verifying, rendering, storing, tallying, publishing said data for each Documents set of data fields, or, if not accepted: Officials rejecting said Ballot and signalling rejection for further human or machine processing;

(b) embodying a Voter Ballot assembled as a portable, anonymous Voter Ballot: optically, electronically, and electromagnetically as a physical data card containing all required Official Ballot information, Ballot voting choices, voting RSID Identifiers and PassCodes encoded, encrypted and stored in visible character symbols, invisible character symbols, magnetic data field stripes, holograms, and micro-devices;

(c) further having a Voter Registration Objects and data assembled as a Voter ID data card optically, electronically, and electromagnetically as a physical data card containing specific information pertaining to a particular Eligible Voter or designated Proxy Voter, such as their government public identification data, private voting session Identifiers and Official PassCodes, and private personal information such as: face pictures, body size scale pictures, eye retina images, fingerprint images, images of their personal handwritten signatures and initials that all encoded and securely stored using encryption and private PassWords or PassCodes, magnetic data field stripes, holograms, invisible and visible characters, symbols and security images, special chemicals, special materials, micro-devices;

(d) embodying zero, one or a plurality of Official Registrations and Official Identifications data assembled optically, electronically, and electromagnetically as a physical data card for use as a portable Official ID card having for each Official, their government public identification data, private voting session Identifiers and Official PassCodes, and private personal information such as: face pictures, body size scale pictures, eye retina images, fingerprint images, images of their personal handwritten signatures and initials that all encoded and securely stored using encryption and private PassWords or PassCodes, magnetic data field stripes, holograms, invisible and visible characters, symbols and security images, special chemicals, special materials, micro-devices;

(e) utilizing at least one symmetric or asymmetric encryption public and private key pairs, key certificates, encryption algorithms, decryption algorithms, digital signature algorithms to encrypt and decrypt at plurality of data such as, but not limited to: Voter Ballot data sets, Voter Ballot processing data sets, Voter Registration data sets, Ballot process data sets, Ballot casting transaction Identifiers; whereby Voters use their provided Ballot Voting RSID and correlated Official PassCode along with Officials public keys and encryption algorithms to generate a private voting or Voter Registration authentication voucher that is unique to each Ballot RSID or Registration RSID and is printed on the correlated Receipt, and further with a private Voter created PassWord, and may be used to encrypt the semi-public Voter data page contents (eg Receipt or Ballot revealed) so as to be revealed only to the Voter who cast that Ballot or submitted that information or to an entrusted Official as authorized by the Voter; and further providing Voters and Proxy Voters with personal, secure, encrypted: communications methods, registration and voting methods, identity certificates, type-places methods of contact: (i) real physical—in person, (ii) non-physical virtual—Internet cyberspace, telephone communications, interactive television communications;

(iii) proxy-person, corporation, proxy-devices: Fax or Facsimile machine;

(iv) relay media—EMail, postal, voter information data vaults;

(f) Whereby a Voting Session Data Set comprises of: Voting Session Identifier, Nation Identifier, Province-State Identifier, Zone-Riding Identifier, Poll Station Identifier, Postal-Zip Identifier, Voting Start Date, Voting Start Time, Voting End Date, Voting End Time and further each Voting Session has a unique Validation Identifier (Voting Session Validation Identifier);

(g) Whereby each Ballot has zero, one or a plurality of correlated unique Ballot Validation RSID, at least one Ballot Voting RSID, at least one correlated Ballot PassCode and further whereby each unique Ballot and correlated Ballot RSID is correlated to at most one Voting Session;

(h) Whereby a Ballot Data Set is described earlier herein as per Electronic Voting Receipt data and further comprises of data specifying Ballot Type (Candidate, Proposal, or Candi-Prop combining both Candidates and Proposals), Ballot choice options and correlated voter selections of Ballot choice options as well as any voter Write-In choices or proposals, and further Voter Private Security Item (any combination of: image or PassWord or phrase) used to authenticate associated choice selections and Write-In choices made by the voter; and is correlated to the specific Ballot;

(i) Whereby for electronic voting methods and for any optical scanned Documents as well as for both in-person voting or paper-ballot mail-in voting or electronic or optical voting: each Voter, Proxy Voter, and zero, one or a plurality of Voter or Proxy Devices may add a Voter Privacy Security Record comprised of any combinations of and zero, one or a plurality of PassWords, PassCodes, PassPhrases, signatures, initials, graphics or image(s) which are then all merged with zero, one or a plurality of Ballot Voting Signatures Keys that is all Voter encrypted using the Voter Privacy Record contents as variables to be used within zero, one or a plurality of Voter Encryption Algorithms or, alternatively the Official Encryption Algorithm or a Public Encryption Algorithm, or any combinations of aforesaid Encryption Algorithms to form a Voter Privacy Key; thereafter said Voter Privacy Security Key is correlated to and combined with the Voter Ballot Data Set, Voting Session Data Set, and Ballot Voting Signature Keys which are then encrypted to form a Voter Ballot Encrypted Object by applying the Official Private Encryption Key and Officials Private Encryption Algorithm; said Voter Ballot Encrypted Object is then securely transmitted to the Officials and Official Devices for decryption by applying the Official Private Decryption Key and Official Private Decryption Algorithm thereafter producing the component Voter Ballot Data Set, Voting Session Data Set, Voter Privacy Security Key and Ballot Voting Signature Keys which are then submitted to Official Devices for error checking, error correcting, review, tallying, storage, redundancy replication and publishing while always keeping the Voter Privacy Security Key, Voter Privacy Security Object, Voter Privacy Security Record and the Ballot PassCode secret and unpublished; further whereby aforesaid steps and methods of Voter Privacy may be similarly implemented for Voter Registration Documents and any other types of Documents, or Communications of this invention;

(j) whereby Voters submit a plurality of Documents or Forms, from each of the aforesaid Document group types (Ballots, Voter Registration forms, Voter-Proxy Language Registration forms, any types of Receipt Documents and any types of marked Containers) to Officials by enclosing any number of, and any types of Documents and zero, one or a plurality of Document or Forms in a physical or electronic or optical or electromagnetic Container having zero, one or a plurality of unique machine-readable Identifiers of:

(1) (i) Container Identifiers, (ii) Jurisdictional Identifiers, (iii) Voting Session Identifiers, (iv) Voter Identifiers, (v) submitted date-stamps or date-time-stamps markings;

(vi) Container Contents Identifier or markings;

(2) whereby for each Official designated Identifier (Container, Jurisdiction, Voting Session, Voter, Container Contents) shall also include: (i) one correlated binary value, (ii) at least one correlated barcode value, (iii) at most a single two-dimensional bar code graphics, (iv) whereas the Container Contents identification markings may be a simple choice selection marking with an X or check-Mark, or solid fill-in box, or Identifier markings;

(3) the aforesaid identifiers, markings, barcodes, glyphs, graphics and correlated values shall also have a prescribed font, symbolic representations of characters, symbols, numbers, alphanumeric characters, non-alphanumeric characters, graphical drawings, graphical icons that are represented accurately in any format (physical, electronic, magnetic, optical), and that are capable of data capture, optical recognition (OCR) processing, intelligent character reading (ICR), data inter-format conversion, and data storage in any format (physical, electronic, magnetic, optical) or any combination of formats;

(k) aforesaid Identifier criteria shall include and apply to zero, one or a plurality of correlated Official Security Elements and zero, one or a plurality of Voter Personal Security Items thereof;

(l) whereby each type of Container that is timely sent to, then received by Officials, and said Container is further markable for recording markings thereon of the Officially Received date-time-stamp markings, and for of zero, one or a plurality of Official processing notes; otherwise Officials processing to detect and reject untimely, invalid, erroneous and forgery Containers per Voting Session Rules;

(m) applying to each timely received Documents and forms (Voting Ballot, Voter Registration, Voter Language Selection, Voter Registration Confirmation, Voting Ballot Receipt, Voter Registration Receipt, Voter Complaint, Public Complaint, Official Reply) processing of checking for timeliness, validity, authentication, applicability, error detection and when appropriate error correction, or alternatively, rejection for any failures of timeliness, validity, authenticity, applicability, error correction or any other reasons per voting session rules;

(n) sorting, marking, organizing, orienting and aligning Documents, Forms, Containers for processing, thereafter for publishing, reporting, storing, retrieval;

(o) for each and for a plurality of said Documents, Forms and Containers: Officials selecting a Reading and Decoding Template or a series or combination of Reading and Decoding Templates that are singly or sequentially applied or applied in combination for each assigned reading device-machine, said Reading and Decoding Template or a series or combination of Reading and Decoding Templates are then used for reading and decoding information from predefined areas or data field areas of said Documents, Forms and Containers, and also reading and decoding data from embedded devices, holograms or any other markings having data values, identifiers, barcodes, QR codes, symbols, graphics, holograms, voter selections and voter Write-In data voter personal security items, official security elements that are marked, attached, embedded, encoded and-associated with and specifically correlated to each type and any type of format (physical, optical, electronic, electro-magnetic or any combination thereof) of said Documents, Forms, Containers—including any data fields whose data values are marked and submitted in any formats: physically, optically, auditorily, chemically, electronically, electromagnetically, optical-electronically, optical-electromagnetically;

(p) (1) said Template reading and decoding of the Official data field label Identifiers, data fields and correlated barcodes, Official Security Elements, Voter selections, Voter Write-In data values, identifiers, symbols, glyphs, graphics and Voter Personal Security Items that are read from each Document in accordance with the selected Reading and Decoding Template comprises reading and decoding consistent with the determined orientation, magnification ratio, and proportionality aspect ratio of each Document for the Official data field label Identifiers, Official data fields and correlated barcodes, Official Security Elements, Voter selections, Voter Write-In data values, symbols, graphics and Voter Personal Security Items marked on each Document in accordance with the correlated reading Template or series of sequentially applied Templates;

(p)(2) utilizing orientation Indicia whereby:

(i) zero, one or a plurality of face-orientation Indicia that are place for aiding to rotate the Document or Container or Object image to the correct orientation for reading, and further to assist in determining and signaling whether the Document or Container or image requires to be flipped over to view the opposite face (back view or front view) to enable proper scanning and reading;

(ii) or at least one or more orientation Indicia comprised of: Indicia include one or more of: concentric circles (bulls-eye) or oval shapes, cross-hair lines, cross-hair lines in a circle or concentric circles, typographical bullet graphics, crossed connected or pyramidal: + Marks, X and x Marks, O and o Marks, T Marks, I Marks, arrow, bracket, rectangle, triangle or wedge shapes; and (iii) whereby any of the said Indicia may be further modified with one or more black, darkened or contrasting adjacent sections, any notches or darkened area Marks;

(iv) and whereby said Indicia and said Marks may be further modified by overlapping or combination of any type and zero, one or a plurality of said Indicia, Marks or Indicia and Marks using any combinations of said Indicias and said Marks;

(v) consistently placing and position said Indicia and said Marks on each Document, Container, Object or rendered formats of any types of said Documents, Containers, Objects along at least one edge or corner so as to be distinguishable from any other types of Documents, Container, Object;

(p)(3) Officials and Officials Voting Session Devices and machines and computers running software programs actively: properly orienting, aligning and adjusting the perceived aspect ratio, magnification, focus, contrast, hue, color saturation, white balance, white point, black point, chroma levels and channels for red, green and blue colors, infrared and ultra-violet detection levels and amplification factors, and other readability factors of said Documents, Forms, Containers for manual or automated processing of scanning wherein said reading of each Document, Form and Container includes First capturing an optical image that is an exact duplicate copy representation of the originally submitted Document, Form or Container, then accurately recording then securely storing the captured duplicate image of the Document, Form or Container; wherein said reading each Document or Container includes capturing the entire optical image of the Document or Container or Object and any portions thereof, via use of any specially designed and commercially available devices or combination of devices such as: optical camera, optical film recording media, digital camera, digital image recording media, optical copier machine, optical scanner, electronic facsimile machine, telephone, interactive television, audio-video camera, computer or personal data device running a virtual or real screen imaging display and capture program, personal data device or computer running a Document rendition and capture program, any image capture device, any printing device, or any scanning device, optical barcode reader, ultra-violet light invisible ink illuminator and reader, electromagnetic ink reader, plastic credit card magnetic stripe reader, electronic micro-device, integrated circuit reader, with any combination(s) thereof for of zero, one or a plurality of aforesaid devices;

(p)(4) selecting the appropriate single, series or combination of Reading and Decoding Templates that are responsive to physically, electronically, optically, chemically, magnetically, electromagnetically detecting, evaluating, capturing, revealing, any number of: encoded data, decoded data, identifiers, marking, symbols, glyphs and graphics for purposes of correlating, duplicating, transcribing, recording (auditorily, optically, electronically, electromagnetically, physically), evaluating, error detecting, error correcting, amending, tallying, storing (optically, electronically, electromagnetically, physically), indexing, retrieving, rendering, displaying, sorting, organizing, evaluating, prioritizing, researching, summarizing, reporting, publishing and communicating (physically, optically, audibly, electronically or electromagnetic media formats using aforesaid devices) for any combination of aforesaid data, identifiers, markings, and graphics to a plurality of Officials, Official devices, Official machines, Voters, Voter devices and machines, Candidates, Political party members, Voting session host Government, Business, Organization as well as to their devices and machines, and to any Officially authorized third party such as the public, public news media, auditors, and to a plurality of those public devices;

(p)(5) for each said Document, Form, or Container: reading and decoding via the correlated Reading and Decoding Template(s) and related Voting Session Devices are machines used for reading and decoding-Voter selections, Voter Write-In data values, Document identifiers, symbols, glyphs and graphics and Voter Personal Security Items from each of the timely received Documents, also reading each of the Official data field label Identifiers, Official data fields and correlated barcodes, graphics and Official Security Elements in a manner consistent with each respective reading Template or correlated series of sequentially applied Reading and Decoding Template(s) for that particular type of Document, form or container and for zero, one or a plurality of Documents of each Document type; further logically grouping sorting, indexing, organizing, correlating, aggregating and analyzing each type of similar or identical or logically grouped Document, Form or Container and the Template and zero, one or a plurality of human read and decoded correlated values of data, identifiers, marking, symbols, glyphs and graphics;

(p)(6) said Template Reading and Decoding of the Official data field label Identifiers, data fields and correlated barcodes, Official Security Elements, Voter selections, Voter Write-In data values, identifiers, symbols, glyphs, graphics and Voter Personal Security Items that are read from each Document in accordance with the selected reading Template comprises decoding consistent with the determined orientation, magnification ratio, and proportionality aspect ratio of each Document for the Official data field label Identifiers, Official data fields and correlated barcodes, Official Security Elements, Voter selections, Voter Write-In data values, symbols, graphics and Voter Personal Security Items marked on each Document in accordance with the selected, correlated reading Template or series of sequentially applied Templates;

(p) (7) whereby a method for reading paper or electronically-optically rendered visual Voting Ballot Documents, Voter Registration Documents, Proxy Registration Documents and Language Selection Forms wherein each paper or visually rendered Document, Form and Container is marked with Official information, orientation Marks and indices, data clarity Marks, graphics, security elements, and is further markable for marking Voter selections, Voter Write-In data values, symbols and graphics thereon, said method comprising: from a plurality of machine readable Document and Form predetermined data field areas, then actively and accurately capturing (reading) the content then decoding values of data fields comprising of: determining the Voter selections, Voter Write-In data values, symbols and graphics marked on each paper Document; tabulating the Voter selections, Voter Write-In data values, symbols and graphics determined from each of the paper Documents, and each of the electronic-optically rendered Documents; wherein each paper and electronic-optically rendered Document is markable for marking Voter selections, Voter Write-In data values, symbols and graphics thereon, and wherein each type of aforesaid Document has a Jurisdiction Identifier and fiducial Marks thereon, said method comprising: reading each Document including at least the machine readable Official Document Identifier [Official Ballot Voting RSID(s), Voter Registration RSID(s), Voter Language Selection RSID(s), Voter Contact Update RSID(s), Voter Proxy Assignment RSID(s)], Official PassCodes [(Ballot PassCode(s), Voting Data Access PassCode(s), Voter Registration PassCode(s), Voter Contact Update PassCode(s), Proxy Assign PassCode(s), Voter Registration PassCode(s), Voter Language Selection PassCode(s)], Official Document data fields, orientation or sorting markings, and zero, one or a plurality of Voter selected choices, Voter Write-In choices, Voter and Officials Marks, signatures, initials, Voter PassWords, thereon;

(p)(8) decoding the machine readable Document Identifier read from each Document; displaying at least the decoded Document Identifier, Official PassCode(s), Voter signature, Voter initials, Voter PassWord of each Document for a purpose of determining from the Official Document—the Document Identifier, and whether the Document is a valid, authentic, timely submitted Document or Ballot; and if the Ballot is determined to be a valid, authentic, timely submitted Ballot, removing each paper Ballot determined to be a valid, authentic, timely submitted Ballot from its Ballot envelope, and then performing the following steps on each paper Ballot determined to be a valid, authentic, timely submitted Ballot: determining from the fiducial Marks the orientation of each paper Ballot; reading consistent with the determined orientation of each paper Ballot the Jurisdiction Identifier of each paper Ballot; selecting a Template responsive to the read Jurisdiction Identifier of each paper Ballot for reading the Voter selections marking(s) and correlated selections, Voter Write-In data values, symbols and graphics (Voter signature, Voter initials, Voter PassWord) marked thereon; and reading the Voter selections markings and correlated selections, Voter Write-In data values, symbols and graphics marked on each paper Ballot in accordance with the selected Template and consistent with the determined orientation of each paper Ballot, whereby the Voter selections markings and correlated selections, Voter Write-In data values, symbols and graphics marked on each paper Ballot are accurately read in accordance with a selected Template corresponding to the Jurisdiction Identifier for that paper Ballot irrespective of the orientation of the electronic-optically rendered Ballots or paper Ballot; and further comprising: decoding for each Ballot the aforesaid Voter voting selections and Write-In choices, further comprising: decoding the voting selections and Write-In choices read from each optically rendered Ballots and paper Ballot in accordance with the selected Template; and then: tabulating the voting selections and Write-In choices decoded from each of: the electronic-optically rendered Ballots and paper Ballots, consistent with their respective selected Templates; or publishing the voting selections and Write-In choices decoded from each of the electronic-optically rendered Ballots and paper Ballots; or tabulating the voting selections and Write-In choices decoded from each of the electronic-optically rendered Ballots and paper Ballots consistent with their respective selected Templates and publishing the decoded voting selections and Write-In choices read from each electronic-optically rendered Ballots and paper Ballot in accordance with the selected Template; and then: tabulating the voting selections and Write-In choices decoded from each of the electronic-optically rendered Ballots and paper Ballots consistent with their respective selected Templates; or publishing the voting selections and Write-In choices decoded from each of the electronic-optically rendered Ballots and paper Ballots; or tabulating the voting selections and Write-In choices decoded from each of the electronic-optically rendered Ballots and electronic or paper Ballots consistent with their respective selected Templates, then determining the decoded voting selections and Write-In choices; and further comprising prior to said tabulating step for zero, one or a plurality of Ballot Document types: determining from the decoded voting selections whether each Ballot Document contains an under-vote, an over-vote, missing voting selection(s), Write-In voting selection(s), or any combination thereof; segregating each Ballot determined to contain an under-vote, an over-vote, missing voting selection(s), Write-in voting selection(s), or any combination thereof from other Ballots determined not to contain an under-vote, an over-vote, missing voting selection(s), or Write-in voting selection(s) or any combination thereof; and then: performing said tabulating step for all other Ballots not determined to contain an under-vote, an over-vote, missing voting selection(s), Write-in voting selection(s) or any combination thereof, separately processing and separately tabulating each segregated Ballot determined to contain an under-vote, an over-vote, missing voting selection(s), Write-in voting selection(s), or any combination thereof;

(p)(9)(a) whereby Officials physically, optically, electromagnetically and/or electronically print and send or render and display or auditorily broadcast or transmit to each successfully registered a Voter and Proxy Voter, their personal Voter Registration Confirmation form (refer to FIG. 31) or Proxy Voter Registration form which the Voter may use to enable Voting in person, or may be kept or returned or submitted with their completed Ballot or Language Selection form when required by Officials;

(p)(9)(b) said Voter Registration Confirmation form comprises of optically, or, electromagnetically, or electronically scannable and Template machine readable information data fields capable of accurately capturing and recording data (as well as the absence of data) for locating reading and decoding; said data fields are correlated to values for at least one of: Voting Session Identifier(s), Voting Jurisdiction Identifier (s), Voting Elector District(s), Voting Polling Station(s), Voting List Identifier(s), Voting List Group Identifier(s), Voting List Sub-Group Identifier(s), Voting List Sequence Locator Identifier(s), Voting List Sequence Identifier(s), Poll Station Voter Sequence Number(s) Identifier(s), (unique) Voter Identifier(s), (unique) Voter SuperKey Identifier(s), First Name, Middle Name(s), Family Name(s), Voting Status, Voting Methods Available, Qualifying Home Address, Home City, Home State, Home ZipCode, (unique) Home Address Identifier, Phone, EMail, Mailing Address, Mailing City, Mailing State, Mailing ZipCode, (unique) Mailing Address Identifier, General Instructions, Voter Special Instructions, (unique) Voter Registration Confirmation Identifier;

(p)(9)(c) further said Voter Registration Confirmation Document also comprises of encoded barcodes and electromagnetic materials having data storage fields containing the correlated alpha-numeric values for: Voting Session Identifier(s), Voting Jurisdiction Identifier(s), Voting Elector District(s), Voting Polling Station(s), Voting List Identifier(s), Voting List Group Identifier(s), Voting List Sub-Group Identifier(s), Voting List Sequence Locator Identifier(s), Voting List Sequence Identifier(s), Poll Station Voter Sequence Number(s) Identifier(s), Voter Identifier(s), Voter SuperKey Identifier(s), Home Address Identifier, Mailing Address Identifier, General Instructions Identifier, Voter Special Instructions Identifier, (unique) Voter Registration Confirmation Identifier;

10. The further steps and methods of the Computerized Voting System of claim 1 whereby:

(A) Further to the aforesaid methods (such as: In-Person, Courier, Postal Mail, Email, Internet, Telephone, Computer, Personal Data Device, Interactive Television, Facsimile) of Voting (casting a Ballot) and Registering to Vote, for each of a plurality of Officials, Voters, Proxy Voters sending and receiving zero, one or a plurality of Voting Session Documents, a plurality of Ballot Processing Agents (also known as Ballot Agents) are employed to independently send, receive and process Ballots and correlated Voter Selections (Candidates, Groups, Political Parties, Proposals, Proposal Identifiers), Voter Write-in Choices, Voter Personal Security Items, Ballot Security Elements using Ballot Agents Voting Session Devices (such as: computer systems, fax machines, Internet Webservers, Email servers, data communications systems, secure private networks, proxy routers) which Ballot Agents control and manage independently and separately from Officials; said Agent Voting Session Devices and Ballot related Voting data are independently managed and controlled by said Ballot Processing Agents, thereby isolating and securely keeping secret the correlation between the unique Ballot Voting Identifier, Ballot PassCode and the unique Voter Identifier, Voter Password, also keeping secret all Voter and Proxy Ballot selections, Write-in choices and Voter Personal Security Items, further securely keeping secret any other information that may directly or indirectly provide a significantly probable link between the Ballot and the Voter or Proxy Voter;

10.(B) Officials generating, recording and providing each of a plurality of Registered Voters and a plurality of: Registered, designated Proxy Voters and a plurality of Officials with at least one unique private Voter Registration Identifier, at least one correlated unique Voter Registration PassCode, and at least one unique Voting Access Identifier and zero, one or a plurality of unique Voting Access PassCodes of which only the Voting Access Identifier and correlated Voting Access Passcodes are provided to Ballot Processing Agents which are not given access to Voter or Proxy or Officials Voting Registration Identifiers or Voting Registration PassCodes, thereby isolating and protecting sensitive private personal information from Official Ballot Processing Agents;

Voters and Proxy Voters personal information is also shielded from Official Vote Processing Agents (Ballot Agents) that only receive the unique Voter Identifier, Voter PassCode. A plurality of Voting Session Primary Officials employ a plurality of Voting Session devices to capture and store all Voter and Proxy Voter personal registration data securely, independently and in a manner that inaccessible to the Official Ballot Processing Agents (Ballot Agents or Official Agents) so as to protect the Voter and Proxy Voter private, sensitive personal information (example: social security number, drivers license number, healthcare number, date of birth, place of birth) and to prevent Official Ballot Processing Agents (Ballot Agents) from linking the Ballot RSID and selection and Write-in choices to a specific person; a plurality of Voting Session Primary Officials research potential Voters, accept applications for Voter and Proxy Voter registrations, then primary Voting Session Officials validate, authenticate, certify and register valid, Eligible Voters and valid, Eligible Proxy Voters, generating and correlating to each eligible Voter and eligible Proxy Voter, unique extremely hard to guess Voter Random Symbolic Identifiers, Voter Random Symbolic Barcodes or QR code and correlated numeric value and graphical image, Voter PassCodes RSIDs, Voter Passcode barcode or QR code and correlated numeric value and graphical image, and zero, one or a plurality of Security Elements, Validation, and Authentication data, markings, signals and messages, and zero, one or a plurality of Voter Personal Security Items, that is all correlated to each respective Voter or Proxy Voter personal information, aggregated in at least one record or zero, one or a plurality of linked records, and then securely and redundantly stored with at least one exact duplicate record of all the aforesaid Voter and Proxy Voter data that is stored in or on an immutable media along with at least one unique transaction identifier, data and time data, unique Official and Official devices identifiers, unique location identifier, and a unique Voter data signature derived from applying a computer running a hashing algorithm software program (example: MD5 hashing algorithm) which is applied to compute a unique hashing value for each the personal data and Voter Personal Security Items as well as the Voter or Proxy Identifier and Voter Passcode for each Eligible Voter and each Eligible Proxy Voter who successfully registers to vote with Voting Session Primary Officials;

10(C) (i) After each of a plurality of Voters and Proxy Voters has successfully registered to vote, at least one Primary Official or at least one Ballot Agent generates a plurality of groups of unique Ballot RSID, and zero, one or a plurality of unique Ballot PassCodes, Ballot Voting RSIDs, Ballot Voting PassCodes, and zero, one or a plurality of Security Elements, Limits of Use data, Validation data, Authentication data, which form a Voter Ballot Record Group that is then given, messaged, or revealed to each Voter and Proxy Voter for their use to vote with or without any direct or indirect or derivable correlation to the Voter or Proxy Voter; further aforesaid Voter Ballot Record Group is further combined with and correlated to the creation dates and times of Ballot RSID, Ballot Voting RSID and Ballot PassCodes, the creating Official devices unique identifier, the Voter or Proxy Voter location or electronic address and identifier, the Voting Session devices location or electronic address and unique identifier, that are correlated to unique value from a computer software hashing algorithm that computes a unique value for said Voter Ballot Record Group that is immutably stored and added to a database or other type of data storage as the Official Ballot Record Group;

(ii) this invention includes the further steps and methods of preserving privacy and anonymity of Voter and Proxy Voter for their ballot selections and Write-in choices by exchanging with zero, one or a plurality of Voters and Proxy Voters: zero, one or a plurality of Voter Ballot Record Groups (Ballots, Ballots RSIDs, correlated Ballot PassCodes, correlated Ballot Voting RSIDs, and correlated Ballot PassCodes, Security Elements, Limits of Use data, Validation data, Authentication data) zero, one or a plurality of times, without disclosing any exchanges and any lack of exchanges with any Officials;

(iii) Ballot Processing Agents and Primary Officials of the Voting Session exchange and share said Official Ballot Record Groups (Voter Ballot Record Group combined with creation date, time and location and Officials identifier data, and location and device identifier of the non-specific Voter and Proxy Voter) that are recorded on at least one and often a plurality of listings of said Ballot RSIDs, correlated Ballot PassCodes, Ballot Voting RSIDs, Ballot Voting RSID Passcodes, each of which are managed by a plurality of Primary Officials and Primary Officials Voting Session devices, or Ballot Agents and Ballot Agents Devices or any combinations thereof so long as neither any Primary Officials nor any Ballot Agents are able to employ any devices or data access permissions so as to independently correlate, derive, infer or compute the Official Ballot Record Group data and Voter Ballot selections and Write-in Choices to any specific Voter or Proxy Voter; and further that neither any Primary Officials nor any Ballot Agents are able to derive, infer, decode reverse engineer or compute the Voter and Proxy Voter Private Security Items so as to enable any Officials or Agents to view the Voter or Proxy Voter Ballot Selections and Write-in Choices that are associated with their private vault, yet all that Official Ballot Record Group data is otherwise visible for review and confirmation at the Official created Internet web-page record of the cast Ballot Receipt, each said web-page (of a plurality of said web-pages) is stored at the correlated Uniform Resource Locator (URL) Internet address comprised of a unique, extremely hard to guess random symbolic identifier that is, or is correlated to: the unique Transaction Identifier generated for each correlated, completed (successful, unsuccessful, unused) specific Ballot casting event or Investigation event (lost, damaged, stolen, amended, confirmed) for a plurality of Ballot casting events and for a plurality of Investigation events;

10.(D) (i) zero, one or a plurality of Primary Officials (Registration Officials) research and provide each Eligible Voter and each Eligible Proxy Voter with exactly one private, unique and extremely hard to guess, calculate and infer, static and immutable Voter Private Random Symbolic Identifier (Voter Private RSID) and also one correlated, modifiable unique Voter Private Passcode both of which the Voter keeps private and confidential; a plurality of said Primary Officials (Registration Officials) recording, storing, and retrieving a plurality of said Voter Private Random Symbolic Identifiers, Voter Private PassCodes, Voter Public Random Symbolic Identifiers, Voter Public PassCodes along with a unique Voter Creation Transaction Identifier that is correlated to both said Voter Public and Private Random Symbolic Identifiers; said plurality of Registration Officials validating, authenticating, certifying, error checking, error detecting, error correcting, and false error detecting of zero, one or a plurality of Voter Private and Voter Public Random Symbolic Identifiers and PassCodes;

(ii) a plurality of said Registration Officials and Registration Officials Voting Session Devices creating, assembling, populating, updating and amending a plurality of Registered Voter Public Lists containing a plurality of Voter Public Random Symbolic Identifiers, and for each said Voter Public RSID, the correlated dates and times of eligibility to vote, and zero, one or a plurality of correlated Voting Region Identifiers, Polling Station Identifiers, and any other suitable information; said Registration Officials verifying, validating, authenticating, certifying and optionally sharing said Registered Voter Public List with Third Party Auditors and Electoral Board, and Official Candidates but not with the news media or general public until after the election (prevent hackers);

(iii) zero, one or a plurality of a plurality of Registered Voters and Proxy Voters submits zero, one or a plurality of their Voting Access Identifiers and zero, one or a plurality of correlated Voting Access Identifier Passcodes to at least one Ballot Processing Agent and zero, one or a plurality of Ballot Agents independently managed and controlled Voting Session Devices, using any of this inventions methods of voting (such as: In-Person, Courier, Postal Mail, facsimile transmission, Telephone, EMail, Internet, Interactive Television); at least one Ballot Processing Agents comparing each Voting Access Identifier and zero, one or a plurality of correlated Voting Identifier Passcodes to the Official provided lists of Voting Access Identifiers using zero, one or a plurality of Voting Session Devices; zero, one or a plurality of Ballot Processor Agents and zero, one or a plurality of Ballot Agent managed Voting Session Devices to validate, authenticate, certify, authorize and enable, or otherwise: suspend and disable, disqualify and disable, reject and disable a plurality of Voters and Proxy Voters access to the Voting Systems of this invention;

(iv) a plurality of Ballot Agents and Ballot Agent Devices verifying, confirming and validating said Voting Access Identifiers (and zero, one or a plurality of correlated Voting Access Passcodes) are on the list of Official Voting Access Identifiers, thereafter verifying (validating), authenticating, to accept and enable said Voter for using any of the Voter selected Voting methods; at least one Ballot Agents or Agent Devices recording the said provided Voting Access Identifier, zero, one or a plurality of correlated Voting Access PassCodes, Voter Limits of Use Data, Voter Validation data, Voter Authentication data, Voter Certification data, the date, time, location and zero, one or a plurality of Voting Session Devices Identifiers, Voter, Proxy and Ballot Processing Agents Identifiers, which is immutably stored and correlated with a unique Transaction Identifier and Data Signature that is correlated to the Accept4Voting Event which also has a unique Events Identifier that is also correlated with aforesaid data and immutably stored; further step of at least one Ballot Agent or Ballot Agent Device generating one public, unique and extremely hard to guess, Voter Public Random Symbolic Identifier (Voter Public RSID) which also has a correlated Voter Public PassCode which is then revealed, communicated and provided to the Voter or Proxy Voter and is further recorded, stored in or on immutable media; said Voter Public RSID is also randomly inserted into a list of many other Voter Public RSIDs that is randomly mixed (the list contents, not individual Voter Public RSIDs which remain unchanged) so as to obscure the time that any single Voter Public RSID is created that could link to a particular Voter or Proxy Voter, then the List of Voter Public RSIDs or incremental changes thereof is securely sent to Primary (Registration) Officials at regular intervals;

(v) for each of a plurality of Voters and Proxy Voters whom have successfully Registered to Vote, upon further employing any acceptable Official methods of this invention for Voting and casting Ballots (In Person, Postal Mail, Courier, Email, Internet, Telephone, Facsimile transmission, Interactive Television) to submit to at least one Ballot Agent or Ballot Agent Device:

(a) at least one Voter Public Random Symbolic Identifier (Voter Public RSID) and at least one Voter Public PassCode, and optionally:

(b) any number of: Ballot RSIDs and Ballot PassCodes, and optionally (c) zero, one or a plurality of Ballot Voting RSIDs and Ballot Voting PassCodes;

(vi) said Ballot Agent(s) and Ballot Agent Device(s) accepting said Voter Public RSID and Voter Public PassCode, then searching for matching pair of Voter Public RSID and Voter Public PassCode on Public List of Registered Voters, then: (a) upon successfully found a matching pair on the Public List of Registered Voters, then validating as matching by zero, one or a plurality of Ballot Agent and zero, one or a plurality of Ballot Agent Voting Session Devices, then copying, authenticating and certifying said Voter and Voter correlated Security Elements, Limits of Use data, as well as the dates, times, methods and locations available for the Voter or Proxy Voter according to the Public Registered Voter List and any other further processing of claim 3; or, alternatively, (b) upon Ballot Agents or Ballot Agents Devices failing to validate, authenticate or certify said Voter Public RSID and correlated Voter Public PassCode then rejecting, suspending or disallowing Voter or Proxy Voter from access to the Voting System, recording and notifying by messages and signals to each rejected, suspended or disallowed Voter, Proxy Voter and also to Registration Officials; and further at least one Ballot Processor Agent or Ballot Agent managed Voting Session Device alternatively rejects the provided Voter Public RSID and Voter Public PassCode as not being on the Official Public List of Registered Voters; thereafter Ballot Processing Agents or said Voting Session Devices providing zero, one or a plurality of retry attempts until exceeding a threshold value, then denying any further retry attempts for a specified time, or suspending or completely denying that attempted Voter Public RSID and Voter Ballot PassCodes as well as the Voter and their detectable personal electronic machine identifier, electronic address, telephone number, or internet provider (IP) allocated Internet address, or internet provided address or television electronic address or any other personal or device specific identifiers;

(vii) upon Ballot Agents and Ballot Agent Devices providing positive certification of said Voters and Proxy Voters, at least one Ballot Agents or Ballot Agent Devices then enabling each of a plurality of said certified Voters and Proxy Voters and zero, one or a plurality of Personal Communications Devices and related software, security methods and devices, and communications networks used by Voters and Proxy Voters so as to be enabled to connect, engage, communicate and interact with zero, one or a plurality of Ballot Agents and zero, one or a plurality of Ballot Agents Voting Devices, at zero, one or a plurality of locations (physical, virtual) and with zero, one or a plurality of polling stations (physical, virtual) for a plurality of Ballots of individual Voters and Proxy Voters, but only at one location (physical, virtual) and only one polling station (physical, virtual) for each single Ballot of each Voter and each Proxy Voter; for a plurality of Voters and Proxy Voters that each successfully submits a certified pair of Voter Public RSID and Voter Public PassCode, thereafter a plurality of Ballot Agents and a plurality of Ballot Agent Devices granting and providing accesses and secure connections to any number of, and a plurality of Ballot Agent Voting Devices and software programs, and to zero, one or a plurality of Ballot Agent Communications Systems, Networks, Devices and software programs used for that portion of the Voting Session assigned for Ballots Validation, Authentication, Certification, Selections, Amendments, Corrections and Casting, and optionally for creating, recording, assigning, storing, retrieving, reporting, and correlating Ballot Voting Random Symbolic Identifiers, Ballot Voting PassCodes;

(viii) a plurality of Voters and a plurality of Proxy Voters being provided with or otherwise providing at least one Ballot RSID and correlated Ballot PassCode, zero, one or a plurality of Ballot Voting RSIDs and correlated Ballot Voting Passcodes; at least one Ballot Agent or Ballot Agent Device(s) receiving said Ballot RSID and correlated Ballot Passcode, zero, one or a plurality of Ballot Voting RSIDs and correlated Ballot Voting Passcodes; in the case whereby no Ballot Voting RSID is provided, and optionally when a Ballot Voting RSID is provided: said Ballot Agents and Ballot Agents Devices creating (if no Ballot Voting RSID provided) or correlating (if a Ballot Voting RSID is provided) exactly one unique, extremely hard to guess Activated Ballot Voting RSID, which is then further correlated to one extremely hard to guess (randomly generated if no Ballot Voting PassCode is provided) Activated Ballot Voting PassCode (Ballot Voting PassCode if provided) and optionally, a unique Activated Voter Identifier which is then correlated to the said Activated Ballot Voting RSID and Activated Ballot Voting PassCode; said Activated Ballot Voting RSID, Activated Ballot Voting PassCode and Activated Voter Identifier are then revealed, transmitted or otherwise provided to each said Registered Voter and each said Registered Proxy Voter that has begun their Voting Process with said Ballot Agents and Ballot Agent Voting Session Devices; said correlated Activated Ballot Voting RSIDs and Activated Ballot Voting PassCodes are recorded and stored on or in immutable media, along with date, time, Ballot Agent Identifier, Ballot Agent Voting Session Devices Identifier, and Transaction Identifier; said Activated Voter Identifier, Activated Ballot RSIDs and Activated Ballot PassCodes thereafter managed by Ballot Agents for the entire Voting Session, and eventually communicated to Primary Officials in groups that are randomly mixed without any time data or any other data that could be used to correlate a Voter or Proxy Voter to a specific Activated Voter Identifier, Activated Ballot RSID, Activated Ballot PassCode;

(ix) For a plurality of Ballot Agents, Ballot Agent Devices, Voters and Proxy Voters: at least one Ballot Agents and Ballot Agent Devices then either: (a) admitting to the Ballot Agent Voting System, each certified Voters and certified Proxy Voters that was found on the Public List of Voters RSIDs; said Ballot Agents and Ballot Agent Devices establish a secure connection between the Ballot Agents Voting System to the Voter or Proxy Voter employed communications systems, networks, devices and software; zero, one or a plurality of Ballot Agents and at least one Ballot Agent Devices then render exactly one optical, electronic, electro-magnetic Official Voting Ballot upon the Ballot Agent Devices or Voter or Proxy Voter personal devices; Ballot Agents and Ballot Agent Voting System Devices then further apply the previously said Activated Ballot RSID to the rendered Official Voting Ballot, then further enabling the Ballot Agent Voting System software to allow each said enabled Voter and enabled Proxy Voter to mark to select zero, one or a plurality of Ballot Candidate or Group choices, to provide zero, one or a plurality of alternative Write-in Candidate or Group choices, and mark to select zero, one or a plurality of Proposals, and to provide zero, one or a plurality of alternative Write-in Proposals, and to further add zero, one or a plurality of private, Personal Security Items so as to complete their Official Voting Ballot and correlated Activated Ballot RSID which is then submitted for error checking, error detecting, error correcting, zero, one or a plurality of amendments, one or a plurality of resubmissions—all of which is monitored, controlled, co-joined, merged and processed by the Ballot Agents and Ballot Agents Voting System Devices and software programs; and further whereby each of a plurality of cast Official Voting Ballots, Activated Ballot RSIDs, said Voter and Proxy Voter particular Candidate or Group choices and Candidate or Group Write-in choices, Proposal selections and Proposal Write-in values are combined with the date, time, unique location identifier, polling station identifier, unique Ballot Agent Identifier, unique Ballot Agent Voting Device Identifier, Agent Communication Network Identifier, Voter-Proxy Device Identifier, Voter-Proxy Network Identifier, Voter-Proxy Device Identifier, Voting Session Identifier, Voting Transaction Identifier, Official Cast Ballot Image, Cast Ballot Receipt, Cast Ballot Data Vault electronic address (example: Internet address Uniform Resource Locator), and the unique Cast Ballot Data Vault Access RSID that is provided by the Voter, Proxy Voter or Agent Voting System Devices when a Ballot is submitted (cast) for counting and tallying;

Optionally encrypting the contents of said Cast Ballot Data Vault using the Cast Ballot Data Vault Access RSID by employing zero, one or a plurality of encryption algorithms and public encryption keys provided by the Voter or the Ballot Agents, Agent Encryption Devices, Agent Encryption software;

and further upon successful completion and submission of said co-joined and merged Official Voting Ballot and Activated Ballot RSID and said Voter and Proxy Voter choices, Write-in choices and selections, said Ballot Agent and Ballot Agent Voting System Devices and software programs: accepting, recording, imaging, storing, data extracting (reading), verifying, counting, tallying, retrieving, publishing, auditing, investigating, correcting, confirming, certifying and any further or any other processing of claim 3, for creating of a plurality of "Cast Ballot Public Record" for each Cast Activated Official Ballot, which is securely stored in or on immutable media, then accurately copied and verified as an exact duplicate before forwarding said duplicate copy to Primary Officials for counting, tallying, publishing and certifying, publishing, auditing, investigating, amending, confirming; further step of storing an exact copy of the said "Cast Ballot Public Record" in the Cast Ballot Data Vault that is correlated to the Official Voting Ballot RSID;

and the further steps and methods of zero, one or a plurality of Ballot Agents and zero, one or a plurality of Ballot Agent Voting System Devices and software programs verifying and then marking the List of Voter Public RSIDs so as to indicate the cast Ballot status (examples: CastOK, Spoiled, Incomplete) and to signal and disable the same Voter Public RSID from being used again (unless allowed multiple ballots by the Electoral Board and Voting Session Rules in which case the threshold limit is checked and the Voter or Proxy Voter is enabled or disabled accordingly); and further Primary Officials (Registration Officials) regularly review said List of Voter Public RSIDs and upon detecting that a Voter Public RSID has voted, obtains the correlated Voter Private RSID and accesses that Voter Registration data to mark that they have cast a ballot, and the status of that Ballot when submitted; or, alternatively (b) at least one Ballot Processor Agent or Ballot Agent managed Voting Session Device alternatively rejects the provided Voter Public RSID and Voter Public PassCode as not being on the Official Public List of Registered Voters; thereafter Ballot Processing Agents or said Voting Session Devices providing zero, one or a plurality of retry attempts until exceeding a threshold value, then denying any further retry attempts for a specified time, or suspending or completely denying that attempted Voter Public RSID and Voter Public PassCode, as well as recording the Voter (or Proxy Voter) Public RSID and their detectable personal electronic machine identifier, electronic address, telephone number, or internet provider (IP) allocated Internet address, or internet provided address or television electronic address or any other personal or device specific identifiers;

(x) for each of a plurality of Voters and Proxy Voters: (a) successfully completing and submitting at least one of their Ballots, Ballot Agents and Agents Devices generating a new Voting Storage Identifier, allowing the Voter to enter their own private PassWord or PassCode and zero, one or a plurality of Personal Security Items which are then securely stored on immutable media using POEM methods, optimizing for data storage and data retrieval; a plurality of Ballot Processing Agents and Ballot Agent Devices waiting for a plurality of successfully cast Ballots to accrue, then sending and transmitting time delayed groups of randomly mixed, successfully completed Voter Ballot Identifiers, their correlated Voter Candidate or Group choices, Write-in Candidate or Group choices Proposals, and Write-in Proposals, to at least one Officials Voting Session Devices and zero, one or a plurality of Primary (Registration) Officials employing secure communications methods, software, networks and devices; Ballot Agents and Ballot Agent Devices restricting Voter specific and inferential data from Primary (Registration) Officials and zero, one or a plurality of Electoral Board members, otherwise securely communicating for a plurality of and for each Activated Voting Ballot RSID, correlated Ballot Candidate Choices and Write-in Candidate choices, Proposal selections and Write-in Proposal selections, certification data, zero, one or a plurality of Security Elements, Limits of Use data, signals and messages for each Activated Voting Ballot and optionally, the Internet address (Uniform Resource Locator: URL) where the Ballot data is stored for Voter private auditing, but absolutely no Voter or Proxy Voter specific, derivable or inferable information that would allow Primary (Registration) Officials or Electoral Board members to identify the Voter or Proxy Voter, nor to enable anyone to link them to any of their correlated Activated Voter Identifier, Activated Ballot RSID or their Activated PassCodes; or, alternatively, (b) upon Ballot Agents or Ballot Agents Devices failing to validate, authenticate or certify said Voter Public RSID and correlated Voter Public PassCode then rejecting, suspending or disallowing Voter or Proxy Voter from access to the Voting System, recording and notifying by messages and signals to each rejected, suspended or disallowed Voter, Proxy Voter and also to Registration Officials; and further at least one Ballot Processor Agent or Ballot Agent managed Voting Session Device alternatively rejects the provided Voter Public RSID and Voter Public PassCode as not being on the Official Public List of Registered Voters; thereafter Ballot Processing Agents or said Voting Session Devices providing zero, one or a plurality of retry attempts until exceeding a threshold value, then denying any further retry attempts for a specified time, or suspending or completely denying that attempted Voter Public RSID and Voter Ballot PassCodes as well as the Voter and their detectable personal electronic machine identifier, electronic address, telephone number, or internet provider (IP) allocated Internet address, or internet provided address or television electronic address or any other personal or device specific identifiers;

(xi) and for aforesaid steps and methods, the further steps and methods of claim 3 whereby said Ballot Processing Agents employ, one or a plurality of, and any types of similar, identical or distinct and independent methods of: data compression and decompression, data encryption and data decryption, data error checking, data error detecting, data correcting as well as false error detection for said Ballot Processing; said Ballot Processing Agents further providing distinct and independent steps and methods for validating, authenticating and granting Voters access to the Ballot Processing System and for all other steps and methods of completing, error checking, amending and submitting Ballots for tallying, storage, certification and submission of Ballot filtered data to Officials for tallying, as well as for all the after Voting auditing procedures and publications;

(xii) and for the aforesaid and following claims, steps and methods whereby for a plurality of Voters, Proxy Voters, Officials, Primary Officials, Registration Officials, Primary (Registration) Officials, Electoral Board members, Ballot Processing Agents, Ballot Agents, employing the Official Devices, Official Registration Devices, Ballot Agent Devices, Ballot Agent Voting Devices, Ballot Agent Vote Processing Devices according to claim 1, which are used for receiving, validating, authenticating, verifying, imaging, reading, extracting, copying, duplicating, securely storing, securely retrieving, securely communicating the Voters, Proxy Voters, Primary Officials, Electoral Board Members, Ballot Processing Agents private personal information and Official data excluding all the Voters Ballot choices and Write-in selections as well as any connective data or derivable connective information that would link any Voter or Proxy Voter to a particular Ballot, Ballot choices and Write-in choices; and any such further processing, steps and methods according to claims 1 through 20;

(11) Network and Multi-Processor Parallel Computing with Artificial Intelligence Software (a) and the further steps and methods of employing a plurality of computers running a plurality of software programs as functioning independently or cooperatively via zero, one or a plurality of any types of networks and for any types of communications systems;

(b) and the further steps and methods of employing a plurality of computers running a plurality of software programs functioning independently or cooperatively employing any number of, and any types of computer neural networks, artificial intelligence software, electronic or optical or electromagnetic vote processing devices and communication networks used for data processing, storage, telemetry, communications, security, and for any types of functions or processes of this invention (such as: Ballot image capturing, Ballot data field reading and decoding, data storage, data search, data retrieval, intelligent image processing, RSID character reading, device assignment and prioritization, resource allocation, data searches, data retrievals, data communications, data security, system access security, Voter authentication, Registration processing, Ballot sorting, tallying, analysis, reporting, error processing (error detection, error identification, error specification, error localization, error position locating, error marking, error correction, error data recovery, false error detection rejection), validation, authentication, certification, forgery detection, forgery rejections, duplicate detections, duplicate rejections, duplicate extractions, Document design, printing, Voter Registration, Ballot processing, Voter Registration research, Ballot sorting, distribution, receiving, vote processing device workload balancing) and for any other claimed or implied steps and methods described herein this invention and of all prior versions of this invention.

What is claimed is:

1. A Computerized Voting System comprising of the methods and system of Voter Registration and for Voter Ballot Casting, by conducting communications with a plurality of Voters for the purposes of Registration and Voting in zero, one or a plurality of Voting Sessions, by delivering Voting Session Documents to, and receiving said Voting Session Documents from: a plurality of Voters, a plurality of potential Voters, and a plurality of Eligible Voters by any combination of at least one delivery methods of:

(i) a plurality of In-Person or designated Proxy persons physically attending a Poll Station to Vote;

(ii) employing zero, one or a plurality of postal mail or courier delivery services, (iii) employing the Internet for a plurality of: electronic mail messages, electronic data of Internet web-pages, forms, data, audio, video, images, text, symbols, alphanumeric data transmissions and receptions;

(iv) Telephone-voice or touch-tone signals, audio and video messaging, texting messages, electronic mail Facsimile or personal audio-video transmissions and receptions;

(v) personal data devices: electronic data tablets, cellular, telephones, personal computers;

(vi) Internet and Telephone Document facsimile transmissions and receptions;

(vii) Interactive Television, secure interactive channel broadcasts, interactive menus and private channel signals, electronic mail, audio and video messaging, texting messages, personal audio-video transmissions and receptions:

(viii) in-person video, personal audio recordings, records transmissions and receptions;

(ix) connecting to and employing at least one public or private communications networks and zero, one or a plurality of secure private transmission networks;

whereby said Computerized Voting System comprises of:

(A) a plurality of electronic voting systems, operating independently or interconnected via zero, one or a plurality of networks, whereby each voting system is comprised of at least: one data processing computer running data processing software, zero, one or a plurality of telephone communication devices, zero, one or a plurality of computers running software programs to process telephone voice audio and facsimile transmissions, zero, one or a plurality of Internet communication systems, zero, one or a plurality of Internet communication devices, zero, one or a plurality of Internet webserver computers, zero, one or a plurality of Internet client computers, zero, one or a plurality of Internet electronic mail server computers, at least one computer security server controlling voting system security, zero, one or a plurality of optical Document scanners, any number of optical barcode readers, any number of camera devices, zero, one or a plurality of magnetic ink printed Document processing devices, zero, one or a plurality of computer printers, zero, one or a plurality of computer Compact Disc Read Only Media and—Digital Video Data reader and writer devices, zero, one or a plurality of electro-magnetic memory devices, zero, one or a plurality of security authentication devices, zero, one or a plurality of electronic voting terminals, zero, one or a plurality of paper Document voting processing devices, zero, one or a plurality of interactive television systems devices, zero, one or a plurality of computer Uninterruptable Power Supplies, zero, one or a plurality of ancillary electronic devices, zero, one or a plurality of physical Document sorting, counting, processing and handling devices, and zero, one or a plurality of any other types of electronic devices, electro-magnetic devices, electro-optical devices or electro-mechanical devices that shall also include any number of: data acquisition devices, electronic, electromagnetic, optical or biological or other computing or analytical devices, communication networks, electronic data transmissions, any other man-made devices, hereafter referred to individually and collectively as Vote Processing Devices as well as at least one related computer software programs or algorithms—which are used individually or in any combination, with zero, one or a plurality of: Documents, forms, Ballots, Containers, data elements, data sets, data or physical Objects, data transmission, security elements;

(B) For a plurality of voting sessions, a secure electronic voting method whereby at least one Voting Session Official is using a Computerized Voting System comprising of at least one computer executing a plurality of computer programs of instructions directing the computerized voting system and other related devices to be acting as a polling station for Voter Registrations and for Voter Ballot casting, during preset periods of time and ranges of dates, said Computerized Voting System (CVS) is used by Officials for:

(i) researching Voters designing Documents (Voter Registration, Voter Ballots, Voter communication preferences, Voter error processing (error detection, error identification, error specification, error localization, error position locating, error marking, error correction, error data recovery, false error detection rejection), in any format (POEM—physical, optical, electronic, magnetic);

(ii) generating Documents, error correcting Documents, marking each Document with at least one unique Identifier and zero, one or a plurality of correlated barcodes and a correlated barcode values for at least one unique Document Identifier;

(iii) marking zero, one or a plurality of Document Containers with zero, one or a plurality of correlated voting session data, Document type information, barcodes;

(iv) distributing Documents to Voters (physically, optically, electronically electronically), and also tracking of Documents Document contents, Document Containers and contents thereof;

(v) receiving a plurality of Voter return Document Containers and zero, one or a plurality of Documents therein—also recording the date, time and location received at, further verifying within data and time limits for accepting to processing or otherwise rejecting as outside of time constraints;

(vi) upon accepting, scanning (physically, optically, electronically electromagnetically) then generating a complete accurate image of said received Document Containers and content Documents therein and further correlating associated Container security and transmission data;

(vii) creating an optical replica of the received Voter Container, Container Documents therein and also for any related data fields and markings thereto so as to be rendered as an exact duplicate copy for human optical visual processing and optical-electronic data processing;

(viii) selecting and applying zero, one or a plurality of Document reading Templates for each Container and for each type of Document (Voter Registration, Proxy Registration, Language Selection, Ballots, Voter Complaint, Official Investigation, Official Amendment, Document Validation, Document Authentication, Document Certification);

(ix) extracting, recording, storing relevant Document data and Voter data acquired (Voter Registration data, Voter Ballot choices, Voter request data, Voter Identification Documents);

(x) for a plurality of Voters, Documents and Containers: evaluating aforesaid Documents, Containers, Official data and Voter data and related markings, then accepting or rejecting a plurality of Voter Documents (Voter Registrations, Voter Language selection forms, Voter Ballots, Voter request forms (Ballot replacement, Ballot error report), Voter Identification Documents) or Containers or Voter markings thereon said Documents and Containers;

(xi) actively storing a plurality of Voter and Official information, Document designs, physical Documents, digital Documents and related data, markings and attachments;

(xii) at least one computer device acting as a tally site device for Ballots;

(xiii) at least one computer device acting as a publication site for the tally and other results;

(xiv) said polling station, tally site and publication site being grouped together in a same computer, or, distributed among a plurality of computers, and may be located at a virtual or physical polling station, and further may be connected via at least one computer communications network to a plurality of other computers at a plurality of virtual and physical polling station locations by employing secure cryptography communications methods and protocols so as to guarantee Voting Session privacy, security and data integrity requirements of an electoral process throughout the duration of the method and the electoral process, whereby said method of secure communications comprising of these steps:

(a) according to voting session rules for secret sharing of cryptographic keys and protocols, providing an Electoral Board and Officials operating said tally site with at least one pair of symmetric keys and at least one pair of asymmetric keys, allowing access to at least one private decryption key of each key pair or a private secret component of either or both said pairs of keys correlated encryption and decryption algorithms, further access to at least one digital signature encoding-decoding algorithm and software program, and to a plurality of: Ballot-ID RSIDs (Random Symbolic Identifiers), correlated Voting Ballot RSIDs, correlated Ballot PassCodes, correlated Ballot Validation RSIDs, Voter Registration Identifiers, Proxy Voter Registration Identifiers, Voter-Proxy Language Selection Identifiers, and correlated data sets of said Voter Registrations, Proxy Voter Registrations, voter-proxy Language Selections—that are provided only to a number of tally site Officials and tally site Official computing devices as determined by a quorum of the members of said electoral board and Officials;

(b) for each polling station and related Official sites:

(i) initializing and starting security systems, communications systems, research systems, Document data acquisition, analytical, data processing, error handling systems, reporting and publishing systems;

(ii) further providing said polling station with at least one pair of Official Polling Station asymmetric and symmetric electronic data encryption-decryption key pairs comprised of published, accessible public key and a securely stored Official private key;

(iii) starting researching, creating, generating, delivering, accepting, Document processing, error and forgery processing, reporting and publishing of a plurality of Voter Registrations, Ballots, Voters Document return Containers, digital Documents, digital Containers, and zero, one or a plurality of other Voter and Official Documents at each polling station (virtual, physical);

(iv) correlating aforesaid processing relative to the local preset dates and times allowable for the voting session and further to any adjustments made for local date and time, daylight savings time, and as may further be allowable by any Official exceptions granted thereof, (v) providing each Certified Eligible Voter or their Proxy with at least one Ballot, and zero, one or a plurality of Ballot Return Containers, zero, one or a plurality of correlated Ballot PassCodes for each Ballot and for a plurality of Ballots, and zero, one or a plurality of correlated unique Container Identifiers and PassCodes for each Ballot Return Container and for a plurality of Ballot Return Containers;

(vi) providing each Voter Certified Eligible Voter or their Proxy with at least one pair of Official Polling Station asymmetric and symmetric electronic data encryption-decryption key pairs comprised of securely stored Voter private key and an Official use private key;

(vii) creating a plurality of organizational groups each comprising of zero, one or a plurality of sub-groups and correlated attributes thereof for organizing a plurality of: data, RSIDs, processes, transactions, as well as for at least one Documents, Ballots, Voter Registrations, Proxy Registrations, Language selection forms, Containers, data encryption key pairs, encrypted data, encrypted Ballots, encrypted Voter Registrations Events, errors, communications, images, tallies, reports, publications, WebPages, Official records, Voter data, security elements, and further employing computer programs for sorting, correlating and organizing data into aforesaid groups and sub-groups;

(viii) initializing zero, one or a plurality of computers running artificial intelligence programs performing distributed processing and optimization of task prioritization and workload balancing among a plurality of vote processing devices, and further providing distributed processing and optimization for zero, one or a plurality of tasks and processes: data processing data acquisition, Document scanning and imaging, Template data extraction, Document image rendering, voting and Registration device processing, communications, security, data organization, data storage, data retrieval, data processing, key encryption, key decryption, RSID generation, RSID searching, session Identifier generation, Receipt generation, selection encoding, data decoding, message encryption, and for any other tasks, processes or any steps and methods of the invention, and further prioritizing said allocation of computing and devices resources;

(c) (i) each potential Voter for a voting region, business or group is researched and contacted to register to vote by completing Voter Registration and Language forms also submitting zero, one or a plurality of required Documents; each Voter and is either rejected or, accepted and then added to the Certified Eligible Voters list; further step of zero, one or a plurality of Voters notifying Officials to assign zero, one or a plurality of Proxy Voters to cast a vote on behalf of the Voter by providing a Proxy consent form with Proxy personal contact information; Officials recording zero, one or a plurality of Proxy Voters contact information and further correlating said Proxy Voters to the originating Voter record in the Certified Eligible Voters list;

(d) (1) a plurality of Voters and plurality of Proxy Voters casting a vote physically or electronically or optically or electromagnetically through a set of computer software programs acting as a Voter agent at a virtual site or a physical site and using at least one vote casting platform, the vote casting step comprising sub-steps of: Officials creating a plurality of Ballots comprised of two parts, a Master part and a Receipt part and said Ballot parts are correlated by a shared unique Ballot-ID RSID (random symbolic Identifier) comprised of a randomly selected group of numbers or symbols or, numbers and symbols, that as a group pattern is extremely near impossible to guess derive or predict; said Ballot is marked or embedded with said Ballot-ID RSID on each part, said Ballot-ID RSID correlated to a unique barcode symbol and a unique barcode value correlated to the unique value of the Ballot-ID RSID, Officials sending at least one Ballot to the Voter or Voter Proxy, said Voter or Proxy marking each Ballot with zero, one or a plurality of Official pre-defined choices and Voter or Proxy writing-in and choosing zero, one or a plurality of Voter or Proxy Write-In choice(s) and zero, one or a plurality of Voter Personal Security Items; said Voter or Proxy casting said Ballot thus causing Polling Station Voting Device(s) to generate: a unique Ballot Casting Identifier (Session Identifier) that is used as a Digital Signature Key Value for the Ballot casting transaction, a predefined choice Identifier to identify of each vote cast without repetitions thereby identifying each of the vote choices and Write-In choices by means of selecting a value for the unique Ballot Identifier within a predetermined range, said choice Identifiers comprising a set of Voter Ballot data correlated to said Ballot-ID RSID; the Voter or Proxy obtaining a voting Receipt which provides validity at least to said unique Ballot Identifier Ballot-ID RSID, Ballot voting RSID, Ballot casting transaction Identifier and the set of Ballot pre-defined choices and Voter or Proxy Write-In choices, and at least one Jurisdiction Identifier for said electoral process and which verifies the results of the voting without revealing the Ballot PassCode or Voter Personal Security Items; said Ballot Casting Identifier being a unique, extremely near impossible to guess predict or derive group of symbols that is of a different size length or different composition of reference symbols compared to any other Ballot-ID RSID of the current Voting Session;

(d)(2) for digital rendering of said Ballot and voting choices, Officials creating and each Voter accessing a uniquely marked digital envelope protecting Voter's privacy, said digital envelope contents comprising of: Ballot-ID RSID, Ballot Voting RSID, Ballot PassCode, the set of Voter Ballot data, Voter private security items, at least one Jurisdiction Identifier, the Ballot casting transaction Identifier, and an electronic digital rendering of an exact duplicate optical-visual representation of said marked Ballot, said digital envelope unique marking comprising of a pre-assigned Ballot Container RSID and at least one Jurisdiction Identifier, after or before said sub-steps: carrying out a Voter authentication proof, carrying out a Ballot-ID RSID authentication proof, carrying out a Ballot Validation RSID authentication proof, carrying out a Ballot Voting RSID authentication proof, carrying out a Ballot PassCode authentication proof, encrypting said digital envelope contents by using the secret algorithm component of said symmetric algorithm and the Ballot-ID RSID as the random key to symmetrically encrypt said digital envelope contents, digitally signing said digital envelope and contents with Voter Identifier or Proxy Identifier or Voter created digital signature or Proxy created digital signature, then applying at least one public part of a pair of asymmetric keys taken from the correlated voting site, a correlated digital certificate of the Electoral Board or Officials, then applying the correlated asymmetric encryption public key and correlated asymmetric algorithm to further encrypt said digital envelope symmetric encrypting key (Ballot-ID RSID) and Voter or Proxy digital signature, then delivering said symmetrically encrypted, digitally signed envelope contents and asymmetrically encrypted Ballot-ID and asymmetrically encrypted Voter or Proxy digital signature to said digital Ballot box of the correlated virtual or physical site, generating a proof of delivery of said digital envelope in the polling station which is transmitted to Officials of the voting site and to the Voter agent as a voting voucher and Receipt of having cast the vote for each Voter, recording and redundantly storing each digital envelope and contents thereof and each correlated delivery Receipt at the receiving voting site, transmitting a copy of each proof of delivery and each delivered signed encrypted Ballot to a plurality of central auditing computers and data storages, a plurality of central auditing computers and data storages receiving and redundantly storing a plurality of digitally signed encrypted Ballots and correlated delivery Receipts, ongoing tallying all Ballots received at each virtual voting site and each physical voting site and comparing to the total number of delivery Receipts at each virtual voting site and physical voting site, comparing said total Ballots received tally and delivery Receipts tallies to the central computer tallies of Ballots and delivery Receipts, reconciling zero, one or a plurality of differences in tallies at any site and also reconciling to central auditing computers;

(d)(3) the members of the Electoral Board and Officials collaborating so that they have access to said at least one pair of asymmetric keys including the private key or said private component and using said private component to have access to the content of the digital envelope; said Officials decrypting each delivered Ballot and a plurality of delivered Ballots, extracting each set of Voter data from each delivered Ballot, extracting a plurality of Voter sets of data, evaluating each Voter set of data for over-voting and under-voting then segregating and sorting said Voter sets of over-voting and under-voting for separate processing, for Voter sets of correct voting extracting, reading, decoding and tallying each set of Voter choices and Voter Write-In choices, and further for a plurality of Ballots having Voter sets of correctly cast voting—tallying a plurality of sets of Voter choices and Voter Write-In choices;

(4) zero, one or a plurality of Certified Eligible Voter and Proxy Voters generating:

(i) zero, one or a plurality of digital signatures by said Voter or Proxy Voter or Voter agent using CRVS devices and software programs for creating zero, one or a plurality of their own private data key or the private key components of a pair of symmetric or asymmetric or any other type of encryption-decryption key pairs;

(ii) and any combination of zero, one or a plurality of private Voter Personal Security Items comprised of any combination of: Voter created PassWord(s), passphrases, PassCode(s), graphic symbols, images, personal biological data (eye retinal scan, fingerprint(s), voice, ear patterns, DNA sample, eye pupils, face patterns), personal signatures and initials; and the further optional step of each Voter pre-validating and confirming they are in fact Certified Registered Voters or Proxy Voters whom are eligible to vote in the current voting session by submitting zero, one or a plurality of their Personal Security Items that were previously submitted when registering to vote with Officials;

(4) zero, one or a plurality of Voters, Proxy Voters, and electronic Voter Agents and Proxy Agents attach or embed or enscribe the Voter private key provided by Officials in prior sub-step (d)(4)(i), and zero, one or a plurality of private keys and Voter Personal Security Items of prior sub-step (d)(4)(ii) on zero, one or a plurality of physical, optical, electromagnetic or electronic Ballot return Containers (digital envelope)

before delivery of said envelope to the polling station Officials or delegated Official Receivers;

(e) A plurality of computer programs executing coded instructions directing the Computerized Voting System to carry out a vote casting process operation in which each Voter casts a vote electronically through a set of programs acting as a Voter Agent and using at least one computer device acting as a vote casting platform, comprising sub-steps of: in that at the beginning of the process of vote casting all required Official held Voter private keys and Voter public keys, secure PassWords are privately disclosed to the Voter, or are being directly selected or generated by the Voter; said protected private and public keys component are sent to the Voter by polling station computers and devices via means of said communication networks, whereby each said network is secured from tampering and eavesdropping by robust encryption of data prior to transmission (virtual private networks) then accurately decrypted and error checked and error corrected at the receiving devices; each Voter or Proxy submitting the unique Ballot Identifier (RSID) that is extremely hard to guess, estimate or derive, the Voter or Proxy marking zero, one or a plurality of Officials predefined voting choices for zero, one or a plurality of candidates, parties, and proposals and further adding zero, one or a plurality of Voter or Proxy Write-In choices of candidates, parties, proposals; then Officials devices generating a digital vote casting signature for Voter and Proxy Ballot selections of pre-defined choices and Write-In choices; generating a Ballot casting session key incorporating CRVS internal processing session information, Officials authorization keys, voting date, voting time, voting polling station Identifier, voting polling station location, and zero, one or a plurality of Ballot RSIDs, generating a pair of public-private digital data keys for use as a unique Ballot casting-voting transaction Identifiers, correlating said Ballot casting-voting transaction Identifiers to the Ballot RSID and vote casting signature, providing each Voter with a voting Receipt which discloses the public key of the transaction Identifier, voting date, voting time, voting polling station Identifier, voting polling station location, and which verifies the results of the Voters vote casting-voting process with an exact copy of all voting selections or without disclosing content of the Voter choice by the digital vote casting signature, CRVS devices running software programs constructing a digital envelope protecting Voter's privacy by using a public component of at least one pair of symmetric or asymmetric encryption keys of an Electoral Board or Officials; each Voter adding zero, one or a plurality of personal security elements to said digital envelope comprising of a digital signature and zero, one or a plurality of private Voter Personal Security Items comprised of any combination of any number of: Voter created PassWord(s) and PassCode(s), graphic symbols, images, personal biological data obtained from eye retinal blood vessel pattern scan, fingerprint(s voice, ear size and shape patterns, DNA-DioxyNucleic Acid samples from skin, hair or blood, eye pupils colors and patterns, skin galinometric readings, skin blood capillary readings, breathing patterns and breath exhalation contents, body movements and facial micromovements, reflex actions, responses to tactile and auditory stimuli, face structure patterns, personal written signatures, personal initials; said digital envelope containing at least the Voter choice, after or before said sub-steps, carrying out a Voter authentication proof, generating a proof of delivery of said digital envelope in a computer server acting as a Polling Station which is transmitted to the Voter, Proxy and Voter agent as a voting voucher of having cast the vote for each Voter, fully separate from non-coded Voter choice; wherein said program also comprises parts of computer program codes that are readable by a computer system to carry out a vote verification process operation that allows said Voter to verify the Voter's vote by accessing the results published on a computer device acting as a publication site, which contain the Voter's unique Ballot Identifier, carrying out a search of the unique Ballot Identifier and allowing the Voter to file a claim supported on said voting Receipt and said voting voucher in the Event of lack of the unique Ballot Identifier in the results published, either with or without disclosing the Voter choices; and further wherein said voting voucher is validated at said Voter Registration devices and Voter Ballot Polling Station devices by means of a digital signature and zero, one or a plurality of private Voter Personal Security Items comprised of Voter created PassWord(s) or PassCode(s), graphic symbols, images, personal biological data (eye retinal scan, fingerprint (s), voice, ear patterns, DNA sample, eye pupils, face patterns), personal signatures, initials; said voting Receipt is validated by means of a digital signature with a private component of said at least one pair of symmetric or asymmetric or any other aforesaid type of digital data encryption-decryption keys and key pairs utilized by of said Polling Station; when said Voting Receipt has been encrypted by means of a symmetric or asymmetric key cryptosystem, using a session key generated by the Voter or Proxy Voter or Voter Agent or Officials or Electoral Board, or Officials computers, devices and software of the CRVS; using a private component of said unique pair of asymmetric or symmetric or any other type of aforesaid data encryption keys, key-pairs and data encryption-decryption algorithms provided and used by each Polling Station devices and Officials, whereby at each Polling Station used for receiving Voter Documents or Voter data or Officials Documents, Officials reports or Officials data: Officials and Officials Voting Session Devices digitally signs each Container envelope(s) used to transmit or submit or receive or validate or authenticate or certify or store or retrieve or amend or error detect or error check or error repair: (i) a cast Ballot, or (ii) Voter Registration, or (iii) Voter Language choice, (iv) or Voter Investigation Request (v) Official Investigation Report or (vi) Official Amendment, or (vii) Official Validation, (viii) Official Authentication, (ix) Official Certification; (x) Official Tallys; said Official Voting Session Devices also digitally sign each received: Ballot, Voter Registration, Voter Language selection, Voter Investigation Request, Official Investigation Report, Official Amendment, Official Validation, Official Authentication, Official Certification, Official Tally and for a plurality of any other types Documents or Voter data or Officials Documents, Officials reports or Officials data; said Officials Voting Session Devices creating lists of certified eligible Voters and Proxy Voters who submitted Documents or information for processing, list of Identifiers of Voters and Proxy Voters started Registration or casting their vote or submitting an investigation request but did not complete the submission for recorded reasons also included, and digitally signed for all Official reports, and any other and contents of the digital Ballot Box, and the digital Voter Registration Box; Officials securely storing and securely sharing among other Officials and Official devices, zero, one or a plurality of aforesaid Documents and data of zero, one or a plurality of Voters and Officials;

(ii) further whereby for electronic voting methods and for optical scanned Documents as well as for both in-person voting or paper-ballot mail-in voting—zero, one or a plurality of Voters, Proxy Voters, Officials or devices may optionally add zero, one or a plurality of Voter Private Authentication Keys: PassWords, PassCodes, phrases, signatures, graphics or images which is then computer algorithmically combined with the Ballot Data Set and Voting Session Data Set which are all correlated then aggregated as a single Object then encrypted using Official Public Encryption Key and Official Encryption Algorithm, then transmitted securely for decryption (using Official Private Decryption Key, and Officials Decryption Algorithm) then reviewed for error checking, error correcting, review, tallying, storage and publishing but keeping the Voter Private Authentication Key(s), and the Ballot PassCode secret and unpublished—and further similarly for a plurality of Voter Registration Documents and any other Documents of this invention;

(f) counting and tabulating the Voter choice of each Voter and publishing the results at the publication site and allowing said Voter to verify said results by using said voting Receipt with or without disclosing the Voter choice through accessing the results published on the publication site, which contain the Voter's unique Ballot Identifier, carrying out a search of the unique Ballot Identifier and allowing the Voter to file a claim supported on said voting Receipt and said voting voucher in the Event of lack of the unique Ballot Identifier in the results published, with or without disclosing the Voter choices thereof said Ballot;

(g) receiving and investigating zero, one or a plurality of Voter discrepancy reports, recording investigation results, amending records and marking each amended Ballot as being amended, reporting amended results to Voters, auditors, and publishing all amendments;

(i) when the voting period nearing end date and end time, Officials or Electoral Board sending to each Polling Station a closing order from which time no new connections are accepted from the Official Voter Agent for which each polling station and zero, one or a plurality of Officials carries out following operations: obtaining a cryptographic summary of the sets of digital envelopes issued or digital Ballot box; obtaining a cryptographic summary of the Voter Identifiers which having started the vote casting process still did not complete it; sending to the electoral board the two preceding cryptographic summaries or a single summary of said set of digital envelopes with said Voter Identifiers who did not still complete the vote casting process; and after a predetermined time elapses which allows the Voters that are still in the process of voting to end the vote casting processing, Voter Registration processing and other Documents processing;

(h) Officials actively authenticating, validating, monitoring, tracking, and assessing: actively participating voters, proxy voters, officials, official devices, voter and proxy voter devices, communications systems, computer processes and services—allowing valid, authentic activities but disallowing invalid, unauthenticated, and unapproved activities—and further upon reaching or surpassing the allowed end date and end time for Registration or voting session ballot casting, actively stopping receiving, issuing and processing of all Ballots, Registrations, and Document Containers at the end of the Registration and voting sessions; certifying the final results and closing the voting session relative to the local preset dates and times allowable for the voting session and further to any adjustments made for local date and time, daylight savings time, and as may further be allowable by any Official exceptions; at least one Official declaring the Voting Session as closed, then sending the complete digital Ballot box to the Electoral Board whose members and Officials and Official Agents use a plurality of CRVS computers, software program and related devices to tally, summarize, analyze, generate and review reports of voting session results and resolve zero, one or a plurality of outstanding issues, then at least one or a plurality of Electoral Board members and Officials and Official Agents verify, validate, certify then publish the final amended records, tallies, calculations, summaries and reports pertaining Voter Registrations, Ballots, and any other relevant aspect of the Voting Session to the Voters, sponsoring business(es), political party(s), government, non-political groups, and optionally to the public and public news media.

2. The Computerized Voting System of claim 1 wherein: at least one Official uses at least one computer running software programs for the purposes of creating, defining, assigning and correlating each type of Security Element such that at least one Official:

(A)(i) generating a plurality of Random Symbolic Identifiers (RSIDs) which are constructed so as to be extremely near impossible to guess, derive, extract, predict or pre-calculate; and applying sorting and grouping mathematical algorithms in computers running software programs so as to also derive the RSID symbolic characters and RSID correlated numeric value which may alternatively been pre-computed and stored with the binary value so as to facilitate sorting, organizing, storing and retrieval of RSIDs;

(ii) records and stores each RSID created in an unchangeable form on at least one permanent data storage media, along with the creation dates, times, any other relevant information;

(iii) assigns at least one RSID to any single Ballot, Voter Registration form, Language selection form, Ballot envelope, data Container, Receipt, Object, data item or transmission of this invention;

(iv) assigning consistently to zero, one or a plurality of groupings of similar Ballots, Voter Registration forms, Language selection forms, Ballot envelopes, data Containers, Receipts, Objects, data items or transmissions—such that at least one RSID is consistently assigned for each Ballot, Voter Registration form, Language selection form, Ballot envelope, data Container, Receipt, Object, data item or transmission within any group;

(v) assigns zero, one or a plurality of RSIDs to zero, one or a plurality of Ballots, Voter Registration forms, Language selection forms, Ballot envelopes, data Containers, Receipts, Objects, data items, Communications or Data transmissions of this invention;

(vi) assigns at least one Ballot Voting RSID to each Ballot;

(vii) assigns zero, one or a plurality of Validation RSID to each Ballot;

(viii) assigns one Voter Registration RSID to each Eligible Voter and each Eligible Proxy Voter;

(ix) assigns one Certified Voter RSID to each certified, registered Voter and each Proxy Voter; (x) records the dates, times, and any other relevant information along with the usage assignment notes for each RSID that is assigned;

(B)(i) generating a plurality of linear barcode(s), or two dimensional barcode(s), or three-dimensional or multi-dimensional barcodes, or any other type of value weighted graphical symbolic representations of data;

(ii) correlating each RSID value of aforesaid step (A) to one barcode numeric value and to one barcode representation;

(iii) consistently assigns a barcode along with a correlated RSID to and zero, one or a plurality of Ballots, Voter Registration forms, Language selection forms, Ballot envelopes, data Containers, Receipts, Objects, data items or transmissions of this invention;

(iv) assigns and correlates any number of, and group of character symbols, data values, data elements, numbers, symbols or groups of human readable words—that are regarded as the source(s) of information—so that each unique content from the source(s) of information is correlated to a specific unique barcode pattern which shall be further correlated to a uniquely encoded group of symbols that has a correlated, unique numeric value for each unique barcode pattern and unique source content;

(v) retrieves or scans zero, one or a plurality of data elements or groups of human readable words, numbers and symbols that are regarded as or correlated as the source for the information element for each barcode;

(vi) corroborates the accuracy of scanning of zero, one or a plurality of barcodes, by further comparing the values and symbolic representations of each information element of the source to the values or symbols derived from scanning the correlated barcodes;

(vii) recording the results of scanning and corroboration comparison, then signaling zero, one or a plurality of error messages, and option steps of error verification analysis, error correction, error correction analysis so as to facilitate the accurate scanning of data associated with each barcode, for zero, one or a plurality of barcodes and the inter-related source information and correlated numeric values and symbolic values thereof;

(viii) For a plurality of RSIDs, Officials assembling and constructing said RSIDs while also sorting and storing RSIDs into data structures comprised of arrays, linked lists, N-trees, sparse matrices, files, tables, database records; for said assembled RSIDs, Officials creating an indexed table of data entries consisting of at least the binary value for each completed well formed RSID concatenated symbolic characters and also the correlated RSID Assembly Identifier (which is stored with each correlated RSID as the Assembly RSID identifies and correlates the specific group of RSID symbols used to assemble each unique RSID of the correlated unique RSIDClusterGroupName as well as the unique RSIDClusterGroupID, unique RSIDAssemblyID, RSIDAssemblyStatus, RSIDAssemblyValue, RSIDAssemblyDate, RSIDAssemblyTime, RSIDAssembly DeviceID(s) and RSIDAssemblyLocationID(s);

(viii) Officials then using at least of said data structures and said indexing and said identifiers to correlate and store the correlated data of each RSID for a plurality of RSIDs;

Officials then correlating and storing entire RSID and RSID Assembly data;

(ix) Officials calculating hashing values while or shortly after assembling said plurality of RSIDs, Officials using computers running software hashing calculation algorithms calculating hashing values for zero, one or a plurality of entire RSIDs, and for zero, one or a plurality of portions of each RSID whereby each RSID portion of each RSID is consistently the same size and taken from the exact same positions of the RSID, for zero, one or a plurality of RSID symbolic characters copied from at or near the RSID start, middle and end portions of each properly formed RSID; Officials then identifying and storing into said data structure(s), said hashing values that are also correlated to each RSID—whereby hashing values and correlated RSID portions are stored into at least one computer data structures comprised of data arrays, linked lists, N-Trees, sparse matrices, data file, data tables, database table records;

(x) Officials searching for and validating or rejecting hashing values computed from Voters provided RSIDs and further whereby Officials record and message said search results for RSID hashing values further handling any and all errors arising; Officials locating computed Voters RSID hashing values in Officials data storages then retrieving cluster group of all correlated identical RSID hashing values from Officials data storages then Officials further searching for the exact RSID value within each retrieved cluster group and then messaging and recording whether and exact Official RSID is found to match the Voters provided RSID and further handling all errors; Upon locating Voter provided RSID with an exact matching RSID in Official records data storage records, Officials validate and authenticate Voter provided RSID, record search result, send correlated message to said Voters then Officials enable allowing further processing for each Voter whose Voter provided RSID was found, otherwise denying unfound RSIDs; Repeating aforesaid Voter RSID search for Ballot RSIDs, Ballot PassCodes, Voter Registration IDs, Voter Registration PassCodes, Voter Language Selection Documents, Ballot and Registration Container RSIDs, correlated Official PassCodes, Officials Registration Ids, correlated Official Registration PassCodes, Voting Session Receipt Identifiers, Ballot Selection Identifiers, Language Selection Identifiers, Officials Personal Security Items, Voters Personal Security Items, Voters Privacy Security Records, Ballot Signature Identifiers, Registration Signature Identifiers, and any other Voting Session RSIDs, PassCodes, Records, Groups, Events for a plurality of Officials, Voters, RSIDs, PassWords, Session IDs, Location Identifiers, Device Identifiers;

(C) a plurality of Officials and Official Devices defining, detecting and verifying a plurality of Objects characteristics or properties of materials or man-made devices comprised of: embedded micro-electronic or micro-optical or micro-chemical devices, holograms, Braille code embossing, optical structures or devices, electronic devices or structures, magnetic fields or devices, organic or inorganic chemicals, biological materials, genetic materials or genetic structures or genetic sequences, specialized man-made materials, crystal structures, plastics, metals, gas emissions, electromagnetic radiation, radioactive materials, optical emissions, natural fibers, man-made fibers, microfilm dots, microscopic writing, embossing, photon-sensitive symbols, photon-sensitive text, or infra-red radiation sensitive (text, symbols or images) on and in materials, electronic codes, optical codes, optical or digitized pictures, codes embedded within optical pictures or digitized pictures, watermarks, or seals of authenticity which are integral, affixed or associated thereto any Ballots, Voter Registration forms, Language selection forms, Ballot envelopes, data Containers, Receipts, Objects, data items or transmissions, or to zero, one or a plurality of Voter Personal Security Items, or to zero, one or a plurality of Vote Processing Devices of this invention.

3. The Computerized Voting System of claim 1 wherein at least one Official:

(A) (i) employing zero, one or a plurality of people using any number and combination of Vote Processing Devices and zero, one or a plurality of computers and other data gathering devices running software programs for the purpose of determining the names of Potential Voters, and their contact information of said Potential Voters;

(ii) recording the Potential Voters names, contact information, dates, times, and any other relevant Voter-Registration qualifying information;

(iii) determining from prior step (i) herein this claim, which persons or legal entities are Eligible Voters;

(iv) correlating each Eligible Voter to a single Eligible Voter List which is then also correlated to the Voting Region or Voting Caste the Voter is affiliated with;

(v) sending and making available a plurality of Voter Registration forms to each Voter, and to a plurality of Voters and to each reasonably Potential Voters;

(vi) evaluating, certifying and registering all Voters who reply in time with a sufficiently completed Voter Registration form that contains adequate Voter personal data which qualifies them to be designated to the Certified Registered Voters List;

(B) sending or making available, at least one Ballot, Voter Registration form, Language selection form, Ballot envelope, data Container, Receipt, Object, data item or transmission of this invention to each Voter—with the restriction of sending Ballots for Voting to each Voter only if their name is already recorded on the Certified Registered Voters List;

(C) sending a plurality of Ballots, Voter Registration forms, Language selection forms, Ballot envelopes, data Containers, Receipts, Objects, data items or transmissions of this invention to any number of, and any types of Voters—with the restriction of sending Ballots for Voting to each Voter only if there name is already recorded on the Certified Registered Voters List;

(D) Official(s) recording for each Voter, dates, times, and any other relevant information of each single Ballot, Voter Registration form, Language selection form, Ballot envelope, data Container, Receipt, Object, data item and communications to each Voter and a plurality of Voters.

4. The Computerized Voting System of claim 1 wherein: a plurality of Voters receives: (A) at least one Voter Registration forms, Language selection forms, data Containers, Receipts, Objects, data items or transmissions of this invention;

(B) (i) a plurality of Eligible, Registered Voters receiving at least one Whole Ballot, zero, one or a plurality of Ballot envelopes, data Containers, Receipts, Objects, data items or transmissions of this invention; (ii) and further whereby within any Voting Region, zero, one or a plurality of Certified Registered Voters, or their designated legal Proxy, may optionally exchange zero, one or a plurality of times, zero, one or a plurality of valid, authentic Ballots, that are useable within their Voting Region and Jurisdiction for the currently active or impending Voting Session; and (iii) whereby zero, one or a plurality of Certified Registered Voters or their Proxy, use zero, one or a plurality of Validation RSIDs assigned to communicate to at least one Official as to whether the Ballot they may exchange their Ballot for has a valid RSID;

(C) and further whereby: after participating or disregarding the options for exchanging Ballots as may be allowed for the Voting Session, zero, one or a plurality of Eligible Voters and Proxy Voters complete zero, one or a plurality of Ballots, Voter Registration forms, Language selection forms, Ballot envelopes, data Containers, Receipts, Objects, data items or transmissions of this invention;

(D) whereby completing said Ballots entails Eligible Voters and designated Proxy Voters choosing zero, one or a plurality of Officials pre-defined options of Candidates, Groups and Proposals, a plurality of said Eligible Voters and designated Proxy Voters may then optionally Write-In zero, one or a plurality of alternative Candidate choices, zero, one or a plurality of alternative Group choices, and zero, one or a plurality of alternative Proposals, Voters and Proxy Voters then affixing or assigning or linking their Personal Security Items to the aforesaid Ballot, then returning said completed Ballot(s) to at least one Official, using zero, one or a plurality of Return Containers.

5. The Computerized Voting System of claim 1 wherein: at least one Official or a plurality of Officials:

(A) receiving zero, one or a plurality of Ballots, Voter Registration forms, Language selection forms, Ballot envelopes, data Containers, Receipts, Objects, data items or transmissions and Voter Personal Security Items of this invention—from zero, one or a plurality of Voters, and any types of Voters;

(B) recording notes for each Voter submission: the dates, times, and any other relevant information along with data about each and all received Ballots, Voter Registration forms, Language selection forms, Ballot envelopes, data Containers, Receipts, Objects, data items, transmissions and Voter Personal Security Items; then chooses to either:

(C) accepting for processing zero, one or a plurality of Ballots, Voter Registration forms, Language selection forms, Ballot envelopes, data Containers, Receipts, Objects, data items or transmissions of this invention, which DO have a valid, usable RSID, or, (D) refusing to accept for processing zero, one or a plurality of Ballots, Voter Registration forms, Language selection forms, Ballot envelopes, data Containers, Receipts, Objects, data items or transmissions of this invention, which DO not have a valid, usable RSID, or, (E) accepting and segregating zero, one or a plurality of items or transmissions of this invention, which do have a valid, but duplicate RSID—and then reviewing the authenticity of a plurality of Objects, data items or transmissions, and then certifying and restoring processing of the valid Objects, data items or transmissions, then amending all related records to reflect relevant actions;

(F) and for all instances of a valid RSID, then processing all timely received Ballots, Voter Registration forms, Language selection forms, Ballot envelopes, data Containers, Receipts, Objects, data items or transmissions of this invention which are validated and certified by First acquiring, recording and storing an image of the entire Ballot, form, Container, Receipt, then for the said image, enhancing, scaling and rendering said image for scanning the associated RSID symbols and the RSID barcode by selecting an appropriate Document scanning Template, or a series of scanning Templates, designed to isolate desired data fields for data capture and imaging, then extracting the correlated values of said data fields by employing optical character recognition software and intelligent character reading software for extracting, reading and decoding the extracted data fields values so as to compare to the corresponding Official records of valid RSID values previously created, recorded and stored;

(G) whereby for each matching RSID values deemed valid:

(i) processing each Voter Registration form, Language selection form, Ballot envelope, data Container, Receipt, Object, data item or transmission is deemed valid for scanning;

(ii) scanning each of the aforesaid having a valid RSID, extracting any number of: Voter information items, Voter Personal Security Items, Official data elements, Security Elements, alignment Marks and scan zone coordinate Marks which are then recorded, correlated, analyzed, error checked, authenticated or rejected, tallied, and stored;

or, (iii) scanning each Ballot that is deemed having a valid RSID, extracting zero, one or a plurality of data contents of: Voter Selections, Voter Write-In choices, Voter Personal Security Items, Official data elements, Security Elements, alignment Marks and scan zone coordinate Marks from zero, one or a plurality of required portions of the Ballot for which said data contents are read-extracted, recorded, analyzed, error checked, validated, authenticated or rejected, tallied, and stored for immediate use, later retrieval;

(H) (a) whereby Officials physically, optically, electromagnetically and/or electronically print and send or render and display or auditorily broadcast or transmit to each successfully registered a Voter and Proxy Voter, their personal Voter Registration Confirmation form or Proxy Voter Registration form which each Voter may use to enable Voting in person, or may be kept or returned with their completed Ballot or Language Selection form, or when required by Officials;

(b) said Voter Registration Confirmation form comprises of optically, electromagnetically, electronically scannable and Template machine readable information data fields capable of accurately capturing and recording data and for detecting the absence of data, is used for locating, reading and decoding; said data fields are correlated to values for each of a plurality of: Voting Session Identifier, Voting Jurisdiction Identifier, Voting Elector District, Voting Polling Station, Voting List Identifier, Voting List Group Identifier, Voting List Sub-Group Identifier, Voting List Sequence Locator Identifier, Voting List Sequence Identifier, Poll Station Voter Sequence Number Identifier, Voter Identifier, Voter SuperKey Identifier, First Name, Middle Name, Family Name, Personal Title, Voting Status, Voting Methods Available, Qualifying Home Address, Home City, Home State, Home ZipCode, Home Address Identifier, Phone, Electronic Mail address, postal Mailing Address, Mailing City, Mailing State, Mailing ZipCode, Mailing Address Identifier, General Instructions, Voter Special Instructions, Registration Confirmation Identifier;

(c) further said Voter Registration Confirmation form also comprises of encoded barcodes comprised of any combinations of: physically printed or electronically rendered optical markings or electromagnetic materials having data storage fields containing the correlated alpha-numeric values for: Voting Session Identifier, Voting Jurisdiction Identifier Voting Elector District Voting Polling Station Identifier Voting List Identifier Voting List Group Identifier, Voting List Sub-Group Identifier, Voting List Sequence Locator Identifier, Voting List Sequence Identifier, Poll Station Voter Sequence Number Identifier, Voter Identifier Voter SuperKey Identifier Home Address Identifier, Mailing Address Identifier, General Instructions Identifier, Voter Special Instructions Identifier, Voter Registration Confirmation Identifier;

(I) enabling each Voter to validate their Voter Registration or cast Ballot vote processing accuracy by using their privately known Ballot Voting RSID or Voter Registration RSID and zero, one or a plurality of Official PassCodes and zero, one or a plurality of Voter Personal Security Items, so as to confirm Official processing accuracy or to make amendments, optionally by referring to correlated private Internet WebPages and zero, one or a plurality of Official records;

(J) Receiving and investigating all amendments requested and processing or rejecting zero, one or a plurality of amendment requests, recording all valid amendments, publishing the amendments; and retaining a record of the image of the pre-amendment Ballot or Registration;

(K) tallying, summarizing and publishing all Registrations and Ballots received, along with a complete list of all timely received, and all other valid, Ballot RSIDs that were assigned to Ballots and Registrations for public validation, and also tallying, summarizing and publishing for all amendments of all Ballots, all Voter Registrations and for any other Documents and Containers.

6. The Computerized Voting System of claim 1 wherein:

the actions, functions, operations and processing of this invention are performed by any combination and zero, one or a plurality of any plurality of Official persons, designated agents, zero, one or a plurality of Vote Processing Devices;

whereby zero, one or a plurality of Officials, Officials appointees, Official Devices utilize zero, one or a plurality of combination(s) of Vote Processing Devices to send, receive or process zero, one or a plurality of: Documents, forms, Containers, and zero, one or a plurality of data elements therein and any correlated information thereof, and also zero, one or a plurality of: data files, data transmissions or data Objects or data of this invention—whereby zero, one or a plurality of Officials use zero, one or a plurality of Vote Processing Devices and zero, one or a plurality of types of computer software programs to facilitate at least one or a plurality of tasks, comprised of the steps and methods to perform:

(i) research, identify, define, design, create, amend, correlate, associate, link, verify, authenticate, certify, prepare, organize, sort, assemble, record, store, print, publish, distribute, send, transmit, receive, create, assign, attach, link, embed, photograph, image process, image enhance, record, data scan, data detect, data reject, data store, data retrieve, electronically scan and detect, optically scan and detect, electromagnetically scan and detect, copy, duplicate, tally, count, calculate, search, sort, organize, Mark, label, tag, identify, data encrypt, data decrypt, data convert, data translate, Language translation, data reconstruction, data compression, data decompression, data inventory, data organization, data encoding, data decoding, data storage, data indexing, data retrieval, data linking, data embedding, data extraction, data manipulation, data optimization, task planning, data design, data software design, data tracking, data storage, data retrieval, random number creation, symbolic character design, printing, package labeling, package identification, package tracking, data security, Document tracking, Document identification, acknowledging, error identification, error recording, error correction, error transmission, error reception, error reporting, error authenticating, data reporting, data communicating, data printing, data publishing, transmitting data, receiving data—either internally by Officials or, to or from zero, one or a plurality of combinations of and any types of: Officials, Voters, Proxy Voters, legal entities, public, news media, electronic devices, communications networks, public devices, Official Voting Session Devices;

(ii) translating human and device readable codes to modes, protocols or methods of communication, transmission, data storage, data indexing, decryption, encryption, compression, decompression of any data;

(iii) locating, receiving, detecting, interpreting, translating, reporting, transmitting error free data;

(iv) locating, receiving, detecting, interpreting, translating, reporting, and correcting compromised data, erroneous data, dubious data, duplicate data or duplicate transmissions;

(v) enhance processing speed and accuracy of processing (scanning, imaging, reading, decoding, storing, searching, retrieving, analyzing, authenticating, validating, tallying, reporting, publishing) for zero, one or a plurality of Ballots, Documents, forms, Containers and any other Objects of this invention by assigning, correlating, affixing, attaching or embedding zero, one or a plurality of markings, electro-magnetic fields, optical scanning markings, optical alignment markings or optical skew markings to ensure proper optical scanning, and proper electromagnetic processing;

(vi) and the further steps and methods of enabling optical or physical orientation comprised of: a darkened, or highlighted or cut-away corner, V-notch, circular, rectangular or shaped hole markings or holes that is consistently implemented so as to assist in expediting sorting, organizing, separation, grouping, scanning, counting, accounting or enumeration of at least one of a plurality of: Documents, forms, Containers and any Objects of this invention;

(vii) whereby Officials actively take steps to ensure the accuracy of data as well as to preserve data integrity, and ensure data longevity, data security and Voter privacy.

7. The Computerized Voting System of claim 1 wherein: Security Elements, are applied to zero, one or a plurality of Documents of this invention, so as to preserve the integrity of Voting Session for any Documents, data records, data communications, data Containers, data storages whereby Security Elements are:

(A) zero, one or a plurality of Voters create and assign zero, one or a plurality of PassCode, PassWord, signature, initials or other uniquely identifiable physical markings, audio recordings, video recordings, electronic, electromagnetic, chemical, biological, physical structures, bio-metric data submissions;

(B) zero, one or a plurality of Officials created graphical: linear barcodes, two dimensional barcodes, three dimensional barcodes, QR graphic codes, value weighted graphical symbolic representations of data; and the steps and methods of assigning at least one or a plurality of: character symbols, data values, data elements, numbers, symbols or groups of human readable words, that are regarded as the sources of information, so that each unique content from the sources of information is correlated to a specific barcode pattern which shall be correlated to a uniquely encoded group of symbols that also has correlated, a unique numeric value for each unique barcode pattern and unique content of information; and for corroboration of accuracy, the further steps and methods of comparing the values and symbolic representations of each information element to the values or symbols derived from scanning the correlated barcodes; and the further steps and methods to retrieve or scan zero, one or a plurality of data elements or groups of human readable words, numbers and symbols that are regarded as or correlated as the source for the information element for each barcode; and for corroboration of accuracy, the further steps and methods of comparing the values and symbolic representations of each information element to the values or symbols derived from scanning the correlated barcodes; and the further steps of recording the results of comparison, signaling zero, one or a plurality of error messages, and option steps of error verification analysis, error correction, error correction analysis so as to facilitate the accurate scanning of data associated with each barcode, and for zero, one or a plurality of barcodes of a plurality of barcodes;

(C) zero, one or a plurality of Officially recognized characteristics or properties of materials or man-made devices comprised of: embedded micro-electronic or micro-optical or micro-chemical devices, holograms, Braille code embossing, optical structures or devices, electronic devices or structures, magnetic fields or devices, organic or inorganic chemicals, biological materials, genetic materials or genetic structures or genetic sequences, specialized man-made materials, crystal structures, plastics, metals, gas emissions, electromagnetic radiation, radioactive materials, optical emissions, natural fibers, man-made fibers, microfilm dots, microscopic writing, embossing, photon-sensitive symbols, photon-sensitive text, or infra-red radiation sensitive (text, symbols or images) on/in materials, electronic codes, optical codes, optical or digitized pictures, codes embedded within optical pictures or digitized pictures, watermarks, or seals of authenticity which are integral, affixed or associated thereto any Document or zero, one or a plurality of Vote Processing Devices of this invention;

(D) a plurality of Random Symbolic Identifiers (RSIDs) are manufactured by Officials using at least one computer running software programs such that:

(i) each RSID is manufactured to be unique among all RSIDs of the Voting Session;

(ii) each RSID is comprised of randomly selected symbols (chosen from a pre-defined reference group of symbols) that are directly usable by the Voters and Officials;

(iii) Officials estimate the total number of RSIDs required and thereafter calculate a larger quantity of character symbol permutations so as to completely accommodate the total number of RSIDs required, while also acting to remove undesirable symbol permutation patterns;

(iv) during assembly, the quantity of selectable pre-defined symbols chosen is consistently the same for each usage type of RSID;

(v) all of the selected RSID symbols are concatenated to produce one unique string of symbols to be the resultant manufactured RSID;

(vi) each RSID pre-defined symbol of the preceding steps is consistently assigned a binary value or base X numbering system value (where X is any chosen number) which is the assigned symbol numeric value;

(vii) for each manufactured RSID string, and for all of the symbols within each RSID, Officials consistently assemble a concatenated string of the assigned symbol numeric values that is directly correlated to the symbols within the RSID and is designated as the numeric value of the RSID;

(viii) as a result of the preceding, each RSID is a unique group of symbols, and each RSID has a correlated unique numeric value—both of which are made to be near impossible to guess, derive, extract, predict or pre-calculate—and therefore whatever Document or electronic file or data transmission uses an RSID is assured of protection against forgery as the voting system will reject invalid RSIDs and will also set flag and set aside any duplicate RSIDs;

(ix) further said RSID symbols may be further data compressed;

(x) said RSID may be further appended or prefixed by zero, one or a plurality of data symbols used for error detection, error identification, error specification, error localization, error correction and error data recovery, error detection rejection, usage designation Identifier, data encryption security;

(E) and the further steps and methods whereby:

(i) Officials organize each type and group of RSID's to be rapidly retrievable with a minimum of processing for authentication and validation, which may be achieved by merging implementations of data storage, search, retrieval methods that is applied to any number of, and data storage structures that are correlated to zero, one or a plurality of data structures such as: flat-files, linked lists, arrays, data records, data record tables, N-trees, Object-oriented or relational databases, file structures or any combinations thereof, which are stored, accessed, indexed and manipulated by computer running software programs and that are communicating with zero, one or a plurality of peer and supervisory computers and any number and combination of Vote Processing Devices using zero, one or a plurality of communications systems and computer networks via any number of, and any types of communication devices, computer security devices and zero, one or a plurality of types of computer software so as to effectively and efficiently process data for optimal data storage, retrieval, integrity, longevity, security, privacy;

(ii) all created RSIDs are permanently and redundantly recorded to at least one secure, unalterable form of data storage;

(F) Officials creating, assigning and correlating zero, one or a plurality of RSIDs, to zero, one or a plurality of Documents, zero, one or a plurality of data Containers, zero, one or a plurality of data communications of this invention;

(G) and the further steps of assigning, correlating and encoding each RSID and RSID numeric value and correlated RISD symbol string value to zero, one or a plurality of barcodes and correlated barcode numeric values and derived barcode symbol-characters of prior step B;

(H) and the further steps and methods whereby:

(i) all valid RSID's created by Officials, except for any RSIDs received by all Registered Voters, or used for examples or testing purposes, are kept absolutely secret from all other Voters before and during a voting session;

(ii) any public RSID used for testing, examples or information purposes are disallowed in Eligible Voter Registrations, Voting Ballot counts and tallies;

(iii) Officials enable validation of zero, one or a plurality of RSIDs, by providing for each Voter, controlled access to a session limited number queries of valid RSIDs for Documents, Forms, Containers, or data records of this invention;

(I) and the further steps and methods to securely Mark, record, associate, attach, enclose, encrypt, embed zero, one or a plurality of Security Elements of this claim to zero, one or a plurality of Documents, Containers, data transmissions, data storages, data retrievals, and any validation, authentication and certification processes and any related events, data, communications and processes for any claims of this invention.

8. The Computerized Voting System of claim 1 wherein: a Certified Registered Voter List is developed by one or more Officials who:

(A) use any number and combination of Vote Processing Devices to query various computer databases to gather, sort and record data to identify any viable Potential Voters;

(B) assign each identified person or legal entity of the preceding step A, a unique Potential Voter Identifier (PVID) which is public, and also a private, internal use RSID, and the further steps of correlating each Voter, public PVID and private, internal use PV-RSID;

(C) assign each Voter Identifier and each correlated PV-RSID of the preceding step B to be linked to and correlated to zero, one or a plurality of lists, forms, Documents, Ballots, data Containers, Fax or Facsimiles, Internet web-pages, Internet EMails, or any other information data of this invention;

(D) deliver or make available zero, one or a plurality of incomplete Voter Registration forms by postal mail, electronic mail, facsimile, mobile data device, interactive television, interactive telephone, Internet WebPages for zero, one or a plurality of Voters to complete and return deliver to Officials who receive for review, certification, amending or rejecting of each Voter Registration received;

(E) assemble at least one of each type of Voters Lists;

(F) conduct research to determine each Voter eligibility then assigns zero, one or a plurality of Potential Voters to, at most, one type of Voter List of the preceding step;

(G) determine for zero, one or a plurality of Potential Voters their unique geo-political voting region Identifier or unique voting caste Identifier and thereafter correlates each Potential Voter, based on their status according to step (D) of this claim, to a specific correlated Voters List assigned to the correlated geo-political voting region or voting caste;

(H) each Potential Voter is assigned a Voter Registration Status attribute so as to define whether the Voter has been registered to Vote in the Voting Session, and the further step whereby the attribute value is set by default to False, No or otherwise according to Voting Session Rules;

(I) Officials employ computers running software programs to query reliable data systems so as to determine whom will be eligible to vote during the Voting Session, and also gathers data as to how to contact those Eligible Voters and other Potential Voters;

(J) Officials create, print, distribute zero, one or a plurality of Voter Registration forms to zero, one or a plurality of Eligible, Potential and Unknown Voters;

(K) each Whole Voter Registration form is comprised of at least two parts, such that one part has exactly one Master Voter Registration form and the Second part is comprised of zero, one or a plurality of Receipt Voter Registration form(s);

(L) and the further step such that each Master and Receipt parts of each Whole Voter Registration is assigned at least one unique Identifier, a Voter Registration Identifier having acronym: VRID that is used to correlate said Whole Voter Registration constituent Master and Receipt parts thereof, and to distinguish each Voter Registration form and each Master and Receipt constituent parts from among all other Voter Registrations forms, and the VRID is unique among all Identifiers of this invention;

(M) for each Whole Voter Registration form, the component Master Voter Registration form part and all component Receipt Voter Registration forms parts (for the same Whole Voter Registration form are correlated to each other by sharing the same unique Voter Registration Identifier having acronym: VRID that is directly printed, embedded, affixed or otherwise magnetically encoded or electronically linked and correlated to each constituent Master and Receipt part and also for each Whole Voter Registration form, for at least one said POEM format and any form of presentation, storage, retrieval, processing, authentication, communication of this invention;

(N) each Receipt Voter Registration form is manufactured to be easily distinguishable from the Master Voter Registration form using any combination of word markings: Receipt or Official Receipt and symbols in at least one Languages, using zero, one or a plurality of different colors, different textures, or different materials, different physical, electronic, electromagnetic, or optical representation, or any other form of visual, audio or tactile representation or markings that serves to noticeably differentiate and identify each Receipt Voter Registration form so as to be distinguished from every Master Voter Registration form—and may optionally include printing, affixing, attaching, linking, correlating or embedding zero, one or a plurality of Security Elements consistently to a specific area for each part of each Voter Registration Master and Receipt form parts:

(O) each Whole Voter Registration form and each Master part and each Receipt part is comprised of zero, one or a plurality of portions, with at least one portion containing voting session name, voting session type, Voter Registration Identifier having acronym VRID, at least one portion for recording Voter identification, at least one portion for recording the Voters legal names, zero, one or a plurality of portions for recording the Voter signature, at least one portion for recording the date of Registration form completion, zero, one or a plurality of portions to record the preferred Language(s) of the Voter which may used with or in lieu of the Voter Language Selection form;

(P) each Voter Registration form is allocated zero, one or a plurality of portions for Voters or Officials to Mark and record information elements for any number of: (i) personal Identifiers, (ii) Official defined PassWords, (iii) Voter defined PassWords, (iv) printed names, (v) Official signature(s), (vi) Voter signature(s) (vii) date information, (viii) Proxy assignments information, (ix) Proxy signature(s), (x) location information (xi) contact information, (xii) Voter alternative addresses, (xiii) Proxy contact information, (xiv) Voter or Proxy: (a) telephone number(s), (b) cell phone or mobile phone numbers, (c) Internet telephone contact numbers, (d) electronic mail address, (e) Internet webpage(s) for (i) online dialogue or (ii) to leave messages, (f) interactive television contact addresses, (g) work, home or personal Internet Service Provider allocated electronic address, (h) zero, one or a plurality of other contact methods information;

(Q) at least one portion is assigned to zero, one or a plurality of Voter Permanent Address Identifier having acronym: VPAID with zero, one or a plurality of portions for additional physical address information—whereby each Voter Permanent Address Identifier is unique among all VPAIDs and among all Identifiers of this invention, yet any VPAID is not unique among Voters as several Voters may reside at the same VPAID address;

(R) each Potential Voter is correlated to zero, one or a plurality of VPAID of prior step Q;

(S) at least one portion is assigned to zero, one or a plurality of Voter Mailing Address Identifier having acronym: VMAID with at least one portion for additional physical address information elements—whereby each Voter Mailing Address Identifier is unique among all VMAIDs and among all Identifiers of this invention, yet any VMAID is not unique among Voters as many Voters may share a same common address;

(T) each Potential Voter is correlated to zero, one or a plurality of Voter Mailing Address Identifiers;

(U) adding zero, one or a plurality of additional portions which are provided by Officials for zero, one or a plurality of other types of useful, relevant information;

(V) delivering physically or electronically zero, one or a plurality of Voter Registration forms and zero, one or a plurality of Voter Registration Data Return Containers to zero, one or a plurality of Eligible, Potential, or Unknown Voters;

(W) and the further steps whereby at least one Official generates zero, one or a plurality of uniquely identified Voter Registration Internet WebPages and further secures each webpage by encoding the Internet Universal Resource Locator for each Voter Registration webpage so as to be obscured by encoding the assigned Voter Registration ID that is made very hard to guess using such methods as those to create a Ballot Voting RSID; and the further steps such that each webpage accepts the potential Voter input data which is error checked and then submitted with other non-input hidden submission data which is then correlated to the Voter Registration ID, and then to aforementioned Voter Registration Data and any other Voter Language Selection data;

(X) zero, one or a plurality of said Eligible, Potential and Unknown Voters receive, possibly complete and return zero, one or a plurality of Voter Registrations, keeping at least one Registration Receipt Document copy for themselves for processing verification and self-identification; and the further steps whereby zero, one or a plurality of Potential Voters register to vote by:

(i) properly and accurately completing their Voter Registration form, (ii) completing and keeping zero, one or a plurality of duplicate Receipt copy(s), (iii) separating Master from Receipt copies then return delivering at least one completed Master Voter Registration form to Officials, either in person or by Proxy delivery service or via a Voter Registration Return Data Containers with any required markings according to Voting Session Rules;

(iv) separating Master from Receipt copies then return delivering zero, one or a plurality of completed Master Voter Language Selection forms to Officials, either in person or by Proxy delivery service or via a Voter Registration Return Data Containers with or without required markings as per Voting Session Rules;

(Y) Officials receiving zero, one or a plurality of Voter Registration forms for validation processing;

(Z) The further steps and methods whereby:

(1) at least one Official generates zero, one or a plurality of Internet WebPages that shall then be correlated to each submitted Voter Registration and assigned one unique Voter Registration ID; and (2) the further steps and methods whereby for each Officially Approved Voter Registration, at least one Official generates a Voter Language Selection Internet webpage and then directly correlates each Voter Registration to the inputted Voter Language selection and associated data;

(3) and the further steps and methods whereby for each Officially Approved Voter Registration generate exactly one unique and privately accessible Internet web page that is correlated via the unique Ballot Voting RSID that is further encoded so as to be part of the Internet Universal Resource Locator address for the private webpage; and (4) the further steps and methods whereby each Voter can use at least one or a plurality of electronic devices so as to connect to the Internet, telephone, interactive television system, or cell phone communications systems to securely access, input, verify, validate, review, amend, submit, retrieve, store, record, print or save—personal information and personal choices so as to complete:

(i) zero, one or a plurality of Voter Registration(s) or constituent parts thereof, (ii) zero, one or a plurality of Voter Language selection forms or constituent parts thereof;

zero, one or a plurality of Master Ballot(s) or constituent parts thereof;

zero, one or a plurality of any other types of Documents of this invention;

(AA) at least one Official records as part of Voter Registration, zero, one or a plurality of portions of the Voter Language Selection information;

(AB) for zero, one or a plurality of any types of Voters, Officials correlate zero, one or a plurality of Languages for each Voter so as to provide Language translations for zero, one or a plurality of Documents of this invention, as well as to provide spoken text of Documents for the visually impaired;

(AC) for each physical or electronic version of the Voter Registration form, the value of the Voter Registration Identifier is correlated to zero, one or a plurality of electromagnetically detectable magnetic ink symbols and readable optical symbolic codes alpha-numeric, barcodes or pattern codes) or holographic images as well as zero, one or a plurality of any other type of Security Elements;

(AD) for each Master part or Receipt part of a Voter Registration form and for each Voter Language Selection form that is received by Officials, at least one Official records the information provided using Vote Processing Devices and then at least one Official acts to determine whether each received Voter Registration form and whether each Voter Language Selection form was properly completed, and the further steps whereby for incorrectly completed VReg form or VLS form submissions, the incorrectly completed form is rejected, and for successful submissions, the VReg form or VLS form is accepted, recorded and electronically stored; and the further step whereby for each correctly completed VReg forms, and for each correctly completed and correlated VLS form, Officials change the correlated Voter Registration Status attribute value to TRUE for submitted data that is accurate and verified by at least one Official; and the further steps whereby Officials certify zero, one or a plurality of accurately verified Voters to be eligible to vote and then add them to the Certified Registered Voters list; embodying a Voter Registration, Ballot or both as a smart card having private Identifiers and PassCodes encoded and embedded in magnetic stripes, holograms, micro-devices; creating and distributing a plurality of said smart cards to each Certified Registered Voter and to a plurality of Certified Registered Voters.

9. The Computerized Voting System of claim 1 wherein: Official(s) create, print, distribute, receive, sort, scan, image, read, decode, analyze, interpret, validate, authenticate, certify, error detect, tally, store, retrieve, publish and further process zero, one or a plurality of Whole Ballots, whereby:

(A) each Whole Ballot is comprised of at least one part, whereby one part is the Master Ballot and zero, one or a plurality of Receipt Ballot parts;

(B) each Master and Receipt parts of each Whole Ballot are assigned at least one shared, yet unique Ballot Random Symbolic Identifier having acronym Ballot-ID RSID, which is prominently visible on the Whole Ballot and component Master and Receipt parts so as to distinguish the considered Whole Ballot and all of its component parts from all other Whole Ballots and those other whole Ballot component parts;

(C) each Receipt Ballot is manufactured so as to be easily distinguishable from the Master Ballot to the using any combination of additional word markings: Receipt or Official Receipt, raised symbols or Braille codes, as well as zero, one or a plurality of different colors, different textures, or different materials, or by applying different physical, electronic, electromagnetic, or optical representational format, or any other form of representation that noticeably differs from that which is used to manufacture the Master Ballot, that may include zero, one or a plurality of Security Elements and zero, one or a plurality of unique Ballot Identifiers correlated to the matching Master Ballot part of the same Whole Ballot;

(D) each Whole Ballot component Master Ballot and all of the Receipt Ballots of the same Whole Ballot are correlated to each other by sharing the same unique Ballot-ID RSID that is printed, embedded or linked to each Master and Receipt Ballot part;

(E) at most one Ballot-ID RSID is created and assigned to each Whole Ballot and constituent parts thereof; further creating a plurality of Whole Ballots and a plurality Ballot RSIDs for each Voting Session;

(F) each Ballot-ID RSID is correlated to a barcode which has an encoded symbol and symbol value equal to the concatenated symbols correlated numeric value of the RSID;

(G) at most, one private Ballot Voting RSID is created and assigned to each Ballot-ID RSID and kept hidden until the Voter is prepared to make Ballot choices and cast said Ballot;

(H) at most one Official PassCode RSID is correlated to each Ballot-ID RSID or each Ballot Voting RSID for the purpose of providing additional security for Vote Casting for each Whole Ballot Master part;

(I) each Voter creates zero, one or a plurality of Voter PassWords which are then correlated to each Ballot RSID they have used to vote with, for the purpose of providing additional security for Vote Casting for Ballot Master part;

(J) each Voter PassWord is correlated to one Whole Ballot and one correlated Master Ballot, and to each correlated Receipt Ballot;

(K) for each Official PassCode is kept hidden from view by a removable covering or openable Container which is constructed in such a way that the only way for any PassCode to be viewable will automatically create evidence of having been revealed, thereby indicating the Ballot or other Document may be already used or subject to unauthorized copying or future use;

(L) for each Ballot PassCode, zero, one or a plurality of Security Elements may be printed, assigned, linked, correlated or embedded, for each correlated Whole Ballot and each correlated Master and Receipt constituent part by at least one Official, Official Agent or Official Device;

(M) zero, one or a plurality of Ballot PassCode(s) and zero, one or a plurality of Voter Personal Security Items: Voter signature, Voter initials, Voter PassWords or phrases, Voter audio, video, graphics, glyphs, Personal Security Numbers and patterns graphics are recorded and correlated by at least one Official, Official Agent or Official Device, either manually or using computers running software programs to generate at least one compatible POEM format types of: optically, electronically, electromagnetically, chemically or structurally scannable: identification marker codes, selection choices, data fields, symbolic codes, barcodes, barcode values, electromagnetic codes associated with, attached to, affixed upon, or embedded within any portion of each Ballot and Ballot part;

(N) for every Ballot, Officials allocate portions for Voters to Mark and record information such that there are zero, one or a plurality of portions for:

(i) selecting zero, one or a plurality of candidates, (ii) selecting zero, one or a plurality of proposals, (iii) elements of voting information, (iv) Security Elements, (v) Ballot processing markings;

(O) each Master Ballot part and each correlated Receipt Ballot part is subdivided into, and comprised of zero, one or a plurality of portions:

(i) at least one Election Info portions—these portions provide information to enable the Voter to independently make informed decisions for voting:

(i.1) at most one unique Voting Session Identifier, and zero, one or a plurality of correlated Voting Session Details Identifiers which may be distinctly unique, or, optionally merged and encoded, so as to be correlated zero, one or a plurality of optically, electronically or electromagnetically scannable identification marker codes or other symbolic codes, optical barcodes, or electromagnetic codes correlated, attached or embedded to each Voting Ballot, so as to facilitate automated processing of said Ballot, and for a plurality of Ballots and Ballot parts;

(i.2) correlating zero, one or a plurality of correlated human-readable symbolic characters, graphical symbols, alphabetic or numeric character symbols that are correlated to zero, one or a plurality of: Voting Session Identifiers, Voting Session Detail Identifiers, correlated reading Templates and marker codes;

(i.3) at least one portion defining the scope of Ballot application;

(i.4) at least one portion identifying the type of Ballot;

(i.5) at least one portion of instructions for completing the Ballot;

(ii) at least one Vote Selection portion—this portion provides information to enable the Voter to independently make clearly informed decisions regarding the Ballot selection options by providing specific information whereby:

(ii.1) the title of political position which may optionally be repeated and also include a Candidate Position Identifier which may be further correlated to zero, one or a plurality of scannable barcodes, electromagnetic or optical codes and materials, or other symbolic Identifiers embedded or attached to each Voting Ballot;

(ii.2) at least one portion for a description of the voting region the Ballot is correlated to zero, one or a plurality of region data elements: (a) Voting Region NAME, (b) Voting Region Identifier, (c) Poll Stations Identifier, that may optionally be repeated and each are further correlated to any combinations of zero, one or a plurality of: scannable marker position codes, correlated barcodes, correlated RSIDs, QR codes, any symbolic codes or markings and correlated values so as to facilitate automated data processing for valid, non-erroneous data and for error processing: error detection, error identification, error reporting, error specification, error localization, error position locating, error marking, error correction, error data recovery, false error detection rejection;

(ii.3) at least one portion for Voting Information: (a) how many candidates to select, and (b) how to properly select the candidates of choice;

(ii.4) at least one portion for Candidates and for at least one portion for Proposals:

(a) zero, one or a plurality of candidate Identifiers and descriptions to reduce selection errors;

(b) optional description(s) of each candidate's political party affiliation;

(c) zero, one or a plurality of proposals Identifiers and correlated descriptions of proposals;

(d) at least one portion for candidates selection and for at least one portion for proposal selection area which contains at least designated vote marking area for each candidate or each proposal that is used to receive a Voter marking of the Voter's choice of candidate and proposals, so that each vote marking area is placed to clearly correlate to data of prior steps (a) to (c); and zero, one or a plurality of Candidate Write-In areas and zero, one or a plurality of proposal Write-In areas so that each Write-In area is placed to clearly correlate to data of prior steps (a) to (c);

(e) a plurality of data element location-position coordinates for each vote marking area and each Write-In area of prior step (d), allocating and assigning zero, one or a plurality of location-position coordinates portion of the Ballot for correlating data elements therein, such that the location-position coordinates are derived from pre-defined vertical and horizontal areas and correlated reading Templates which are used independently or in conjunction with scan alignment markings and scan position markings to isolate and uniquely identify the position of all data elements within the Ballot Document, and is used to facilitate the extraction of data from the Ballot by deriving and correlating the identity of each data element on the Ballot to the scanned value found at the coordinates of each correlated data element;

(f) zero, one or a plurality of Voter Write-In areas having zero, one or a plurality of sub-areas to write or print the Voters alternative preferred Candidate(s) given legal names and optionally the name of zero, one or a plurality of Groups or Political Parties and zero, one or a plurality of alternative Proposals or Proposal Identifiers that are the Voter's preferred choices; and further steps and methods of having at least one area for each Voter write-print in the legal name of a candidate that is to be used to Mark the Voter selection that is further correlated to each correlated Voter written or printed Candidate legal names, Group or Political Party and Proposals or Proposal Identifiers;

(iii) at least one Ballot ID portion—the Ballot identification area comprising of, but not limited to:

(iii.1) embedding, correlating and associating zero, one or a plurality of Security Elements, to be inextricably linked to the Ballot, for the purpose of authenticating the Ballot for the Voting Session;

(iii.2) at least one Ballot Identifier—whereby each Master and Receipt Ballots that comprise a Whole Ballot are correlated to each other, and is uniquely identifiable among all other Master Ballots and all other Receipt Ballots of a Voting Session; and further step and methods that each Ballot Identifier is assigned at least one Random Symbolic Identifier referred to as the Ballot-ID RSID; and the further step of methods by which each Ballot-ID RSID may be further encoded and correlated to a unique barcode symbol having a derived numeric value or symbolic string value equivalent to the correlated RSID derived numeric value or symbolic string value; and the further step of validating the Ballot is authentic and usable by submitting the Ballot-ID RSID to query the Official records of all valid Ballot-ID RSIDs; and the further step of zero, one or a plurality of Voters casting zero, one or a plurality of Master Ballots, each Maser Ballot having at least one Ballot-ID RSID;

(iii.3) at most one Ballot Voting RSID—whereby each Whole Ballot and constituent Master and Receipt parts are assigned at most one private, hidden RSID that is revealed at the time of voting so as to enable the Ballot to be authenticated and certified for scanning, recording and tallying the Voter selected choices; and the further step that each Ballot Voting RSID may be further encoded and correlated to a unique barcode symbol having a derived numeric value or symbolic string value equivalent to the correlated RSID's derived numeric value or symbolic string value; and the further methods of validating the Ballot is authentic and usable by submitting the Ballot Voting RSID to query the Official records of all valid Ballot Voting RSIDs; and the further step of zero, one or a plurality of Voters casting a Master Ballot using a Ballot Voting RSID;

(iii.4) at most one Ballot PassCode that is used in several ways to: (a) enable the Ballot-ID RSID or Ballot Voting RSID to be use for voting; and, (b) to prevent unauthorized access to electronic reporting of the Ballot Selections or any other information associated with a Ballot Voting RSID or Ballot-ID RSID;

(c) whereby the Voting PassCode RSID may be optionally hidden to enable Ballot Validation using the Ballot-ID RSID without risking enabling of the Ballot-ID RSID to be used for Voting or access to Voter information;

(d) whereby the Ballot PassCode RSID is constructed to be sufficiently different in length and composition so as to not be easily confused with the Ballot Voting RSID;

(iv) at least one Limits of Use portion—defines any limitations of the Ballot and is comprised of data elements:

(iv.1) at most one Expiry Date, Time—is the final date and time after which the Ballot is no longer useful for the Voting Session;

(iv.2) zero, one or a plurality of Due Dates and Due Times for receiving by Officials for tallying;

(v) a plurality of Alignment Marks portions—whereby for zero, one or a plurality of Whole, Master, or Receipt Ballots and any Documents, forms or Containers of this invention may each include zero, one or a plurality of:

(v.1) alignment Marks, alignment graphics, electronic encoding, magnetic fields, and any form of index Identifiers for accurate orientation of optical, magnetic, electronic scanning devices so as to facilitate the accurate scanning of data on any Ballot in reasonable condition; and to further provide location coordinates for any data elements therein;

(v.2) and the further steps for printed Ballots or any other printed Documents of this invention, of including darkened, highlighted or cut-away corners or notched edges so as to enable rapid sorting, identical orientation for scanning or filing;

(v.3) a plurality of location-position Marks, pre-defined data field coordinates, pre-defined data field reading Templates;

(vi) at most one Voter Signature Portions—zero, one or a plurality of spaces allocated for the Voter to place their personal signature Mark or private Voter PassWord directly upon, or otherwise correlated to, zero, one or a plurality of their Master Ballots and zero, one or a plurality of their Receipt Ballots so as to provide further means of authentication and Ballot tamper proofing;

(vii) at most one Voter Signature Date portions—zero, one or a plurality of spaces allocated for the Voter to write or print the date that they signed, per (vi) above, their Ballot and Ballot Receipt;

(O) encapsulating zero, one or a plurality of Container or removable cover may be applied to a Master Ballot or other Document such that the cover obscures essential, private data and may also reveal necessary to know information, by methods comprising of:

(i) completely obscured Ballot Voting RSID of prior step N(iii.3) that is within a sealed Sending Ballot Data Container (physical or electronic), or, (ii) Ballot-ID RSID of prior step N(iii.2) that is visible through a viewing window of the sealed Sending Ballot Data Container, so the partial Whole Ballot RSID provides enough data for verification, with disclosing the Voting Ballot RSID, or, (iii) visible Ballot-ID RSID paired with a completely obscured Official created Ballot PassCode RSID that can only be made visible by the detectable removal of a temporary cover or by controlled access to an electronic presentation;

(iv) zero, one or a plurality of visible Ballot Validation RSIDs are used to validate the Ballot is genuine, and that is also correlated with a hidden Ballot Voting RSID and a hidden Ballot PassCode RSID which are revealed at Ballot casting by removing the temporary covers;

(P) Officials enable methods for rapid automated optical scanning, electro-magnetic field processing, or high speed photographic picture taking and data analysis—for zero, one or a plurality of Documents of this invention; and for each physically printed or optically-visually rendered or electronically or electromagnetically rendered Whole Ballot and other Documents of this invention, there are zero, one or a plurality of electronic processing scanning markings used for marking boundaries of scannable data areas of detection within portions of Voter data areas and Officials data areas so as to identify all the scannable data areas used for scanning, imaging, enhancing, photographing, enhancing, reading and decoding by use of:

(i) data start markers, (ii) data stop markers, (iii) combined data start-stop markers, (iv) optical alignment (skew) detection markings to ensure proper optical scanning detection for alignment error detection, alignment error measurement, alignment error specification, alignment error messaging, alignment error correction, alignment error rejection, for zero, one or a plurality of portions of zero, one or a plurality of physical, optical or structural Documents or physical, optical or structural data Containers of this invention;

(v) Officials and Official Agents employ zero, one or a plurality of computers running software programs to provide zero, one or a plurality of data processing steps and methods to: automatically provide data extraction, alignment measurement, data alignment correction, data orientation measurement, data orientation correction—for each of a plurality of Documents and for each portion of zero, one or a plurality of portions of each type of Document;

(Q) Officials consistently Mark, shape, or cut zero, one or a plurality of corners of each Master Ballot part, and optionally each Receipt Ballot part, so as to enable a consistent method to orient, identify and sort to assist in sorting, separating, organizing, grouping, scanning, counting, tallying by zero, one or a plurality of humans and any combinations of zero, one or a plurality of Vote Processing Devices;

(R) and the further steps whereby Officials use the Ballot Voting RSID, Ballot-ID RSID in whole or in part, as a derivable, integral component to encode or enable tracing or correlation of zero, one or a plurality of and any types of: data files, Internet WebPages, data storages, data transmissions, Documents, Ballots, Registration forms, data Containers, data sets, persons, communications, or Objects of this invention.

10. The Computerized Voting System of claim 1 wherein at least one Official:

(A) encapsulates zero, one or a plurality of Whole Ballots and each Whole Ballots correlated constituent components (Master, Receipts) so as to facilitate zero, one or a plurality of claims or processes of this invention while also ensuring Ballot contents security;

(B) associates, correlates, Marks, attaches or embeds zero, one or a plurality of Security Elements, to zero, one or a plurality of encapsulating Containers of prior step (A);

(C) associates, correlates, Marks, attaches or embeds zero, one or a plurality of RSID, to zero, one or a plurality of encapsulating Containers of prior step (A);

(D) associates, correlates, Marks, attaches or embeds zero, one or a plurality of barcodes to zero, one or a plurality of encapsulating Containers of prior step (A);

(E) correlates, records and stores for each of a plurality of said encapsulated Ballots of prior steps (A) to each of the Security Elements of steps (B), (C), (D), (E);

(F) further correlates each of a plurality of unique Registered Voter Identifiers having acronym: RVID's, and private Voter RSIDs, to zero, one or a plurality of Ballots and Security Elements of prior steps (A) to (E);

(G) and the further steps and methods whereby zero, one or a plurality of Officials provide zero, one or a plurality of, and any types of Voters and Officials with the means, materials, options and methods so as to enable zero, one or a plurality of, and any types of Voters, zero, one or a plurality of Officials, to Mark on the outside or External View of each Return Data Container with zero, one or a plurality of unique Return Data Container Security Elements, zero, one or a plurality of Return Voter-ID RSID Barcode(s), and zero, one or a plurality of correlated Return Data Container Identifier symbols that are correlated to their respective Return Data Container Security Elements, zero, one or a plurality of Return Data Container Identifier Verification Validation text, numbers, or symbols and any combination of text, numbers and symbols;

(H) and the further steps and methods whereby zero, one or a plurality of Officials provide zero, one or a plurality of, and any types of Voters to:

(i) Mark and correlate their personal signature or any other private identifying information (such as: social security number, private PassWord) and zero, one or a plurality of Security Elements, Ballot RSIDs, Ballot PassCodes to be hidden from visibility and contained on the inside of zero, one or a plurality of, and any type (paper, electronic, optical, electromagnetic) of Sending Data Containers and type of Return Data Containers, Registration Forms, Return Envelopes, Master Ballot Return Envelopes, Electronic Data Containers;

(ii) and the further steps whereby zero, one or a plurality of Eligible Voters apply the methods of step (G) to actively Mark, on the outside or External View of each Return Data Container (Master Ballot Return paper Envelopes, Receipt Voter Registration Electronic Data Container, Document Return Envelopes, Forms Return Envelopes, Ballot Return Envelopes) with:

(i) zero, one or a plurality of unique Return Data Container RSID Barcode(s);

(ii) zero, one or a plurality of Return Data Container RSID symbols that are correlated to the alpha-numeric value of the Return Data Container RSID Barcodes;

(I) and the further steps and methods of enclosing, attaching or correlating:

(i) zero, one or a plurality of election Documents, Voter Registration Master parts, Voter Registration Receipt parts, Master Ballots, Receipt Ballots;

(J) and the further steps and methods of correlating zero, one or a plurality of Whole Ballot Voting RSIDs, Voter Registration RSIDs of this invention, and any correlated symbols, numeric and alpha-numeric values thereof, to be further correlated to zero, one or a plurality of Barcodes of used for the Whole Ballot RSID Barcode, Ballot PassCode, Master Ballot part RSID Barcode, Receipt Ballot part RSID Barcode, Voter Registration RSID Barcode, Voter PassCode, and for zero, one or a plurality of Data Containers Whole Ballot Data Containers, Ballot Return Data Containers, Master Ballot Return Data Containers, Receipt Ballot Return Data Containers, Voter Registration Return Containers and for each associated Data Container RSIDs and correlated Data Container Barcodes and for each other types of Data Container Marking Symbols and their respective correlated values;

(K) and the further steps and methods whereby zero, one or a plurality of Voters, and zero, one or a plurality of Voter Proxies actively sends, transmits, or delivers, or, conveys:

(i) zero, one or a plurality of Master Ballots, (ii) zero, one or a plurality of Receipt Ballots, (iii) zero, one or a plurality of Documents, Containers, forms, events, communications, processes and data of this invention;

(iv) zero, one or a plurality of any type of Data Containers of this invention—to zero, one or a plurality of Officials, Official Agents, Official Voting Session Devices, and to zero, one or a plurality of other interested persons or legal entities;

(L) whereby zero, one or a plurality of Officials, Official Agents, Officials subordinate electronic devices and manual methods to actively send, transmit, or deliver at least one Whole Ballots and component Master part and at least one, Receipt parts, and at least one correlated, pre-marked Ballot Data Return Container of steps (A) to (G), to each of a plurality of Certified, Registered Voters and Proxy-Voters;

(M) and the further steps and methods whereby zero, one or a plurality of Officials, Official Agents, employ zero, one or a plurality of Officials subordinate electronic devices to passively make available, and to actively send, transmit, or deliver zero, one or a plurality of, and any Ballots, Documents, Forms, Data Containers, telephone transmissions, Internet web-pages, Internet Electronic Mails, Fax or Facsimiles, interactive television transmissions, amendments, error processes and messages to zero, one or a plurality of interested parties Voters, News Media, Political Candidates, Government Officials, Voting Session Officials;

(N) and the further steps of recording or amending zero, one or a plurality of the important, relevant data associated with zero, one or a plurality of attributes associated with each type of Voter, in correlation with, or independent of, each type of crucial Voting Document each Whole Ballot, Master Ballot, Receipt Ballot, each Whole Registration Form, Master Registration Form, Receipt Registration form, each Language Selection Whole form, Language Selection Master form, Language Selection Receipt form, and for a plurality of Documents, for each type of Documents, and also for each of a plurality of Data Containers and Data Return Containers as well as for any correlated data thereof.

11. The Computerized Voting System of claim 1 wherein: zero, one or a plurality of Voters and zero, one or a plurality of Officials, Official Agents and Official Devices:

(A) act to determine the usefulness and validity of zero, one or a plurality of: Ballots, Registration forms, other Documents or Data Containers, or data records or data transmissions by correlating: zero, one or a plurality of Security Elements and zero, one or a plurality of non-Security Element portions, Election Information portion, Due Date portion, Due Time portion), and comparing to Official records utilizing zero, one or a plurality of Vote Processing Devices—to transmit and receive information, as well as to provide data for the confirmation, rejection, or error messages as to the validity of each and for a plurality of Documents, data Containers, communications and data information of this invention;

(B) before revealing a Ballot Voting RSID or PassCode RSID, and before marking or casting their Ballot(s), determining whether zero, one or a plurality of Whole Ballots or constituent parts were already used to Vote, by comparing the current Ballot to Official data sources manually or electronically;

(C) and the further steps that if the Ballot is confirmed as not previously having been used to vote, zero, one or a plurality of Voters may exchange, zero, one or a plurality of times, zero, one or a plurality of Whole Ballots they possess for other zero, one or a plurality of similar Whole Ballots possessed by zero, one or a plurality of other trusted Voters, Eligible Voters, Proxy Voters) or exchange with zero, one or a plurality of Voting Session Officials or their designated Official Agents;

(D) and the further step whereby the Voter optionally does not open the sealed or encrypted Whole Ballot Container to verify the validity of the Ballot;

(E) and the further steps and methods whereby each the Voter does use zero, one or a plurality of Ballot Validation RSIDs in whole or in part, zero, one or a plurality of Ballot Validation PassCodes, and other Ballot information and security elements used to verify Ballot usability and validity;

(F) and the further steps and methods whereby each Ballot Validation RSID and zero, one or a plurality of correlated Ballot Validation PassCodes or Sending Ballot Container ID are used to authenticate and verify exactly one Whole Ballot Container and zero, one or a plurality of Whole Ballot Voting RSIDs within the correlated Whole Ballot Container, without revealing any Whole Ballot Voting RSID to anyone handing or exchanging zero, one or a plurality of Whole Ballot Containers, until such time a Whole Ballot Container is opened at least one Whole, Master, or Receipt Ballot Voting RSID are revealed and further authenticated in correlation with zero, one or a plurality of associated Ballot Validation RSID and any other information associated with the Whole Ballots or Whole Ballot Container from which the Whole Ballot was extracted;

(G) and the further steps of zero, one or a plurality of Voters and zero, one or a plurality of Officials and zero, one or a plurality of other Interested Parties validating zero, one or a plurality of:

(i) Voting Ballot RSIDs in whole or in part, (ii) Voting Ballots correlated Ballot PassCode RSIDs—by comparing to Official records using zero, one or a plurality of voting, Registrations and communications methods;

(H) and the further steps and methods whereby if it is determined that a Ballot Voting RSID has not been used to vote, then zero, one or a plurality of Eligible, Registered Voter then completes zero, one or a plurality of Whole Ballots whereby each Voter does zero, one or a plurality of combinations of these following sub-steps (a), (b), (c) whereby for sub-step:

(a)(i) chooses zero, one or a plurality of Official, predefined Candidates, Political Party(s); and (a)(ii) chooses zero, one or a plurality of Official predefined Proposals on their Master Ballot by marking the Master part of the Whole Ballot, whereby the Mark may be an enclosing circle or oval, X, x, checkmark glyph, filled in circle or oval, filled in rectangle, line, or any other style of Mark or line or graphic or glyph made in at least one POEM format as per Rules of the Voting Session;

(a.iii) each active Voter manually or automatically via Voting Devices creating a duplicate Mark on each Receipt part of each correlated Whole Ballot with the same correlated RSID;

(b.i) giving each Voter, and a plurality of Voters the option to manually print or Write-In, or use a typing device or electronic device interface to type in on the Voter's Master part of their Whole Ballot, the Voter's choice of zero, one or a plurality of unofficial Candidate names, unofficial Political Party and Group names, and zero, one or a plurality of unofficial Proposals and Proposal Identifiers;

(b.ii) whereby zero, one or a plurality of Voters then chooses zero, one or a plurality of their newly printed-written-in unofficial Candidates, zero, one or a plurality of unofficial Groups and Political party(s) and zero, one or a plurality of their newly printer-written-in unofficial Proposals and Proposal Identifiers of sub-step (b.i) by marking the Master part of the Whole Ballot, whereby the Mark may be an enclosing circle or oval, X, x, checkmark, filled in circle or oval, filled in rectangle, line, or any other style of Mark or line or graphic made in at least one said POEM format: physical, optical, electronic, electromagnetic, chemical, structural as per Rules of the Voting Session;

(b.iii) each active Voter manually or automatically via Voting Devices creating a duplicate entry on each Receipt part of the Whole Ballot that has the same identical, correlated RSID, and also for a plurality of other Master-Receipt parts of every other correlated Whole Ballots having different Ballot RSIDs, each completed separately by a plurality of Voters;

(c) a plurality of Voters each creating zero, one or a plurality of Voter Personal Security Item Mark, correlating their personal signature, initials, graphic symbols, or other private identifying information of a Voter Private PassWord or Private Security Number or symbols patterns to zero, one or a plurality of Voter Registration Documents, correlated RSIDs and PassCodes, Voter Proxy Assign Documents, correlated RSIDs and PassCodes, Voter Contact Update Documents, correlated RSIDs and PassCode Voter Error Investigation Documents, correlated RSIDs and PassCodes, Master Ballots Documents, correlated RSIDs and PassCodes and to zero, one or a plurality of correlated Receipt Documents, correlated RSIDs and PassCodes of the aforesaid Documents as well as to each of the electronic-optical or physical renderings thereof;

(d) and the further steps and methods whereby zero, one or a plurality of Voters Mark and correlate the date and time of completion to zero, one or a plurality of Master Ballots and for zero, one or a plurality of correlated Ballot RSIDs and correlated Receipt parts of each Whole Ballots;

(e) and the further steps whereby a plurality of Voters Mark and correlate each Master Ballot they possess to each correlated Receipt Ballot, by marking each with zero, one or a plurality of:

(e.i) Voter personal signatures Voter Private PassWords, Voter personal initials, Voter glyphs or graphics, Voter Private Security Numbers or number patterns;

(e.ii) and the further steps and methods whereby for a plurality of Ballots, a plurality of Voters recording and storing data of the Ballot being signed, cast, or signed and cast; zero, one or a plurality of Voters marking and correlating the transaction identifier, transaction signature data, date, time and location where the Ballot was signed or cast, or signed and cast, along with any identifying information for zero, one or a plurality of personal devices and Official devices that is then correlated to zero, one or a plurality of Master Ballots and all correlated Ballot Receipts;

(e.iii) the step whereby a plurality of Voters keep zero, one or a plurality of Receipt Ballots which are correlated to the completed Master Ballot part for zero, one or a plurality of Whole Ballots assigned to them.

12. The Computerized Voting System of claim 1 wherein at least one Official, Official Agent or Official Voting Device or combination thereof:

(A) receives zero, one or a plurality of Ballots, Voter Registration forms, Language selection forms, Ballot envelopes, data Containers, Receipts, Objects, data items or transmissions and Voter Personal Security Items of this invention—from at least one type of Voter, and for zero, one or a plurality of Voters;

(B) records notes for each Voter submission: the dates, times, and any other relevant information along with data about each and all received Ballots, Voter Registration forms, Language selection forms, Ballot envelopes, data Containers, Receipts, Objects, data items, transmissions and Voter Personal Security Items, then chooses to either:

(C) accepting for processing zero, one or a plurality of Ballots, Voter Registration forms, Language selection forms, Ballot envelopes, data Containers, Receipts, Objects, data items or transmissions of this invention, which do have a valid, usable RSID, or, (D) refusing to accept for processing zero, one or a plurality of Ballots, Voter Registration forms, Language selection forms, Ballot envelopes, data Containers, Receipts, Objects, data items or transmissions of this invention, which do not have a valid, usable RSID, or, (E) accepting and segregating zero, one or a plurality of items or events or processing actions or transmissions of this invention, which do have a valid, but duplicate RSID—and then said Officials, Official Agents, Official Devices reviews the authenticity of a plurality of Objects, data items or transmissions, and then acting to certify and restore the valid Objects, data items or transmissions to relevant processing, then promptly and accurately amends all related records;

(F) and for all instances of a valid RSID then processing all timely received Ballots, Voter Registration forms, Language selection forms, Ballot envelopes, data Containers, Receipts, Objects, data items, amendments, events, error processing or transmissions of this invention which are validated and certified by First acquiring, recording and storing an image of the entire Ballot, form, Container, Receipt, then for the said image, enhancing, scaling and rendering said image for scanning the associated RSID symbols and the RSID barcode by selecting an appropriate Document scanning Template, or a series of scanning Templates, designed to isolate desired data fields for data capture and for imaging, extracting the correlated values of said data fields by employing optical character recognition software and-intelligent character reading software for extracting, reading and decoding the extracted data fields values so as to compare to the corresponding Official records of valid RSID values previously created, recorded and stored,—whereby for matching RSID values that are deemed valid:

(i) processing zero, one or a plurality of each said Document and Document type: Voter Registration form, Language selection form, Proxy Registration, Ballots, Error Complaints and of each Document part Document Container, Data Container image, Template, Object, data item, message, signal, data transmission and data reception whereby for each that is deemed valid for scanning;

(ii) scanning each of the aforesaid of preceding item (i) which has a valid RSID; extracting zero, one or a plurality of: RSID's, PassCodes, Voter information items, Voter Personal Security Items, Official data elements, Official Security Elements, alignment Marks and scan zone coordinate Marks which are then recorded, correlated, analyzed, error checked, authenticated or rejected, each tallied, stored; or, (iii) scan each Ballot that is deemed having a valid RSID, extracting zero, one or a plurality of: Voter Selections, Voter Write-In choices, Voter Personal Security Items, Official data elements, Security Elements, alignment Marks and scan zone coordinate Marks from zero, one or a plurality of required portions of the Ballot which are recorded, analyzed, error checked, authenticated or rejected, tallied, securely and immutably stored, followed by computers running programs designed to optimize data storage and data retrieval;

(iv) scan each Container that is deemed having a valid RSID, extracting zero, one or a plurality of: Jurisdiction and sub-Jurisdiction Identifiers, Nation, State and Region Identifiers, Area Identifiers, Zone Identifiers, Polling Station Identifiers, Submission Date, Time and Location Identifiers, Submitters Identifiers, Receiving Officials Identifiers, Submitting and Receiving Device Identifiers, Submitting and Receiving Network Identifiers, Container Identifiers and Container Security Items, Container data elements, Security Elements, alignment Marks and scan zone coordinate Marks from zero, one or a plurality of required portions of the Container which are recorded, analyzed, error checked, authenticated or rejected, tallied, securely and immutably stored, followed by computers running programs designed to optimize data storage and data retrieval.

13. The Computerized Voting System of claim 1, the steps and methods for machine reading of: Ballots, Voter Registration forms, Voter-Proxy Language Registration forms, any types of Receipt Documents and any types of marked Containers and any other Objects of this invention—whereby the aforesaid are manifested in at least one POEM format whereby:

(A) A plurality of Voters and a plurality of Proxy Voters each submits zero, one or a plurality of Documents, from each of the aforesaid Document group types, and any types of marked Containers) to Officials by enclosing zero, one or a plurality of any types of said Documents in in least one POEM format Containers having zero, one or a plurality of unique machine-readable Identifiers of:

(1)(i) Container Identifiers, (ii) Jurisdictional Identifiers, (iii) Voting Session Identifiers, (iv) Voter Identifiers, (v) submitted date-stamps or date-time-stamps markings;

(vi) Container Contents Identifier or markings; and (2) wherein for each Official designated Identifier: (Container, Jurisdiction, Voting Session, Voter, Container Contents) shall also include: (a) one correlated binary value, (b) at least one correlated barcode value, (c) at most a single two-dimensional bar code graphics, (d) whereas the Container Contents identification markings may be a simple choice selection marking with an X, x or check-Mark, solid fill-in box, or Identifier markings; and (3) the aforesaid Identifiers, markings, barcodes and values shall also have a prescribed font, symbolic representations of characters, symbols, numbers, alphanumeric characters, non-alphanumeric characters, graphical drawings, graphical icons that are represented accurately in any format: physical, optical, electronic, magnetic, electromagnetic, chemical, structural, and are capable of data capture, optical recognition processing, intelligent character recognition, data inter-format conversion, and data storage in any said format or in zero, one or a plurality of said POEM formats; and (4) furthermore the aforesaid Identifier criteria shall include and apply to zero, one or a plurality of correlated Official Security Elements and zero, one or a plurality of Voter Personal Security Items thereof;

(B) and whereby each type of POEM format Container is further markable for recording markings thereon of the Officially Received date-time-stamp markings, and for of zero, one or a plurality of Official processing notes;

(C) and further steps comprising of:

(1) for each and every Container, reading each type of POEM format Container markings including reading all of the machine readable Identifiers comprised of: zero, one or a plurality of Container Identifiers, zero, one or a plurality of Jurisdictional Identifiers, zero, one or a plurality of Voting Session Identifiers, zero, one or a plurality of Voter Identifiers, zero, one or a plurality of Official Security Elements, zero, one or a plurality of Voter Personal Security Items, zero, one or a plurality of Container Content markings, zero, one or a plurality of Delivery-Submission date-stamp or date-time-stamp markings;

(2) wherein for each POEM format Container that has a machine readable Container, Jurisdiction, Voting Session, Voter, Delivery-Submission date-stamp, Delivery-Submission date-time-stamp, Official Security Elements, Voter Personal Security Items, Container Contents Identifier—said method of decoding each machine readable POEM format Container, Jurisdiction, Voting Session, Voter, Delivery-Submission Date-Timestamp, Delivery-Submission date-time-stamp, Official Security Elements, Voter Personal Security Items, Container Contents Identifier read from each POEM format Container thereof;

(3) and said selecting a Template includes selecting the Template, or a series of sequentially applied of Templates that are used for decoding and therefore are responsive to the physical or EMO Container, Jurisdiction, Voting Session, Voter, Delivery-Submission date-stamp, Delivery-Submission date-time-stamp, Official Security Elements, Voter Personal Security Items, physical or EMO Container Contents Identifier and markings thereof each POEM format Container;

(4) said selecting an aforesaid responsive Template includes selecting the Template responsive to physically, electronically, optically, electromagnetically capturing, revealing, rendering and displaying zero, one or a plurality of encoded and decoded Identifiers or markings for each of a plurality of POEM format Containers and correlated data fields of: Jurisdiction, Voting Session, Voter, Delivery-Submission date-stamp, Delivery-Submission date-time-stamp, Official Security Elements, Voter Personal Security Items, Container Contents Identifiers and markings that are read from each POEM format Container, so as to determine from the aforesaid markings and Identifiers of the submitted POEM format Container the correlated: Jurisdiction, Voting Session, Voter and Official Security Elements are valid for the current voting session and the recipient Jurisdiction, and whether the POEM format Container Contents therein were submitted or received within the date-time period allowed for Official processing;

(5) marking a plurality of physical Containers and a plurality of POEM format Containers as having a valid Container Identifier, if said POEM format Containers are determined to have a valid Identifier, or, the alternative step of marking zero, one or a plurality of POEM format Containers as having an invalid Container Identifier or not having a valid Container Identifier and further step of rejecting said invalid POEM format Container should it not have a valid Container Identifier;

(6)(a) and further step if the POEM format Container is found to be timely submitted to, or received by Officials at the correct Jurisdiction, the steps of recording and optionally marking each said POEM format Container as being timely with the Official Received date-time-stamp, and then removing all of the internal received Documents from each timely Container, and for each Document therein said Containers, recording each as being timely received, optionally marking each Document with the Official Received date-time-stamp, with zero, one or a plurality of Container Identifiers, and (b) the further steps of marking and correlating each valid Container Identifier to each of the said Documents therein, and (c)(1) the alternative step for each invalid Identifier for each said Container, marking said Container as having an invalid Container Identifier; and the further step of from each Container having an invalid Container Identifier, extracting each Document therein, marking each said Document invalid Container Identifier, optionally marking each Document with the Official Received date-time-stamp, and with zero, one or a plurality of Container Identifiers, then segregating said Documents for separate processing; and (c.2) the further step of rejecting each Document extracted from a Container having an invalid Container Identifier; (c.3) the further step then for of the Documents taken from an invalid Container, marking each therein Document invalid Container Identifier then separately determining the validity, authenticity and usability of each said Document thereof for any further processing; and thereafter processing any valid, authentic Documents that were received in a POEM format Container having an invalid Container Identifier; and (d) for each timely received and valid Container Identifier Document, and for each timely received Document, then performing the following steps of:

(1) submitting each said Document to validation and authentication testing; and for those Documents passing validation and authentication testing, certifying each then submitting each to reading of the Document, comprising the steps and methods of:

(i) selecting a Template for reading, decoding and displaying zero, one or a plurality of data fields of any type that are assigned to each type of Document: Voting Ballot, Voter Registration form, Voter-Proxy Assignment form, Voter-Proxy Language Registration form, Voter Registration Complaint form, Voter Ballot Processing Complaint form, Ballot Receipt, Voter Registration Receipt, Voter Proxy Assignment Receipt, Language Selection Receipt, and for the particular Voting Session, Jurisdiction, current Template version, Official current date and time;

(ii) wherein for each of a plurality of said Documents, in accordance with the selected appropriate Document processing Template, or a series of sequentially applied Templates, that are correlated to the type of Document for performing the tasks thereof: reading then decoding, and displaying zero, one or a plurality of Official data field label Identifiers, zero, one or a plurality of Official data fields and zero, one or a plurality of correlated barcodes, and zero, one or a plurality of Official Security Elements as well as zero, one or a plurality of Voter selections, zero, one or a plurality of Voter Write-In data values, zero, one or a plurality of symbols, zero, one or a plurality of graphics and zero, one or a plurality of Voter Personal Security Items, that are marked on each Document and that is correlated and responsive to the Template and Identifier provided for reading each of the aforesaid: Official data fields, field label Identifiers, barcodes, Security Elements, Voter selections, Voter Write-In data values, symbols, graphics and Voter Personal Security Items: Voter Signature, Voter Initials, Voter PassWords, Voter graphics and glyphs, Voter Personal Security Numbers and patterns;

(iii) and thereafter interpreting, recording, sorting, storing as at least one or a combination of POEM formats: physically, optically, electronically, magnetically, chemically, structurally, then tabulating each of the decoded Voter selections, Voter Write-in data values, symbols, graphics and Voter Personal Security Items from each of the timely received Documents, and reading each of the Official data field label Identifiers, Official data fields and correlated barcodes, and Official Security Elements in a manner consistent with each respective reading Template or correlated series of sequentially applied Templates for that Document, and for each type of Document, and for zero, one or a plurality of Documents of each Document type;

(2) wherein each said type of Document and each Container need not be pre-sorted into groups prior to said reading thereof;

(a) sorting a plurality of the aforesaid Documents by Document type, Document Identifier, Container Content Identifier or markings, Container validity designation or marking, Jurisdiction Identifier, voting session Identifier, date submitted, date received, date and time submitted, date and time received or otherwise sorted by any combination thereof;

(b) sorting a plurality of Containers by Container Identifier, Container Content Identifier (content Document type) or Container validity designation or marking, Jurisdiction Identifier, Voting Session Identifier, date submitted, date received, date and time submitted, date and time received or sorted by a combination thereof;

(c) and further wherein for each aforesaid Documents has orientation Indicia and fiducial Marks and may be in an orientation different from other ones of the same types of Documents, and among different rendering POEM formats of the same Document—said method further comprising: determining from the orientation Indicia the orientation of each said Document;

(D) said decoding of the Official data field label Identifiers, data fields and correlated barcodes, Official Security Elements, Voter selections, Voter Write-in data values, symbols, graphics and Voter Personal Security Items that are read from each Document in accordance with the selected reading Template comprises decoding consistent with the determined orientation, magnification ratio, and proportionality aspect ratio of each Document for the Official data field label Identifiers, Official data fields and correlated barcodes, Official Security Elements, Voter selections, Voter Write-in data values, symbols, graphics and Voter Personal Security Items marked on each Document in accordance with the selected, correlated reading Template or series of sequentially applied Templates;

(E) said orientation Indicia includes:

(1)(a) zero, one or a plurality of face-orientation Indicia that are place for aiding to rotate the POEM formats of said Document, Container or Object image to the correct orientation for reading, and further to assist in determining and signaling whether the POEM format of each said Document, Container or image requires to be flipped over to view the opposite view other angle to enable proper complete scanning and reading;

(b) or at least one or more orientation Indicia comprised of: Indicia concentric circles, bulls-eye, or concentric oval or rectangular shapes, cross-hair lines, cross-hair lines in a circle or concentric circles, typographical bullet graphics, crossed connected or pyramidal: + Marks, X and x Marks, T Marks, I Marks, arrow, bracket, rectangle, triangle or wedge shapes, and further whereby any of the said Indicia may be further modified with one or more black, darkened or contrasting adjacent sections, any notches or darkened area Marks are further whereby said Indicia may be further modified by overlapping or combination of any type and number of said Indicia; further consistently placing and position said Indicia on each Document, Container, Object or rendered formats of any types of said Documents, Containers, Objects along at least one edge or corner so as to be distinguishable from any other types of Documents, Container or Object;

(2)(a) at least two size-scaling Indicia that are spaced apart by a predetermined distance for defining an outer edge perimeter dimension for each of the respective Documents, Containers or Objects; or at least two scaling-sizing Indicia that are placed at opposite corners along the same edge of width or length, and spaced apart by a predetermined distance for defining a dimension of the Document consistently for each Document type;

(b) and placing at least two aspect-sizing Indicia placed at a right angle or other angle relative to the said size-scaling indices—or at diagonally opposite corners—for defining the proportionality and aspect ratio of the Document, consistently for each Document type;

(c) said Indicia size-scaling and aspect-ratio sizing may be combined;

(3) and at least two scan-position Indicia that are spaced apart consistently by a predetermined distance for defining a dimension of a scanning zone for a Template reading area within the boundaries of each of the respective Documents, and for each Document type;

(4) zero, one or a plurality of imaging-quality Indicia for detecting and calibrating the captured image quality comprising of: scan resolution dpi, focus-sharpness, depth-of-field, brightness, contrast, hue, saturation, chromatic values, grey-scale values;

(5) each said Indicia markings may be manifested as physical Marks, POEM format data and in any combination thereof;

(6) each said Indicia include at least one of: concentric circles bulls-eye, or concentric oval or rectangular shapes, cross-hair lines, cross-hair lines in a circle or concentric circles, typographical bullet graphics, crossed connected or pyramidal: + Marks, X and x Marks, T Marks, I Marks, arrow, bracket, rectangle, triangle or wedge shapes, and further whereby any of the said Indicia may be further modified with one or more black, darkened or contrasting adjacent sections, any notches or darkened area Marks are further whereby said Indicia may be further modified by overlapping or combination for a plurality of any type of said Indicia;

(7) for each said Indicia, made in any type of rendering POEM format (optical, electronic, electromagnetic, chemical, structural the steps of consistently sizing each said Indicia with the correct aspect-ratio, color, or greyscale or blackness or whiteness, contrast, darkness, brightness, focus, sharpness and clarity, then accurately placing and position said Indicia, on each Document, Container, Object and for a plurality of said Documents, Containers, Objects;

(8) for said Official Document markings and Voter marking areas, and for zero, one or a plurality of Voter or Official markings thereto, made in any said of rendering POEM format the steps of consistently sizing each said markings with the correct aspect-ratio, color, or grey-scale or blackness or whiteness, contrast, darkness, brightness, focus, sharpness and clarity, then accurately placing and positioning said markings, on each Document, Container, Object and for a plurality of said Documents, Containers, Objects;

(F) wherein said reading each physical or EMO format of Document or Container includes capturing an optical representation image of the Document or Container and securely storing the captured image of the POEM format of Document or Container; wherein said reading each POEM format of Document or Container includes capturing the entire optical image of the Document or Container or Object (and for any portions thereof, by employing at least one or a combination of: camera, optical copier machine, optical scanner, electronic facsimile machine, a computer running a virtual or real-time screen imaging display and high resolution image capture program, a computer running a Document rendition and high resolution image capture program, a commercial image capture device, a commercial printing device, or a commercial scanning device, or optical barcode reader, ultra-violet light invisible ink illuminator and reader, electromagnetic ink reader, magnetic stripe reader, electronic micro-device, integrated circuit reader or any combination thereof said devices and with any number and combination of other said Voting Session Devices, independently and in combinations with at least one or a plurality of other devices of network systems, telemetry systems, telephone and computer communications systems, voter reporting and security systems, reporting and publishing systems, investigation and security systems, validation and authentication systems, error detection, error reporting and error correction systems of this invention;

(G) whereby a method for reading paper or visually or audibly or tactilely rendered physical, structural or electronic, magnetic, optical, chemical POEM format of Documents or portions thereof said Documents whereby: each said POEM format of Document is markable for marking Voter selections, Voter Write-in data values, symbols and graphics thereon, said method comprising: decoding the machine readable: determining the Voter selections, Voter Write-in data values, symbols and graphics marked on each paper Document; and tabulating the Voter selections, Voter Write-in data values, symbols and graphics determined from each of the POEM format of Documents; wherein each POEM format of Document is markable for marking Voter selections, Voter Write-in data values, symbols and graphics thereon, and wherein each manifested or rendered POEM form of Document has a Jurisdiction Identifier and fiducial Marks thereon, said method comprising: reading each manifested or rendered POEM form of Document including at least the machine readable Document Identifier, and zero, one or a plurality of Voter signatures, Voter initials, and Voter PassWords thereon; decoding the machine readable Document Identifier read from each Document; displaying at least the decoded Document Identifier Voter signatures, Voter initials, and Voter PassWords of each Document for determining from the Document Identifier, the Voter signatures, Voter initials, and Voter PassWords or the Document Identifier and the Voter signatures, Voter initials, and Voter PassWords, whether the Document is a valid, authentic, timely submitted Ballot; and if the Ballot is determined to be a valid, authentic, timely submitted Ballot, removing each said manifested or rendered POEM form of Ballot determined to be a valid, authentic, timely submitted Ballot from its Ballot envelope, and then performing the following steps on each said form of Ballot determined to be a valid, authentic, timely submitted physical or EMO form of Ballot: determining from the fiducial Marks the orientation of each said Ballot; reading consistent with the determined orientation of each Ballot the Jurisdiction Identifier of each Ballot; selecting an appropriately correlated form of reading Template responsive to read the Jurisdiction Identifiers of each said form of Ballot and for reading the Voter selections, Voter Write-in data values, symbols and graphics marked thereon; then using said reading Template for reading the Jurisdiction Identifiers, Voter selections, Voter Write-in data values, symbols and graphics marked on said form Ballot in accordance with the selected Template and consistent with the determined orientation of each said Ballot, whereby the Voter selections, Voter Write-in data values, symbols and graphics marked on each said form of Ballot are read in accordance with a selected Template corresponding to the Jurisdiction Identifiers for that Ballot, irrespective of the orientation of each Ballot; and further comprising: decoding the voting selections and Write-in choices, further comprising: decoding the voting selections and Write-in choices read from each paper Ballot in accordance with the selected Template; then: tabulating the voting selections and Write-in choices decoded from each of the manifested or rendered POEM formats of all unique Ballots consistent with their respective selected Templates, or, publishing the voting selections and Write-in choices decoded from each of all unique RSID Ballots, or tabulating the voting selections and Write-in choices decoded from each of all unique RSID Ballots consistent with their respective selected Templates and publishing the decoded voting selections and Write-in choices read from each all unique RSID Ballot in accordance with the selected Template; and then: tabulating the voting selections and Write-in choices decoded from each of all unique RSID Ballots consistent with their respective selected Templates; or publishing the voting selections and Write-in choices decoded from each of all unique RSID Ballots, or, tabulating the voting selections and Write-in choices decoded from each of all unique RSID Ballots consistent with their respective selected Templates, and then determining the decoded voting selections and Write-in choices; and prior to said tabulating step for zero, one or a plurality of Ballot Documents and types of Ballot Documents: determining from the decoded voting selections whether each Ballot Document contains an under-vote, an over-vote, a missing voting selection, a Write-in voting selection, or a combination thereof; segregating each Ballot determined to contain an under-vote, an over-vote, a missing voting selection, a Write-in voting selection, or a combination thereof from other Ballots determined not to contain an under-vote, an over-vote, a missing voting selection, or a Write-in voting selection; and then: performing said tabulating step for all other Ballots not determined to contain an under-vote, an over-vote, a missing voting selection, or a Write-in voting selection; separately processing and separately tabulating each segregated Ballot determined to contain an under-vote, an over-vote, a missing voting selection, a Write-in voting selection, or a combination thereof an under-vote, an over-vote, a missing voting selection, a Write-in voting selection;

(H) (a) and further whereby said reading each marked Container and a plurality of Containers, each Document and a plurality of Documents, includes imaging of marked physical Containers and imaging any physical Documents: (i) that are effectively transported linearly without oscillations along a physical transport path of an image Document scanner, or (ii) by capturing an image of the Container or Document or Object by using a high resolution digital optical camera, or (iii) using zero, one or a plurality of alternative scanning data acquisition devices: optical barcode reader, ultraviolet light invisible ink illuminator and reader, electromagnetic ink reader, plastic card magnetic stripe reader, electronic micro-device, integrated circuit reader, or (iv) by converting electronic, optical, magnetic and electromagnetic data of the physical, electronic, optical, magnetic or electromagnetic Container or Document so as to be able to render said Container or Document as a high resolution optical image in a pixelated or bitmapped image file format—for each of a plurality of said: Containers, Documents, Objects;

(b) wherein all physical, electronic, optical and electromagnetic Documents have boundary, alignment, orientation and sorting markings to facilitate the scanning process;

(c) whereby the process of scanning comprises the general steps:

(i) determine the Document voting Jurisdiction, zero, one or a plurality of sub-Jurisdictions;

(ii) determine zero, one or a plurality of voting session Identifiers, (iii) determine the types of Documents to be scanned;

(iv) optional pre-sorting and grouping a plurality of Documents by any type;

(v) at least one imaging control devices or Officials:

(vi) enables at least one scanning device;

(vii) loads scanning device parameters;

(viii) capturing the entire Document image and for any portion thereof;

(ix) applying image processing software to adjust visibility, quality and file size;

(x) applying image processing software to convert said image file to at least one image storage format, then saves-stores the image in zero, one or a plurality of said forms and formats;

(xi) applying IPS to scale the image view to required size;

(xii) rotating the image to the proper orientation;

(xiii) signaling an error if the image is blank, indiscernable, or too dark to use;

(xiv) setting the image to the proper alignment relative to a test alignment sheet;

(xv) loading the appropriate Document reading Template, or a series of Templates for that respective Document type, voting Jurisdiction, and for that election Identifier on that date—for which that Template or series of Templates are designed to scan Voter Data portions of the Document to extract the Voter provided selections and information therein and thereof said Document that is correlated to specific Voter Data positions areas of the Document;

(xvi) scanning each Voter Data position that is correlated to the Voter Template Data Field Value adjacent to, or at each Voter Data position;

(xvii) reading and decoding each Voter data field value that is converted from optical images to the actual values of the characters, numbers and symbols by using at least one computer running programs of optical character recognition software and intelligent character recognition software;

(xviii) storing at least one image parts of any Document portions or Container having markings of Voter signature, Voter initials, Voter PassWords, Voter Ballot casting date, Voter personal devices Identifiers, and any other Voter Personal Security markings or graphics;

(xix) scanning, reading, and decoding from each reading Template area that corresponds to each Official data position: every Official data field Identifier: Ballot RSIDs, Ballot PassCodes, Officials devices Identifiers, Ballot casting date, Ballot casting time, Ballot casting location, Jurisdiction,—each correlated Official data field values, and zero, one or a plurality of: correlated barcodes, characters, numbers, symbols, graphics, Official Document Security Elements;

(xx) scanning, reading, and decoding from each reading Template area that corresponds to each Official alignment Marks, orientation Marks, scan zone Identifier Marks, image quality control Marks;

(xxi) Voter portions captured of what is read and decoded has correlated values redundantly stored in at least one said formats: optically, electronically, electromagnetically, physically, structurally, chemically redundantly; converting and correlating said read and decoded values to binary, octal or hexadecimal number values that are used for machine processes: comparisons, validation, authentication, certification, tallying, counting, sorting, analyzing, summarizing, reporting, storing) for provided Voter data; and further said Voter portions of Document and Container read images of Voter signature, Voter initials, Voter PassWords, Voter graphics and glyphs, Voter Personal Security Numbers and patterns, Official PassCodes are used to compare to verify or reject zero, one or a plurality of Ballots, Complaints or Amendments due to failed comparison of Official records of Voter signatures, Voter initials, Voter PassWords, Official PassCodes, Official graphics and glyphs, Voter Personal Security Numbers and patterns, on or within zero, one or a plurality of: Documents or Containers by comparison to said Voter signature, Voter initials, Voter PassWords, Official PassCodes, Official graphics and glyphs, Voter Personal Security Numbers and patterns, recorded previously for the Voter Registration;

(d) whereby aforesaid steps of part (c) are also used for each marked Container that is received so as to determine First whether the Container and internal Documents were sent to the proper Jurisdiction and whether said Containers and Documents were timely submitted for processing;

(e) said decoding the machine readable Identifiers, markings, values, and data that are read from each Container and each Document includes decoding the machine readable Identifiers, markings, values, and data from the said pixelated or bitmapped format of the Container image or Document image; and the steps of extracting relevant: Container data variables, Ballot variables Voter Registration variables, Voter Language select variables, and further:

(i) the Container Identifier includes zero, one or a plurality of unique Container Identifiers, zero, one or a plurality of unique voting session Identifiers, at least one unique Jurisdiction Identifiers, zero, one or a plurality of unique Voter Identifiers, whereby the determining is from the Container Identifier, Jurisdiction Identifier, Voting Session Identifier, Voter Identifier, and zero, one or a plurality of: Voter signature, Voter initials, Voter PassWord and Voter graphics and glyphs, Voter Personal Security Numbers and patterns;

(ii) whether the Container is a valid, verifiable Container comprises: determining whether the Template read Voter signature, Voter initials, Voter PassWord closely matches the Voter signature, Voter initials, Voter PassWord in the Certified Voter Registration record having the identical, unique Registered Voter Identifier, or, alternatively, the Container Identifier, Jurisdiction Identifier, Voting Session Identifier, Voter Identifier, are found in the voting system data storage and determined to be valid, active Identifiers;

(f) (i) wherein the Document Identifier includes at least one unique Document Identifiers, at least one unique voting session Identifiers, at least one unique Jurisdiction Identifiers, zero, one or a plurality of unique Voter Identifiers—wherein the determining is from the unique Document Identifier, Jurisdiction Identifier, and Voting Session Identifier, and zero, one or a plurality of unique Voter Identifiers, zero, one or a plurality of: Voter signature, Voter initials, Voter PassWord or phrase or numeric value or alpha-numeric value, Voter graphics and glyphs, Voter Personal Security Identifiers of audio sounds;

(ii) whether the Document is a valid, verifiable Document comprises: determining whether the Template read Voter signature, Voter initials, Voter PassWord, Voter graphics closely matches the Voter signature, Voter initials, Voter PassWord, Voter graphics that are found in the Certified Voter Registration record having the identical unique Registered Voter Identifier, or, alternatively, the Document Identifier, Jurisdiction Identifier, voting session Identifier, Voter Identifier, found in the voting system data storage and determined to be valid, active Identifiers;

(g) said decoding of the Official data field label Identifiers, data fields and correlated barcodes, Official Security Elements, Voter selections, Voter Write-in data values, symbols, graphics and Voter Personal Security Items that are read from each Document in accordance with the selected reading Template comprises decoding consistent with the pre-determined minimum acceptable values for: illumination, tonal contrast, focus-sharpness, white point value, black point value, black and white contrast, color contrast, hue, saturation, and chromatic values of each Document for the Official data field label Identifiers, data fields and correlated barcodes, Official Security Elements, Voter selections, Voter Write-in data values, symbols, graphics and Voter Personal Security Items which are marked on each Document in accordance with the selected, correlated reading each Template or each correlated plurality (series) of Templates;

(h) enabling each Voter to validate their Voter Registration or cast Ballot vote processing accuracy by using their privately known Ballot Voting RSID or Voter Registration RSID and zero, one or a plurality of Official Ballot PassCodes and zero, one or a plurality of Voter Personal Security Items, so as to confirm Official processing accuracy or to make amendments, optionally by referring to correlated private Internet WebPages and webpage PassCodes to zero, one or a plurality of Official records;

(i) in combination with each valid voting Ballot RSID submitted, further employing zero, one or a plurality of Official Ballot PassCodes as a mutually shared private Second-stage authentication for zero, one or a plurality of Ballot RSIDs whereby each Official Ballot PassCode submitted for each Ballot RSID must be correlated to said Ballot RSID prior to the Ballot being accepted for voting and recording each Ballot Voter choices and all other data correlated to said Ballot and Ballot RSID;

(j) employing zero, one or a plurality of Official Ballot PassCodes as a mutually shared private encryption-decryption key used by public-private key encryption-decryption algorithms for securely and privately encrypting or decrypting Voter data, Voter Ballot choices and related data, and Ballot security data between at least one Official and zero, one or a plurality of Voters authenticating or submitting zero, one or a plurality of valid authentic Ballots;

(k) employing zero, one or a plurality of Official Ballot PassCodes as a mutually shared private encryption-decryption key used by any type of public-private key encryption algorithms for securely and privately encrypting or decrypting Voter, Voting and Ballot data between Officials and zero, one or a plurality of Voters authenticating or submitting zero, one or a plurality of valid authentic Ballots;

(l) tallying, summarizing and publishing all Registrations and Ballots received, along with a complete list of all timely received, and all other valid, Ballot RSIDs that were assigned to Ballots and Registrations for public validation;

(m) Receiving and investigating all Registration or Ballot casting amendments requested and processing or rejecting zero, one or a plurality of amendment requests, then recording and completing all valid allowable amendments, then verifying zero, one or a plurality of amendments were correctly and accurately processed and then publishing zero, one or a plurality of amendments that each have one active status of completion: submitted, accepted, rejected, verified, completed, incomplete, pending, erroneous as well as one of four inactive statuses: inactive, rescinded, voided or cancelled.

14. The Computerized Voting System of claim 1 wherein: at least one Official, Official Agent, or Official Voting Device does accept, receive, acknowledge, sort, organize, record, store, tally, calculate, summarize, print or publish or otherwise process:

a plurality of Voting Documents: (i) Voter Lists, (ii) Voter Registrations, (iii) Voter Language Selections, (iv) Voter Ballots, (v) Data Containers, (vi) Security Items, (vii) Data Items, (viii) Data Transmissions;

(B) and the further steps and methods whereby each created Voting Documents (Voter Registration forms, Voter Language form, Ballot, Data Container) is assigned at least one new, unique data record containing at least one variable content data fields, and all records are stored in at least one data system which comprises of a new record Identifier, date, time, location, and zero, one or a plurality of other attributes are updated as needed to describe the various data and status conditions for each Voting Document;

(C) (i) and the further steps and methods whereby for processing (scanning, imaging, enhancing, reading, decoding, storing and correlating) of Voter Ballots includes said processing of data fields for each portion containing zero, one or a plurality of candidates, proposals or zero, one or a plurality of both candidates and proposals, which are each further correlated with zero, one or a plurality of barcodes and further correlated with a portion of the area assigned to Mark or record each Voter voting information at least one Voting Region Identifier for zero, one or a plurality of subsidiary Voting Region Identifiers, zero, one or a plurality of polling station Identifiers, zero, one or a plurality of Postal Code-Zip Code Identifiers, zero, one or a plurality of geographic location Identifiers at least one election type Identifiers, zero, one or a plurality of due date Identifiers, zero, one or a plurality of due time Identifiers, zero, one or a plurality of Activation identifiers, Expiry Date identifiers, Expiry Time identifiers, at least one Election Identifier, at least one Voting Session Identifier, zero, one or a plurality of Security Elements, at least one Ballot Voting RSID and zero, one or a plurality of Official Ballot PassCode RSIDs, and zero, one or a plurality of Ballot Validation RSIDs, zero, one or a plurality of Ballot Validation PassCodes, at most one Ballot Origin and Assign RSID, and at most one Successful Document—Ballot Registration RSID—whereby the aforesaid are then correlated to each other and to the Whole Ballot and each Master, Receipts parts thereof;

(ii) and further steps and methods of processing (scanning, imaging, enhancing, reading, decoding, storing and correlating) each item of each Voter Ballot to a data field within the same unique data system record;

(iii) and the further steps and methods of providing a data retrieval key value for rapid location and retrieval of the aforesaid data-items;

(D) (i) and the further steps and methods of said processing for zero, one or a plurality of Voter Registrations processing for each received Voter Registration, at least comprising of: zero, one or a plurality of Voter personal Identifiers, at least one printed family names, at least one printed First name, zero, one or a plurality of middle initials, at least one signatures, signed initials, zero, one or a plurality of date information, at least one address information, zero, one or a plurality of non-mail contact information, zero, one or a plurality of Electronic Mail addresses, zero, one or a plurality of Cellular phone numbers, zero, one or a plurality of Home phone numbers, zero, one or a plurality of Work phone numbers, zero, one or a plurality of Proxy Voter: family names, First names, middles initials, addresses, telephone contacts, Electronic Mail Addresses, signatures, and initials, Voter graphics and glyphs, Voter Personal Security Numbers and patterns;

(ii) correlating and storing each item of each Voter Registration to a data field within the same unique data system record;

(iii) providing a data retrieval key value for rapid location and retrieval of said data-items, (E) and the further steps and methods of said processing for a plurality of voter-proxy Language forms and all the relevant information therein;

(F) (i) the steps and methods of processing zero, one or a plurality of personal Identifiers, as well as the steps and methods for each Ballot, Registration or Language form of correlating of each aforementioned Identifier or to the respective barcodes or other optical scanning markings or encodings, or electronic processing markings or encodings;

(ii) and the further steps and methods of creating, assigning, attaching, linking and processing additional encoding for a plurality of POEM format: physical, optical, electronic, magnetic, electromagnetic, chemical or structural copies and the original Documents so as to ensure accurate processing;

(G) and the further steps of data storage, retrieval and organization of received Ballots, Voter Registrations and Voter Language forms so as to be easier to record, validate, verify, authenticate, certify, error check, amend, tally, identify, sort, store, locate, retrieve, publish and otherwise process in any other manner using the Voting Session Devices, Voter and Proxy devices;

(H) whereby Officials create, distribute and otherwise process zero, one or a plurality of acknowledgements for each Whole Voter Registrations, Master Voter Registrations, Receipt Voter Registrations, Whole Ballots, Master Ballots, Receipt Ballots, Whole Voter Language forms, Master Voter Language forms, Receipt Voter Language forms, received from zero, one or a plurality of Eligible Voters zero, one or a plurality of: Potential Voters, Certified Registered Voters, Unknown Voters, Ineligible Voters, designated proxies or Officially approved legal entities;

(I)(i) whereby Officials receive zero, one or a plurality of: Master Ballots, Receipt Ballots, Voter Registration forms, Language Selection forms, Containers, Transaction Receipts, or other types of Documents, Objects, Events, processing, transactions, error and amendments processing, security activities, data or data transmissions or communications of this invention;

(ii) whereby at least one Official accepts or rejects the validity and authenticity of each Master Ballots, Receipt Ballots, Voter Registration forms, Language Selection forms, Containers, Transaction Receipts or other types of Documents, Objects, Events, processing, transactions, error and amendments processing, security activities, data or data transmissions or communications of this invention;

(iii) whereby at least one Official validates then accepts for recording and tallying zero, one or a plurality of Authenticated, Valid Master Ballots, Receipt Ballots, Voter Registration forms, Language Selection forms, Containers, or other types of Documents, Objects, Events, processing, transactions, error and amendments processing, security activities, data or data transmissions or communications of this invention;

(iv) whereby at least one Official verifies by (manual or automated visual comparisons, optical-electronic data scanning, computers running software programs performing signature-address validation comparisons) for each Voter signature or initials and for each Proxy signature or initials and for zero, one or a plurality of contact and address information located inside or outside of the Ballot Return Data Container or any other type of Data Container so as to be compare to the signature, initials, contact, address data recorded on the Master Voter Registration Form submitted prior to Whole Ballot return delivery to Officials;

(v) whereby at least one Official either:

(a) accepts the Ballot as being from a registered Voter, and then forwards the Ballot for further processing associated with completing processing of the vote, or, (b) rejects the Ballot and then takes steps of either returning the Ballot and Ballot-address-signature card to the Voter for amendments or, holds the Ballot and Ballot-address-signature card for further investigations; and (c) for zero, one or a plurality of Documents, forms, data Containers, Objects, data transmissions, data storages that are items found to contain an RSID or any other Unique Identifier having acronym UID determined to have been previously submitted, then:

(c)(i) both the duplicate and First Object or data are each uniquely marked with new distinct RSIDs or UIDs, recorded, tallied, removed and stored separate from all other valid, authenticated, certified Objects or data and are separately error processed (error detection, error identification, error specification, error reporting, error localization, error position locating, error marking, error correction, error data recovery, false error detection rejection) and are separated from all other non-duplicate Documents or ballots for further investigation and authentication or rejection;

(c)(ii) Officials act to resolve which of the duplicates items are authentic and true, using Security Elements, then separately store the false Object or data;

(c)(iii) Officials restore, certify, and tally each authentic, valid item;

(d) restoring each and all validated Ballots, or final rejecting any un-validated Ballots;

(e) recording and storing all Voter Personal Security Items that were provided by the correlated Voter or Proxy Voter and also for zero, one or a plurality of Officials and Electoral Board members.

15. The Computerized Voting System of claim 1 wherein at least one Official, Official Agent, or Official Voting Device does accept, receive, acknowledge, sort, organize, record, store, tally, calculate, summarize, print or publish or otherwise process:

(i) zero, one or a plurality of Voters requesting zero, one or a plurality of replacements of: Ballots, Voter Registration forms, Voter Language Selection forms, and other Documents types, Containers, Data, Objects, Messages, Signals, Methods, Algorithms, Keys, Records, Events, Errors, Amendments, Calculations, data transmissions, data receptions of this invention:

(ii) the further steps whereby zero, one or a plurality of Officials determine, for each Voter, the appropriateness whether to provide zero, one or a plurality of replacements for zero, one or a plurality of Voters whom are requesting replacements;

(iii) zero, one or a plurality of Officials, Agents or Official Third Party refuses or provides zero, one or a plurality of replacement Documents or Containers to zero, one or a plurality of Voters;

(iv) at least one Official, Agent or Official Third Party records all relevant data regarding the replacement Documents and Containers provided and the recipient Voter the item was provided to, then accurately amends each correlated Official records.

16. The Computerized Voting System of claim 1 wherein at least one Official, Official Agent, or Official Voting Device does accept, receive, acknowledge, sort, organize, record, store, tally, calculate, summarize, print or publish or otherwise process and investigates:

(A) each of a plurality of Voter complaints of errors or omissions pertaining to zero, one or a plurality of and any portions of Voter Registrations, or, or zero, one or a plurality of Ballots or both Voter Registrations and Ballots with all relevant details, then Officials or their designated Official Agents proceed to investigate whether to accept or reject each Voter request to amend any errors, record the Official findings of the investigation, and when required, Officials amend zero, one or a plurality of disputed records, tallies, summaries, calculations, and publications for zero, one or a plurality of Voter or Ballots, Ballot Containers, Voter Language Selection Containers and Voter Registration Containers, in accordance with the findings and Voting Session Rules, and then Officials verify that each submitted amendment was completed accurately, or then resubmit zero, one or a plurality of improper or incomplete amendments, then provide a report to each complainant Voter, other Officials and zero, one or a plurality of other interested parties.

17. The Computerized Voting System of claim 1 wherein at least one Official, Official Agent, or Official Voting Device generates and assigns:

(i) a plurality of unique Container Validation RSIDs are generated by Officials then printed, embedded, attached, correlated or otherwise associated with the visible exterior of zero, one or a plurality of Whole Ballot Containers;

(ii) a plurality of unique Container Validation RSIDs are generated, correlated and attached to a plurality of Whole Ballot Containers;

(iii) each of a plurality of Data Container has created and assigned zero, one or a plurality of unique Container Validation RSIDs that are individually or collectively correlated to at most one Data Container;

(iv) zero, one or a plurality of Container Validation RSIDs are correlated to zero, one or a plurality of Whole Ballot Voting RSIDs within a Whole Ballot Container;

(v) each Container Validation RSID is further correlated to Voting Session Identifiers and Limits of Use details of the voting session, and further to zero, one or a plurality of Security Elements that are displayed clearly and prominently so as facilitate equitable Ballot use and validation for exchanges by clarifying exactly which elections and voting region the Whole Ballot Containers internal Whole Ballot Voting RSIDs correspond to, and what time frame these items are useful for;

(vi) physically sealing the physical Whole Ballot Container or electronically, electromagnetically or optically PassWord protecting and encrypting of the POEM format Whole Ballot Container such that subsequent accessing of said Container internal Ballots and any other contents noticeably revealing access occurred;

(vii) if said Whole Ballot Container is electronic, electronic-optical, magnetic, electro-magnetic in form, that for each Master and Receipt Ballot, sets of Voter marked Ballot choices and correlated Voter Personal Security Items may not be easily revealed without prior decryption using zero, one or a plurality of Ballot validation Official PassCodes, Voter PassWords, Voter Data and Ballot Internet WebPages specially encoded Internet address Universal Resource Locator and correlated Official Internet webpages respective webpage login PassCodes and encrypted Internet accessible data vaults, private virtual networks and other methods of controlling public access to allow only the authorized Voter or the Voter designated Proxy to restrict access so as to allow only the person casting the Ballot to view the cast Ballot data, or, optionally allow both Voter and Proxy to access the shared cast Ballot data, yet also separating and restricting access capabilities of each Voter and correlated designated Proxy so that the Voter and correlated Proxy cannot read each others personal data used for Registration, Voting, Complaints, Investigations, Reports.

18. The Computerized Voting System of claim 1 whereby, for a plurality of Voters and Proxy Voters successfully registering to cast a Ballot, each Voter or Proxy Voter:

(A)(1) may optionally be required to First activate the Ballot before use, by applying the steps and methods of activation by submitting zero, one or a plurality of Ballot Activation Documents by submitting Ballot Validation RSID and Ballot Validation PassCode, or, alternatively: a private Voter Identifier and private Voter PassWord or phrase, glyph, image, audio, image, or Personal Identification Number or pattern, by said methods of delivery: in person, by courier or delivery service, by personal computer device, telephone, Internet, Fax or Facsimile, Electronic Mail, interactive television to at least one Officials or, Official Agents or Official devices so as to enable said Ballot for casting, and to also enable said Voter to change the Ballot Validation PassCode or to add a private Ballot Voter PassCode to be correlated to said Ballot Validation RSID which is recorded, and redundantly stored by at least one Official; or, (A)(2) is not required to pre-activate the Ballot for use, and then opens zero, one or a plurality of Whole Ballot Containers for use;

(B)(1) upon successful activation of the Ballot, or lack of requirement for Ballot activation, whereby a Voter and plurality of Voters are enabled to vote either in person, by mail, Fax or Facsimile, EMail, Internet, telephone, or interactive television, after revealing, viewing and using the Ballot PassCode RSID which may be delivered to the Voter separately from the Whole Ballot, or is within the Whole Ballot Container, or, printed on, or associated with the Master Ballot; and (i) the further step where the Ballot PassCode is also printed on the Receipt Ballot by Voting Officials, or, is not printed on the Receipt Ballot and must then be manually recorded by each Voter;

(ii) the further step where the Ballot PassCode on the Receipt may also have a removable covering for privacy; and (iii) the further steps and methods whereby a Ballot PassCode is used in conjunction with a Ballot Voting for that same Whole Ballot, Master Ballot or Receipt Ballot for the purpose of validating or authenticating the correlated Whole Ballot, Ballot Master part or Ballot Receipt part;

(iv) the further steps whereby zero, one or a plurality of Voters complete aforesaid Ballot and constituent parts by applying zero, one or a plurality of: Voter signature or Voter private PassWord, Ballot signing date, Ballot selections and Write-in choices then submitting Ballot Voting RSID, Ballot PassCode for zero, one or a plurality of Master Ballots;

(v) and the further step of generating and then retaining zero, one or a plurality of correlated Receipt Ballots for each Master Ballot completed;

(vi) and the further steps and methods whereby zero, one or a plurality of Voters deliver zero, one or a plurality of Master Ballots to Election Officials or Officially Designated Recipients for tallying, as well as zero, one or a plurality of successful completion Receipt Confirmations that are delivered to each successful Voter by methods in person paper Receipts, postal mail paper Receipts, or electronic mail Receipts, Fax or Facsimile, tele-texting, interactive television, or Internet website post-submit web-pages, and to zero, one or a plurality of third parties to verify the integrity of the Voting Session;

(C) for a plurality of remote Voters and Proxy Voters whom are not at the polling station and instead are acting from a remote location and actively registering, voting, reviewing, amending, error reporting, or performing other related activities by employing personal devices to connect to a variety of data communications infrastructure networks comprised of: telephone, Internet, Intranet, television, radio so as to then connect to an electronic virtual polling station, physical polling stations in order to: obtain voting information, register for voting, review, verify or amend their personal Registration, report Registration errors, assign Proxy Voters, amend Proxy Voters data or assignment, authenticate the Ballots received, cast their Ballots, review Ballots cast, report Ballot casting errors; Said polling stations employ various devices to connect to said data communications infrastructure networks, so as to then connect to said Voter and Proxy Voters and further said polling stations devices also act to record, store and enable said remote Voters to register, cast their Ballots for Official tallying, review submitted data, amend or report perceived errors whereby:

(D) a plurality of Voters and Proxy Voters use zero, one or a plurality of, any and combinations of electronic devices to connect to the Internet, telephone or cellular telephone communications systems, or interactive television system, or electronic mail system so as to securely access, input, verify, validate, review, amend, submit, retrieve, store, record, print or save—their Voter personal information and personal choices so as to complete zero, one or a plurality of:

(i) Voter Registrations and constituent parts thereof, (ii) Voter Language Selection forms or constituent parts thereof;

(iii) Master Ballot(s) or constituent parts thereof;

(iv) Voter Proxy Assignment forms or constituent parts thereof;

(v) Voter Contact Update forms or constituent parts thereof;

(vi) Voter Registration Complaint forms or constituent parts thereof;

(vii) Voter Ballot Complaint forms or constituent parts thereof;

(viii) Polling Station Irregularities forms or constituent parts thereof;

(ix) Official Investigation Report forms or constituent parts thereof;

(x) Voter Status (Active-Inactive) Amendment forms or parts thereof;

(xi) Proxy Registration forms or constituent parts thereof;

(xii) Proxy Status (Active-Inactive) Amendment forms or parts thereof;

(xiii) each of other types of Documents and Containers of this invention;

(E) and further whereby zero, one or a plurality of Voters submitting privately and securely to Officials all necessary data so as to enable Voter Registration, Voter Language Selection, and Voter Ballot Casting also known as Ballot Voting or Voting, whereby Voters are reviewing or completing then casting of zero, one or a plurality of each type of Ballots for each registered Voter, or Proxy appointees;

(F) and the further steps whereby: zero, one or a plurality of Officials and zero, one or a plurality of third-parties provide services of:

(i) Official Computer Authentication—the steps and methods whereby zero, one or a plurality of Voters using computers, telephones or any other devices are provided with zero, one or a plurality of secure telephone lines, secure Internet connections: Hyper-Text Transport Protocol Security having acronym https, Secure Sockets Layer having acronym: SSL, Transport Layer Security having acronym TLS and computer authentication data issued by at least one third party certificate authority so as to validate the authenticity of the Official computers and communications systems being used for voting and communications are legitimate and authorized for use; and (ii) the further steps and methods of:

(1) Official computer and data storage hacker protection—the steps and methods whereby zero, one or a plurality of Officials, Official Agents, Official Devices, computers, telephones communications systems and networks are provided with enhanced security software, equipment, personnel and procedures to ensure the electronic voting systems availability and reliability for use for authorized users, and the further steps and methods of providing zero, one or a plurality of security measures to ensure the integrity and reliability of the voting system processes, zero, one or a plurality of: data transmissions, data receptions, data error corrections, Document processing Document validations, certifications, calculations and publications; and the further steps and methods whereby:

(2) Internet Identity Masking—the steps and methods whereby zero, one or a plurality of Voters using computers connected to the Internet for voting employ user identity masking to hide from zero, one or a plurality of election computers by enabling each Internet Voter to appear as another unrelated computer Internet Provider internet connection identifier and internet address by masking at least one of Voters computer unique computer machine identifier and the unique Internet connection identifier and Internet address that was assigned to the Voters computer by the Voters Internet Provider; and the further steps and methods whereby Internet Provider address masking employs zero, one or a plurality of software from third parties that connect to commercial or privately owned computer and routers so as to use the third party Internet Provider addresses as an alias for the Voter, and connect zero, one or a plurality of public or private masking network systems whereby Internet routers encrypt the data and originating Voters Internet Provider address so as to hide the Voters data from Internet users and further hide each Voter's original Internet Provider addresses and computer or telephone or fax machine, or personal data device, or television identity from the election computer systems, or employ client side software to mask the Voters' public Internet and private local network IP addresses, and unique Machine Identifier of the sending device; and the further steps whereby:

(3) Voting Receipt Encryption—to ensure data integrity of Receipt Ballots by reducing the possibility of falsification and Ballot tampering—the steps and methods whereby zero, one or a plurality of election computers employ public-private key pair encryption algorithms of Cast Ballot Receipt information comprised of the following {set of data}: {Ballot voting RSID, Ballot PassCode, Voter selections, selection validation codes, Receipt sequence ID, Receipt validation code, Voter Personal Security Items comprised of the following sub-set of data: Voter signature, Voter initials, Voter PassWords, Voter graphics and glyphs, Voter Personal Security Number and patterns, Voter submitting device ID, date and time of submission information, Official receiving device ID, Official encrypting device ID, encryption date and time so that for each encrypted Cast Ballot shall have Public Receipt codes created to hide or obscure the original Ballot Receipt voting information by using at least one private encryption key that is a PassWord, phrase or alpha-numeric symbol code or pattern, image or glyph created by the Voter when registering or when casting their Ballot, and an Official device generated unique Private key that is used to encrypt the Voter private key to create an encrypted private Voter SuperKey; Official device(s) generating a persistent, consistently used public key to enable secure encryption of Voter SuperKey such that each Voter can securely access their original Cast Ballot Receipt data; and further whereby encryption-decryption by said computer keys and Voter SuperKey employs zero, one, or a plurality of Official devices assigned private encryption algorithm, further having multiple iterative encryption steps to further embed the encrypted data values, Voter key and Voter SuperKey via a series of multiple re-encrypted encryptions of Voter key, Voter SuperKey and Cast Ballot Receipt data; whereby said computer keys, Voter key and Voter SuperKey are each unique, redundantly and immutably stored, separate from the Cast Ballot Receipt data, yet associatively linked to said Cast Ballot Receipt data;

(4) and the further steps and methods whereby each original Ballot Receipt information is recoverable from the correlated public encrypted Ballot Receipt Code by applying manually or by computer, the correlated private Receipt Encryption Key and the correlated private Receipt Encryption Algorithm to the correlated public encrypted Ballot Receipt Code;

(5) and the further steps and methods whereby zero, one or a plurality of:

(i) public encrypted Ballot Receipt codes are each correlated to their respective Ballot RSID;

(ii) public encrypted Ballot Receipt codes are optionally printed on the face of the Ballot;

(iii) Ballot information data elements are not printed on each Ballot to preserve privacy of data Ballot RSID;

(iv) each computer private encryption key and encrypted Voter Superkey are both unique and distinct;

(v) privately encrypted Ballot Receipt codes are each correlated to their respective Ballot RSID;

(vi) public encryption algorithms and public encryption keys are provided and employed to enable general public validation of Ballot Receipts data and Ballot Receipt codes without revealing private encryption algorithms or private computer and Voter encryption keys or Voter SuperKey;

(vi) barcodes and zero, one or a plurality of other symbolic marking codes are generated and correlated to zero, one or a plurality of Ballot information data elements and zero, one or a plurality of public encrypted Ballot Receipt codes, then printed on or incorporated into the Ballot Receipt data to facilitate machine scanning;

(vii) geometric shapes, lines, holes and other symbolic marking codes to be used for orientation or alignment are generated then printed on, or otherwise incorporated into the Ballot Receipt data to facilitate machine scanning;

and the further steps and methods of:

(G) Internet Processing: Registration, Voting, Validation, Authentication, Error Detection, Processing, Corrections and Reporting, Complaints, Investigations, Amendments, Certifications, Reporting, Publishing whereby:

(1) Internet Registrations, Internet Voting, Internet Complaints, Internet Investigations, Internet Amendments, Internet Auditing is performed by a plurality of Voters, Proxies, Officials, and Official Agents using personal communications devices to create a secure, private connection and interactive session, to at least one Official computer Internet server system and a plurality of Officials computer Internet server systems which are integrated and connected to the Voting System of claim 1; said private connection and interactive session to establish zero, one or a plurality of Voter-Officials inter-devices connection physically, electronically, optically, electromagnetically by secured tunnels of isolated communications by using at least one or a plurality of: secure data network cables, virtual private networks, Anonymous Proxy Servers, trusted devices, device Authentication Certificates, and at least one or a plurality of secure communications and cryptography methods and protocols: Hyper-text Transport Socket Security, Secure Socket Layer, Transport Layer Security software and hardware layers security, secure login methods for computers, telephones, data routers and Voting Devices, zero, one or a plurality of Public-Private encryption-decryption key pairs, RSIDs, and cryptographic protocols;

(2)(a) a plurality of Voters and Proxys Registering to vote, or amending or activating their Voter Registration previously established by the Voter, Voter Proxy, or research of at least one Official or Official Device running artificial intelligence software for specific research validation;

(2)(b) a plurality of Potential Voters, New Voters, Proxy Voters, Eligible Voters receiving from at least one Official Internet Server:

(i) at least one Internet accessible website with a main Home webpage giving access to the Official Voting Session with embedded inter-webpage optical-electronic links to enable navigation to the Voter Registration webpage, and to zero, one or a plurality of other inter-linked WebPages that are used for the Voting Session; or, (ii) Internet enabled navigation to the Voter Registration main Home webpage via a unique electronic address that is correlated to the Officials Internet Servers Internet Address, said Officials Internet Servers provide WebPages having embedded inter-webpage optical-electronic links to enable navigation to the Voter Registration webpage, and to zero, one or a plurality of other inter-linked WebPages that are used for the Voting Session;

(3) said Voter(s) completing, reviewing and submitting their personal identity information to Officials via said Voter Registration webpages—thus confirming, denying, amending, questioning or complaining as to Officials research—or, submitting new data for Officials to investigate, accept, amend or reject;

(4) Officials accepting a plurality of said Voters Registration submissions, then investigating, accepting, amending or rejecting each Voter submission, then creating new or amending existing or deleting existing Voter Registration records accordingly;

(5) Officials certifying a plurality of Voters whose Registrations were accepted or amended by Officials; communicating acceptance to each Certified Voter or rejection to unaccepted Voters sending to each Certified Registered Voter, at least one Voting Whole Ballot via the method selected by each Certified Registered Voter;

(6) for each Certified Registered Voter, Officials creating an electronic, electromagnetic, optical data storage Voter Registration Vault containing all of the Voter private Voter Registration information in an encrypted form, communicating how to access said Voter Registration Vault to each Certified Registered Voter, communicating an Official generated combination of PassWord, phrase or Personal Security number or pattern, images, glyphs or graphics symbols, sounds; alternatively, allowing the Voter to create any combination of: a PassWord, phrase or Personal Security number or pattern, any selected images, glyphs or graphics symbols, sounds, then applying said PassWord, phrase or Personal Security number or pattern, an images, glyphs or graphics symbols and sounds as a private key, also applying zero, one or a plurality of public encryption keys and encryption algorithms, and zero, one or a plurality of recursive repetitions to said Voter Registration data thereby encrypting said Voter Registration data; then storing said encrypted Voter Registration data redundantly, and securely in or on immutable media using at least one or a plurality of said data storage formats;

(7) repeating aforesaid steps of Voter Registration for a plurality of Proxy Voters who may each be appointed by zero, one or a plurality of Voters to cast a Ballot on the behalf of each original Voters;

(8) enabling Internet Voting by a plurality of Officials transmitting zero, one or a plurality of Receipt Confirmation Documents to a plurality of Voters, whereby each Voter electronically, using methods of using a computer, tablet, telephone, interactive television, or personal data device to connect to the internet and then connect to the Official website via the Official provided unique secure Universal Resource Locator webpage that is uniquely encoded so as to only be accessible by Voting Ballot RSID and Ballot PassCode or Voter PassWord; or, by Electronic Mail sent to each Voter provided Electronic Mail address or, by Facsimile machine data transmission to the Voter specified Facsimile machine and telephone number; or, by combinations of: telephone audio tones, voice, video, pictures, text messaging or applications processing; or, by interactive television, personal computer or any other type of personal data device data transmission and processing; or by Postal Mail delivery or Courier Delivery Service to each Voter and a plurality of Voters that successfully submitted their Registration using said delivery methods;

(b) and the further optional steps and methods of using the unique, private Registration RSID as part of an Internet address to organize and privately store each Voter Registration webpage vault, as well as all actions, tallies and summaries of Voter selections for each Registration of each Voter;

(9) for a plurality of Certified Registered Voters whose Registration was adequately completed and timely received—Officials sending or enabling to send at least one Whole Ballot and constituent Master, Receipt parts via Postal Mail, Courier Delivery Service or by any other preferred communication method of the Voter or as designated by Officials;

(10) for delivery method of Internet, a plurality of Voters and Officials using the Internet for sending, receiving at least one Ballot per Certified Registered Voter by applying modified (substituting the word Ballot for Registration for above steps (F)(1) to (8);

(11) for a plurality of Voters and Officials, further modifying of aforesaid steps (F)(1) to (9) to enable Validation, Error Reporting and Amendments of Voter Registration, Voter Cast Ballots, Proxy Assignment, Voter Contact Updates, Proxy Contact Updates, Voter Active-Inactive, Proxy Active-Inactive, Voter Ballot Complaints, Voter Registration Complaints—all via Internet;

(12) Internet Processing (Voter Registration, Voting, Validation, Error Identification and Amendments, Reporting) employing the steps and methods of claim 1 and the further steps and methods of: Internet Processing, Internet Registration, Internet Voting, Validation, Error Identification, Amendments, Complaints, Investigations, Reporting, Publishing, Auditing performed by a plurality of Voters, Proxy Voters, Officials, Agents, Third Party Officials whereby:

(a) Officials, Agents and Official Third Parties obtaining and utilizing zero, one or a plurality of Identity Authentication Certificates from zero, one or a plurality of public Certificate Authorities that are correlated to the respective Validation Session Identifier or Voting Session Identifier;

(b) Voters using the Internet to connect to at least one Official Internet Voting Website that is secured from unauthorized manipulation; said connection between Voter and Officials Internet Voting Website may be via a Virtual Private Network connection or Double Virtual Private Network Connection or The Onion Router or Tomato Router anonymizing connection that is provided by a Third Party or Official Network Devices and Official Computers running Virtual Private Network software programs; and the further steps and methods of Voters hiding their personal device originating Internet Address and their personal Computer or Telephone or Device Machine Identifier by running software programs to hide that said information or by connecting to an anonymizing proxy server before connecting to an Official provided Virtual Private Network or Double Virtual Private Network, or The Onion Router or Tomato Router or other type of router providing secure, anonymizing connections;

(c)(i) Voters navigating from zero, one or a plurality of webpage menus to a secure Official Internet webpage form that is used for validation of Ballot RSIDs and Ballot PassCodes; Voters computer internet browsers then receiving, verifying and error checking the Official, Agent or Third Party Certificate Authority Identity having acronym: CAI to confirm the website is the Official, Agent or Third Party website; Voters then proceeding if no CAI error is detected, otherwise optionally terminating if a serious CAI error is detected;

(c)(ii) Officials, Agents or Official Third Party Devices provide zero, one or a plurality of messages, images, numbers, and symbols with zero, one or a plurality of requests that the Voter provide a reply to confirm that it is a human interacting with the IVALS system; the Voter response and Rules of the Voting Session determine whether the Voter is allowed to continue;

(d)(i) Voters accessing said secure Official webpage form, then Officials, Agents or Third Party Officials creating and correlating an Internet Validation Session ID having acronym: IVALSID created by Officials computers and devices then correlated to each particular connected Voter;

(d)(ii) Voters data entering a Validation RSID and zero, one or a plurality of correlated Validation PassCode(s) or a Ballot Voting RSID and correlated Voting PassCode on their local computer Internet Browser webpage form, then submitting and transmitting said webpage form and Ballot RSID and Ballot PassCode to the Internet Validation System having acronym: IVALS for processing;

(e)(i) IVALS receives correlates the IVALSID to the Ballot RSID submitted, records this information along with the Voter computer IP address, date and time;

(e)(ii) IVALS computer system employs computer running software programs and people to determine whether there have been statistically numerous RSID Masters from the Voter computer IP address for a given time period, and if so, communicates Denial Of Service to the Voter and stops further processing of zero, one or a plurality of Voter submitted false RSID's;

(e)(iii) whereby if there is no Denial of Service, the IVALS continues to determine whether the submitted Validation RSID or correlated Ballot Voting RSID is valid along with zero, one or a plurality of other said Ballot authentication and validation information items and zero, one or a plurality of Security Elements;

(e)(iv)(1) whereby if the Voter enters a Validation RSID that is determined to be valid, the Voter is shown Status information of the Ballot: Voted-OK, Voted-Error, ActiveVoting, Enabled2Vote, Disabled, Rescinded, Null&Void correlated to the Validation RSID, but the Voter is not shown the Ballot Voting RSID, Ballot PassCode nor any Ballot selections of the Voter—but to aid validation, the Voter may be shown any or all of the available Candidate and Proposals for selection;

(e)(iv)(2) whereby if the Voter enters a Ballot Voting RSID that is determined to be valid, and a valid Ballot PassCode for the Ballot Voting RSID, then the Voter is shown Ballot Status information as well as the Ballot Validation RSID, Ballot Voting RSID, all Ballot selections made by the Voter;

(f)(i) whereby if the Voter enters a Ballot Voting PassCode RSID that is determined to be valid, and the Ballot Voting RSID has not been disabled, then the Enabled Voter receives the Validation RSID, Voter selections and zero, one or a plurality of other information items associated with of the Ballot Voting RSID for review that may be used for voting, excluding the Ballot Voting PassCode;

(f)(ii) whereby upon submitting a valid Ballot Voting RSID, the IVALS prompts the Voter, a limited number of times, to provide zero, one or a plurality of Ballot Voting PassCode(s) on a secure website form; said Ballot Voting PassCode is then compared to the Official Ballot Voting PassCode that is correlated to the Ballot Voting RSID; if said Voter provided PassCode matches the Official Ballot PassCode for the same Ballot Voting RSID then the Voter is granted access to the Internet Voting System having acronym IVOTS and access to the generated Voting WebPage correlated for the given Ballot Voting RSID;

(f)(iii) whereby zero, one or a plurality of Official people and zero, one or a plurality of computers running software programs, determine whether the Ballot Voting PassCode provided is correlated to the Ballot Voting RSID of steps (5)(d)(ii) and allows processing to continue if they match;

(f)(iv) for each Voter and for a plurality of Voters attempting to submit a Valid Ballot PassCode, the further steps and methods of IVALS counting and recording each Valid Ballot PassCode submission attempt so as to determine, per Voter, whether the number of attempts to provide a Valid Ballot Voting PassCode has exceeded limitations, then if the number of attempts to provide a Valid Ballot Voting PassCode has exceeded limitations, the further steps of: temporarily disabling the Ballot, sending a message notifying the correlated Voter, signalling Officials, recording a change of Ballot status to Disabled with grounds of Exceeded PassCode Attempts;

(f)(v) the steps and methods for each Internet Ballot, of detecting, reporting, and stopping submission of Ballot RSIDs for Voting or Validation upon detecting not timely receiving the Ballot Voting RSID or Ballot Validation RSID being submitted to IVALS or IVOTS;

(f)(vi) if the Enabled Voter submitted Ballot Voting RSID has not already been cast, said Enabled Voter is connected to the Internet Voting System having acronym: IVOTS which generates a unique Internet Voting Session Identifier having acronym: IVOTSID with a date-time-stamp that are both correlated to the Ballot Voting RSID and zero, one or a plurality of Ballot Validation RSID that are correlated to the Ballot Voting RSID; said Enabled Voter is then securely connected to an Official or Agent or Official Third Party provided Internet pre-Voting WebPage that provides the graphical and auditory options: Begin, Wait, Exit whereby:

(1) for the choice of Exit, the Enabled Voter exits Internet Voting System without disabling the Voting Ballot and Validation Ballot from future use and the Voter Status is set to Valid;

(2) for the choice of Wait, IVOTS suspends the Enabled Voter Voting Session and displays a countdown timer on the webpage showing the time remaining to Begin or Exit the Voting Session, and if no choice is made before the countdown timer reaches zero then the Enabled Voter is automatically forced by IVOTS to exit said Internet Voting System without disabling the Voting Ballot and Validation Ballot from future use and the Voter Status is set to Valid;

(3) for the choice of BeginVote:

(i) said Enabled Voter is connected by Official Voting Computer to the Internet Voting System webpage;

(ii) a unique Internet Voting Session ID is generated, stored and associated with the Ballot Voting RSID provided by the Voter;

(iii) the IVOTS provides the Voter with zero, one or a plurality of choices of:

(a) Candidates;

(b) areas to select, write, print or type Alternative Voter Candidates;

(c) Proposals;

(d) areas to select, write, print or type Alternative Voter Proposals;

(e) option to Abstain and Decline from Selecting and Voting for Candidates, Proposals, Ideas or Political Parties or Groups; and further to Abstain and Decline from said Voter Writing in their alternative Candidates, Proposals, Ideas, Political Parties or Groups;

(f) providing related information items on internet or intranet web pages as data and hyper-links to access, search and navigate each Candidate biographies, each Candidate political party affiliations and policies, each Proposals descriptions, current date, current time, time left until polling station closes, Internet connection information, Official devices information, Voter specific current voting session completion information, Voter specific Voter devices information, Voter specific Voting Session Security information, Voters, Proxy Voters, Official and Official Agents messages, status data, warnings, errors, events, pending actions: authorized, unauthorized, pending, completed, suspended, stopped, cancelled, outstanding, delayed, rescinded, null&void;

(g) menus, links, audio and visual tools for navigating, searching and accessing each IVOTS Voting webpages and other related webpages;

(h) options for processing the IVOTS Voting webpage form and Voter selections: Submit, Reset, Pause, Save, Resume, Exit;

(i) options to store and communicate each Enabled Voter selections made and Submitted for processing: Download, Print, Internet Publish, Internet EMail, Telephone Voice Message, Telephone Text Message, Facsimile Message, Interactive Television Message;

(g)(i)(1) for each Enabled Voter and a plurality of Enabled Voters that chooses to Abstain from Voting for Candidates, the Candidates and Candidate Write-in portions are cleared of all Voter selections and the Candidates and Write-in Candidates portions of the IVOTS Voting Ballot webpage form is visually marked Abstained for the Voter to see, no selections are permitted in those portions, and the IVOTS detects and records the said Abstained portions as not being a voting error;

(g)(i)(2) for each Enabled Voter and a plurality of Enabled Voters that chooses to Abstain from Voting for Proposals, the Proposals and Proposals Write-in portions are cleared of all Voter selections and the Proposals and Write-in Proposals portions of the IVOTS Voting Ballot webpage form is visually marked Abstained for the Voter to see, no selections are permitted in those portions, and the IVOTS detects and records the said Abstained portions as not being a voting error;

(g)(ii) for each Enabled Voter and a plurality of Enabled Voters that completes and submits their Ballot selections of Candidates, Proposals, Write-in Candidates, Write-in Proposals:

(1) IVOTS software and zero, one or a plurality of Officials detecting and identifying zero, one or a plurality of errors on the aforesaid Submitted Ballot Voting form then communicating those errors to the directly correlated Enabled Voter and in general to each Voter of a plurality of Enabled Voters;

(2) zero, one or a plurality of Enabled Voters make zero, one or a plurality of corrections, zero, one or a plurality of times, until all Ballot Voting Selections of Candidates, Write-in Candidates, Write-in Proposals and Proposals are submitted without error;

(3) zero, one or a plurality of Enabled Voters, zero, one or a plurality of times, resubmits to IVOTS their respective Ballot and zero, one or a plurality of corrections for zero, one or a plurality of Candidate Selections, Write-in Candidates, Proposal Selections and Write-in Proposals;

(h)(i) for each Enabled Voter and plurality of Enabled Voters, if all of the said Ballot Selections and Enabled Voter Write-in choices submitted are processed successfully by IVOTS:

(1) a unique Ballot-Selection-Signature-Key is generated to precisely duplicate the Ballot selections made by the Voter;

(2) a unique IVOTS Receipt ID is generated, and then correlated to the IVOTS Session ID and further correlated to the Ballot Voting RSID and to any each Ballot Validation RSID that is already correlated to the Ballot Voting RSID;

(3) each said Voter is prompted by IVOTS to provide their own Voter Privacy Key comprised of a combination of Voter defined: PassCode, PassWord, PassPhrase, Signature, Initials, Glyph, Symbols, Picture, Music, Song, Poem, Book, Personal Security Number or pattern, and other personal validation reference to privately sign to enable Voter post-voting authentication and to enable secure encryption of each Voter specific Voting Session;

(4) for each Voter of a plurality of Voters, adding the Voter Ballot Selection Signature Keys to the Voter Privacy Key to form a Voter Privacy Record;

(5) encrypting the Voter Privacy Record using the Voter Privacy Key items as private variables in an encryption algorithm provided or selected by the Voter or using an Encryption Algorithm provided by IVOTS or from a Third Party to create an Encrypted Voter Privacy Record;

(6) redundantly storing the IVOTS Receipt ID, Session ID, Ballot Voting RSID, Ballot Voting PassCode, Ballot Validation RSID, Ballot Selections, Encrypted Voter Privacy Record, date, time, unique Location Identifier, unique Official Device Identifier, and zero, one or a plurality of other related information items as the BallotCast Record in at least one Official BallotCast Data Structure;

(7) securely transmitting to each Enabled Voter computer browser, an exact copy of their cast Ballot, rendered on the Voter computer internet browser;

(8) IVOTS allows the Enabled Voter to download a copy of their Voter BallotCast Record, typically via a link to download a PDF file that is optionally encrypted with another Voter provided BallotVote PDF Privacy Key; said copy file is certified a true copy and digitally signed by IVOTS;

(9) optionally IVOTS provides an internet link to a secure Voter provided password encrypted BallotCast webpage that when decrypted displays an exact copy of the Voter Ballot, Selections and Write-in Choices and components of the Ballot Cast Record of prior step (v);

said BallotCast webpage may be separately provided by an Official Third Party, and may be restricted only to Eligible Voters; said webpage may optionally embed the Ballot Voting RSID as part of the Internet Universal Resource Locator webpage address used to locate and access the encrypted BallotCast webpage; said encrypted BallotCast webpage may also contain or be preceded by a webpage that contains a data input field for the Voter to provide their Voter Privacy Key, and to select or provide the correlated Encryption Algorithm that was used to encrypt their Voter Privacy Record so that when both said Key and Algorithm are provided and the Voter selects a webpage control button to start decryption, the webpage software initiates a computer to run software programs to use said Key and Algorithm to perform decryption of the encrypted Voter Privacy Record, which is displayed in the computer browser with an exact copy of the cast Voting Ballot when decryption succeeds;

(10) using the unique, private Ballot RSID as part of an Internet address to organize and privately store each Voter BallotCast webpage, and a plurality of Voter BallotCast webpages;

(11) further steps and methods of securely transmitting the Ballot Cast Record to zero, one or a plurality of: Enabled Voters, Election Officials, Political Parties, Candidates, News Media, Government Officials, and zero, one or a plurality of other approved third parties for processing actions, verification, authentication, error detecting, error correcting, publishing and auditing;

(12) Officials, IVOTS, or an Official Third Party creating, publishing and continually updating a publicly accessible Internet webpage that displays summaries of BallotCast voting with Voting Ballot RSID and tallies of correlated Voter selections and Write-in choices that are sorted by Voting Region, Voting Area, Voting Area Polling Station Identifier; Officials, IVOTS and zero, one or a plurality of Official Third Parties sharing and transmitting exact copies of said BallotCast Summary webpage to zero, one or a plurality of Voters, non-Voters, Election Officials, Political Parties, Candidates, News Media, Government Officials, and zero, one or a plurality of other interested third parties for processing actions, verification, authentication, error detecting, error correcting, publishing and auditing;

(g)(ii)(1) creating and then transmitting zero, one or a plurality of Receipt Confirmation Documents to each Enabled Voter and a plurality of Enabled Voters either electronically, using methods of secure Universal Resource Locator having acronym: URL webpage accessible by Ballot ID and Ballot PassCode or Voter ID and Voter PassWord, and optionally by sending a confirmation EMail to each Voter provided EMail, and optionally by sending a confirmation Fax or Facsimile to the Voter specified Fax or Facsimile machine telephone number, and optionally by text messaging a confirmation message to each Voter provided cellular phone device or tablet or computer or other communications devices), and by using at least one said POEM format, and further by Officials or their delegates providing to a plurality of Voters at least one certified, verifiable Receipt Documents to each Enabled Voter who has successfully submitted their validated Ballots in person or electronically or by using at least one said POEM format or method;

(g)(ii)(2) and the further optional steps and methods of using the unique, private Ballot RSID as part of an Internet address to organize and privately store each Voter webpage, as well as all actions, tallies and summaries of Voter selections;

(g)(iii) for a plurality of Enabled Voters and Enabled Proxy Voters, Officials providing at least one POEM Voting Receipt to each said Voter or Proxy Voter whom successfully casts their Ballot, whereby said POEM Receipt is rendered to the Voter in the format deliverable according to the Voter interactive device; said POEM format of Voting Receipt data comprises of: Voting Session Identifier, Voting Session Descriptors Voter POEM Session Type Ballot Voting RSID with correlated Ballot Voting RSID barcode having a unique numeric value correlated to the Ballot Voting RSID, Voting Location Descriptors and Voting Location Identifier PostalZipCode Identifier, and Polling Station Identifier, Official Duty Title, Voter Selected Candidates and correlated Candidate Identifier, Proposal Heading, Voter Selected Proposals and correlated Proposal Identifier, and correlated Voter Proposal Vote Voter Selected Candidates and correlated Candidate Identifier, Official Ballot Casting DateTimeStamp comprised of the Date and Time the Ballot was cast, Voter Candidate Selection Signature concatenated to the front of the Voter Proposal Selection Signature with a combined alpha-numeric value, language symbols or glyphs, or computer language encoding that is correlated to the value of the said barcode for said Voter Proposal Selection Signature, said POEM format of the Voting Session Receipt Identifier having a unique alpha-numeric value, language symbols or glyphs, or computer language encoding that is correlated to the value of the said barcode for said Voting Session Receipt Identifier which is unique for each of a plurality of Voting Session Receipt Documents, and POEM format of the Voting Session Validation Identifier having a unique alpha-numeric value for the originating Official Voter Validation Session that permitted the Ballot to be cast and is correlated to the unique alphanumeric value, language symbols or glyphs, or computer language encoding that is correlated to the value of the said barcode barcode of the Voting Session Validation Identifier; and further whereby aforesaid data is correlated to other hidden, unprinted Official data that is recorded and stored at the time the said ballot is cast; and further the aforesaid for a plurality of ballots cast;

and (h)(i) the further steps of applying zero, one or a plurality of/* the aforementioned steps and methods, actions, data or results zero, one or a plurality of times, to zero, one or a plurality of Ballots, Voters, Officials, or other legal entities, by zero, one or a plurality of Voters, Officials or other entities;

(h)(ii) modifying aforesaid steps and methods to enable Voter Registration via Internet;

(h)(iii) further modifying of aforesaid methods to enable Validation, Error Reporting and Amendments of Voter Registration, Ballots, Proxy Assignment, Voter Contact Updates, Proxy Contact Updates, Voter Active-Inactive, Proxy active-inactive, Voter Ballot Complaints, Voter Registration Complaints—all via the Internet Voting WebPages provided by Officials, IVOTS, and zero, one or a plurality of Official Agents, Official Third Parties;

and the further steps and methods of the Computerized Voting System of claim 1 by adding the steps and methods of (H) Telephone Voting, Registration, Validation, Error Reporting, Amendments whereby:

(1) for Voters using their Telephone to connect to the Internet to connect to at least one Official Internet Voting Website that is secured from unauthorized manipulation; said connection between Voter and Officials Internet Voting Website may be via a Virtual Private Network having acronym: VPN connection or Double Virtual Private Network Connection Network having acronym: DVPN that is provided by a Third Party or Official Network Devices and Official Computers running Virtual Private Network software programs; and the further steps and methods of Voters hiding the originating Internet Address and Telephone Identifier by running software programs to hide that said information or by connecting to an anonymizing proxy server before connecting to an Official provided VPN or DVPN connection; thereafter the steps and methods of Internet Voting apply for Telephones connecting to the Internet;

(2) otherwise, for regular audio-only telephone methods, the following steps and methods apply whereby:

(a) zero, one or a plurality of Voters use a telephone to connect to the Telephone Validation System having acronym: TVALS managed by a plurality of Officials, Agents, Official Third Parties;

(b) zero, one or a plurality of Official computers running software programs creates a unique Telephone Validation Session Identifier having acronym: TELVALSID that is correlated to each connected Telephone Session;

(c) for each active Telephone Session, a Telephone Recording Session is created for each Official Recording Device that is started; a Telephone Recording Session Identifier having acronym: TELVALRID is created and correlated to the Telephone Recording Session and the related Telephone Validation Session Identifier;

(d) zero, one or a plurality of Official computers running software programs obtains and utilizes zero, one or a plurality of authentication certificates from zero, one or a plurality of Identity Certificate Authorities that are then correlated to the TELVALSID;

(e) zero, one or a plurality of Official computers running software programs optionally determine the Voter Telephone Number to detect issues excessive guessing of Ballot RSIDs and Passcodes;

(f) the Voter uses the telephone keypad, verbally words, or any other acceptable methods to navigate through zero, one or a plurality of menus and menu options to interact with the Telephone validation menu;

(g) each Voter then uses a combination of: keypad tones, verbal words, text message, graphical touch-activated interface, menu option selections to enter a Ballot Validation RSID or Ballot Voting RSID;

(h) the said TELVALS records the Ballot RSID and correlates it to the said TELVALSID, with the date, time, Official Telephone Device ID and optionally, the Voter telephone number when available;

(i) the said TELVALS then determines whether any statistically significant inhibitory issues are related to the Voter telephone number or Ballot RSID provided, and if so, then communicates Denial Of Service to the Voter; otherwise, (j)(i) the said TVALS processing determining whether the Ballot Validation RSID or correlated Ballot Voting RSID are valid and still usable for voting, processing any other essential information;

(j)(ii) Voters using their telephone keypad for data entering a Validation RSID and Validation PassCode or a Ballot Voting RSID and Voting PassCode, transmitting said Ballot RSID and Ballot PassCode to the Telephone Validation System for processing;

(j)(iii) the said TELVALS receives and correlates the said TELVALSID to the submitted Ballot RSID, recording this information along with the Voter computer IP address, date and time and Official Telephone Device ID and Voter Telephone Number when available;

(j)(iv) the said TELVALS computer system employs computer running software programs and people to determine whether there have been statistically numerous RSID Masters from the Voter Telephone Number for a given time period, and if so, communicates Denial Of Service to the Voter and stops further validation, authentication processing for each of zero, one or a plurality of Voter submitted false RSID's;

(k)(v) whereby if there is no Denial of Service, the said TELVALS continues to determine whether the submitted Validation RSID or correlated Ballot Voting RSID is valid along with zero, one or a plurality of other information items;

(k)(vi)(1) whereby if the Voter enters a Validation RSID that is determined to be valid, the Voter is told Status information of the Ballot: Voted-OK, Voted-Error, ActiveVoting, Enabled2Vote, Disabled, Rescinded, Null&Void that is correlated to the Voter provided said Validation RSID, but is not told the Ballot Voting RSID, Ballot PassCode nor any Ballot selections of the Voter;

(k)(vi)(2) whereby if the Voter enters a Ballot Voting RSID that is determined to be valid, and the correlated Ballot PassCode that is found to be valid for the Ballot Voting RSID, then the Voter is told Voting Ballot Status information as well as the Ballot Validation RSID, Ballot Voting RSID, and all of the Ballot selections made by the Voter;

(l)(i) whereby if the Voter enters a Ballot Voting PassCode RSID that is determined to be valid, and the Ballot Voting RSID has not been disabled, then the Enabled Voter is informed of zero, one or a plurality of all Personal and Official information items associated with of the Ballot Voting RSID that may be used for voting, and are further given the opportunity to change their personal information, and to apply to Officials to change the Official provided Ballot Voting PassCode;

(l)(ii) whereby upon submitting a valid Ballot Voting RSID, the IVALS prompts the Voter, a limited number of times, to provide zero, one or a plurality of Ballot Voting PassCodes; said Ballot Voting PassCode is then compared to the Official Ballot Voting PassCode that is correlated to the Ballot Voting RSID; if said Voter provided PassCode matches the Official Ballot PassCode for the same Ballot Voting RSID then the Voter is granted access to TELVOTS and the correlated Telephone Voting Record generated for that specific Ballot Voting RSID;

(l)(iii) whereby zero, one or a plurality of Official people and zero, one or a plurality of computers running software programs, determine whether the Ballot Voting PassCode provided is correlated to the Ballot Voting RSID provided earlier and allows processing to continue if they match;

(l)(iv) for each Voter and for a plurality of Voters attempting to submit a Valid Ballot PassCode, the further steps and methods of TELVALS counting and recording each Valid Ballot PassCode submission attempt so as to determine, per Voter, whether the number of attempts to provide a Valid Ballot Voting PassCode has exceeded limitations, then if the number of attempts to provide a Valid Ballot Voting PassCode has exceeded limitations, the further steps of: temporarily disabling the Ballot, sending a message notifying the correlated Voter, signalling Officials, recording a change of Ballot status to Disabled with grounds of Exceeded PassCode Attempts;

(l)(v) the steps and methods for each Internet Ballot, of detecting, reporting, and stopping submission of Ballot RSIDs for Voting or Validation upon detecting not timely receiving the Ballot Voting RSID or Ballot Validation RSID being submitted to TELVALS or TELVOTS;

(l)(vi) if the Enabled Voter submitted Ballot Voting RSID has not already been cast, said Enabled Voter is connected to the Telephone Voting System having acronym TELVOTS which generates a unique Telephone Voting Session Identifier having acronym TELVOTSID with a date-time-stamp that are both correlated to the Ballot Voting RSID and zero, one or a plurality of Ballot Validation RSID that are correlated to the Ballot Voting RSID; said Enabled Voter is then securely connected to an Official or Agent or Official Third Party provided Telephone pre-Voting Recorder that provides the graphical and auditory options: Begin, Wait, Exit whereby: (1) for the choice of Exit, the Enabled Voter exits the Telephone Voting System: without disabling the Voting Ballot and Validation Ballot from future use and the Voter Status is set to Valid; (2) for the choice of Wait, TELVOTS suspends the Enabled Voter Voting Session and starts an audible countdown timer that states at regular intervals, the time remaining to Begin or Exit the Voting Session, and if no choice is made before the countdown timer reaches zero then the Enabled Voter is automatically forced by TELVOTS to exit the Telephone Voting System without disabling the Voting Ballot and Validation Ballot from future use and the Voter Status is set to Valid;

(3) for the choice of BeginVote:

(i) said Enabled Voter is connected by Official Voting Computer to the Telephone Voting System;

(ii) a unique Internet Voting Session ID is generated, stored and associated with the Ballot Voting RSID provided by the Voter;

(iii) the TELVOTS provides the Voter with zero, one or a plurality of choices of:

(a) Candidates;

(b) areas to select or speak zero, one or a plurality of Alternative Voter Candidates;

(c) Proposals;

(d) areas to select or speak zero, one or a plurality of Alternative Voter Proposals;

(e) option to Abstain or Decline from Voting for Candidates, Proposals;

(f) employing related information items comprised of: audible data and audio-links to search, navigate and access each Candidate biographies, each Candidate political party affiliations and policies, each Proposals descriptions, current date, current time, time left until polling station closes, connection information, Official devices information, Voter specific current voting session completion information, Voter specific Voter devices information, Voter specific Voting Session Security information, Voters, Proxy Voters, Official and Official Agents messages, status data, warnings, errors, events, pending actions comprised of: authorized, unauthorized, pending, completed, suspended, stopped, cancelled, rescinded, null&void, outstanding, delayed;

(g) menus, audio links, audio tools for navigating and searching TELVOTS Voting audio data pages;

(h) options for processing the TELVOTS Voting audio recording and correlated Voter selections: Submit, Reset, Pause, Save, Resume, Exit;

(i) audio command options to store and communicate each Enabled Voter Ballot selections made and Submitted for processing: Download, Print, Internet Publish, Internet EMail, Telephone Voice Message, Telephone Text Message, Facsimile Message, Interactive Television Message;

(m)(i)(1) for each Enabled Voter and a plurality of Enabled Voters that chooses to Abstain from Voting for Candidates, the Candidates and Candidate Write-in portions are cleared of all Voter selections and the Candidates and Write-in Candidates portions of the IVOTS Voting Ballot webpage form is visually marked Abstained for the Voter to see, no selections are permitted in those portions, and the IVOTS detects and records the said Abstained portions as not being a voting error;

(m)(i)(2) for each Enabled Voter and a plurality of Enabled Voters that chooses to Abstain from Voting for Proposals, the Proposals and Proposals Write-in portions are cleared of all Voter selections and the Proposals and Write-in Proposals portions of the IVOTS Voting Ballot webpage form is visually marked Abstained for the Voter to see, no selections are permitted in those portions, and the TELVOTS detects and records the said Abstained portions as not being a voting error;

(m)(ii) for each Enabled Voter and a plurality of Enabled Voters that completes and submits their Ballot selections of Candidates, Proposals, Write-in Candidates, Write-in Proposals using computer, personal communications device or telephone keypad menu selections or voice commands;

(1) TELVOTS software and zero, one or a plurality of Officials detecting and identifying zero, one or a plurality of errors on the aforesaid Submitted Ballot Voting form then communicating those errors to the directly correlated Enabled Voter and in general to each Voter of a plurality of Enabled Voters;

(2) zero, one or a plurality of Enabled Voters make zero, one or a plurality of corrections, zero, one or a plurality of times, until all Ballot Voting Selections of Candidates, Write-in Candidates, Write-in Proposals and Proposals are submitted without error using voice commands or keypad selections;

(3) zero, one or a plurality of Enabled Voters, zero, one or a plurality of times, resubmits to TELVOTS their respective Ballot and zero, one or a plurality of corrections for zero, one or a plurality of Candidate Selections, Write-in Candidates, Proposal Selections and Write-in Proposals;

(n)(i) for each Enabled Voter and plurality of Enabled Voters, if all of the said Ballot Selections and Enabled Voter Write-in choices submitted are processed successfully by TELVOTS:

(1) creating a unique set of Ballot-Selection-Signature-Keys for each said Voter generating a unique Ballot-Selection-Signature-Key comprised a series of alphanumeric language glyph symbols by using at least one computer or telephone application program running a computational hashing or encoding algorithm to calculate a unique hash value for each set of Ballot Selections that are assembled and recorded so as to precisely duplicate each of the zero, one or plurality of Ballot selections made by the Voter; and further steps and methods of creating said Ballot-Selection-Signature-Keys and unique hashing values for a each of plurality of Voters and for each said plurality of Voters respective Voters Ballot Selections;

(2) a unique TELVOTS Receipt ID is generated, and then correlated to the TELVOTS Session ID and further correlated to the said Ballot Voting RSID and to each Ballot Validation RSID of at least one Ballot Validation RSID that is already correlated to the said Ballot Voting RSID;

(3) the Voter is prompted by TELVOTS to provide their own Voter Privacy Key comprised of a unique combination of PassCode, PassWord, PassPhrase, Music, Song, Poem, Personal Identification Number or pattern, or other personal validation text, picture, glyph or audio reference to privately sign to enable Voter post-voting authentication and to enable secure encryption of each Voter specific Voting Session;

(4) for each Voter of a plurality of Voters, adding the Voter Ballot Selection Signature Keys to the Voter Privacy Key to form a Voter Privacy Record;

(5) encrypting the Voter Privacy Record using the Voter Privacy Key items as private variables in an encryption algorithm provided or selected by the Voter or using an Encryption Algorithm provided by TELVOTS or from a Third Party to create an Encrypted Voter Privacy Record;

(6) redundantly storing the TELVOTS Receipt ID, Session ID, Ballot Voting RSID, Ballot Voting PassCode, Ballot Validation RSID, Ballot Selections, Encrypted Voter Privacy Record, date, time, unique Location Identifier, unique Official Device Identifier, and zero, one or a plurality of other related information items as the BallotCast Record in at least one Official BallotCast Data Structure;

(7) securely transmitting to each Enabled Voter, an exact copy of their cast Ballot;

(8) TELVOTS allows the Enabled Voter to fax or email a copy of their Voter BallotCast Record, typically a PDF file that is optionally encrypted with another Voter provided BallotVote PDF Privacy Key; said copy file is certified a true copy and digitally signed by TELVOTS;

(9) optionally TELVOTS provides an internet link to a secure Voter provided password encrypted BallotCast webpage that when decrypted displays an exact copy of the Voter Ballot, Selections and Write-in Choices and components of the Ballot Cast Record; said BallotCast webpage may be separately provided by an Official Third Party, and may be restricted only to Eligible Voters; said webpage may optionally embed the Ballot Voting RSID as part of the Internet Universal Resource Locator webpage address used to locate and access the encrypted BallotCast webpage; said encrypted BallotCast webpage may also contain or be preceded by a webpage that contains a data input field for the Voter to provide their Voter Privacy Key, and to select or provide the correlated Encryption Algorithm that was used to encrypt their Voter Privacy Record so that when both said Key and Algorithm are provided and the Voter selects a webpage control button to start decryption, the webpage software initiates a computer to run software programs to use said Key and Algorithm to perform decryption of the encrypted Voter Privacy Record, which is displayed in the computer browser with an exact copy of the cast Voting Ballot when decryption succeeds;

(10) using the unique, private Ballot RSID as part of an Internet address to organize and privately store each Voter BallotCast webpage, and a plurality of Voter BallotCast webpages;

(11) further steps and methods of securely transmitting the Ballot Cast Record to zero, one or a plurality of: Enabled Voters, Election Officials, Political Parties, Candidates, News Media, Government Officials, and zero, one or a plurality of other approved third parties for processing actions, verification, authentication, error detecting, error correcting, publishing and auditing;

(12) Officials, TELVOTS, or an Official Third Party creating, publishing and continually updating a publicly accessible Internet webpage that displays summaries of BallotCast voting with Voting Ballot RSID and tallies of correlated Voter selections and Write-in choices that are sorted by Voting Region, Voting Area, Voting Area Polling Station Identifier; Officials, TELVOTS and zero, one or a plurality of Official Third Parties sharing and transmitting exact copies of said BallotCast Summary webpage to zero, one or a plurality of Voters, non-Voters, Election Officials, Political Parties, Candidates, News Media, Government Officials, and zero, one or a plurality of other interested third parties for processing actions, verification, authentication, error detecting, error correcting, publishing and auditing;

(g)(ii)(1) creating and then transmitting zero, one or a plurality of Receipt Confirmation Documents to each Enabled Voter and a plurality of Enabled Voters either electronically, using methods of secure Universal Resource Locator webpage accessible by Ballot ID and Ballot PassCode or Voter ID and Voter PassWord, and optionally by sending a confirmation EMail to each Voter provided EMail, and optionally by sending a confirmation Fax or Facsimile to the Voter specified Fax or Facsimile machine telephone number, and optionally by text messaging a confirmation message to each Voter provided cellular phone device or tablet or computer or other communications devices, and by using at least one POEM format, or a combination of POEM formats, and by Officials or their delegates providing to a plurality of Voters at least one certified, verifiable Receipt Documents to each Enabled Voter who has successfully submitted their validated Ballots in person or electronically or by using zero, one or plurality of other POEM formats and methods of said delivery communication;

(g)(ii)(2) and the further optional steps and methods of using the unique, private Ballot RSID as part of an Internet address to organize and privately store each Voter webpage, as well as all actions, tallies and summaries of Voter selections;

(g)(iii) for a plurality of Enabled Voters and Enabled Proxy Voters, Officials providing at least one POEM Voting Receipt to each said Voter or Proxy Voter whom successfully casts their Ballot, whereby said POEM Receipt is rendered to the Voter in the format deliverable according to the Voter interactive device; said POEM Voting Receipt data comprises of Voting Session Identifier, Voting Session Descriptors, Voter POEM Session Type, Ballot Voting RSID with correlated Ballot Voting RSID barcode having a unique numeric value correlated to the Ballot Voting RSID, Voting Location Descriptors and Voting Location Identifier, PostalZipCode Identifier, and Polling Station Identifier, Official Duty Title, Voter Selected Candidates and correlated Candidate Identifier, Proposal Heading, Voter Selected Proposals and correlated Proposal Identifier, and correlated Voter Proposal Vote Voter Selected Candidates and correlated Candidate Identifier, Official Ballot Casting DateTimeStamp, Voter Candidate Selection Signature concatenated to the front of the Voter Proposal Selection Signature with a combined alpha-numeric value that is correlated to the barcode which has a correlated unique alpha-numeric or language glyph symbols or machine computed digital or digitally encoded value, POEM format Voting Session Receipt Identifier having a unique alpha-numeric or language glyph symbols or machine computed digital or digitally encoded value for this Voting Session Receipt Document that is correlated to the barcode having a correlated value, of said Voting Session Receipt Identifier, and POEM format Voting Session Validation Identifier having a unique alpha-numeric or language glyph symbols or machine computed digital or digitally encoded value for the originating Official Voter Validation Session that permits the Ballot to be cast in the Active Voting Session, and is correlated to the value of the barcode which has a correlated unique alpha-numeric or language glyph symbols or machine computed digital or digitally encoded value for the Voting Session Validation Identifier; and further whereby aforesaid data is correlated to other hidden, unprinted Official data that is recorded and stored at the time the ballot is cast;

and (h)(i) the further steps of applying zero, one or a plurality of the aforementioned steps and methods, actions, data or results zero, one or a plurality of times, to zero, one or a plurality of Ballots, Voters, Officials, or other legal entities, by zero, one or a plurality of Voters, Officials or other entities;

(h)(ii) modifying aforesaid steps and methods to enable Voter Registration via Internet;

(h)(iii) further modifying of aforesaid methods to enable Validation, Error Reporting and Amendments of Voter Registration, Ballots, Proxy Assignment, Voter Contact Updates, Proxy Contact Updates, Voter active-inactive, Proxy Active-Inactive, Voter Ballot Complaints, Voter Registration Complaints—all via the Internet Voting WebPages provided by Officials, TELVOTS, and zero, one or a plurality of Official Agents, Official Third Parties;

(i)(1) further modifying aforesaid TELVOTS and TELVALS steps methods to enable Voter Registration and amendments, Voter Language Selection and amendments, Voter Document Processing, Ballot Validation and Ballot Authentication and Ballot Voting via Telephone; and other further modifying of aforesaid TELVALS and TELVOTS steps and methods so as to enable Validation, Error Reporting and Amendments of Voter Registration, Ballots, Proxy Assignment, Voter Contact Updates, Proxy Contact Updates, Voter active-inactive, Proxy Active-Inactive, Voter Ballot Complaints, Voter Registration Complaints—all via Telephone employing telephone or computer telephony applications for sending, receiving, processing, validating, authenticating, error detecting, error correcting, error reporting, filing complaints, processing investigations and amendments and replacement documents and containers, providing security, providing tallying, verification and certification as well as calculations, providing photographic images, Document and Container scanning Templates, Data Fields and data, as well as Voter Selections of Candidates and Proposals, with access to Officials, Agents, Official Voting Devices, Official Internet Webservers and Official Internet webpages by Telephone devices, touch-tone codes, Audio recordings Video recordings, and Telephone Texting messages and related information of aforesaid data;

(I) Fax or Facsimile Voting, Registration, Validation, Error Reporting, Amendments employing the steps and methods of claim 1, and the further steps and methods of Validation, Registration and Voting by Facsimile transmission delivery method having acronym: Fax, or Electronic Mail transmission delivery method having acronym: Email or by said Telephone or Computer Message Texting whereby:

(i1) at least one and each of a plurality of Voter follows in general the modified previous steps and methods of said Internet and Telephone Validation and Voting, such that zero, one or a plurality of Voters generally do, but are not limited to: (i1a) obtains and utilizes zero, one or a plurality of authentication certificates from zero, one or a plurality of certificate authorities;

(i1b) any facsimile device or computer running facsimile software or Document processing software or EMail software or any other combination of electronic devices and software in conjunction with zero, one or a plurality of and any types of communications system and methods to connect to the Fax or Facsimile and EMail Validation System having acronym: FEVALS;

(i2) and the further optional steps and methods of using the unique, private Ballot RSID as part of an Internet address to organize and privately store each Voter webpage, as well as all actions, tallies and summaries of Voter selections; and (i3) the further, optional, steps and methods for each Fax Facsimile or EMail Ballot, to detect, report and then: (a) stop processing of the appropriate Fax or Facsimile-EMail Ballot cast via FEVOTS upon detecting any types of critical failures, failure of timely Receipt of the Printed Master or Receipt Ballot, or, (b) of disregarding zero, one or a plurality of failures of non-critical Events; delivery of zero, one or a plurality of Printed or optically rendered Master or Receipt Ballots correlated to a Fax or Facsimile-EMail Ballot cast via FEVOTS;

(i4) modifying aforesaid methods to enable Voter Registration via Fax or Facsimile or EMail; and other further modifying of aforesaid methods to enable Validation, Error Reporting and Amendments of Voter Registration, Ballots, Proxy Assignment, Voter Contact Updates, Proxy Contact Updates, Voter active-inactive, Proxy Active-Inactive, Voter Ballot Complaints, Voter Registration Complaints—all via Facsimile or Email or Telephone Texting;

(J) Electronic Mail and Internet Webpage Voting, Registration, Validation, Error Reporting, Amendments whereby zero, one or a plurality of and a plurality of Voters and Proxy Voters:

(1) utilize computer or electronic data devices running EMail communications software operating in conjunction with a combination of electronic communications and security devices and software acting to connect with zero, one or a plurality of and communications systems operating to connect to the Voting Session Officials EMail Validation System having acronym EMVALS;

(2) EMVALS and zero, one or a plurality of Voters obtains and utilizes zero, one or a plurality of authentication certificates from zero, one or a plurality of certificate authorities that is correlated to each respective, originating EMVSID which is recorded and stored by EMVALS;

(3) whereupon a Voter successfully connects to the Official EMVAL System by sending an EMail to the EMVALS whereupon Receipt of said Voter EMail, a unique EMail Validation Session Identifier having acronym: EMVSID which is generated by the Official EMVAL System and then is associated with the EMVAL Validation Session for that particular Voter EMail address and the submitted Voter EMail Initial Contact Message having acronym: VEM-ICM;

(4) for a plurality and each VEM-ICM contains and submits the Voter Email correlated Internet address, Ballot Validation RSID, optional Voter Registration ID and optional correlated Ballot PassCode—which are recorded and stored by EMVALS along with the Date, Time and Voter EMail Message Header and related data which enables error checking of the VEM-ICM contents and tracing the source, distribution and transit-delivery path of each VEM-ICM;

(5) EMVALS then employs at least one computers running software programs applying algorithms and instructions code for receiving and interpreting said Document and Container reading template obtained optical images and data fields for accurate symbol, graphic and alpha-numeric or language glyph character recognition as well as so as to securely receive and process the EM-ICM;

(6) whereby zero, one or a plurality of Officials employ EMVALS to run computer software that automatically checks the validity and authenticity of the VEM-ICM contents submitted to Official data sources, and if the VEM-ICM contents and Voter EMail are valid and authentic, and if not received from a known blacklisted, fraudulent SPAM EMail source then:

(i) EMVALS then generates an EMICM-VALID that is correlated to the VEM-ICM and EMVSID and is stored by EMVALS;

(ii) and then EMVALS generates and sends to the Voter provided VEM-ICM EMail address: an Official Validation EMail Message having acronym: EM-OVAL with an a new Official Voting EMail Address to reply to with a subject header of the EMVSID and EMICM-VALID and further that the Official vote enabling EMail message also contains an attached or embedded electronic optically readable EMail Voting Ballot which replicates the entire contents of the regular Official Voting Ballot and contains at least the Ballot Voting RSID, Ballot and Voting Session data, Voting Choices, and optional Write-in choices, optional Voter security data, and optional orientation Marks and alignment Marks, and further providing a computer software Internet link to an Officials Internet Voting Webpage that is visually rendered as an exact replica of the Official Voting Ballot or approximation thereof for alternative use for voting;

(7) zero, one or a plurality of EMVALS connected and validated-authenticated Voters then replies to EMVALS by submitting their completed EMail Voting Ballot and correlated Ballot PassCode to the EMVALS by reply to the original Official Voting EMail message that validated the EM-ICM or alternatively, by completing and submitting one or a plurality of the Official Internet Webpage forms designated for this purpose;

(8) for each of at least one and for a plurality of submitted EMail Ballots, said EMVALS:

(i) receives and processes each EMail Completed Voting Ballot having acronym: EM-CVB and upon receiving and successfully verifying the EM-CVB was received before the Expiry Date and Expiry Time for a valid, active Voting Session; and further upon confirming that the validity of the Voter submitted Ballot Voting RSID and correlated Ballot PassCode;

(ii) disables and excludes from tallying the correlated Internet Voting Webpage for each said EM-CVB;

(iii) disables and excludes any other subsequent Ballot tallying submissions for the Ballot Voting RSID, but EMVALS still accepts submission for Ballot processing error complaints and Damaged, Lost or Stolen complaints for submitted Ballot RSID;

(iv) EMVALS generates an internal unique Transaction Identifier having acronym: EMTID then transfers the received EM-VB to the EMail Submitted Ballot System having acronym: EMSBS for authenticating, analyzing, tallying, certifying, publishing or alternatively rejecting EM-VCB upon detecting flawed validation, or flawed authentication, an improperly completed Ballot, or, an invalid Ballot Voting RSID, or an invalid Ballot PassCode;

(9) zero, one or a plurality of EMVALS connected and validated-authenticated Voters then replies to EMVALS by submitting their completed EMail Voting Ballot and correlated Ballot PassCode to the EMVALS by reply to the original Official Voting EMail message that validated the EM-ICM or alternatively, by completing and submitting the Internet Voting Webpage forms;

(10) for a plurality of EMail Ballots, said EMVALS:

(i) receives and processes each EMail Completed Voting Ballot having acronym: (EM-CVB) and upon receiving and successfully verifying the EM-CVB was received before the Expiry Date and Expiry Time for a valid, active Voting Session; and further upon confirming that the validity of the Voter submitted Ballot Voting RSID and correlated Ballot PassCode;

(ii) disables and excludes from tallying the correlated Internet Voting Webpages for each said EM-CVB;

(iii) disables and excludes all other subsequent Ballot tallying submissions for the Ballot Voting RSID, but EMVALS still accepts submission for Ballot processing error complaints and Damaged, Lost or Stolen complaints for all Ballot RSID and for a plurality of Ballot RSIDs;

(iv) EMVALS generates an internal unique Transaction Identifier having acronym: EMVALS-TID then transfers the received EM-CVB to the EMail Submitted Ballot System having acronym: EMSBS for authenticating, analyzing, tallying, certifying, publishing or alternatively rejecting EM-CVB upon detecting flawed authentication, improperly completed Ballot or invalid Ballot Voting RSID or invalid Ballot PassCode;

(11) for a plurality of and for each successful transfer of each EM-VCB from EMVALS:

(i) the EMSBS generates a unique Session Identifier Receipt having acronym: EMSBS-SIDR that is correlated to the EMVALS-Transaction Identifier having acronym EMVALS-TID, or, (ii) upon failure of transfer from EMVALS, generating at least one error message and retrying the said transfer automatically zero, one or a plurality of times;

(12) for each successful transfer of the prior step, EMSBS then employs zero, one or a plurality of steps and methods according to claim 9 along with computers running software for optical image and character recognition so as to validate any number data items securely receive and process the EM-VCB and correlated data comprised of: Ballot Voting RSID, Ballot PassCode, Voting Session Identifier and Limits of Use and Expiry data, Official Security Elements, Voter Selections, Voter Write-in Choices, Voter Personal Security Items, orientation and alignment Marks, and attached electronic POEM format of the certified exact copy of original optical image files, identification data for Document reading template and said template data fields;

(13) if the Ballot Selections are processed successfully by EMSBS, then a unique EMSBS Receipt ID having acronym: EMSBS-OKRECID is generated, then correlated to the EMSBS Session ID and further correlated to Voting System Identifiers Ballot Voting RSID, Ballot PassCode, Validation RSID for the correlated Ballot Voting RSID;

(14) permanently, securely and redundantly receiving, processing, storing, transmitting: zero, one or a plurality of: Voting System ID, Receipt ID, Session ID, Ballot Voting RSID, Ballot Voting PassCode, Ballot Validation RSID, Ballot Selections, Voter Write-in selections, Voter Personal Security Items, and zero, one or a plurality of other related information items are for verification, investigation and accounting in zero, one or a plurality of formats, for publishing, investigation, verification and accounting in any said POEM format to each of a plurality of Voters, Election Officials, Official Agents, Political Parties, Candidates, and to zero, one or a plurality of other approved third parties;

(15) the further steps and methods of transmitting zero, one or a plurality of Receipt Confirmation Documents to each successful Voter either electronically, (using said delivery methods of Fax or Facsimile transmission confirmation copy of Ballot cast, sent back to each Voter used submitting: Fax or Facsimile machine, webpage with access requiring Voter PassWord or Ballot PassCode, EMail address, interactive television, cell phone, land line phone, or, to each Voter provided EMail address, Fax or Facsimile telephone number, private cellular telephone, interactive television, voting terminal, or, providing a paper Receipt Documents that is mailed or given in person to each Voter and each Proxy Voter who has successfully submitted their Ballots or Registration or Voter Language Selection forms;

(16) the further optional steps and methods of using the unique, private Ballot RSID as part of an Internet address to organize and privately store each Voter webpage, as well as all actions, tallies and summaries of Voter selections;

(17) stopping processing of the zero, one or a plurality of submitted EMail Ballots upon detecting of critical failure Events, non-correctable data errors, substantial data processing or communications errors, failure of timely Receipt of the printed Master or Receipt Ballot, or, disregarding zero, one or a plurality of non-critical failures or relying upon self-correcting artificial intelligence software algorithms to detect, locate, correct, re-verify erroneous data, Objects, Processes, Services Events, messages, and signals of this invention;

(18) further modifying of aforesaid methods to enable Validation, Error Reporting and Amendments of Voter Registration, Ballots, Proxy Assignment, Voter Contact Updates, Proxy Contact Updates, Voter active-inactive, Proxy Active-Inactive, Voter Ballot Complaints, Voter Registration Complaints, Voter Ballot Amendments, Voter Registration Amendments;

(19) repeating with modifying said steps of EMail Voting, Registration, Error Reporting, Amendments, so as to enable said steps for the method of Interactive Television Voting, Registration, Error Reporting, Amendments by substituting use of an interactive television device connected to a television network or the Internet in place of a computer terminal or Internet tablet device connected to the Internet; and further Voter selecting appropriate interactive television channel or correlated secure Universal Resource Locator having acronym: URL address of the Internet or private intranet or secure telephone communication line, so as to enable interactive voting, registration, error reporting and amendments processing, results publishing; enabling and processing aforesaid with modified steps of EMail Voting, EMail Registration, EMail Error Reporting, EMail Amendments, EMail Results Publishing;

(K) and for all of the said methods of voting: (In Person, By Proxy, Postal Mail, Courier, Email, Internet, Audio, Video, Fax or Facsimile, Telephone, Telephone Texting, Interactive Television) the further steps and methods of each Voter (i) affixing zero, one or a plurality of personal Identifiers their personal signature, personal verification data, private PassWord, personal EMail address, and zero, one or a plurality of date or time information to zero, one or a plurality of paper, or electronic Ballots, Registration forms, data Containers or other types of Documents of this invention, including the Master Voter Registration form, Master Language preference form, Whole Ballot Receipt part, and (ii) further steps and methods of affixing per step a unique Container Identifier either inside to protect private sensitive data, or, upon the outside, or a combination thereof per each items, so as to be upon or within each of a plurality of Delivery Containers and each of a plurality Return Containers of this invention; and the further step of zero, one or a plurality of Voters or Proxy Voters generating a digital signature or applying their personal Voter Registration Identifier or Proxy Registration Identifier and applies at least one digital signature algorithm to digitally sign zero, one or a plurality of Documents: Voter Ballot, Voter Registration, Voter Language selection, and zero, one or a plurality of any types of Containers, and zero, one or a plurality of affidavits for Ballot replacement; for each Voter and for a plurality of Voter, at least one Official applies zero, one or a plurality of digital signature algorithm to digitally sign each aforesaid Documents successfully submitted to said Officials;

(L) for zero, one or a plurality of Ballots being cast, zero, one or a plurality of Officials may optionally first determine if the Ballot has previously been activated for use by zero, one or a plurality of Ballot Activation Documents and then separating correlated Ballot processing as per Voting Session rules;

(M) the further steps and methods of applying zero, one or a plurality of Ballot Voting PassCodes, Ballot Validation PassCodes, Voter Registration PassCodes, Voter Proxy Assign PassCodes, Voter Language Selection PassCodes, Voter Contact Update PassCodes, Voter Ballot processing complaint PassCodes, Voter Registration complaint PassCodes, Voter PassWords, separately or in combination with zero, one or a plurality of symmetric or asymmetric or both symmetric and asymmetric digital data encryption key pairs, and zero, one or a plurality of digital key certificates by using at least one computers running software programs employing encrypting algorithms and decrypting algorithms to digitally sign, digitally authenticate, encrypt, decrypt, read and secure a least one and for each of a plurality of: Documents, Containers, Events, Objects, Security Items, Elements & Processes, Communications, Amendments, Investigations, Error Detection, Correction & Reporting, Voter Ballot data sets, Voter Registration data sets, Voter Language data sets, Voter Personal Security Items, Containers, system data sets, processing data sets transaction Identifiers, Ballot images, Registration form images, Language selection form images, Container images, any types of Voter identification images, any types of Document images, any types of affidavits, any types of Documents, communications, data storages, images, reports or tallies of the invention; this invention shall also include any related or further modifications of the aforesaid steps so as to meet the spirit of the invention and unique goals of any voting session.

19. The Computerized Voting System of claim 1 wherein: A plurality of Officials, Official Agents and Official Devices are constructing one or a plurality of RSID which is a Random Symbolic Identifier, as well as: zero, one or a plurality of Sequential Symbolic Identifier, Unique Identifier, Universal Identifier, Group Pattern Random Symbolic Identifier, Group Pattern Sequential Symbolic Identifier used in any type of Document, Container, Objects, Events, or data items or processing or events or communications or security of this such that the steps in creating each RSID and each group of RSIDs are done in a logical consistent manner is comprised of:

(A) defining the maximum number of Random Symbolic Identifiers needed to ensure that each RSID is unique and extremely difficult to guess, infer and predict; First determining the minimum number of RSIDs required by considering data of: the number of Potential Voters according to Research steps, the number of correlated RSIDs per each type of Objects and Events of this invention; whereby Officials determine, perform manual calculations, and use zero, one or a plurality of computers running software programs to apply mathematical concepts in estimating and calculating, for each RSID Object and Event group type: Voter Ballots, Voter Registration forms, Proxy Registration, Voting Session Officials Registrations, Voting Sessions Devices Identifiers, Official and Voter Ballot Containers, Official and Voter Registration Containers, Official and Voting Receipt Identifiers, Official and Voter Registration Receipt Identifiers, Official and Voter Transaction Identifiers, Internal Computer System Identifiers, External Audit Identifiers, Secure Communications Identifiers or private-public Encryption-Decryption Keys) to estimate:

(i) total number of unique RSIDs needed per group;

(ii) the largest number of RSIDs needed for each group;

(iii) the total number of RSIDs needed overall;

Whereby a plurality of Officials utilize zero, one or a plurality of Voter lists, perform manual calculations, employing zero, one or a plurality of computers running software programs to apply mathematical concepts and algorithms to estimate, calculate and generate an estimated number of required RSIDs that are constructed to differentiate and accommodate, for each Voter and for all anticipated Voters, all types of each required RSID secured items: Documents—Ballots, Voter Registration forms, Data Containers, voter-proxy Language Registration forms, Security Elements, Security Items and Security labels, Validation Items, Elements and labels, Authentication Elements, Items and labels, Lists of: Eligible Voters, Potential Voters, Ineligible and Disqualified Voters, Eligible Proxy-Voters, Ineligible and Disqualified Proxy Voters, secure data items, securely identified transactions and correlated transaction and audit Receipts secured Receipts, secure validations-authentications of any types of Documents, secure tagging identification of Official Vote Processing Devices, secure data communications, estimated number of Containers, estimated number of Voter Registrations, expected number of Ballot replacements, estimated number of Registration transactions, voting transactions, estimated number of Receipts generated, anticipated number of enquiries, verifications, authentications, publications, communications Events, communications data security info, secure Document and Container scanning activities, secure data Objects, Containers, Events & Data Processing: messages, audits and reports, Communications: messages, audits and reports, Error & Complaint: Detections, Investigations, Corrections & Reports;

(B) the steps and methods of creating and organizing a plurality of RSIDs whereby:

(i) The RSID and RSID group type symbols must be pre-determined, and the number of symbols to use for the RSID of this invention must be pre-calculated, based on the number of Voters anticipated, level of security desired for making the RSID extremely difficult to guess, balanced with the data storage needs, scanning error rate, computer processing error rate and extra communication required for having a large number of symbols comprising each RSID; also taking into consideration total number of Ballots issued, expected replacements, anticipated number of enquiries, verifications, authentications, validations, certifications, transactions, secure communications;

(ii) Officials select or create at least one reference group of symbolic characters (which may include numeric symbols and any other symbols or characters graphics or icons from any known human Languages or codes) and specify correlated numeric values to each symbol removing redundant and easily confused symbols from each reference group;

(iii) Officials calculating minimum number of symbols needed to generate a sufficient number of unique permutations of RSIDs so as to be able to create a plurality of unique combinations of symbol permutations from said reference group for at least equaling and preferably greatly exceeding the required number of RSIDs for each group; and the further steps of reviewing each of the aforesaid symbol permutation substring patterns, then removing and inhibiting the creation of any repetitious or undesirable permutations;

(iv) for the above calculations of (iii), each of a plurality of RSIDs are organized by unique group type and sub-group type, each according to usage, and each RSID sub-group type is comprised of identical quantity number of references symbols of the RSID: Group Containers ID is comprised of: Data Containers, Document Containers, Security Containers, Events Containers, Object Containers, Communications Containers; furthermore, Containers are prefixed and segregated by user: Official, Agent, Voter, Candidate, Government, Third Party;

(v) each said Documents Containers are used in any aforesaid POEM format for delivering and receiving Documents particular to the sender or receiver; and further repeated for each group type and sub-group thereof;

(vi) for each said RSID, and for the correlated numeric quantity of reference symbols for any group or sub-group combination of reference symbols that are used to identify each group and each sub-group are usually different in numeric quantity, or, if numerically identical in quantity, then identical groups shall differ in their arrangement of numbers and characters so as to be unique and prevent errors or accidental misuse;

(vii) and for zero, one or a plurality of permutations of said combined reference symbol groups into usage groups and sub-groups thereof, each usage group comprises of at least one usage sub-group, and each usage sub-group is comprised of at least one unique grouping and arrangement having at least one unique symbol, or a plurality of unique symbols from the reference symbols group, arranged and uniquely combined so each usage group and each usage sub-group are uniquely identifiable among all usage groups and all usage sub-groups; further whereby each usage group is comprised of a combination of reference symbols permutation containing at least one reference symbol group, each symbol group having at least one unique symbol, or a plurality of unique symbols; each solo reference symbol group and each resultant combined usage symbol groups have a plurality of permutations of symbols within each said reference group, and thus within each usage group, usage sub-group and identifiers derived thereof;

(viii) and further whereby for each usage sub-group, at least one or a plurality of components groups of reference symbols are uniquely arranged and combined to create at least one unique combination of reference symbols so as to form a unique identifier which represents to the Voters and Officials, the visual and said POEM format as a unique arrangement of symbols used for a unique Random Symbolic Identifier also known as an RSID; For each said usage group or combined usage sub-groups, each said permutation of group symbols is correlated to one unique binary value, one unique hexadecimal value, one unique base ten numeric value; For each said Random Symbolic Identifier or RSID which is derived from or correlated to any group, sub-group or sub-group components, said Random Symbolic Identifier or RSID is correlated to one unique binary value, one unique hexadecimal value, one unique base ten numeric value;

(v) the reiterative steps of reviewing creation of merged reference symbol groups of step (iv) to (viii) then removing any repetitious, confusing or undesirable symbols or patterns from merged groups;

(vix) and further iterative steps of adding zero, one or a plurality of symbols and symbol permutations so as to increase the number of acceptable said RSIDs patterns and acceptable RSID internal patterns to achieve the required total number of symbol permutations that are needed to assign to each said RSID and to each RSID within each RSID usage group type and for any additional spare RSIDs for each usage group or sub-group, or sub-group components;

(vii) at least one Officials or Official Agents employing zero, one or a plurality of computers running software programs that assign one unique numeric binary value to each symbol or use an existing symbol code set that already has symbols and correlated numeric values;

(C) for each RSID group type, and for each RSIDs belonging to each group, at least one Officials or Official Agents employing zero, one or a plurality of computers running software programs that:

(i) randomly selecting symbols from the set of acceptable symbols until reaching the desired symbol number count required to achieve the maximum range of numeric values required for uniquely distinguishing each of the RSIDs for the usage group or usage sub-group;

(ii) concatenating each symbol of each RSID to produce a unique symbol string—which may then be split into sub-groups of symbols for easier human usage and or processing;

(iii) rejecting undesirable RSIDs by limiting the number of times a single symbol, or group of symbols, is repeated within each RSID so as to avoid confusion, eliminate undesirable patterns, and to optimize human perceptions of recognizable uniqueness; and further whereby each RSID is made to be extreme difficulty to estimate, calculate or guess, and the uniqueness of each RSID enables it to be differentiable among all other RSIDs and all other types Identifiers of this invention;

(D) Officials or Official Agents employing zero, one or a plurality of computers running software programs that:

(i) assign one unique binary value to each acceptable RSID by consistently concatenating the correlated binary value assigned to each RSID symbol assigned in (b)(vii), then interpreting the combined assembled binary string as a single binary number (which may then be split into sub-groups of numbers for easier human usage);

(ii) enforce the principle of substantial numeric spacing so that each RSID binary value is unequivocally unique and predominately numerically distant in value from all other RSIDs within a group and among all RSIDs;

(E) Officials or Official Agents employing zero, one or a plurality of computers running software programs that: apply the further steps and methods of correlating zero, one or a plurality of RSIDs symbol group or sub-group patterns or directly to any symbols of:

(1) any types of alpha-numeric symbols or any other Language graphic or character symbols, as well as to images, icons, scientific or math symbols in any said POEM format;

(2) zero, one or a plurality of barcode graphic image or any other graphical symbolic representations correlated to a group of symbols referred to in preceding step (1);

(3) calculated or derived barcode values that are correlated to a specific barcode graphic;

(F) Officials or Official Agents employing zero, one or a plurality of computers running software programs that: when a pre-determined maximum size of symbol groups is defined by determining a maximum number of symbols then the unused binary can be compressed further to reduce data storage needs or more importantly, to provide another layer of security by reassigning the unused binary values for each unused symbol to provide Data Security-Integrity data bits for: signal marking, bit transition encoding, data parity, and zero, one or a plurality of other bits for data security encoding, error detection, error identification, error specification, error messaging, error localization, error correction and error data recovery, and error detection rejection;

(G) Officials or Official Agents employing zero, one or a plurality of computers running software programs for: assigning zero, one or a plurality of: Data Type or Data Mode data bits symbols to zero, one or a plurality of RSID data signals or any other data of this invention so as to embed the signal type within the data transmitted for data handling optimization and security implicitly by characterizing the quality of the data received, and the further step of assigning zero, one or a plurality of non-RSID Data Mode symbols to each unused compressed binary number after First determining the maximum number of data bits needed to represent a particular type of binary signal data type: Local-Data, Remote-Data, Internal-Data, Internet-Data, Fax or Facsimile-Data, EMail-Data, Telephone-Data, Interactive-eTV-Data, probable source and data signal path, and data signal mode: Official Device Telemetry, Voter Device Telemetry, Internal Communication, External Communication, Official Security, Voter Security, External Security, Voter Data Storage, Official Data Storage, Voter Data Retrieval, Official Data Retrieval, Validation, Authentication, Printing, Voter Data Processing, Official Data Processing, Analyzing, Event Processing, Object Processing, Complaint Processing, Investigation Processing, Error Processing: error detection, error identification, error specification, error localization, error position locating, error marking, error correction, error data recovery, false error detection rejection, Amending, Tallying, Reporting, Certifying, Publishing;

(H)(i) Officials or Official Agents employing zero, one or a plurality of computers running software programs for: constructing resultant final data words of the prior steps (F), (G) may then be re-encoded and re-correlated to the same original symbol encoding group: ASCII symbols group, any language symbol group, any machine or human created symbol group or, may alternatively be cross-encoded to another multi-bit code pattern, thereby further encrypting the original data contents while subsequently and separately embedding error detection, error identification, error specification, error localization, error correction data bits, security encoding bits for capabilities which could also be used to improve secure data storage, data transmissions and receptions;

(H)(ii) Officials or Official Agents employing zero, one or a plurality of computers running software programs for creating and assigning: zero, one or a plurality of specific said usage group type and usage sub-groups and component RSIDs, whereby each RSID of a usage group type or usage sub-group may optionally have appended additional data symbols as prefixes or suffixes, or at specific positions internally as embedded data bits that are at specific positions within the RSID so as to used for security encryption-decryption, transmitting and receiving data compression and decompression, error detection, error identification, error specification, error localization, error correction and error data recovery, error detection rejection, and to provide further information as to the RSID source device identification, source device location, source author identification, source author authorization, creation date-time, voting session, voting region, polling station, Ballot type, Registration type Document type, or other relevant information that is then appended as any combination of extra prefixes, suffixes or embedded within the RSID to create a new composite RSID, while also retaining the integrity of the original core RSID, whereby the composite RSID extreme difficulty to estimate, calculate or guess, and the uniqueness of the composite RSID as it remains readily differentiable among all other types Identifiers of this invention; and the further steps of disassembling and extracting the original core RSID from the composite RSID;

(I) Officials or Official Agents employing zero, one or a plurality of computers running software programs for:

(i) creating and assigning zero, one or a plurality of RSID symbols to belong to a group type RSIDs of identical usage purpose, (ii) and further whereby each RSID of each aforesaid usage group type may have additional data symbols, or data bits or symbols and data bits that are optionally appended as extra prefixes, suffixes and optionally embedded within the RSID so as to used for grouping RSIDs by identical usage purpose for each correlated said usage group type;

(iii) and to provide embedded usage error check; RSIDs are grouped by usage group type and further by sub-group usage type and each RSID and each usage group type RSID and each usage sub-group RSID usage sub-group component RSID is composed of identical or similar number of reference symbols for each of the respective usage group types, usage sub-groups and RSID components;

(J) Officials or Official Agents employing zero, one or a plurality of computers running software programs for: calculating and generating an estimated extra number of RSIDs for each RSID group type that are marked inactive-extra and stored separately for rapid assignment as need arises;

(K) Officials or Official Agents employing zero, one or a plurality of computers running software programs for: creating, populating, and organizing top level of Modal group types: People, Objects, Actions, Events, Security, Communications and each has sub-groups or attributes: Type, Identity, Location, Connectivity, Signals, Data, Devices, Actions, Events, Objects, Processes, Communications, Error Handling, Imaging, Reading, Data Storage, Data Retrieval, Analysis, Reporting, Validating, Authenticating, Certifying, Publishing, each having correlated sub-group information attributes correlated to Voters data, Officials data, Documents data, devices data;

(L) Officials or Official Agents employing zero, one or a plurality of computers running software programs for: the further steps and methods of creating a plurality of data organization groups for each mode and method of voting to provide collecting, sorting, separating and organizing a plurality of data items, any types of RSIDs, Documents, forms, Containers, Objects, Events, groups, communications, processes, or any item of this invention; and further steps and methods of creating any number data organization structures of conceptual group types as group formation categorizations, and further of creating zero, one or a plurality of groups of said group types so as to be usable instances of group types to enable further data organization and logical grouping for Voting Methods, Data Storages, RSIDs, Voters, Officials, Official Voting Devices and related equipment, Voting Regions and Locations, Security data partitioning, Communications, data processing, error processing: error detection, error identification, error reporting, error specification, error localization, error position locating, error marking, error correction, error data recovery, false error detection rejection, auditing, reporting, Voting System optimization;

(M) Officials or Official Agents employing zero, one or a plurality of computers running software programs for: creating and assigning zero, one or a plurality of groups to be subordinate to zero, one or a plurality of other groups; and the further steps of correlating groups to groups, correlating groups to attributes, correlating data and state information to attributes and to parent groups;

(N) Officials or Official Agents employing zero, one or a plurality of computers running software programs for:

(1) creating and assigning at least one reference symbol group to each group of Objects (Documents, Devices) and their correlated Objects Type of Document types: Ballots, Ballot Containers, Voter Registrations, Registration Containers, Officials Registrations, Official Registration Containers, Ballot Receipts, Registration Receipts, voting transaction Receipts, Registration transaction Receipts, Ballot delivery confirmation Receipts, Registration delivery confirmation Receipts, Ballot and Registration processing and error reports, Ballot and Registration tally reports, Registration audit reports, voting audit reports; and also of Devices usage types: printing, voting, verifying, authenticating, communicating, securing, auditing, encoding, decoding, encrypting, decrypting, error detecting, error correcting, translating, computing and publishing;

(2) creating and assigning for each Object group type, a unique Object group Identifier having acronym of: ObjectGroupID to the overall group and further a unique Identifier having acronym of: ObjectID for each Object member of the Object group, further whereby the Event group Identifier may also be concatenated to each Object member for rapid association to the parent Object group;

(3) assigning at least one reference symbol group to zero, one or a plurality of Event groups of this invention: Events: Registrations, voting, authentication, transactions, security, auditing, communications, image capture and processing, error processing comprised of: error detection, error identification, error reporting, error specification, error localization, error position locating, error marking, error correction, error data recovery, false error detection rejection, data processing, data retrieval, data storage, validating, authenticating, certifying, reporting and then generating and correlating Identifiers for each Event group, and for each Event within each Event group;

(4) (i) assigning one unique binary value to uniquely identify each group of Objects;

(ii) assign one unique binary value to uniquely identify each group of Events;

(iii) assigning particular groups of reference symbols, barcodes and correlated barcode values to Objects groups, and Event groups of this invention so as to distinguish Objects group types from Event group types and to distinguish Event related identifiers, barcodes and barcode values from among all other Identifiers, barcodes and barcodes values of this invention;

(iv) assigning zero, one or a plurality of attributes and attribute values to each Object group and to each Event group and to a plurality of other groups;

(5) Officials or Official Agents employing zero, one or a plurality of computers running software programs for: (i) assigning one unique binary value to uniquely identify each Object and Event from within each group of Objects, and within each group of Events;

(ii) forming and assigning particular groups of reference symbols, barcodes and the correlated barcode values to Objects groups and Event groups of this invention so as to distinguish Objects among all other Objects and also to distinguish each Event from among all other Events;

(iii) facilitating organization and proper use, of concatenating the parent Object group Identifier to each Object within an Object group, and concatenating the parent Event group Identifier to each Event within an Event group;

(6) Officials or Official Agents employing zero, one or a plurality of computers running software programs for: creating zero, one or a plurality of data organization structures of conceptual group types as group formation categorizations, and further of creating zero, one or a plurality of groups of said group types so as to be usable instances of group types to enable further data organization and logical grouping for Voting Methods, Data Storages, RSIDs, Voters, Officials, Official Voting Devices and related equipment, Voting Regions and Locations, Security data partitioning, Communications, Data Processing and voting system optimization;

(O) Officials or Official Agents employing zero, one or a plurality of computers running software programs for: (1) forming and assigning Modal Groups: as a top-level of the hierarchy of groups which encompass every type of Voting Session activity: Voting, Registration, Imaging, Reporting, Security, Communications, Data Processing, Error Processing, Authorization, Printing, Delivering, Auditing, Authenticating, Confirming, Analyzing, Tallying, Reporting, History Logging, System and Device Identification, Connectivity, Communication, Authentication, Allocation, Workload Balancing, Optimization, Error Handling, Systems and People Event Handling which may contain or have as attributes Objects and Events groups, and the attributes of those Objects and Events groups and for zero, one or a plurality of sub-groups of Objects and and for zero, one or a plurality of sub-groups of Events;

(2) creating and assigning a plurality of Modal groups for each method of voting and further creating and correlating a plurality of data structures to each said Modal group categorization comprising of: Voter, Proxy, Official, Computer System, Network, Security, Communications, Telephony, Television, Data Processing, Error Processing, Internal, External; and for each Modal group categorization, creating zero, one or a plurality of correlated Modal sub-groups: process, services, Events, Objects, Usage, Documents, Containers, Validation, Authentication, Certification, Complaints, Investigation, Corrections, data, signals, errors, corrections, amendments, certification, reporting which each further have a correlated functional Modal Status Priority attribute: urgent, high, normal, error, pending, completed, suspended, terminated, rescinded, voided, archived and related Modal Status Value attribute: true, false, yes, no, maybe, valid, invalid, unknown, secure, insecure, verified, unverified, authorized, unauthorized, confirmed, unconfirmed, submitted, committed, rollback, undone, canceled, rescinded, voided, pending, transmitted, received;

(2) for each Modal group type the steps of creating zero, one or a plurality of RSIDs for each Modal group type and for each subordinate Modal sub-group and activities thereof by defining the upper limit number of Random Symbolic Identifiers needed to ensure that each Modal related RSID is unique and extremely difficult to guess; by calculating, estimating and considering:

(i) the number of Potential Voters and estimated number of Eligible Voters, (ii) potential number of RSIDs for each Modal group of Objects, Events, Systems, Services, Errors, Complaints, Investigation, & Amendments:

(iii) assigning at least one reference symbol group to each top-level parent Modal group and each modal sub-group, so as to provide auditing records;

(3) calculating the total number of Identifiers needed overall and the minimum number of symbols needed to generate a sufficiently number of unique permutations of symbols so as to be able to create one unique symbol permutation for the required number of Identifiers per Modal group; rejecting undesirable Modal-IDs by limit the number of times a single symbol, or group of symbols, is repeated within each Modal-ID so as to avoid confusion, eliminate undesirable patterns, and to optimize human perceptions of uniqueness;

(4) assigning one unique numeric binary value to each symbol or use an existing symbol code set that has symbols and correlated numeric value for each symbol;

(5) constructing each unique RSID or a plurality of unique RSIDs by consistently concatenating the desired quantity of RSID symbols to form a unique RSID symbol string, further repeating for creating a plurality of RSIDs;

(6) assigning a unique binary value to each acceptable unique RSID Identifier string by consistently correlating the binary value assigned to each RSID symbol, then for the completely assembled sequence of RSID symbols having a correlated sequence of binary values, interpreting said sequence of RSID symbols binary values as a single combined unique binary number; correlating said combined unique binary number to the combined RSID symbol string and value;

(7) enforcing the principle of substantial numeric spacing so that each Identifier has a combined unique binary value that is unequivocally unique and predominately numerically distant in value from all other Identifiers among all Identifiers of the invention;

(8) correlating zero, one or a plurality of Modal Identifier sub-patterns directly to zero, one or a plurality of symbols of:

(i) any types of alpha-numeric symbols or graphical Language symbols, images or icons;

(ii) any types of barcode graphics and barcode values;

(P) Officials or Official Agents employing zero, one or a plurality of computers running software programs for: (i) sorting and organizing a plurality of RSID symbols so as to belong to a Group Type of identical usage purpose whereby each RSID group type is composed of identical or similar number of reference symbols of the RSID group types, (ii) grouping RSIDs of each correlated group type, consistently appending extra prefixes, suffixes or embedding at specific positions within the RSID zero, one or a plurality of additional data symbols or binary data bits or data symbols and binary data bits so as to be an extra part of each group type RSID;

(iii) appending and embedding additional data symbols and binary data bits at specific positions within the RSID to enable error detecting, error correcting, security encrypting, decrypting, encoding-decoding, data compressing-decompressing, RSID source identification;

(iv) creating aforesaid composite RSID by embedding or appending additional data symbols and extra data bits to the original core RSID, in such a manner so as to retain the integrity of the original core RSID and the uniqueness of the composite RSID so that it remains readily differentiable among all other Identifiers of this invention and remains extremely difficult, near impossible to estimate, calculate or guess;

(Q) Officials or Official Agents employing zero, one or a plurality of computers running software programs for each RSID group type, calculating, generating and assembling and estimated extra number of core RSIDs and composite RSIDs that are marked inactive-extra and stored separately for rapid assignment and deployment by Officials as the need arises;

(R) Officials or Official Agents employing zero, one or a plurality of computers running software programs for creating top level Voter group type, Proxy group type, and Official group type, each said group type has correlated sub-groups or attributes of: Identity, Location, Devices, Connection, Documents, Security, Events, Issues, Errors, Communications, Processing (Printing, Assigning, Delivering, Receiving, Validating, Imaging, Reading, Storing, Retrieving, Analyzing, Reporting, Publishing, Certifying) and further containing information correlated to specific Voter, Proxy and Officials data issuing, data delivery data receiving, data processing, people actions, System Events, communications, people errors, system errors, error processing comprising of: error detection, error identification, error reporting, error specification, error localization, error position locating, error marking, error correction, error data recovery, false error detection rejection, data storage, data retrieval, connected devices, off-line devices, in-transit devices, on-order devices, in-repair devices;

(S)) Officials or Official Agents employing zero, one or a plurality of computers running software programs for creating a plurality of Data Organization groups for each mode and method of voting to provide collecting, sorting, separating and organizing a plurality of data items, RSIDs, groups, sub-groups, Documents, Ballots, Registration forms, Language selection forms, Containers, Objects, Events, groups, communications, processes, or any item of this invention; and further steps and methods of creating any number data organization structures of conceptual group types as group formation categorizations, and further of creating zero, one or a plurality of groups of said group types so as to be usable instances of group types to enable further data organization and logical grouping for Voting Methods, Data Storages, RSIDs, Voters, Officials, Official Voting Devices and related equipment, Voting Regions and Locations, Security data partitioning, Communications, data processing, error processing, auditing, reporting and voting system optimization;

(T) Officials or Official Agents employing zero, one or a plurality of computers running software programs for creating and assigning zero, one or a plurality of Data Organization groups to be correlated to zero, one or a plurality of other groups;

(i) and the further steps of correlating Data Organization groups to other group types, and further correlating Data Organization groups to data attributes, and further correlating Data Groups to Object state information;

(ii) Officials or Official Agents using computers running software programs:

(a) creating Data Organization groups thereby organizing a plurality of RSIDs for a plurality of each Identifier of: Officials, Voters, Proxy Voters, Documents, containers, registration Documents identifiers, language session identifiers, ballot identifiers, voting session identifiers, voting type identifiers, location identifiers, region identifiers, zone identifiers polling station identifiers, postal-zipcode identifiers, official devices identifiers, data-time-stamp identifiers, voter candidate selection signatures, voter proposal selection signatures, Document submission identifier, Document validation identifier, RSID hashing algorithm calculated values, RSID Cluster Identifiers, data transmissions, data encryption keys, data decryption keys, Security Elements, Voters Personal Security Items, Officials Security Elements, Session Identifiers, Document Receipt Identifiers, Transaction Receipt Identifiers, Transmission Identifiers, Error Message Identifiers, date-time-stamp identifiers, Report Identifiers, Internet webpage identifiers, PassCode identifiers;

(b) for each RSID of the currently active Voting Session: actively sorting and organizing each RSID into usage groups and sub-usage types then for each usage group and for each sub-usage type: (i) calculating hashing values for each RSID and for a plurality of RSIDs using computer software programs applying hashing algorithms;

(ii) grouping said RSID calculated hashing values having similar hashing values into at least one RSID Cluster Groups that is assigned a unique Cluster Group Identifier, then further refining by grouping RSIDs having only identical hashing values into at least one RSID Cluster sub-Group (Cluster Node group);

(iii) for a plurality of Cluster Groups and Cluster sub-groups (Cluster Nodes), logically connecting and interconnecting a plurality of Cluster Groups and Cluster sub-groups with Cluster Vines, also assigning a unique Identifier to each Cluster Vine, and further assigning a Cluster Root Node to each Cluster Vine, then further connecting and interconnecting Cluster Vines using at least one Primary Vine and zero, one or a plurality of Secondary Vines then further assigning a Primary Vine Root Node to each Primary Vine, and a Secondary Vine Root Node to each Secondary Vine whereby said Primary and Secondary Vines Root Nodes contains data and connection information for each Cluster Vines and Cluster Root Nodes to which they are connected; and further having a plurality of distinct Cluster Vines, Cluster Root Nodes, Primary Vines and Secondary Vines, Primary Vine Root Nodes, Secondary Vine Root Nodes whereby each said Node, Cluster and Vine are clearly distinct, uniquely identified;

(iv) and further whereby each said Cluster Group, Cluster sub-group, Cluster Node, Cluster Vines, Primary Vines, Primary Vines Root Nodes, Secondary Vines and Secondary Vines Root Nodes are uniquely identified and accessible by at least one uniquely identifiable connection path and further connected to each other by zero, one or a plurality of uniquely identifiable connection paths;

(v) further connecting aforesaid Clusters, Groups, sub-groups, Vines and Nodes to a plurality of Officials and Official Devices using said connection paths to a plurality of Clusters, Cluster sub-groups, Cluster Nodes, Cluster sub-group Nodes, Cluster Vines, Primary Vines, Secondary Vines, Cluster Vine Root Nodes, Primary Vine Root Nodes, Secondary Vine Root Nodes to zero, one or a plurality of Official Devices, and to zero, one or a plurality of internal and external: verification and validation devices, error detecting, error reporting, error correcting devices, communications devices, data cryptography devices, communications cryptography devices, data or communication compression or decompression devices, data or communication encoding or decoding devices, and further to zero, one or a plurality of: Voter Devices, Government devices, Candidate devices, and Political Party devices, third-party devices, news media devices, general public devices;

(vi) applying beam-search and nearness factoring algorithms using computers running software programs so as calculate, record and store correlated values for optimal searching and data access paths for each RSID Cluster Group, RSID Cluster Node Group, RSID Data Node as well as for the inter-connecting RSID Cluster Vines linking said Cluster Groups and Nodes, then storing said calculations and values in each logically correlated Cluster Vine Root Node;

(vii) for a plurality of RSIDs, recording each RSID, primary usage type, Secondary usage type, correlated hashing value, correlated similar Cluster Group Identifier and identical RSID Cluster sub-Group (Cluster Nodes group) Identifier, at least one Cluster Vines Identifiers, along with the creation date-time-stamp, author-identifier, transaction identifier, official identifier, official devices identifiers, source-location identifier, official-record-identifier, into at least one, and for a plurality of computer accessible, logically organized, sequentially and randomly searchable Official computer data file records, Official computer database records, Official computer linked lists Official computer circular linked lists, Official computer N-tree data structures, Official computer sparse matrices, in at least one Official computer data storage device and at least one immutable Official computer data storage media, and in each logically correlated Vine Root Node;

(viii) defining Requestors for each of one or a plurality of: Officials, Official Agents, Official Voting System Devices, Voters, Proxy Voters, Potential Voters, News Media, Registered Political Person or Registered Political Group, Registered Interested Party attempting to locate one RSID or a plurality of RSIDs by employing data processing devices connecting to Officials POEM format data sources to validate or authenticate one RSID or a plurality of RSIDs by applying Officials software that employs search methods of prior steps (i), (ii), (v) and (vi) unto Officials data storage devices and correlated RSID Cluster Groups, RSID Cluster Nodes, and RSID Cluster Vines and data structures of prior steps (iii), (iv) and (vii) and correlated Personal Identification data and correlated data of the prior step (iv); recording search results, signalling to each Requestors whether the RSID was located, then granting further processing for each found valid RSID or alternatively for each unfound RSID permitting error correction, thereafter for each Requestor whose search fails then limiting or denying any further processing for a time period;

(U) Officials or Official Agents employing zero, one or a plurality of computers running software programs for creating a plurality of Event group types and a plurality of Object group types then:

(1) assigning at least one reference symbol group to each group of Objects (Documents, Devices) and their correlated Objects Type of Document types: Ballots, Ballot Containers, Voter Registrations, Registration Containers, Officials Registrations, Official Registration Containers, Ballot Receipts, Registration Receipts, voting transaction Receipts, Registration transaction Receipts, Ballot delivery confirmation Receipts, Registration delivery confirmation Receipts, Ballot and Registration processing and error reports, Ballot and Registration tally reports, Registration audit reports, voting audit reports; and also of Devices usage and Events types: designing, constructing, assembling, printing, voting, verifying, authenticating, communicating, securing, auditing, encoding, decoding, encrypting, reviewing, analyzing, diagnosing, resolving, repairing, enabling, disabling, activating, deactivating, decrypting, error detecting, error correcting, translating, computing, auditing, certifying, publishing;

(2) assigning for each Object group type, a unique Object group Identifier (ObjectGID) to the overall group and further a unique Identifier (ObjectID) for each Object member of the Object group, further whereby the Event group Identifier may also be concatenated to each Object member for rapid association to the parent Object group;

(3) assigning at least one reference symbol group to zero, one or a plurality of Event groups of this invention: Events: Registrations, voting, authentication, transactions, security, auditing, communications, image capture and processing, error processing, data processing-retrieval-storage; generating correlated Identifiers for each Event group, and for each Event assigned to each type of Event group;

(4) (i) assigning one unique binary value to uniquely identify each group of Objects;

(ii) assigning one unique binary value to uniquely identify each group of Events;

(iii) assigning particular groups of reference symbols, barcodes and correlated barcode values to Objects groups and Event groups of this invention so as to distinguish Objects group types from Event group types and distinguish from among all other Identifiers of the invention;

(iv) assigning zero, one or a plurality of attributes and attribute values to each Object group and to each Event group and to a plurality of any other groups;

(5) (i) assigning one unique binary value to uniquely identify each Object and Event from within each group of Objects (Object groups), each group of Events (Event groups);

(ii) assigning particular groups of reference symbols, barcodes and the correlated barcode values to Objects groups and Event groups of this invention so as to distinguish Objects groups among all other Objects and also to distinguish each Event group from among all Events;

(iii) and the further step to facilitate organization by correctly and consistently concatenating the parent Object group Identifier to each Object within an Object group, concatenating the parent Event group Identifier to each Event within an Event group;

(6) creating any number data organization structures of Conceptual group types as group formation categorizations, and further of creating zero, one or a plurality of groups of said group types so as to be usable instances of group types to enable further data organization and logical grouping for Voting Methods, Data Storages, RSIDs, Voters, Officials, Official, Communications, Data Processing, Availability and Optimization of: Official Devices, Voting Devices and related peripheral equipment, Voting Regions and Locations, Security Data Partitioning System;

(7) creating a plurality of Modal Groups which may be separate or may contain Objects and Events groups, and whereby Modal Groups encompass every type of Voting Session activity (Voting, Registration, Language Selection, Complaints, Imaging, Security, Communication, Error Processing, Systems Event Processing, People Action Processing, Printing, Delivering, Auditing, Authenticating, Confirming, Analyzing, Tallying, Reporting, Workload Balancing, Official Device Availability and Optimization, Voting System Availability and Optimization);

(a) Officials creating a plurality of Modal groups for each method of voting and further creating and correlating a plurality of data structures to each said Modal group categorization (Voter, Official, system, security, communications, internal, external) and for each Modal group categorization a plurality of correlated subgroups (process, services, Events, data) which each further have a correlated functional mode status priority attribute (urgent, high, normal, error, pending, completed, suspended, terminated, archived) and related Modal status attribute value (true, false, yes, no, valid, invalid, unknown, secure, insecure, verified, unverified, authorized, unauthorized, confirmed, unconfirmed, submitted, committed, rollback, undone, canceled, transmitted, received); (b) for each Modal group type, creating zero, one or a plurality of any type of RSIDs for each group type and for each group subordinate Object, processes, services, Events, activities thereof by defining the upper limit number of Random Symbolic Identifiers needed to ensure that any one RSID is unique and extremely difficult to guess, by considering:

(i) the number of Potential Voters and estimated number of Eligible Voters;

(ii) potential number of RSIDs for each Modal group of Objects, Events, Systems, Services;

(iii) providing top-level parent Modal Functional group or category: people devices, System services, security, data processing, Documents, Containers, publishing, communications, imaging, data storage data retrieval groups—and further providing auditing records for each action, Event, signal, process, person, Object, security by assigning subordinate level symbol groups: person type, person-ID, Objects, Object-ID, Object description, people actions, people action-ID, people action description, System Events, System Event-ID, System Event description, issue-ID, issue-type, issue-description, errors, error-ID, error description, device-Identifier, device description, availability, functionality, location, allocation, history log, reports, date-time, source-ID, authorization-ID, authorization history log as attributes of, or sub-levels to said parent Modal Functional groups;

(W) creating and assembling an RSID and a plurality of RSIDs whereby for each RSID, calculating the total number of RSID Identifiers needed overall for the voting session and for each group type usage-purpose, and further calculating the minimum number of symbols needed to generate a sufficiently number of unique permutations of symbols so as to be able to create one unique symbol permutation for the required number of Identifiers per Modal group; rejecting undesirable Modal-IDs by limit the number of times a single symbol, or group of symbols, is repeated within each Modal-ID so as to avoid confusion, eliminate undesirable patterns, and to optimize human perceptions of uniqueness;

(1) assigning one unique numeric binary value to each symbol or use an existing symbol code set that has symbols and correlated numeric value for each symbol;

(2) Officials concatenate each symbol to produce a unique symbol string;

(3) assigning a unique binary value to each acceptable Identifier, by consistently concatenating the correlated binary value assigned to each Identifier symbol, interpreting the assembled binary string as a single binary number;

(4) enforcing the principle of substantial numeric spacing so that each Identifier has a binary value that is unequivocally unique and predominately numerically distant in value from all other Modal-IDs within any group and among all Modal-IDs;

(5) correlating zero, one or a plurality of Modal Identifier sub-patterns directly to any symbols of:

(i) any types of alpha-numeric symbols or graphical Language symbols, images or icons;

(ii) any types of barcode graphics and barcode values;

(X) embodying a Voter Ballot as a portable, anonymous Voter Ballot optical-electronic data card having all required Official Ballot information, Ballot voting choices, voting RSID Identifiers and PassCodes encoded, encrypted and stored in visible character symbols, invisible character symbols, magnetic data field stripes, holograms, micro-devices; and (Y) further having a Voter Registration data card containing specific information pertaining to a particular Voter or designated Proxy; further embodying an voting session Official Registration and identification as a portable Official ID card having for each Official, their public identification data, private voting session Identifiers and Official PassCodes and Officials private PassWords encoded and stored in visible and invisible character symbols, electronically, optical-electronically, magnetic data field stripes, holograms, chemicals, special materials, micro-devices;

(Z) utilizing any combinations of: at least one symmetric or at least one asymmetric or any other type: logarithmic, algebraic polynomials exponentials of encryption public and private key pairs, key certificates, encryption algorithms, decryption algorithms, digital signature algorithms to encrypt and decrypt a plurality of data within or related to: Voter Ballot data sets, Voter Ballot processing data sets, Voter Registration data sets, Ballot process data sets, Ballot casting Transactions and Transaction Receipts data sets, Events and Event Groups data sets, Containers and Return Containers data sets, Voter Complaints and Amendments data sets, Official Investigations and Amendments data sets, Official Validation, Authentication and Reporting data sets, Data Scanning, Storage, Optimization and Retrieval data sets, Error Detection, Reporting and Correction data sets, Communications, Networks and Devices data sets; whereby Voters use their provided Ballot Voting RSID and correlated Official PassCode along with Officials public keys and encryption algorithms to generate a private voting or Voter Registration authentication voucher that is unique to each Ballot RSID or Registration RSID and is printed on the correlated Receipt, and further with a private Voter created PassWord, and may be used to encrypt the semi-public Voter data page contents so as to be revealed only to the Voter who cast that Ballot or submitted that information or to an entrusted Official or other third party authorized by the Voter;

(AA) further steps and methods of the Computerized Voting System of claim 1 whereby:

(1) Further to the aforesaid methods: in-person, Courier, Postal Mail, Email, Internet, Telephone, Computer, Personal Data Device, Interactive Television, Facsimile of Voting and for each of a plurality of Officials, Voters, Proxy Voters sending and receiving zero, one or a plurality of Voting Session Documents, to zero, one or a plurality of Ballot Processing Agents also known as Ballot Agents, Official Agents or Agents are employed to independently send, receive and process Ballots and correlated Voter Selections (Candidates, Groups, Political Parties, Proposals, Proposal Identifiers), Voter Write-in Choices, Voter Personal Security Items, Ballot Security Elements using Ballot Agents Official Voting Session Devices of claim 1 which Ballot Agents control and manage independently and separately from Officials; said Agent Voting Session Devices and Ballot related Voting data are independently managed and controlled by said Ballot Processing Agents, thereby isolating and securely keeping secret the correlation between the unique Ballot Voting Identifier, Ballot PassCode and the unique Voter Identifier, Voter Password, also keeping secret all Voter and Proxy Ballot selections, Write-in choices and Voter Personal Security Items, further securely keeping secret any other information that may directly or indirectly provide a significantly probable link between the Ballot and the Voter or Proxy Voter;

(2) Officials generating, recording and providing each of a plurality of Registered Voters and a plurality of: Registered, designated Proxy Voters and a plurality of Officials with at least one unique private Voter Registration Identifier, at least one correlated unique Voter Registration PassCode, and at least one unique Voting Access Identifier and zero, one or a plurality of unique Voting Access PassCodes of which only the Voting Access Identifier and correlated Voting Access Passcodes are provided to Ballot Processing Agents which are not given access to Voter or Proxy or Officials Voting Registration Identifiers or Voting Registration PassCodes, thereby isolating and protecting sensitive private personal information from Official Ballot Processing Agents;

Voters and Proxy Voters personal information is also shielded from Official Vote Processing Agents (Ballot Agents) that only receive the unique Voter Identifier, Voter PassCode; A plurality of Voting Session Primary Officials employ a plurality of Voting Session devices to capture and store all Voter and Proxy Voter personal registration data securely, independently and in a manner that inaccessible to the Official Ballot Processing Agents (Ballot Agents or Official Agents) so as to protect the Voter and Proxy Voter private, sensitive personal information (example: social security number, drivers license number, healthcare number, date of birth, place of birth) and to prevent Official Ballot Processing Agents (Ballot Agents) from linking the Ballot RSID and selection and Write-in choices to a specific person; a plurality of Voting Session Primary Officials research potential Voters, accept applications for Voter and Proxy Voter registrations, then primary Voting Session Officials validate, authenticate, certify and register valid, Eligible Voters and valid, Eligible Proxy Voters, generating and correlating to each eligible Voter and eligible Proxy Voter, unique extremely hard to guess Voter Random Symbolic Identifiers, Voter Random Symbolic Barcodes or QR code and correlated numeric value and graphical image, Voter PassCodes RSIDs, Voter Passcode barcode or QR code and correlated numeric value and graphical image, and zero, one or a plurality of Security Elements, Validation, and Authentication data, markings, signals and messages, and zero, one or a plurality of Voter Personal Security Items, that is all correlated to each respective Voter or Proxy Voter personal information, aggregated in at least one record or zero, one or a plurality of linked records, and then securely and redundantly stored with at least one exact duplicate record of all the aforesaid Voter and Proxy Voter data that is stored in or on an immutable media along with at least one unique transaction identifier, data and time data, unique Official and Official devices identifiers, unique location identifier, and a unique Voter data signature derived from applying a computer running a hashing algorithm software program (example: MD5 hashing algorithm) which is applied to compute a unique hashing value for each the personal data and Voter Personal Security Items as well as the Voter or Proxy Identifier and Voter Passcode for each Eligible Voter and each Eligible Proxy Voter who successfully registers to vote with Voting Session Primary Officials;

(3) (i) After each of a plurality of Voters and Proxy Voters has successfully registered to vote, at least one Primary Official or at least one Ballot Agent generates a plurality of groups of unique Ballot RSID, and zero, one or a plurality of unique Ballot PassCodes, Ballot Voting RSIDs, Ballot Voting PassCodes, and zero, one or a plurality of Security Elements, Limits of Use data, Validation data, Authentication data, which form a Voter Ballot Record Group that is then given, messaged, or revealed to each Voter and Proxy Voter for their use to vote with or without any direct or indirect or derivable correlation to the Voter or Proxy Voter;

further aforesaid Voter Ballot Record Group is further combined with and correlated to the creation dates and times of Ballot RSID, Ballot Voting RSID and Ballot PassCodes, the creating Official devices unique identifier, the Voter or Proxy Voter location or electronic address and identifier, the Voting Session devices location or electronic address and unique identifier, that are correlated to unique value from a computer software hashing algorithm that computes a unique value for said Voter Ballot Record Group that is immutably stored and added to a database or other type of data storage as the Official Ballot Record Group;

(ii) this invention includes the further steps and methods of preserving privacy and anonymity of Voter and Proxy Voter for their ballot selections and Write-in choices by exchanging with zero, one or a plurality of Voters and Proxy Voters: zero, one or a plurality of Voter Ballot Record Groups (Ballots, Ballots RSIDs, correlated Ballot PassCodes, correlated Ballot Voting RSIDs, and correlated Ballot PassCodes, Security Elements, Limits of Use data, Validation data, Authentication data) zero, one or a plurality of times, without disclosing any exchanges and any lack of exchanges with any Officials;

(iii) Ballot Processing Agents and Primary Officials of the Voting Session exchange and share said Official Ballot Record Groups (Voter Ballot Record Group combined with creation date, time and location and Officials identifier data, and location and device identifier of the non-specific Voter and Proxy Voter) that are recorded on at least one and often a plurality of listings of said Ballot RSIDs, correlated Ballot PassCodes, Ballot Voting RSIDs, Ballot Voting RSID Passcodes, each of which are managed by a plurality of Primary Officials and Primary Officials Voting Session devices, or Ballot Agents and Ballot Agents Devices or any combinations thereof so long as neither any Primary Officials nor any Ballot Agents are able to employ any devices or data access permissions so as to independently correlate, derive, infer or compute the Official Ballot Record Group data and Voter Ballot selections and Write-in Choices to any specific Voter or Proxy Voter; and further that neither any Primary Officials nor any Ballot Agents are able to derive, infer, decode reverse engineer or compute the Voter and Proxy Voter Private Security Items so as to enable any Officials or Agents to view the Voter or Proxy Voter Ballot Selections and Write-in Choices that are associated with their private vault, yet all that Official Ballot Record Group data is otherwise visible for review and confirmation at the Official created Internet web-page record of the cast Ballot Receipt, each said web-page (of a plurality of said web-pages) is stored at the correlated Uniform Resource Locator (URL) Internet address comprised of a unique, extremely hard to guess random symbolic identifier that is, or is correlated to: the unique Transaction Identifier generated for each correlated, completed (successful, unsuccessful, unused) specific Ballot casting event or Investigation event (lost, damaged, stolen, amended, confirmed) for a plurality of Ballot casting events and for a plurality of Investigation events;

(4) (i) zero, one or a plurality of Primary Officials (Registration Officials) research and provide each Eligible Voter and each Eligible Proxy Voter with exactly one private, unique and extremely hard to guess, calculate and infer, static and immutable Voter Private Random Symbolic Identifier (Voter Private RSID) and also one correlated, modifiable unique Voter Private Passcode both of which the Voter keeps private and confidential; a plurality of said Primary Officials (Registration Officials) recording, storing, and retrieving a plurality of said Voter Private Random Symbolic Identifiers, Voter Private PassCodes, Voter Public Random Symbolic Identifiers, Voter Public PassCodes along with a unique Voter Creation Transaction Identifier that is correlated to both said Voter Public and Private Random Symbolic Identifiers; said plurality of Registration Officials validating, authenticating, certifying, error checking, error detecting, error correcting, and false error detecting of zero, one or a plurality of Voter Private and Voter Public Random Symbolic Identifiers and PassCodes;

(ii) a plurality of said Registration Officials and Registration Officials Voting Session Devices creating, assembling, populating, updating and amending a plurality of Registered Voter Public Lists containing a plurality of Voter Public Random Symbolic Identifiers, and for each said Voter Public RSID, the correlated dates and times of eligibility to vote, and zero, one or a plurality of correlated Voting Region Identifiers, Polling Station Identifiers, and any other suitable information; said Registration Officials verifying, validating, authenticating, certifying and optionally sharing said Registered Voter Public List with Third Party Auditors and Electoral Board, and Official Candidates but not with the news media or general public until after the election (prevent hackers);

(iii) zero, one or a plurality of a plurality of Registered Voters and Proxy Voters submits zero, one or a plurality of their Voting Access Identifiers and zero, one or a plurality of correlated Voting Access Identifier Passcodes to at least one Ballot Processing Agent and zero, one or a plurality of Ballot Agents independently managed and controlled Voting Session Devices, using any of this inventions methods of voting: in-person, Courier, Postal Mail, facsimile transmission, Telephone, EMail, Internet, Interactive Television; at least one Ballot Processing Agents comparing each Voting Access Identifier and zero, one or a plurality of correlated Voting Identifier Passcodes to the Official provided lists of Voting Access Identifiers using zero, one or a plurality of Voting Session Devices; zero, one or a plurality of Ballot Processor Agents and zero, one or a plurality of Ballot Agent managed Voting Session Devices to validate, authenticate, certify, authorize and enable, or otherwise: suspend and disable, disqualify and disable, reject and disable a plurality of Voters and Proxy Voters access to the Voting Systems of this invention;

(iv) a plurality of Ballot Agents and Ballot Agent Devices verifying, confirming and validating said Voting Access Identifiers (and zero, one or a plurality of correlated Voting Access Passcodes) are on the list of Official Voting Access Identifiers, thereafter verifying (validating), authenticating, to accept and enable said Voter for using any of the Voter selected Voting methods; at least one Ballot Agents or Agent Devices recording the said provided Voting Access Identifier, zero, one or a plurality of correlated Voting Access PassCodes, Voter Limits of Use Data, Voter Validation data, Voter Authentication data, Voter Certification data, the date, time, location and zero, one or a plurality of Voting Session Devices Identifiers, Voter, Proxy and Ballot Processing Agents Identifiers, which is immutably stored and correlated with a unique Transaction Identifier and Data Signature that is correlated to the Accept4Voting Event which also has a unique Events Identifier that is also correlated with aforesaid data and immutably stored; further step of at least one Ballot Agent or Ballot Agent Device generating one public, unique and extremely hard to guess, Voter Public Random Symbolic Identifier (Voter Public RSID) which also has a correlated Voter Public PassCode which is then revealed, communicated and provided to the Voter or Proxy Voter and is further recorded, stored in or on immutable media; said Voter Public RSID is also randomly inserted into a list of many other Voter Public RSIDs that is randomly mixed (the list contents, not individual Voter Public RSIDs which remain unchanged) so as to obscure the time that any single Voter Public RSID is created that could link to a particular Voter or Proxy Voter, then the List of Voter Public RSIDs or incremental changes thereof is securely sent to Primary Registration Officials at regular intervals;

(v) for each of a plurality of Voters and Proxy Voters whom have successfully Registered to Vote, upon further employing zero, one or a plurality of said acceptable Official methods of this invention for Voting and casting Ballots: (In Person, Postal Mail, Courier, Email, Internet, Telephone, Facsimile transmission, Interactive Television, submitting said Registration Voting Ballots or other Documents and Containers to at least one Ballot Agent or Ballot Agent Device:

(a) at least one Voter Public Random Symbolic Identifier having acronym: Voter Public RSID and at least one Voter Public PassCode, and optionally:

(b) zero, one or a plurality of: Ballot RSIDs and Ballot PassCodes, and optionally (c) zero, one or a plurality of Ballot Voting RSIDs and Ballot Voting PassCodes;

(vi) said Ballot Agent(s) and Ballot Agent Device(s) accepting said Voter Public RSID and Voter Public PassCode, then searching for matching pair of Voter Public RSID and Voter Public PassCode on Public List of Registered Voters, then: (a) upon successfully found a matching pair on the Public List of Registered Voters, then validating as matching by zero, one or a plurality of Ballot Agent and zero, one or a plurality of Ballot Agent Voting Session Devices, then copying, authenticating and certifying said Voter and Voter correlated Security Elements, Limits of Use data, as well as the dates, times, methods and locations available for the Voter or Proxy Voter according to the Public Registered Voter List and any other further processing of claim 3; or, alternatively, (b) upon Ballot Agents or Ballot Agents Devices failing to validate, authenticate or certify said Voter Public RSID and correlated Voter Public PassCode then rejecting, suspending or disallowing Voter or Proxy Voter from access to the Voting System, recording and notifying by messages and signals to each rejected, suspended or disallowed Voter, Proxy Voter and also to Registration Officials; and further at least one Ballot Processor Agent or Ballot Agent managed Voting Session Device alternatively rejects the provided Voter Public RSID and Voter Public PassCode as not being on the Official Public List of Registered Voters; thereafter Ballot Processing Agents or said Voting Session Devices providing zero, one or a plurality of retry attempts until exceeding a threshold value, then denying any further retry attempts for a specified time, or suspending or completely denying that attempted Voter Public RSID and Voter Ballot PassCodes as well as the Voter and their detectable personal electronic machine identifier, electronic address, telephone number, or Internet Provider allocated Internet address, or television electronic address or any other personal or device specific identifiers;

(vii) upon Ballot Agents and Ballot Agent Devices providing positive certification of said Voters and Proxy Voters, at least one Ballot Agents or Ballot Agent Devices then enabling each of a plurality of said certified Voters and Proxy Voters and zero, one or a plurality of Personal Communications Devices and related software, security methods and devices, and communications networks used by Voters and Proxy Voters so as to be enabled to connect, engage, communicate and interact with zero, one or a plurality of Ballot Agents and zero, one or a plurality of Ballot Agents Voting Devices, at zero, one or a plurality of locations (physical, virtual) and with zero, one or a plurality of polling stations (physical, virtual) for a plurality of Ballots of individual Voters and Proxy Voters, but only at one location (physical, virtual) and only one polling station (physical, virtual) for each single Ballot of each Voter and each Proxy Voter; for a plurality of Voters and Proxy Voters that each successfully submits a certified pair of Voter Public RSID and Voter Public PassCode, thereafter a plurality of Ballot Agents and a plurality of Ballot Agent Devices granting and providing accesses and secure connections to zero, one or a plurality of, and a plurality of Ballot Agent Voting Devices and software programs, and to zero, one or a plurality of Ballot Agent Communications Systems, Networks, Devices and software programs used for that portion of the Voting Session assigned for Ballots Validation, Authentication, Certification, Selections, Amendments, Corrections and Casting, and optionally for creating, recording, assigning, storing, retrieving, reporting, and correlating Ballot Voting Random Symbolic Identifiers, Ballot Voting PassCodes;

(viii) a plurality of Voters and a plurality of Proxy Voters being provided with or otherwise providing at least one Ballot RSID and correlated Ballot PassCode, zero, one or a plurality of Ballot Voting RSIDs and correlated Ballot Voting Passcodes; at least one Ballot Agent or Ballot Agent Device(s) receiving said Ballot RSID and correlated Ballot Passcode, zero, one or a plurality of Ballot Voting RSIDs and correlated Ballot Voting Passcodes; in the case whereby no Ballot Voting RSID is provided, and optionally when a Ballot Voting RSID is provided: said Ballot Agents and Ballot Agents Devices creating (if no Ballot Voting RSID provided) or correlating (if a Ballot Voting RSID is provided) exactly one unique, extremely hard to guess Activated Ballot Voting RSID, which is then further correlated to one extremely hard to guess (randomly generated if no Ballot Voting PassCode is provided) Activated Ballot Voting PassCode (Ballot Voting PassCode if provided) and optionally, a unique Activated Voter Identifier which is then correlated to the said Activated Ballot Voting RSID and Activated Ballot Voting PassCode; said Activated Ballot Voting RSID, Activated Ballot Voting PassCode and Activated Voter Identifier are then revealed, transmitted or otherwise provided to each said Registered Voter and each said Registered Proxy Voter that has begun their Voting Process with said Ballot Agents and Ballot Agent Voting Session Devices; said correlated Activated Ballot Voting RSIDs and Activated Ballot Voting PassCodes are recorded and stored on or in immutable media, along with date, time, Ballot Agent Identifier, Ballot Agent Voting Session Devices Identifier, and Transaction Identifier; said Activated Voter Identifier, Activated Ballot RSIDs and Activated Ballot PassCodes thereafter managed by Ballot Agents for the entire Voting Session, and eventually communicated to Primary Officials in groups that are randomly mixed without any time data or any other data that could be used to correlate a Voter or Proxy Voter to a specific Activated Voter Identifier, Activated Ballot RSID, Activated Ballot PassCode;

(ix) For a plurality of Ballot Agents, Ballot Agent Devices, Voters and Proxy Voters: at least one Ballot Agents and Ballot Agent Devices then either:

(a) admit to the Ballot Agent Voting System, each certified Voters and certified Proxy Voters that was found on the Public List of Voters RSIDs; said Ballot Agents and Ballot Agent Devices establish a secure connection between the Ballot Agents Voting System to the Voter or Proxy Voter employed communications systems, networks, devices and software; zero, one or a plurality of Ballot Agents and at least one Ballot Agent Devices then render exactly one optical, electronic, electromagnetic Official Voting Ballot upon the Ballot Agent Devices or Voter or Proxy Voter personal devices; Ballot Agents and Ballot Agent Voting System Devices then further apply the previously said Activated Ballot RSID to the rendered Official Voting Ballot, then further enabling the Ballot Agent Voting System software to allow each said enabled Voter and enabled Proxy Voter to mark to select zero, one or a plurality of Ballot Candidate or Group choices, to provide zero, one or a plurality of alternative Write-in Candidate or Group choices, and mark to select zero, one or a plurality of Proposals, and to provide, one or a plurality of alternative Write-in Proposals, and to further add, one or a plurality of private, Personal Security Items so as to complete their Official Voting Ballot and correlated Activated Ballot RSID which is then submitted for error checking, error detecting, error correcting, one or a plurality of amendments, one or a plurality of resubmissions—all of which is monitored, controlled, co-joined, merged and processed by the Ballot Agents and Ballot Agents Voting System Devices and software programs; and further whereby each of a plurality of cast Official Voting Ballots, Activated Ballot RSIDs, said Voter and Proxy Voter particular Candidate or Group choices and Candidate or Group Write-in choices, Proposal selections and Proposal Write-in values are combined with the date, time, unique location identifier, polling station identifier, unique Ballot Agent Identifier, unique Ballot Agent Voting Device Identifier, Agent Communication Network Identifier, voter-proxy Device Identifier, voter-proxy Network Identifier, voter-proxy Device Identifier, Voting Session Identifier, Voting Transaction Identifier, Official Cast Ballot Image, Cast Ballot Receipt, Cast Ballot Data Vault electronic address (example: Internet address Uniform Resource Locator), and the unique Cast Ballot Data Vault Access RSID that is provided by the Voter, Proxy Voter or Agent Voting System Devices when a Ballot is submitted (cast) for counting and tallying;

Optionally encrypting the contents of said Cast Ballot Data Vault using the Cast Ballot Data Vault Access RSID by employing, one or a plurality of encryption algorithms and public encryption keys provided by the Voter or the Ballot Agents, Agent Encryption Devices, Agent Encryption software;

and further upon successful completion and submission of said co-joined and merged Official Voting Ballot and Activated Ballot RSID and said Voter and Proxy Voter choices, Write-in choices and selections, said Ballot Agent and Ballot Agent Voting System Devices and software programs: accepting, recording, imaging, storing, data extracting (reading), verifying, counting, tallying, retrieving, publishing, auditing, investigating, correcting, confirming, certifying and any further or any other processing of claim 1, for creating of a plurality of "Cast Ballot Public Record" for each Cast Activated Official Ballot, which is securely stored in or on immutable media, then accurately copied and verified as an exact duplicate before forwarding said duplicate copy to Primary Officials for counting, tallying, publishing and certifying, publishing, auditing, investigating, amending, confirming; further step of storing an exact copy of the said "Cast Ballot Public Record" in the Cast Ballot Data Vault that is correlated to the Official Voting Ballot RSID;

and the further steps and methods of, one or a plurality of Ballot Agents and, one or a plurality of Ballot Agent Voting System Devices and software programs verifying and then marking the List of Voter Public RSIDs so as to indicate the cast Ballot status (examples: CastOK, Spoiled, Incomplete) and to signal and disable the same Voter Public RSID from being used again (unless allowed multiple ballots by the Electoral Board and Voting Session Rules in which case the threshold limit is checked and the Voter or Proxy Voter is enabled or disabled accordingly); and further Primary Officials (Registration Officials) regularly review said List of Voter Public RSIDs and upon detecting that a Voter Public RSID has voted, obtains the correlated Voter Private RSID and accesses that Voter Registration data to mark that they have cast a ballot, and the status of that Ballot when submitted; or, alternatively (b) at least one Ballot Processor Agent or Ballot Agent managed Voting Session Device alternatively rejects the provided Voter Public RSID and Voter Public PassCode as not being on the Official Public List of Registered Voters; thereafter Ballot Processing Agents or said Voting Session Devices providing, one or a plurality of retry attempts until exceeding a threshold value, then denying any further retry attempts for a specified time, or suspending or completely denying that attempted Voter Public RSID and Voter Public PassCode, as well as recording the Voter (or Proxy Voter) Public RSID and their detectable personal electronic machine identifier, electronic address, telephone number, or internet provider (IP) allocated Internet address, or internet provided address or television electronic address or any other personal or device specific identifiers;

(x) for each a plurality of Voters and Proxy Voters: (a) successfully completing and submitting at least one of their Ballots, Ballot Agents and Agents Devices generating a new Voting Storage Identifier, allowing the Voter to enter their own private PassWord or PassCode and zero, one or a plurality of Personal Security Items which are then securely stored on immutable media using POEM methods, optimizing for data storage and data retrieval; a plurality of Ballot Processing Agents and Ballot Agent Devices waiting for a plurality of successfully cast Ballots to accrue, then sending and transmitting time delayed groups of randomly mixed, successfully completed Voter Ballot Identifiers, their correlated Voter Candidate or Group choices, Write-in Candidate or Group choices Proposals, and Write-in Proposals, to at least one Officials Voting Session Devices and, one or a plurality of Primary (Registration) Officials employing secure communications methods, software, networks and devices; Ballot Agents and Ballot Agent Devices restricting Voter specific and inferential data from Primary (Registration) Officials and, one or a plurality of Electoral Board members, otherwise securely communicating for a plurality of and for each Activated Voting Ballot RSID, correlated Ballot Candidate Choices and Write-in Candidate choices, Proposal selections and Write-in Proposal selections, certification data, one or a plurality of Security Elements, Limits of Use data, signals and messages for each Activated Voting Ballot and optionally, the Internet address (Uniform Resource Locator: URL) where the Ballot data is stored for Voter private auditing, but absolutely no Voter or Proxy Voter specific, derivable or inferable information that would allow Primary (Registration) Officials or Electoral Board members to identify the Voter or Proxy Voter, nor to enable anyone to link them to any of their correlated Activated Voter Identifier, Activated Ballot RSID or their Activated PassCodes; or, alternatively, (b) upon Ballot Agents or Ballot Agents Devices failing to validate, authenticate or certify said Voter Public RSID and correlated Voter Public PassCode then rejecting, suspending or disallowing Voter or Proxy Voter from access to the Voting System, recording and notifying by messages and signals to each rejected, suspended or disallowed Voter, Proxy Voter and also to Registration Officials; and further at least one Ballot Processor Agent or Ballot Agent managed Voting Session Device alternatively rejects the provided Voter Public RSID and Voter Public PassCode as not being on the Official Public List of Registered Voters; thereafter Ballot Processing Agents or said Voting Session Devices providing, one or a plurality of retry attempts until exceeding a threshold value, then denying any further retry attempts for a specified time, or suspending or completely denying that attempted Voter Public RSID and Voter Ballot PassCodes as well as the Voter and their detectable personal electronic machine identifier, electronic address, telephone number, or internet provider (IP) allocated Internet address, or internet provided address or television electronic address or any other personal or device specific identifiers;

(xi) and for aforesaid steps and methods, the further steps and methods of claim 3 whereby said Ballot Processing Agents employ, one or a plurality of, and any types of similar, identical or distinct and independent methods of: data compression and decompression, data encryption and data decryption, data error checking, data error detecting, data correcting as well as false error detection for said Ballot Processing; said Ballot Processing Agents further providing distinct and independent steps and methods for validating, authenticating and granting Voters access to the Ballot Processing System and for all other steps and methods of completing, error checking, amending and submitting Ballots for tallying, storage, certification and submission of Ballot filtered data to Officials for tallying, as well as for all the after Voting auditing procedures and publications;

(xii) and for the aforesaid and following claims, steps and methods whereby for a plurality of Voters, Proxy Voters, Officials, Primary Officials, Registration Officials, Primary (Registration) Officials, Electoral Board members, Ballot Processing Agents, Ballot Agents, employing the Official Devices, Official Registration Devices, Ballot Agent Devices, Ballot Agent Voting Devices, Ballot Agent Vote Processing Devices according to claim 1, which are used for receiving, validating, authenticating, verifying, imaging, reading, extracting, copying, duplicating, securely storing, securely retrieving, securely communicating the Voters, Proxy Voters, Primary Officials, Electoral Board Members, Ballot Processing Agents private personal information and Official data excluding all the Voters Ballot choices and Write-in selections as well as any connective data or derivable connective information that would link any Voter or Proxy Voter to a particular Ballot, Ballot choices and Write-in choices;

(BB) and further to the Computerize Voting System of claim 1, the further steps and methods of applying Networking, Multi-Processor Parallel Computing and Artificial Intelligence Processing whereby: a plurality of Officials, Official Appointees, Official Agents and Official Voting System Devices are proactively:

(1) employing a plurality of computers running a plurality of software programs as functioning independently or cooperatively via, one or a plurality of any types of networks and any types of communications systems;

(2) employing a plurality of computers running a plurality of software programs functioning independently or cooperatively employing, one or a plurality of, and any types of computer neural networks, artificial intelligence software, electronic or optical or electromagnetic vote processing devices and communication networks used for data processing, storage, telemetry, communications, security, and for any types of functions or processes of this invention: Ballot image capturing, Ballot data field reading and decoding, data storage, search and retrieval, intelligent image processing, RSID character reading, device assignment and prioritization, resource allocation, data searches, data retrievals, data communications, data security, system access security, Voter authentication, Registration processing, Ballot sorting, tallying, analysis, reporting, error detection, error identification, error specification, error localization, error correction and error data recovery, error detection rejection, error messaging, and for security data and regular data, RSID, Ballot, Voter Registration, containers, official devices, and communications to further provide: authentication, certification, forgery detection, forgery rejections, duplicate detections, duplicate rejections, duplicate extractions, Document design, printing, Voter Registration, Ballot processing, Voter Registration research, Ballot sorting, distribution, receiving, vote processing device workload balancing, calculating, computing by non-quantum physics computers, computing by quantum physics computers, network communications, telephony communications, internet communications and quantum physics secure communications and for any claims, steps and methods of this invention.

20. The Computerized Voting System of claim 1 wherein: Officials provide steps and methods for each Ballot, Voter Registration, Voter Language Form, or any other items related to the Voting Session that is received, such that a certified copy is made available to at each Eligible Voter for verification and error processing: error detection, error identification, error specification, error localization, error position locating, error marking, error correction, error data recovery, false error detection rejection, and further that at least one means, method and opportunity of reporting errors is provided, and the further steps and methods whereby zero, one or a plurality of Officials, or zero, one or a plurality of Eligible Voters, or at least one designated Proxy representative that possess the unique combination of the Ballot Voting RSID and PassCode RSID for each disputed Voter Registration or Ballot submits the Voter Registration or Ballot electronically to Officials, or, zero, one or a plurality of errors are reported by presentation of zero, one or a plurality of sufficiently intact Ballots, zero, one or a plurality of Voter Registrations Voter Language forms, zero, one or a plurality of Ballot Containers by zero, one or a plurality of Potential Voters, Eligible Voters or designated representative Proxy Voters, for each disputed: Voter Registration, voter-proxy Language Selection form, Ballot, Container; and the further steps and methods whereby for zero, one or a plurality of special persons or other special legal entities that are authorized by a Voter owning an appropriate, bona fide Receipt, to be given access to any electronic, digital, or any other transformed version of any printable Ballot, Form, Document or Container of this invention, the Officials will provide a certified copy or representation of zero, one or a plurality of items identified as Crucial Integrity Data Items; and the further steps whereby at least one Official provides each Voter with at least one method, and at least one opportunity, to verify or correct the accuracy of the Official Record of any record, tally, calculation, summary, or publication pertaining to any certified Ballots or certified Ballot vote selections; and the further steps and methods whereby zero, one or a plurality of Registered Voters, Proxy Voters, Officials and authorized legal entities, use their Receipt Ballot and zero, one or a plurality of methods to verify the accuracy of Ballot processing or any other Documents and records processing by personally contacting in-person at least one Official, or by personally accessing or by electronically connecting to at least one of a plurality of Official Voting Session Devices, by using a telephone, cellular phone, interactive television, personal data communications device, or, a computer connect to the Internet, television network, cable Television data network, or tele-communications network, or in-person using any combinations of optical, electronic, electromagnetic personal and Official Vote Processing Devices, whereupon a communication session is established, zero, one or a plurality of Registered Voters, Proxy Voters, Officials, legal entities verify, challenge, accept and reject zero, one or a plurality of Official Documents, images, records, processes, events, tallies, calculations, summaries, communications, or publications of their Master Ballot or voting selections made on their Master Ballot; and the further steps and methods whereby zero, one or a plurality of Voters notify Officials to investigate and correct zero, one or a plurality of errors discovered; and the further steps and methods whereby at least one Official records each Voter request to investigate, with all relevant details; and the further steps and methods whereby zero, one or a plurality of Officials proceed to investigate whether to accept or reject each Voter request to amend zero, one or a plurality of errors, then report to any number Voters, Proxy Voters, and authorized legal entities, as to whether an amendment is required as requested, along with each Official findings of the investigation which is all duly recorded in the Official records; and the further steps and methods if required, whereby at least one Official then amends the records, tallies, summaries, calculations, and publications to correct the records and tallies of zero, one or a plurality of Master Ballots, or Voter selections made on the Master Ballots, in accordance with the findings and the Rules of the Voting Session; and the further steps and methods whereby at least one Official verifies any amendments were completed accurately; and the further steps and methods whereby at least one Officials records in the Official records, and reports to zero, one or a plurality of Voters or other interested legal entities as to when the amendments are completed, along with the results of the Official verification of the amendments; and the further steps and methods whereby at least one Official provides each Voter with at least one method, and at least one opportunity, to accept or reject the accuracy of any amended records, tallies, summaries, calculations, or publications; and whereby zero, one or a plurality of Voters verify correctness or report errors of zero, one or a plurality of amendments; and further that at least one Official generates zero, one or a plurality of Internet WebPages and zero, one or a plurality of Official use only intra-net WebPages and printable Document visual renderings that shall then be correlated to each submitted Voter Registration and assigned one unique Voter Registration Identifier and that is correlated to the set of Registration data and set of Registration System data and set of Registration processing data for each Voter Registration Identifier; and (ii) the further steps and methods whereby for each Officially Approved Voter Registration, at least one Official generates a Voter Language Selection Internet webpage and zero, one or a plurality of Official use only intra-net WebPages and printable Document visual renderings that are each correlated to said Voter Registration Identifier and to the set of Voter Language data and set of Language System data and the set of Voter Language selection processing data for each submitted Voter Language selection;

(iii) whereby for each Officially Approved Voter Registration at least one Official generates exactly one unique and privately accessible Internet web page with a webpage Internet address that is correlated via the unique Voter Registration that is further encoded so as to be part of the Internet Universal Resource Locator (URL) for the Ballot private webpage; further said webpage is protected by a Voter changeable PassWord requiring authentication to change said PassWord; and zero, one or a plurality of Official use only intra-net WebPages and printable Document visual renderings that shall then be correlated to each unique Voter Registration Identifier;

(iv) for each submitted Ballot-ID RSID and Ballot Voting RSID generating zero, one or a plurality of Internet web-pages and zero, one or a plurality of Official use only intra-net web-pages that are directly correlated to the set of voting data, set of Voting System data and the processing data set for each Ballot-ID RSID thereof said Ballot-ID RSID and Ballot Voting RSID; and zero, one or a plurality of Official use only intra-net WebPages and printable Document visual renderings that shall then be correlated to each submitted Ballot Voting RSID and Ballot-ID RSID; said webpage Internet address that is correlated via the unique Ballot Voting RSID and Ballot-ID RSID that is further encoded so as to be part of the Internet Universal Resource Locator (URL) for the Ballot private webpage;

(v) and further step of requiring the Official Ballot PassCode to access and optionally decrypt the private webpage for viewing; and further optional step of requiring the Voter Personal PassWord or Ballot PassCode or Voter Registration PassCode or any combination thereof said PassWords and PassCodes to give access to and optionally decrypt each Voter private webpage for a plurality of Voters and a plurality of Voter WebPages; and for a plurality of Voters and a plurality of Voter WebPages; upon actuating the correct access Universal Resource Locator (URL) and correlated webpage PassCode(s) or PassWord(s) for the Voter Registration or Proxy Registration or Official or Ballot data storage vault, the further steps of accessing and optionally decrypting each Voter private webpage network address locations and correlated data storage vault by providing website or data vault login of UserID (Voter Identifier, Proxy Identifier or Official Identifier) and at least one PassCode or PassWord and one or a plurality of additional alpha-numeric symbols, graphic symbols, language symbols, images, signature, initials, graphical drawings, glyphs, audio records, eye retina scans, or other bio-metric data to confirm the Voter, Proxy or Official identity or validity of being a person not an automated program attempting to gain unauthorized access to any portions of the Computerized Voting System, Computerized Registration System, Officials Data Processing, Networks or Communications Systems and to any related data therein.

* * * * *